US007159271B2

(12) United States Patent
Sepke et al.

(10) Patent No.: US 7,159,271 B2
(45) Date of Patent: Jan. 9, 2007

(54) WET EXTRACTOR CLEANING DEVICE FLUID TANK ARRANGEMENT

(75) Inventors: Arnie Sepke, Hudson, IL (US); Randall Sandlin, Bloomington, IL (US); Vince Bobrosky, Normal, IL (US); Bill Reimer, Normal, IL (US)

(73) Assignee: Electrolux Home Care Products Ltd., Cleveland, OH (US)

( * ) Notice: Subject to any disclaimer, the term of this patent is extended or adjusted under 35 U.S.C. 154(b) by 62 days.

(21) Appl. No.: 10/952,061

(22) Filed: Sep. 29, 2004

(65) Prior Publication Data

US 2005/0091783 A1 May 5, 2005

Related U.S. Application Data

(60) Provisional application No. 60/506,180, filed on Sep. 29, 2003, provisional application No. 60/528,187, filed on Dec. 10, 2003.

(51) Int. Cl.
*A47L 11/30* (2006.01)

(52) U.S. Cl. ..... 15/320; 15/410

(58) Field of Classification Search ..... 15/320, 15/321, 331, 410

See application file for complete search history.

(56) References Cited

U.S. PATENT DOCUMENTS

| | | | |
|---|---|---|---|
| 1,268,962 | A | 6/1918 | Gray |
| 1,982,345 | A | 11/1934 | Kirby |
| 2,109,621 | A | 3/1938 | Kirby |
| 2,178,003 | A | 10/1939 | Smellie |
| 2,416,417 | A | 2/1947 | Taylor |
| 2,524,928 | A | 10/1950 | Platz |
| 2,954,576 | A | 10/1960 | Helm |
| 3,203,707 | A | 8/1965 | Anderson |
| 3,204,272 | A | 9/1965 | Greene et al. |
| 3,316,579 | A | 5/1967 | Smith |
| 3,357,716 | A | 12/1967 | Musichuk |
| 3,485,017 | A | 12/1969 | Duran et al. |
| 3,527,469 | A | 9/1970 | Gobin |
| 3,631,559 | A | 1/1972 | Gaudry et al. |
| 3,685,081 | A | 8/1972 | Wesemann |

(Continued)

FOREIGN PATENT DOCUMENTS

| | | |
|---|---|---|
| GB | 1179898 | 2/1970 |

(Continued)

OTHER PUBLICATIONS

Bissell User's Guide Models 1690 and 1695, 14 pages, Copyright 1997.

(Continued)

*Primary Examiner*—Theresa T. Snider
(74) *Attorney, Agent, or Firm*—Hunton & Williams

(57) ABSTRACT

A wet extraction floor cleaning device having a base assembly adapted for movement on a surface being cleaned, an operating handle pivotally attached to the base assembly, a supply tank having a supply tank outlet, and a recovery tank having a recovery tank inlet and a recovery tank outlet. The base assembly has an inlet nozzle that extends from an inlet slit proximal the surface being cleaned to a nozzle outlet. The device further includes a fluid deposition assembly that can be selectively placed in fluid communication with the supply tank outlet, a vacuum source, and first and second external pockets. The supply and recovery tanks are adapted to be selectively placed in the first and second external pockets, thereby placing the supply tank outlet in fluid communication with the fluid deposition system, the recovery tank inlet in fluid communication with the nozzle outlet, and the recovery tank outlet in fluid communication with the vacuum source inlet.

24 Claims, 55 Drawing Sheets

U.S. PATENT DOCUMENTS 3,855,763 A 12/1974 Seifert et al.
3,950,817 A 4/1976 McKaig
3,959,844 A 6/1976 Cyphert
4,019,218 A 4/1977 Cyphert
4,020,526 A 5/1977 Johansson
4,071,920 A 2/1978 Block
4,071,922 A 2/1978 Davies, III et al.
4,200,951 A 5/1980 Burgoon et al.
4,216,563 A 8/1980 Cyphert
4,245,371 A 1/1981 Satterfield
4,272,861 A 6/1981 Notta et al.
4,295,243 A 10/1981 King
4,458,377 A 7/1984 Frohbieter
4,475,265 A 10/1984 Berfield
4,558,484 A 12/1985 Groth
4,586,208 A 5/1986 Trevarthen
4,595,420 A 6/1986 Williams, III et al.
4,596,061 A 6/1986 Henning
4,660,246 A 4/1987 Duncan et al.
4,662,026 A 5/1987 Sumerau et al.
4,670,937 A 6/1987 Sumerau et al.
4,724,573 A * 2/1988 Ostergaard ..... 15/321
4,763,382 A 8/1988 Sumerau
4,809,396 A 3/1989 Houser
4,809,397 A * 3/1989 Jacobs et al. ..... 15/320
4,817,233 A 4/1989 Waldhauser
4,864,680 A 9/1989 Blase et al.
4,910,828 A 3/1990 Blase et al.
4,951,346 A 8/1990 Salmon
4,956,891 A 9/1990 Wulff
4,976,003 A 12/1990 Williams
5,088,149 A 2/1992 Berg et al.
5,146,647 A 9/1992 Blase et al.
5,208,940 A 5/1993 London et al.
5,261,215 A 11/1993 Hartz et al.
5,299,608 A 4/1994 Bosyj
5,301,386 A * 4/1994 Thomas et al. ..... 15/321
5,311,638 A 5/1994 Furcron et al.
5,326,116 A 7/1994 Flax
5,330,037 A 7/1994 Wang
5,331,715 A 7/1994 Johnson et al.
D354,593 S 1/1995 Koike
5,392,491 A 2/1995 Hwang et al.
5,398,567 A 3/1995 Specht
5,400,462 A 3/1995 Amoretti
5,406,673 A 4/1995 Bradd et al.
5,455,982 A 10/1995 Armstrong et al.
5,459,901 A 10/1995 Blase et al.
5,473,792 A 12/1995 Kent et al.
5,493,752 A 2/1996 Crouser et al.
5,500,977 A 3/1996 McAllise et al.
5,513,415 A 5/1996 Kent et al.
5,548,866 A 8/1996 Reed et al.
D374,017 S 9/1996 Chunn et al.
5,613,272 A 3/1997 Huffman
5,636,504 A 6/1997 Kaley et al.
5,640,738 A 6/1997 Williams et al.
D384,083 S 9/1997 Hinklin
5,669,098 A 9/1997 Tono
5,676,405 A 10/1997 Reed
D394,526 S 5/1998 Strandell
5,765,250 A 6/1998 Lee
5,784,755 A 7/1998 Karr et al.
5,797,163 A 8/1998 Whitaker et al.
5,799,362 A 9/1998 Huffman
5,819,364 A 10/1998 Sham
5,819,365 A 10/1998 Huffman et al.
5,836,046 A 11/1998 Huffman et al.
5,839,159 A 11/1998 Karr et al.
5,860,188 A 1/1999 Maurer et al.
5,864,921 A 2/1999 Chou
5,867,857 A 2/1999 Crouser et al.
5,867,864 A 2/1999 Miller et al.
5,870,798 A 2/1999 Crouser et al.
5,887,313 A 3/1999 Hanold et al.
5,896,617 A 4/1999 Kasen et al.
5,901,406 A 5/1999 Mueller et al.
5,933,912 A 8/1999 Karr et al.
5,937,475 A 8/1999 Kasen et al.
5,983,442 A 11/1999 Louis et al.
6,009,593 A 1/2000 Crouser et al.
6,012,200 A 1/2000 Murphy et al.
6,041,472 A 3/2000 Kasen et al.
6,073,300 A 6/2000 Zahuranec et al.
6,081,962 A 7/2000 Kasen et al.
6,082,376 A 7/2000 Karr et al.
6,088,873 A 7/2000 Pacchini et al.
6,101,671 A 8/2000 Wright et al.
6,125,498 A 10/2000 Roberts et al.
6,131,237 A 10/2000 Kasper et al.
6,145,159 A 11/2000 Zahuranec et al.
6,154,917 A 12/2000 Zahuranec et al.
6,158,081 A 12/2000 Kasen et al.
6,167,586 B1 1/2001 Reed, Jr. et al.
6,167,587 B1 1/2001 Kasper et al.
D437,666 S 2/2001 Park
6,185,781 B1 2/2001 Miller et al.
6,192,548 B1 2/2001 Huffman
6,247,202 B1 6/2001 Lesco et al.
6,286,180 B1 9/2001 Kasper et al.
6,311,366 B1 11/2001 Sepke et al.
6,325,864 B1 * 12/2001 Zahuranec et al. ..... 15/320
6,353,964 B1 3/2002 Andrisin, Jr. et al.
6,363,570 B1 4/2002 Kasper et al.
6,368,373 B1 4/2002 Mueller
D456,961 S 5/2002 Ng
D460,973 S 7/2002 Jong
6,438,793 B1 8/2002 Miner et al.
6,467,122 B1 10/2002 Lenkiewicz et al.
6,513,188 B1 2/2003 Zahuranec et al.
6,533,871 B1 3/2003 Zahuranec et al.
6,550,098 B1 4/2003 Roberts et al.
6,564,423 B1 5/2003 Sergyeyenko et al.
6,629,332 B1 * 10/2003 Morgan et al. ..... 15/320
2003/0051310 A1 3/2003 Morgan et al.
2003/0226230 A1 12/2003 Hertrick et al.
2005/0060837 A1 3/2005 Johnson et al.

FOREIGN PATENT DOCUMENTS

GB 2072496 10/1981
GB 2304031 3/1997

OTHER PUBLICATIONS

Bissell User's Guide Model 16981 Series, 18 pages, Copyright 1998.
Hoover Steamvac V2 Deep Cleaner Manual, 15 pages, Copyright 2002.
Regina Steemer Carpet Cleaner Owner's Manual, 12 pages, undated.

* cited by examiner

FIG. 35A
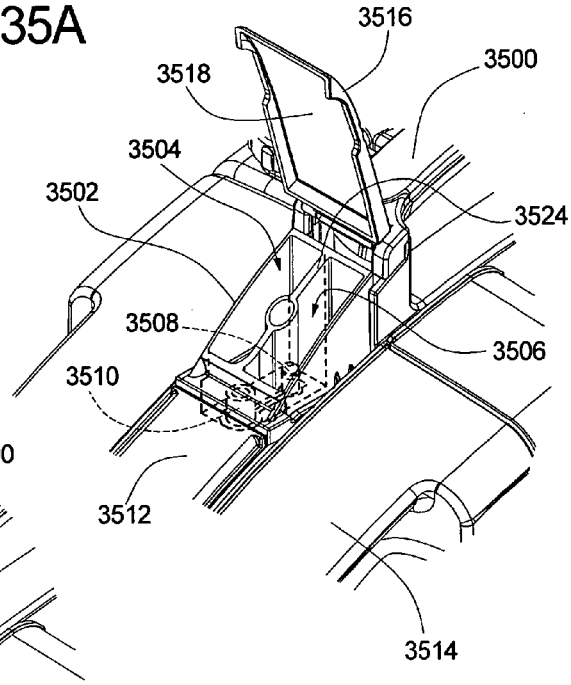
FIG. 35B
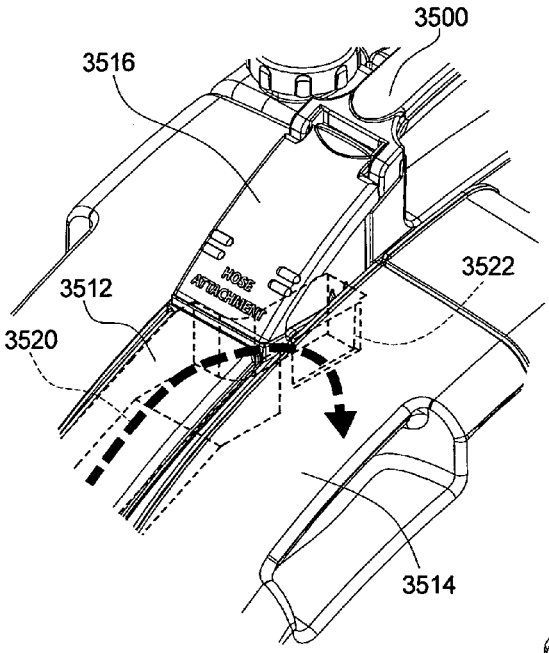
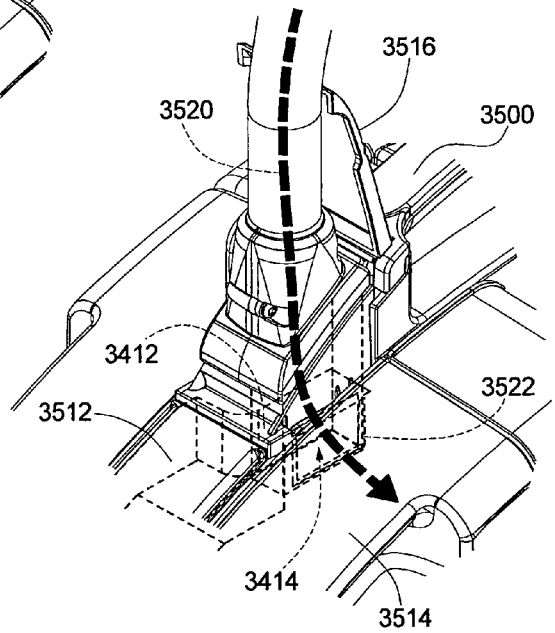
FIG. 35C

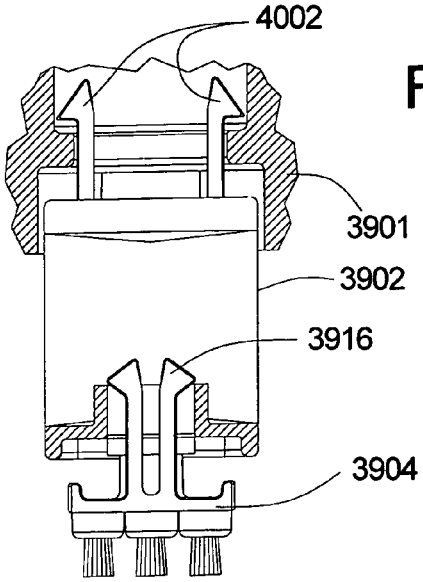
FIG. 40A
FIG. 40B
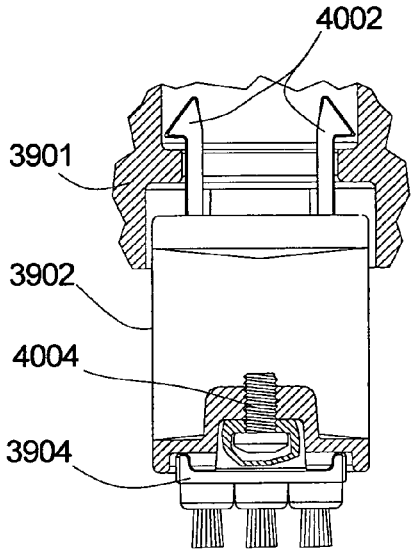
FIG. 40C
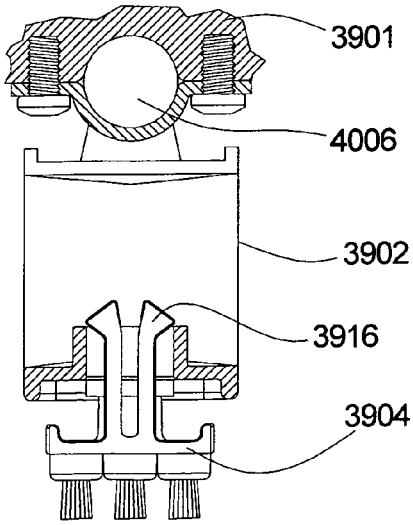

WET EXTRACTOR CLEANING DEVICE FLUID TANK ARRANGEMENT

CROSS-REFERENCE TO RELATED APPLICATIONS

This application claims priority to U.S. Provisional Application No. 60/506,180, filed on Sep. 29, 2003, and U.S. Provisional Application No. 60/528,187, filed on Dec. 10, 2003, which are incorporated herein by reference in their entirety.

BACKGROUND OF THE INVENTION

1. Field of the Invention

The present invention relates generally to floor cleaning devices.

2. Description of Related Art

Many different types of floor cleaning devices are commonly used to clean carpets, rugs and bare floors. Examples of such devices include wet extractors, vacuum cleaners, floor polishers, steam cleaners and the like. A traditional upright floor cleaning device has a base assembly and an operating handle that extends upwardly from the rear of the base assembly. The operating handle is used to guide the base assembly across the floor during operation, and in operation the handle is pushed forward, causing the base to move forward and the handle to pivot downward, and pulled back, causing the handle to move up and the base to move backwards. The operating handle is frequently designed to incorporate various parts of the cleaning device, such as water tanks, vacuum motors, filters, and the like. In these configurations, much of the device's weight is moved up to the handle, thus requiring the user to bear a portion of this weight when operating the device, particularly on the forward strokes. The operating handle also may be equipped with accessory cleaning tools and an extension hose for remote cleaning.

The operating handle of conventional cleaning devices is not configured to facilitate compact storage, shipping, and/or transportation of the device. Specifically, when the floor cleaning device is not in use, most users desire to store the device in a closet or other small space. Because the operating handle occupies a relatively large amount of space, its design is not ideal for compact storage. Shipping is also problematic with conventional cleaning devices because their bulky shapes can not be fit into conventional rectangular shipping boxes without including a large amount of unused air space in the box, which increases shipping cost. In order to reduce this additional shipping expense, some manufacturers disassemble the devices for shipment. While such disassembly reduces shipping costs, it is less desirable to customers, who typically prefer not to assemble the devices, may not be able to do so, and may find it inconvenient to disassemble the device for later storage, shipment and/or transportation. Also, when the floor cleaning device must be transported from one location to another (e.g., up or down a flight of stairs), a user must lift the device off the floor by the operating handle and carry the device in a relatively awkward position to the new location. It can be appreciated that the bulky nature of the device makes this an undesirable task for many users. Similarly, transporting the floor cleaning device in a vehicle (e.g., in a trunk compartment) can be challenging for many users due to the difficulties in loading and unloading the device into and out of the vehicle. This challenge is compounded by the fact that, in the case of wet extractors, users may wish to avoid tipping the device on its side to prevent water from escaping into the vehicle.

In an effort to overcome these problems, floor cleaning devices have been designed in which the operating handle can be partially collapsed to facilitate storage, shipping, and/or transportation of the device. For example, one floor cleaning device has been designed in which the operating handle includes an upper fork and a lower fork, wherein the upper fork can be folded downwardly to a position adjacent the lower fork. An example of such a device is shown in U.S. Pat. No. 3,673,628 to Gaudry et al. (This patent and all others discussed in the present disclosure are hereby incorporated herein by reference in their entireties.) While this device is an improvement on traditional devices, the operating handle is only partially collapsible and thus continues to occupy too much vertical space.

Another floor cleaning device has been designed in which the operating handle includes a pair of upper arms and a pair of lower arms, wherein the lower arms can be pivoted downwardly relative to the base assembly and then the upper arms can be slid inwardly alongside the lower arms. An example of such a device is shown in U.S. Pat. No. 4,245,371 to Satterfield. While the collapsed operating handle of this device occupies a smaller amount of vertical space, a portion of the operating handle still extends laterally a considerable distance from the base assembly and thus occupies a larger amount of horizontal space. As such, this design in not ideal for compact storage, shipping, and/or transportation of the device.

Yet other floor cleaning devices have been designed in which the operating handle includes an upper portion and a lower portion, wherein the upper portion can be folded downwardly relative to the lower portion and then the folded upper/lower portions can be pivoted downwardly relative to the base assembly. Examples of such devices are shown in U.S. Pat. No. 3,203,707 to Anderson and U.S. Pat. No. 3,204,272 to Greene et al. While the collapsed operating handles of these devices occupy a smaller amount of vertical space, substantial portions of the operating handles extend laterally from the base assemblies and thus occupy an even larger amount of horizontal space. As such, these designs are not suitable for compact storage, shipping, and/or transportation of the devices.

Still other floor cleaning devices have been designed in which the operating handle extends upwardly from a two-part base assembly (which includes a horizontal portion and a vertical portion), wherein the vertical portion of the base assembly can be pivoted downwardly onto the floor and then the operating handle can be folded onto the two-part base assembly. Examples of such devices are shown in U.S. Pat. No. 4,660,246 to Duncan et al, U.S. Pat. No. 4,662,026 to Sumerau et al., U.S. Pat. No. 4,670,937 to Sumerau et al., U.S. Pat. No. 4,763,382 to Sumerau, and U.S. Pat. No. Des. 310,438 to Burns. While these devices also occupy less vertical space, the collapsed base assembly occupies an even larger amount of horizontal space. Thus, these designs are also not suitable for compact storage, shipping, and/or transportation of the devices. Furthermore, such devices require the operator to actually remove the handle, reverse it, and reinsert it into the device, which is inconvenient for the operator. This design also limits the manufacturer's ability to place electric switches in the handle, which also inconveniences the operator.

A variety of wet extraction cleaning devices are available for cleaning carpets and bare floors. Typical wet extractors have a supply tank for storing cleaning fluid, and a fluid deposition system that is used to deposit the cleaning fluid onto the floor. In some cases, a mixture of water and detergent may be placed in the supply tank, but in other cases, the wet extractor has a separate detergent tank, and fresh water is placed in the supply tank and is mixed with detergent from the detergent tank by the fluid deposition system. Typical wet extractors also have a vacuum source that is used to suck in the deposited cleaning fluid, and any dirt or grime that it extracts from the floor, through a floor nozzle. This waste fluid is deposited and stored in a recovery tank.

In order to prevent waste fluid from entering and possibly damaging the vacuum source, the recovery tank is positioned, in a fluid flow sense, between the vacuum source and the floor nozzle. The recovery tank is designed to remove the waste fluid from the air flow in which it is entrained, while allowing the air to continue to the vacuum source. Typical wet extractors also have a shutoff mechanism that blocks the vacuum source when the recovery tank is full and prevents waste fluid in the recovery tank from sloshing into the vacuum source when the wet extractor is moved back and forth by the operator. This shutoff mechanism is usually provided in the form of a float device. The float device has a buoyant float that rises on the water, and a sealing surface on or attached to the buoyant float that blocks the passage to the vacuum source. In many cases, the operator of the wet extractor will be alerted to the fullness of the recovery tank by the change in pitch of the vacuum source as its air flow is becoming cut off, and this serves as a signal to empty the recovery tank.

Although a number of different wet extractors, supply tanks and recovery tanks have been produced, the prior art suffers from numerous shortcomings. One shortcoming of prior wet extractors is the that the inlet nozzle often becomes coated or clogged by dirt and debris removed from the surface being cleaned. This is especially true where the inlet nozzle is provided as a narrow slit, which is a common and favorable configuration to generate high-speed airflow and strong, focused suction to remove the fluid and dirt. Because the nozzle profile is so narrow, it is difficult to clean using conventional means, and users must resort to cleaning the nozzle with pipe cleaners and other specialized devices.

Another shortcoming of the prior art relates to supply tanks, which are typically difficult to fill unless a large sink or hose is available. For example, U.S. Pat. No. 5,406,673 to Bradd et al. (the '673 patent) and U.S. Pat. No. 5,937,475 to Kasen et al. (the '475 patent) provide supply tanks that are approximately bucket-shaped, and require a large vertical clearance to place them under sink faucet outlets. Furthermore, such a design may be difficult to fill unless the faucet can be swiveled out of the way to place the tank into the sink. Still further, the supply tank of the '475 patent is retained in place by latching devices that must be manipulated before removing the supply tank. Such latches require additional manufacturing, are subject to breaking, are often not intuitively understood by users, making them difficult to operate, unhook and realign for reinstallation. Similar problems are present with the supply tank of U.S. Pat. No. 6,073,300 to Zahuranec et al. (the '300 patent).

Other shortcomings of the prior art relate to the design of the recovery tank. For example, the recovery tank disclosed in the '673 patent has a complex multi-chambered design that requires the incoming air/fluid mixture to traverse a horizontal inlet that can easily backflow when the vacuum source is turned off, causing waste fluid to seep back out onto the floor. The recovery tank of the '673 patent is also inconveniently placed below the supply tank, and an operator must tilt the operating handle back and away from the upright resting position in order to access the recovery tank. Such maneuvering is awkward to perform and risks toppling the device during recovery tank removal and insertion. Still another shortcoming of the '673 device is that the recovery tank float is located in a relatively large chamber, making it more subject to fluid sloshing and unnecessary vacuum cut-off. The complex structure of the '673 recovery tank also requires disassembly to drain, and is relatively expensive to manufacture.

The recovery tank of the '475 patent also suffers from shortcomings. One shortcoming is that the fluid inlet leads almost directly into the main reservoir of the water recovery tank, and allows the incoming air/fluid mixture to short-circuit the reservoir and go directly into the outlet leading to the vacuum source. Another shortcoming of the '475 recovery tank is that it requires a complex multi-piece construction in which the float is permanently sealed, increasing the cost of construction, making it difficult or impossible to service the float, and necessitating the inclusion of a separate drain plug. Also, like the '673 device, the '475 recovery tank is retained in the wet extractor under the supply tank, and the operating handle must be tilted back from the upright resting position to remove the recovery tank. Still further, the '475 recovery tank uses a pivoting tank handle, which requires additional material and construction effort, and is susceptible to breaking. The recovery tank of the '300 patent has similar shortcomings. In addition to being a complex multi-piece structure, the '300 recovery tank is retained by a latch that requires additional material and construction effort, may be difficult to operate, and appears to be operable only when the operating handle is leaned back from the upright resting position. Other prior art recovery tanks suffer from these and other problems.

Other shortcomings of the prior art relate to the overall configuration of the supply and recovery tanks in the wet extractor. In many instances, such as in the '673 patent, the '475 patent and the '300 patent, the supply tank is carried in the operating handle of the device. Such devices suffer from being difficult to ship and store. These configurations are also unduly complex, making them expensive to manufacture and difficult to operate. Still further, such devices require more operator effort because the operator must bear the weight of the heavier operating handle when the wet extractor is at the end of the forward stroke and the handle is tilted at its lowest angle relative to the ground. Other devices, such as the wet extractor disclosed in U.S. Pat. No. 6,131,237 to Kasper et al. (the '237 patent), have reduced the weight of the operating handle by placing both the supply and recovery tanks in the base, but in the '237 patent device, the handle weight is increased by mounting an accessory device to it, and the operating handle still must be reclined away from the upright resting position to remove the tanks. Furthermore, the supply and recovery tanks of the '237 patent are contained in a single complex chamber having a flexible bladder, which is relatively difficult to manufacture, operate and clean.

Numerous fluid systems for extractors have been developed that apply fluids to a surface to be cleaned to help clean stubborn stains and extract deeply-rooted dirt and grime. The fluid may simply be water, or it may include detergents, fabric brighteners, perfumes and other useful compounds. The fluid also may be heated or converted to steam before being deposited. Liquid management is a continuing challenge in the design of wet extractors. In order to operate well, the operator of the wet extractor must be provided with some way of controlling when the fluid is deposited onto the floor or other surface being cleaned. Furthermore, such operations should be performed for both floor operations, and, if an auxiliary tool attachment is provided, for remote operations.

Previous attempts to provide liquid management systems have entailed the use of complex, bulky and costly arrangements of pumps, valves, solenoids, switches and the like. For example, U.S. Pat. No. 6,286,180 (the '180 patent) and U.S. Pat. No. 6,131,237 (the '237 patent), both to Kasper et al., disclose decentralized liquid management systems that require the pump priming assembly to be connected to a vacuum source to prime the pump. This requires additional construction material and limits flexibility in locating the priming assembly. This also may cause some delay between the time the pump is activated and the time that fluid is pressurized and available for depositing on the surface to be cleaned. As such, these systems require the fluid pump to operate at all times, and must use a mechanical pushbutton-type valve to control the flow of fluid. The use of this mechanical valve requires the valve to be located in the handle of the device so that it can be operated by the user. Furthermore, alternatives to mechanical valves in systems such as those in the '180 and '237 patents typically require the use of expensive electrically-operated solenoid valves to control fluid flow, such as shown in U.S. Pat. No. 6,513,188 to Zahuranec et al. (the '188 patent). A similar deficiency is encountered in the gravity-fed systems of U.S. Pat. No. 6,073,300 to Zahuranec et al. (the '300 patent), and U.S. Pat. No. 5,676,405 to Reed (the '405 patent), which also require a mechanical valve that must be positioned in the handle of the device, or, if the valve is positioned outside the handle, an expensive solenoid to operate the valve.

Another deficiency of prior art liquid management systems relates to the manner in which such systems are converted to operate in an accessory tool mode. In typical prior art systems, such as those disclosed in the '300 patent, the '180 patent, and the '405 patent, the accessory tool is installed in at least two steps. In one step, the vacuum hose for the accessory tool is installed, and in the other step the fluid line to the accessory tool is attached. In many cases, such as in the '405 and '300 patents, the fluid hose hookup is also constructed as a complex and relatively expensive fitting that has a shutoff valve integrally formed with the fluid passage at the point of connection. These systems are inconvenient and relatively difficult to use.

Other prior art accessory tool hookup systems have been developed that use a single plug to install both the vacuum source and the fluid line. Examples of such devices are provided in U.S. Pat. No. 5,400,462 to Amoretti (the '462 patent), U.S. Pat. No. 5,459,901 to Blase et al., (the '901 patent), and U.S. Pat. No. 5,669,098 to Tono (the '098 patent). Although these devices conveniently use a single plug to attach the tool to a vacuum source and a fluid source, neither the '462 patent nor the '901 patent provides any way to divert vacuum and fluid flow from a floor-cleaning circuit to the accessory tool circuit. Both of these devices also pose electrical shock risks to the user due to the exposed electrical switch and terminals in the '462 patent, and the use of a separate electrical plug in the '901 patent. This risk is compounded by the lack of any sort of shutoff valve or anti-siphoning device for the fluid lines at or near the connection point. The '098 patent also suffers from deficiencies as it relies on a coaxial design that is unnecessarily complex, and uses a complex shutoff valve that is integrally formed with the fluid passage at the point of connection with the accessory tool. Such combined fluid passage/shutoff valves can be relatively expensive, and, because the valve is necessarily positioned at the point of contact between the parts, the valves are susceptible to being contaminated by dirt and debris on the parts, which may impair the seal and result in leakage.

Other deficiencies of prior art liquid management systems relate to detergent mixing and metering systems. It many instances, wet extractors have been provided with separate clean water and detergent tanks so that the user does not have to mix the fluids into a single tank. The use of separate clean water and detergent tanks also allows the user to adjust the amount of detergent that is mixed with the water. Previous detergent control valves have been unduly complex. For example, the control valve disclosed in U.S. Pat. No. 4,570,856 to Groth et al. (the '856 patent) uses a complex system of hoses to pressurize the detergent chamber, and uses a rocker assembly to selectively pinch off the detergent supply hose, which can damage the hose and require more expensive hose material. Other systems, such as the system in U.S. Pat. No. 5,937,475 to Kasen et al. (the '475 patent), use valve assemblies that are located in the clean water flow path, and require a rotational movement to actuate such devices allow clean water and detergent to mix even when the device is inactive, and must be turned by hand to change the detergent mixture setting.

It is well known in the art of cleaning floors and other surfaces that it is often desirable to agitate the surface being cleaned to shake out and extract deeply embedded dirt and grime. As such, various different mechanical agitators have been made to agitate floors and carpets to assist with cleaning operations. These devices have been used on their own, in conjunction with vacuums and wet extractors and with other cleaning devices. Many previously known agitators can generally be placed into various categories, such as horizontal rotating brushes (often called "beater brushes" or "disturbulators"), and vertical rotating brushes, but other types of agitator have also been devised.

One type of agitator, the horizontal rotating brush, is exemplified by the device disclosed in U.S. Pat. No. 5,937,475 to Kasen et al. (the '475 patent). In this design, the brush comprises an elongated spindle that is oriented horizontally with its rotating axis parallel to the surface to be cleaned, and has a number of bristles extending radially from its surface. When the spindle is rotated, the bristles are driven downward into the surface being cleaned and swept back through a circular arc. Although these devices have been used with some success, it has been found that they suffer from some disadvantages. For example, they tend to spray fluids deposited by wet extractors, they accumulate dirt (especially hair) and require constant cleaning and attention, and are subject to bearing and drive belt failure. In addition, the aggressive sweeping of the bristles through the carpet or other surface being cleaned tends to cause accelerated wear of the surface, and may be unsuitable for delicate fabrics.

A second type of agitator, the vertical rotating brush, is exemplified by U.S. Pat. No. 6,009,593 to Crouser et al. (the '593 patent). This type of agitator comprises one or more spindles that rotate about an axis aligned orthogonally to the surface being cleaned. Each brush has a number of bristles that project approximately along the axis of rotation, and are swept through a flat circular path (relative to the device) when the brushes rotate. Like the horizontal rotating brush design, this design is prone to accumulating dirt, and particularly hair. Furthermore, it has been found that the counter-rotating vertical brushes of this agitator tend to leave an undesirable streaked pattern in the nap of some carpets, and, when used in a wet extractor, tend to leave corresponding streaks of unrecovered fluid on the surface being cleaned. The aggressive sweeping of the bristles through a large path of travel is also believed to contribute to accelerated carpet wear and may be unsuitable for delicate fabrics.

Another type of agitator that has been devised uses a brush that is simultaneously vibrated laterally relative to the fore-aft direction of the cleaning device and vertically relative to the plane of the surface being cleaned. Such devices are shown in U.S. Pat. No. 2,109,621 to Kirby (the '621 patent) and U.S. Pat. No. 6,353,964 to Andrisin, Jr. et al. (the '964 patent). The '621 patent uses a turbine to drive a shaft that has a brush at its end and an eccentric weight between the brush and the turbine. As the shaft rotates, the eccentric weight applies both vertical and lateral centripetal forces to thereby impel the brush with a "rapid scratching movement." Additional vertical forces against the surface being cleaned are applied by a set of springs mounted between the brush and the device's housing. The '964 patent uses a similar arrangement, but instead drives the brush using an eccentric that rotates in a corresponding hole in the brush. The eccentric rotates about an axis that is angled relative to the floor, and thereby imparts lateral, longitudinal and vertical forces and movements to the brush. Both of these agitators apply a significant vertical force to the brush, which is believed to contribute to accelerated wear of the surface being cleaned and tends to pound dirt and debris more deeply into the surface being cleaned. These agitators (especially the '621 patent) are also believed to provide inconsistent cleaning due to the somewhat random movements generated by their drive systems. Furthermore, these agitators are somewhat limited in their application because they rely on turbine drives that can not be operated independently of the vacuum source.

Still another agitator has been devised that moves laterally relative to the device's fore-aft direction of operation, such as shown in U.S. Pat. No. 3,685,081. However, this device also suffers from notable shortcomings, for example, the two reciprocating brushes do not fully cover the surface being cleaned, and therefore are believed to provide inconsistent cleaning. Furthermore, the device is believed to cause accelerated wear of the surface being cleaned because the entire weight of the device rests on the agitator brushes, and the brushes sweep through a relatively large range of motion. This device also fails to provide any vacuuming capability, and appears to be very difficult to operate on carpeted floors or other surfaces that would tend to hold the brushes and cause the machine to move erratically.

Similar agitating devices have been employed with accessory tool devices and "power heads" that plug into the main body of a cleaning device to provide remote cleaning capability. These devices suffer from similar deficiencies.

Vacuum cleaning devices often benefit from using a flexible strip that contacts the surface being cleaned to focus the vacuumed air and physically constrain the debris being recovered and direct it through the device's vacuum inlet nozzle. Such flexible strips are typically referred to as "wipers" or "squeegees." Wipers are particularly effective when the device is used to clean bare floors, windows, or other hard surfaces that form a solid lower barrier that works in conjunction with the flexible strip to prevent debris from escaping the vacuum inlet nozzle. Wipers are also particularly useful with devices that are intended to recover fluids from the surface being cleaned, such as wet extractors and window washers, which deposit cleaning fluid on the surface then recover the fluid with a vacuum. These wipers can be used with both floor cleaning devices and hand-held cleaners, such as accessory cleaning tools and portable cleaners. While many designs for such wipers have been illustrated in the prior art, there still remains a need to provide an improved squeegee system that provides acceptable cleaning performance, but can be selectively removed from a cleaning device in a convenient manner.

Therefore, the objectives of the present invention are to provide various floor cleaning devices and features that partially or fully overcome or ameliorate these and various other shortcomings of the prior art. Although certain deficiencies in the related art are described in this background discussion and elsewhere, it will be understood that these deficiencies were not necessarily heretofore recognized or known as deficiencies. Furthermore, it will be understood that, to the extent that one or more of the deficiencies described herein may be found in an embodiment of the claimed invention, the presence of such deficiencies does not detract from the novelty or non-obviousness of the invention or remove the embodiment from the scope of the claimed invention.

SUMMARY OF THE INVENTION

These and other objectives of the invention are addressed by an embodiment of the invention comprising a wet extraction floor cleaning device having a base assembly adapted for movement on a surface being cleaned, an operating handle pivotally attached to the base assembly, a supply tank having a supply tank outlet, and a recovery tank having a recovery tank inlet and a recovery tank outlet. The base assembly has an inlet nozzle that extends from an inlet slip proximal the surface being cleaned to a nozzle outlet. The device further includes a fluid deposition assembly that can be selectively placed in fluid communication with the supply tank outlet, a vacuum source, and first and second external pockets. The supply and recovery tanks are adapted to be selectively placed in the first and second external pockets, thereby placing the supply tank outlet in fluid communication with the fluid deposition system, the recovery tank inlet in fluid communication with the nozzle outlet, and the recovery tank outlet in fluid communication with the vacuum source inlet.

In various additional embodiments, the supply tank and the recovery tank may be received in the first pocket and the second pocket, respectively, by snap engagement, or may be individually removable.

The first and second external pockets also may be located in the base assembly. In such an embodiment, either or both of the first and second external pockets may be adapted to receive the supply tank or recovery tank and thereby prevent longitudinal or lateral translation of the supply or recovery tank relative to the base assembly when received therein. In such an embodiment, the supply or recovery tank may be slidably receivable into the respective external pocket in a substantially vertical direction. The first and second pockets may also be positioned between the nozzle inlet and the pivot axis. In still another embodiment, the base assembly may further have a third external pocket and a detergent tank adapted to be selectively received in the third pocket. In this embodiment, the supply tank, the recovery tank and the detergent tank may be individually removable.

In still another embodiment, the supply tank and the recovery tank may protrude from the lower housing. In this embodiment, the upper housing may have a vertical rib positioned between the supply tank and the recovery tank. A handle lock may also be provided and adapted to selectively hold the operation handle in an upright resting posit ion, in which the supply tank and the recovery tank are selectively removable.

In yet another embodiment, the first and second external pockets may be arranged on opposite sides of a longitudinal centerline of the device, or may be laterally juxtaposed with one another relative to a longitudinal axis of the base assembly.

In still other embodiments, the inlet nozzle may comprise a selectively removable nozzle cover attachable and removable without the use of tools.

Furthermore, the operating handle may comprise a collapsible handle having an upper handle portion and a lower handle portion. In one such embodiment, the device further comprises a handle lock adapted to selectively hold the lower handle portion in an upright resting position, and the supply tank and the recovery tank are selectively removable when the lower handle portion is in the upright resting position. In another such embodiment, the lower handle portion is pivotally attached to the base assembly, and the upper handle portion being pivotally attached to the lower handle portion.

In still another embodiment, the device may further include a carry handle, which may be located on or adjacent to a vertical rib between the supply tank and the recovery tank. In an embodiment having a vertical rib between the tanks, the fluid deposition assembly may comprise a valve assembly located within the vertical rib and fluidly connected to one or more spray nozzles. The inlet nozzle may also be located at least partially on top of the vertical rib, and the device may have an accessory tool attachment port located on the rib and in fluid communication with the nozzle and the recovery tank.

The present invention will be better understood from the following detailed description of the invention, read in connection with the drawings as hereinafter described.

BRIEF DESCRIPTION OF THE DRAWINGS

FIG. 35A is fragmented perspective view of an embodiment of an accessory tool outlet of the present invention, shown in the opened position.

FIG. 35B is fragmented perspective view of the accessory tool outlet of FIG. 35A, shown in the closed position.

FIG. 35C is fragmented perspective view of the accessory tool outlet of FIG. 35A, shown in the open position and with the accessory tool plug of FIG. 34A installed therein.

FIGS. 40A–C are a partially cut away side views of three other embodiments of linear agitators of the present invention, shown installed in device housings.

DETAILED DESCRIPTION OF PREFERRED EMBODIMENTS

Figure 1:
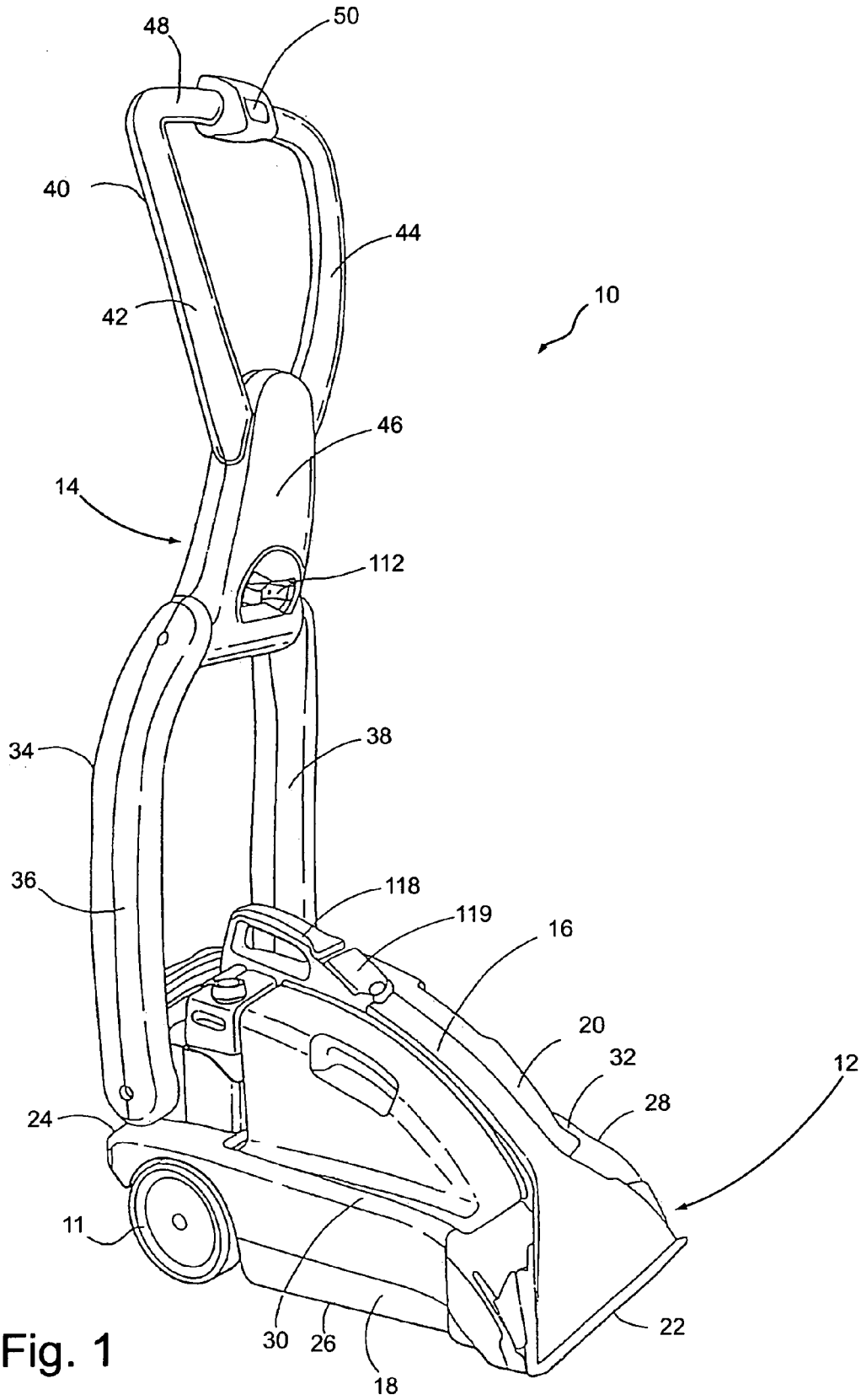
FIG. 1 is a front perspective view of a floor cleaning device in accordance with a preferred embodiment of the present invention, with the operating handle shown in the extended position.

As used herein, and unless otherwise specified, the term "longitudinal" refers to the fore-aft direction of the cleaning device, as generally defined by the device's intended direction of movement during use. In devices with fixed wheels, the longitudinal direction is typically parallel with the orientation of the device's fixed wheels. Also as used herein, and unless otherwise specified, the term "lateral" refers to the direction perpendicular to the longitudinal direction and generally in the plane of the surface being cleaned. Finally, unless otherwise specified, the term "vertical" means the direction orthogonal to the plane of the floor or other surface upon which the device is intended to be operated. The use of these terms is intended to clarify explanation of the invention, and these terms are not intended to limit parts and features described thereby to being strictly co-linear with the above-described directions. For example, a part, such as an operating handle, that is described as extending "vertically" is not limited to only being orthogonal to the plane of the surface to be cleaned, and may additionally extend longitudinally and/or laterally, to thereby be oriented at an angle of less than 90 degrees to the surface to be cleaned. Furthermore, these terms are used in a relative sense with the device as a the frame of reference (rather than using a global frame of reference), and it will be appreciated that a part that is described as having a particular orientation may have a different global orientation if the entire device is rotated in the global frame of reference. The same holds true for terms describing relative positions, such as "side-by-side," "left," "right," "above," "below," "next to," "behind," "in front of," "juxtaposed," and so on.

A first aspect of the present invention is directed to a floor cleaning device with a collapsible operating handle that is designed for compact storage, shipping, and/or transportation of the device. While the invention will be described in detail herein with reference to several embodiments of the invention applied to wet extractors, it should be understood that the invention may be applied to other types of floor cleaning devices, such as vacuum cleaners, floor polishers, steam cleaners and the like. In one preferred embodiment, the device includes a base assembly adapted to be guided across a floor during operation of the device. Also included is an operating handle having a lower handle and an upper handle, which is moveable between an extended position and a collapsed position for storage, shipping, and/or transportation of the device. When the operating handle is moved to the collapsed position, the upper and lower handles are folded on one another. Thus folded, the lower and upper handles preferably also may be pivoted so that they are positioned atop the base assembly so that they do not extend laterally from the outer periphery of the base assembly by a substantial distance. As such, the operating handle occupies a minimal amount of vertical and horizontal space when collapsed. Examples of other advantages provided by embodiments of the present invention are the ability to instantly set up the device without using tools to attach the handle, and the ability to incorporate wiring and switches into the handle.

Figure 10:
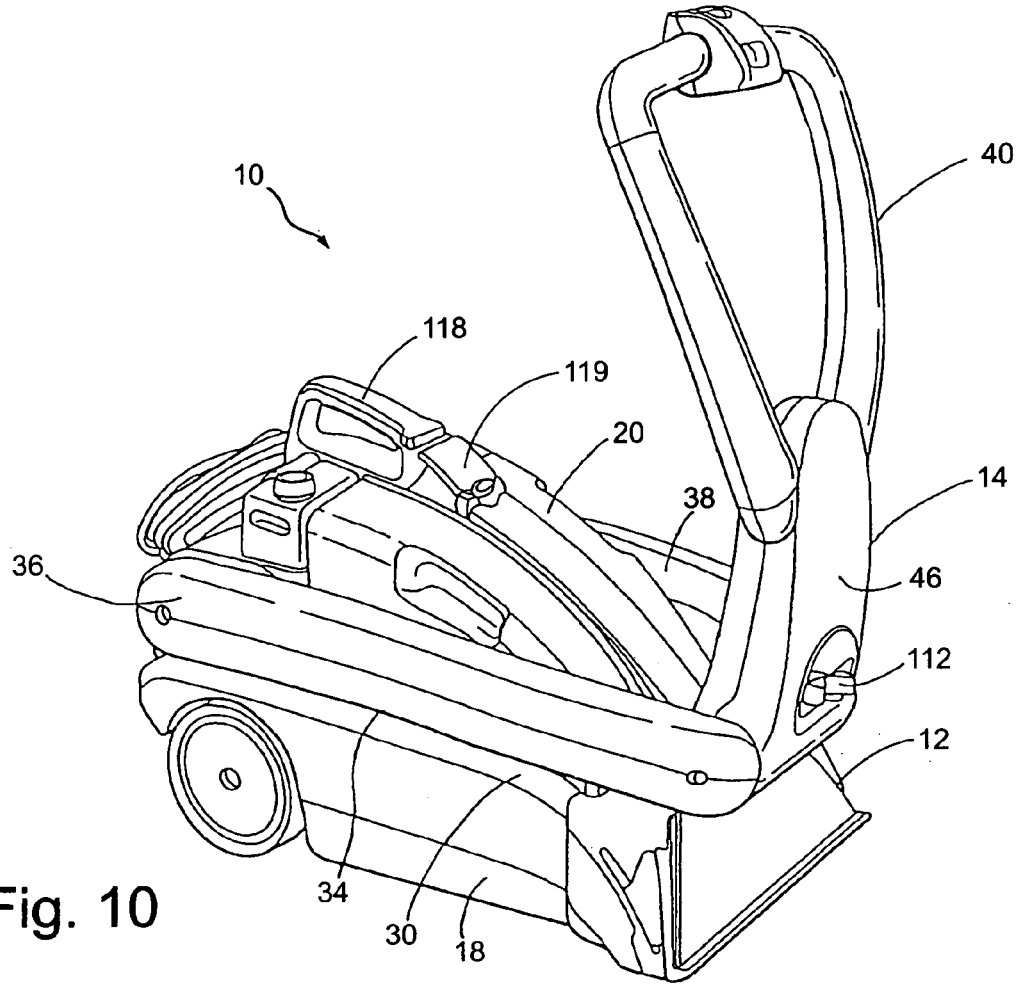
FIG. 10 is a front perspective view of the floor cleaning device of FIG. 1, with the operating handle shown in a partially collapsed position.
Figure 11:
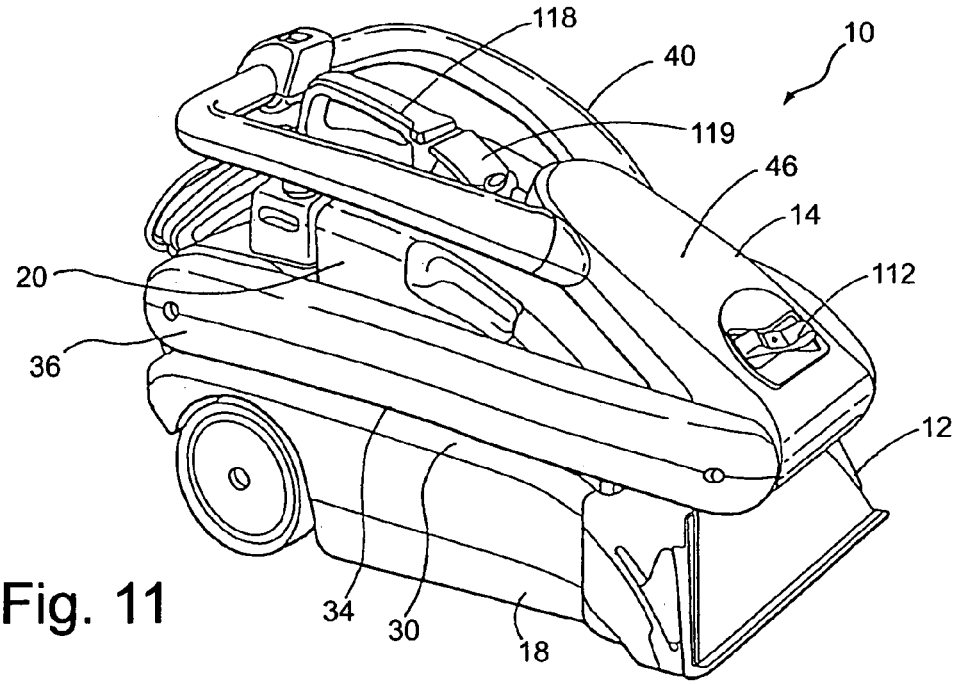
FIG. 11 is a front perspective view of the floor cleaning device of FIG. 1, with the operating handle shown in the collapsed position.

Referring to FIG. 1, a floor cleaning device in accordance with a preferred embodiment of the present invention is designated generally as reference numeral 10. Device 10 includes a base assembly 12 that is adapted to be guided across a floor during operation of device 10. Base assembly 12 may comprise an articulated base having multiple parts that pivot relative to one another, such as a floor portion and an upright portion, or may comprise a single unitary base that does not have a separate pivoting upright portion other than the handle. Device 10 has a pair (or more) of wheels 11 located near its back end to facilitate its operation and movement. Device 10 also includes an operating handle 14 that extends upwardly from the rear of base assembly 12. As will be described in greater detail herein, operating handle 14 is moveable between an extended position for upright operation of device 10 (as shown in FIG. 1) and a collapsed position for compact storage, shipping, and/or transportation of device 10 (as shown in FIGS. 10 and 11), or for use of the device as a canister-type device. It will be readily appreciated that the operating handle 14 is shown in FIG. 1 in a fully-upright position, and can be tilted backwards to facilitate normal cleaning operations in the upright cleaning mode. The operating handle 14 preferably also may be stored in this fully-upright position if it is not desired or necessary to fold the handle for storage.

Base assembly 12 includes a base housing 16 that surrounds and/or holds various internal components of device 10. Base housing 16 has a lower housing 18 positioned adjacent the floor, and an upper housing 20 projecting above lower housing 18 that slopes upwardly from the front side to the rear side thereof. Lower housing 18 may be formed integral with upper housing 20, or may be formed as separate parts and connected together in any suitable manner. Base housing 16 may be formed of any rigid material, and is preferably formed of a material that provides high strength with low weight, such as conventional structural plastic materials, aluminum, and the like. The exterior surface of base housing 16 also may comprise various different parts of the device 10. For example, the exterior surface of base housing 16 may be formed in part by structural housing members, and in part by water tanks, detergent containers, vacuum nozzles, clear windows, and the like.

The outer periphery of lower housing 18 is formed by a front side 22, a rear side 24, a right side 26 (i.e., the side shown in the foreground of FIG. 1) and a left side 28 (i.e., the side shown in the background of FIG. 1), which together define the floor space occupied by base assembly 12. A first support ledge 30 extends generally horizontally along the top surface of lower housing 18 adjacent the right side 26 thereof, and a second support ledge 32 extends generally horizontally along the top surface of lower housing 18 adjacent the left side 28 thereof. It will be seen that support ledges 30 and 32 are positioned and configured to support the lower arms of operating handle 14 when moved to the fully collapsed position. Although support ledges 30 and 32 are shown extending along the entire length of lower housing 18, it will be understood that this is not required.

Operating handle 14 includes a lower handle 34 having a pair of spaced lower arms 36 and 38. Lower arms 36 and 38 are preferably disposed generally parallel to each other, and may have a slight inward taper at their upper ends (i.e., the ends distal from the base assembly 12), as shown in FIG. 1. Of course, lower arms 36 and 38 also may be curved or bent and may project at angles relative to one another. Operating handle 14 also includes an upper handle 40 having a pair of spaced upper arms 42 and 44 that extend upwardly and outwardly from an intermediate yoke 46. Upper arms 42 and 44 are connected together at their upper ends to form a transversely extending hand grip 48, which may be grasped by a user during operation of device 10. Although the transverse hand grip 48 design is preferred because it provides improved leverage and control over conventional one-hand grips, a one-hand grip also may be used with the present invention, as shown with reference to FIGS. 18–23.

Figure 5:
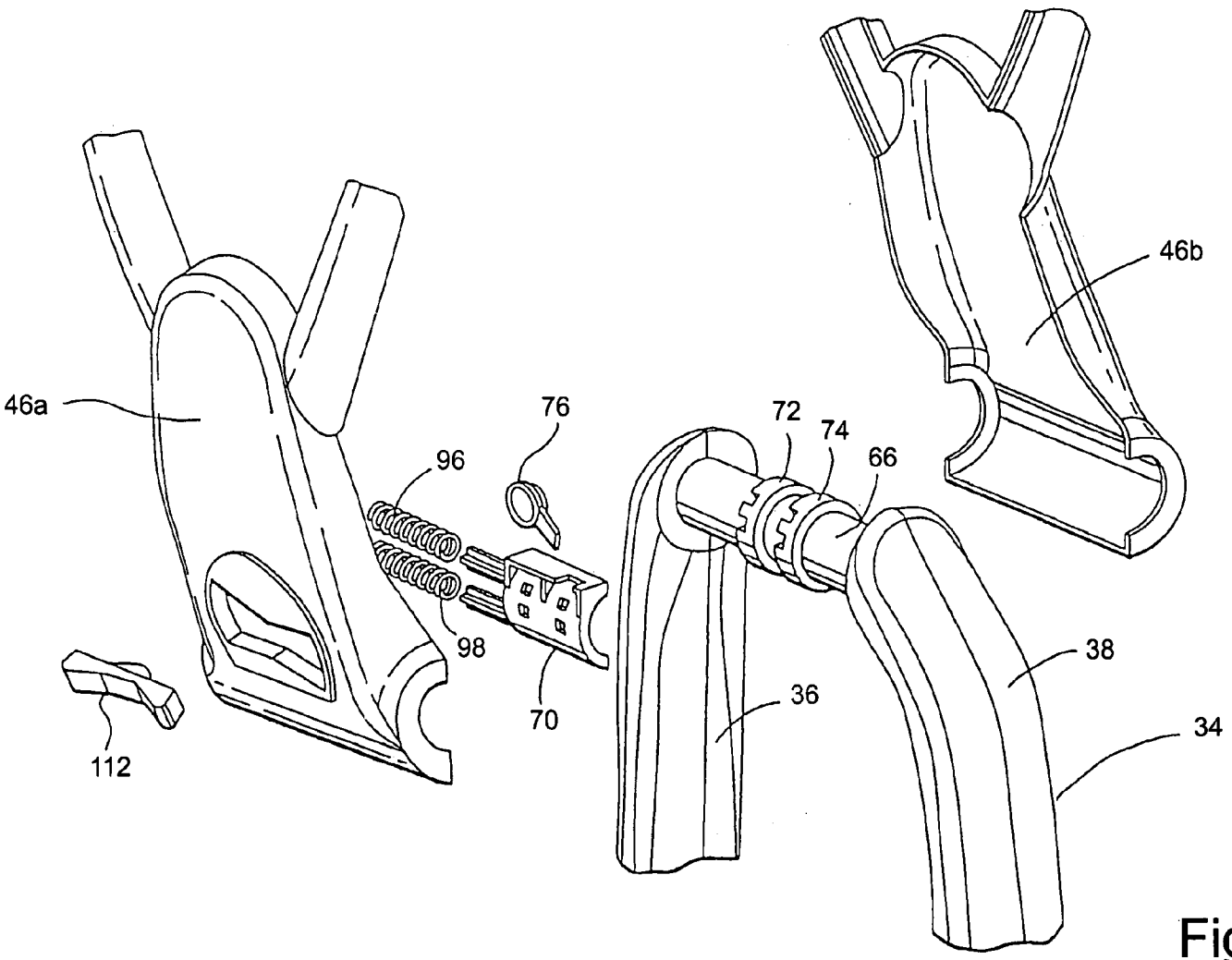
FIG. 5 is an exploded fragmented front perspective view of the floor cleaning device of FIG. 1, showing the interrelationship between the upper handle, the lower handle and the upper lock.

It should be understood that lower handle 34 and upper handle 40 are each preferably formed as two separate clamshell parts or halves (such as the first half 46*a* and the second half 46*b* of yoke 46 in FIG. 5) that are connected together in any suitable manner, although they could of course be formed as integral parts. Also, lower handle 34 and upper handle 40 may be formed of any rigid material, and are preferably formed of a material that provides high strength with low weight, such as conventional structural plastic materials, aluminum, and the like.

A switch 50 is located on hand grip 48 to facilitate easy control of the various power-driven components located within base housing 16, such as an agitator, pump motor and suction motor. These components are described in more detail elsewhere herein. Switch 50 may be located in the center of the transverse grip 48, as shown, or may be located to the sides. In a preferred embodiment, switch 50 comprises a 3-position rocker switch that turns the device off in its first position, activates a vacuum source in its second position, and activates a vacuum source and a floor agitator in its third position. In other embodiments, multiple different independent switches may instead be used to activate the vacuum source and floor agitator, and such switches may be located together or separately from one another. Switch 50 also may be supplemented with a pushbutton (not shown) that electrically or mechanically activates a fluid deposition system that deposits cleaning fluid onto the floor. As is known in the art, a power cord (not shown) interconnects switch 50 to the power-driven components. Preferably, operating handle 14 is hollow to permit the power cord to be encased therein. It should be understood that the power cord has enough slack to allow operating handle 14 to be moved between the extended position (as shown in FIG. 1) and the collapsed position (as shown in FIGS. 10 and 11).

Figure 2:
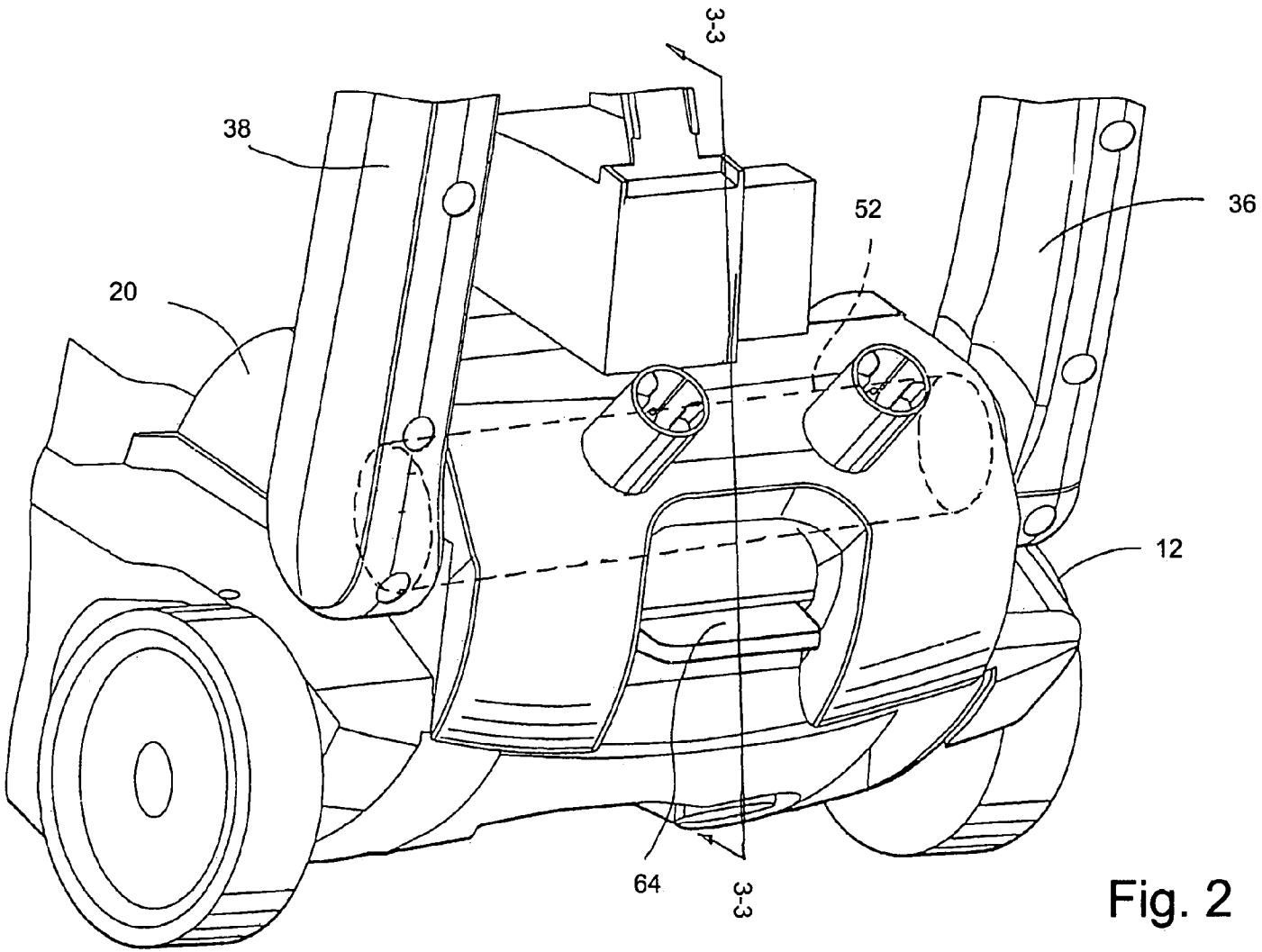
FIG. 2 is a rear perspective view of the floor cleaning device of FIG. 1, showing the handle release pedal of the lower lock.

Referring now to FIG. 2, it can be seen that lower arms 36 and 38 of lower handle 34 are pivotally connected at their lower ends to opposite sides of upper housing 20 at the rear of base assembly 12. Lower handle 34 includes a lower cross member 52 (shown in cross-section in FIGS. 3 and 4) that is generally tubular in shape and extends transversely between the lower ends of lower arms 36 and 38 within upper housing 20, as shown in phantom lines in FIG. 2. One end of lower cross member 52 is rigidly connected to the lower end of lower arm 36, and the other end of lower cross member 52 is rigidly connected to the lower end of lower arm 38. As such, pivotal movement of lower arms 36 and 38 causes rotation of cross member 52.

Figure 3:
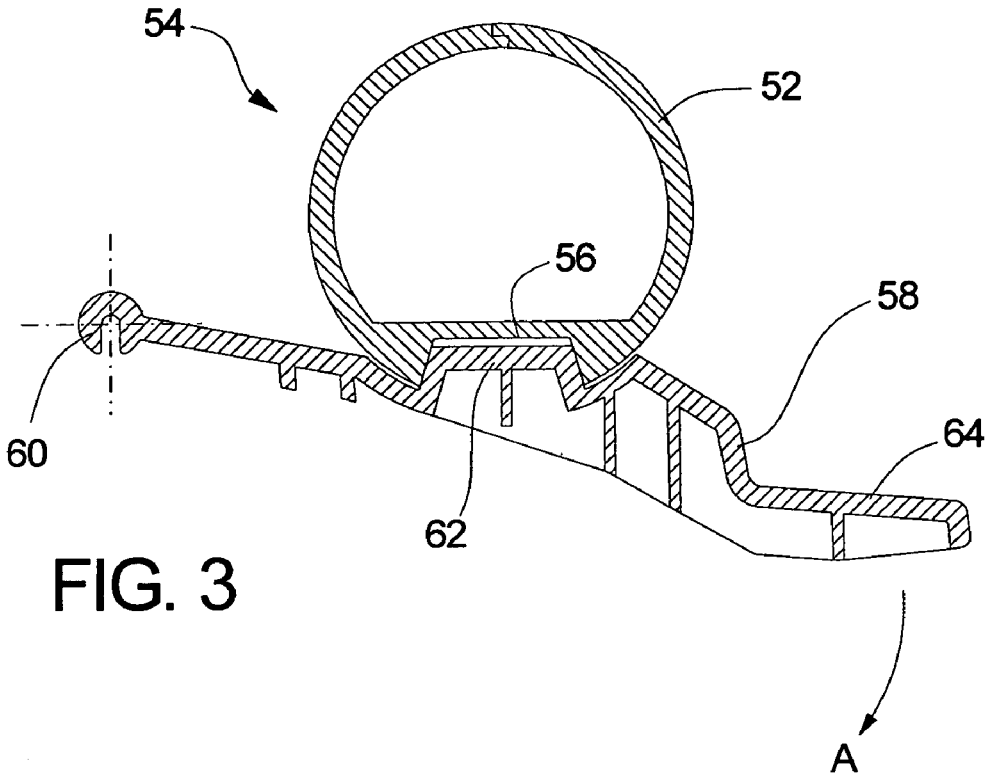
FIG. 3 is a fragmented side cross-sectional view of the lower lock of FIG. 2 taken along line 3—3, shown in the locked position.
Figure 4:
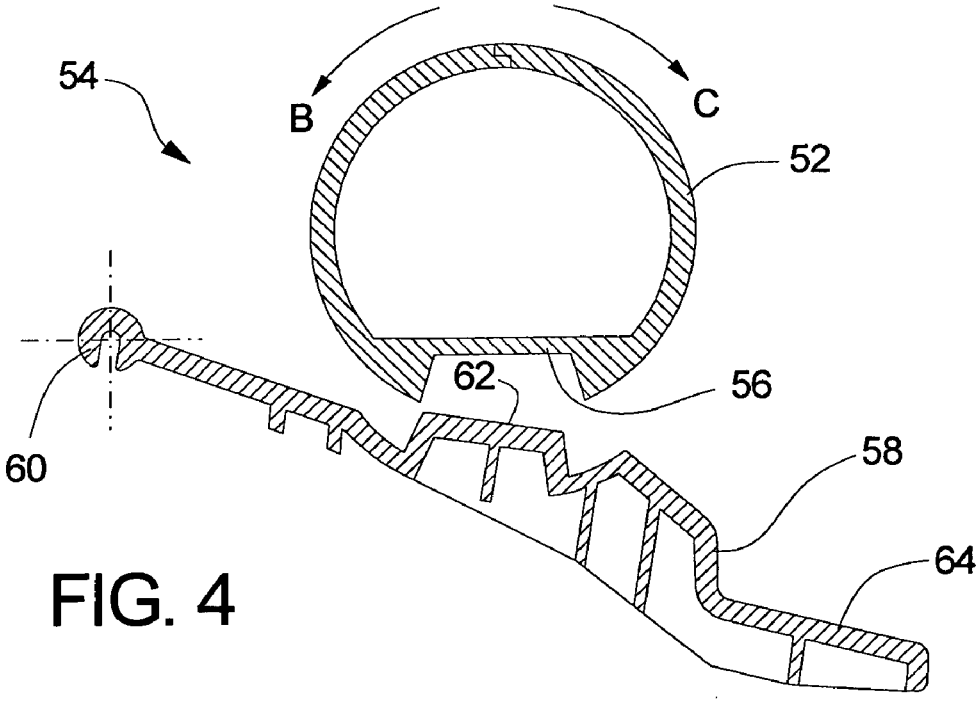
FIG. 4 is a fragmented side cross-sectional view of the lower lock of FIG. 3, shown in the released position.

Referring now to FIGS. 3 and 4, a lower lock 54 is provided that is moveable between a locked position to prevent pivotal movement of lower handle 34 relative to base assembly 12 (as shown in FIG. 3) and a released position to allow pivotal movement of lower handle 34 relative to base assembly 12 (as shown in FIG. 4). Lower lock 54 has a pocket 56 formed in lower cross member 52 and a spring-biased lever 58 that cooperate together to form the lower lock. Lever 58 is pivotally connected to base assembly 12 at a pivot point 60 and includes a locking lug 62 that is aligned to be engaged within pocket 56. Lever 58 also includes a handle release pedal 64 that projects outwardly from the rear of base assembly 12 (see FIG. 2).

When lower lock 54 is in the locked position, lever 58 is biased upwardly under the action of a spring (not shown) and locking lug 62 is engaged within pocket 56. As such, lower handle 34 is fixed to base assembly 12 in an upright position and cannot be pivoted relative thereto. This locked position is shown in FIG. 1, and is useful for holding the handle 14 in place when the user is preparing to use the device 10, and also may be used to pull back on the handle 14 to thereby lift the front end of the device to convey it by its wheels 11 over obstacles such as carpet edges and the like. To move lower lock 54 to the released position, handle release pedal 64 may be depressed (such as with a user's foot) so as to pivot lever 58 in the direction of arrow A (see FIG. 3) against the bias of the spring. When handle release pedal 64 is depressed, locking lug 62 is disengaged from pocket 56 to thereby permit rotation of cross member 52 in either of directions B or C (see FIG. 4). As such, lower handle 34 may be pivoted relative to base assembly 12 to either fold handle 14 forward (direction B) to collapse handle 14, or lean handle 14 back (direction C) to operate the device. Lower cross member 52 may also have a second pocket (not shown) located elsewhere on its surface to engage with the locking lug 62 when the lower handle 34 is pivoted to another position. For example, a second pocket may be provided to lock lower handle 34 in the collapsed position, as it is shown in FIGS. 10 and 11.

Lower cross member 52 also may have a cam surface (not shown) that actuates an override switch (not shown) to deactivate switch 50 when lower handle 34 is folded forward to prevent operation of the device when it is collapsed. The override switch may fully or partially disable device 10. In a preferred embodiment, when handle 14 is collapsed, an override switch disables operation of a floor agitator located in base housing 16, but allows operation of a vacuum source, to thereby allow device 10 to operate as a canister-like device.

Although the lower lock system described herein with reference to FIGS. 2–4 is preferred, other locking systems may be used with device 10 to pivotally lock lower handle 34 relative to base housing 16 in one or more locking positions, as will be appreciated by those of ordinary skill in the art. Furthermore, the lower lock system may not employ a positive lock that requires a release lever to be actuated to overcome the lock, and may instead comprise a device that simply increases the pivoting resistance at one or more points, and only requires the operator to apply pressure to handle 14 to overcome the pivoting resistance.

Referring now to FIG. 5, it can be seen that lower handle 34 includes an upper cross member 66 that is generally tubular in shape and extends transversely between the upper ends of lower arms 36 and 38. One end of upper cross member 66 is rigidly connected to the upper end of lower arm 36, and the other end of upper cross member 66 is rigidly connected to the upper end of lower arm 38. As can be seen, yoke 46 of upper handle 40 includes a first half **46*a* and a second half 46*b* that are configured to clamshell around upper cross member 66. As such, yoke 46 is pivotally connected to upper cross member 66 to thereby allow pivotal movement of upper handle 40 relative to lower handle 34. Preferably, yoke 46 and lower handle 34 have engaging surfaces (not shown) to prevent upper handle 40 from being over-rotated relative to lower handle 34**.

Figure 6:
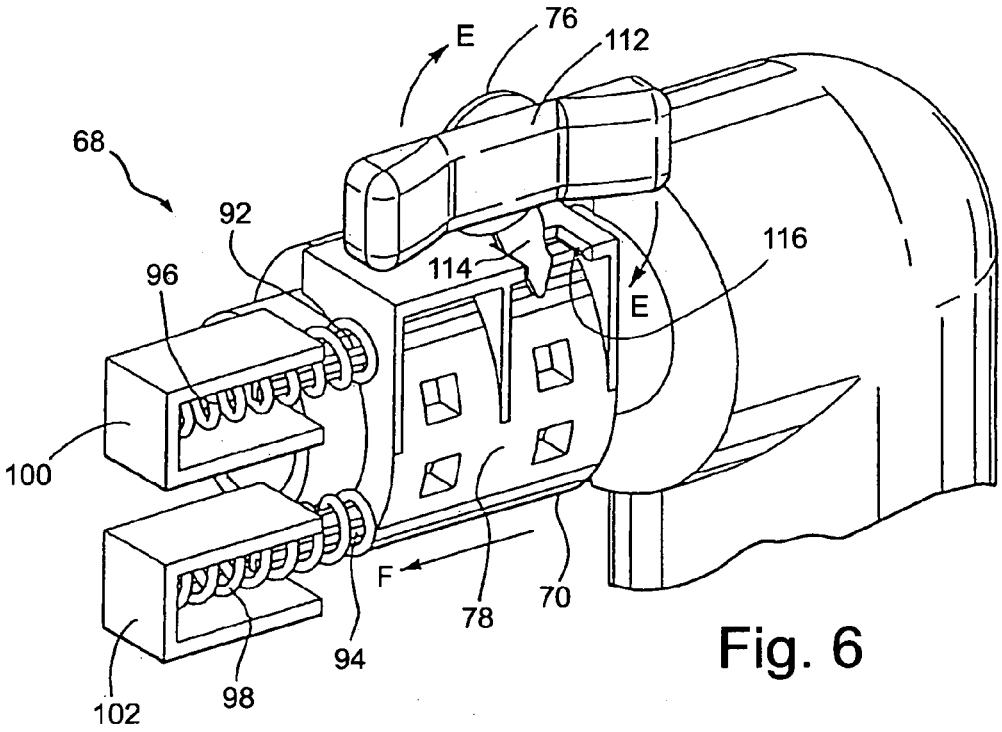
FIG. 6 is a fragmented front perspective view of the upper lock of FIG. 5, shown in the locked position.
Figure 7:
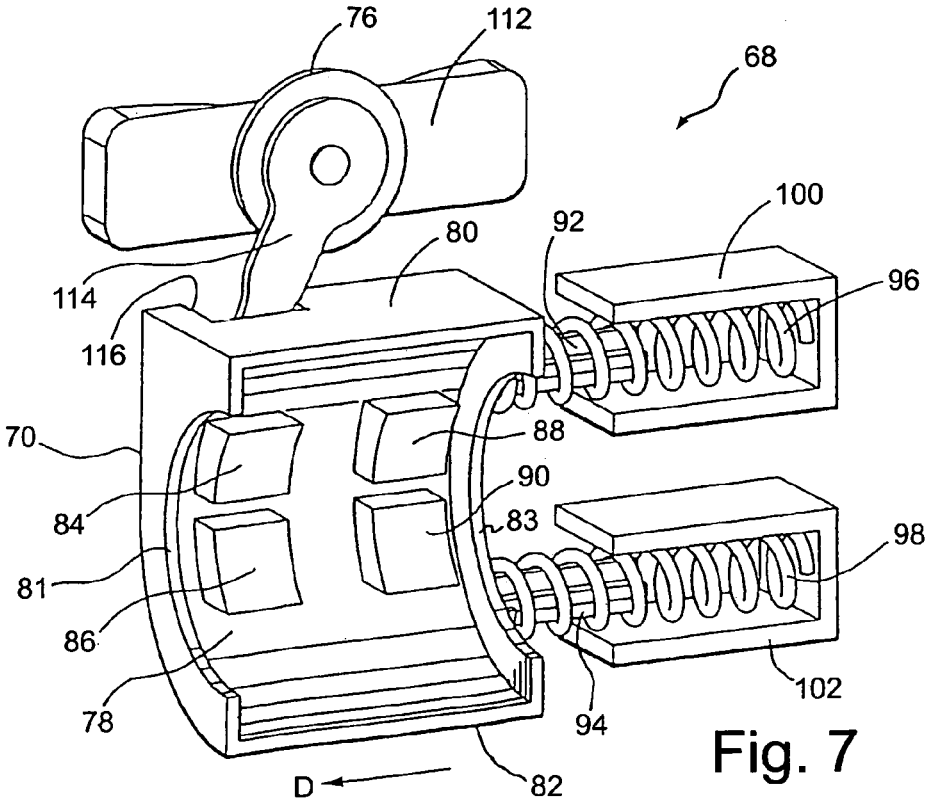
FIG. 7 is a fragmented rear perspective view of the upper lock of FIG. 6, shown in the locked position.
Figure 8:
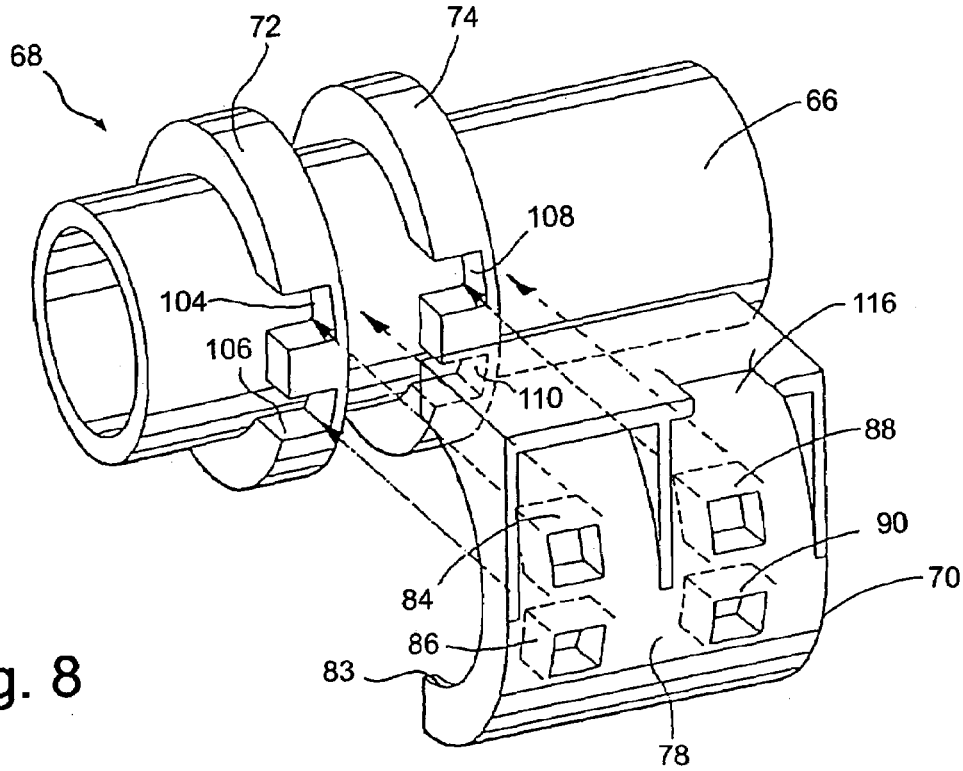
FIG. 8 is a fragmented exploded front perspective view of the upper lock of FIG. 6, shown in the locked position.
Figure 9:
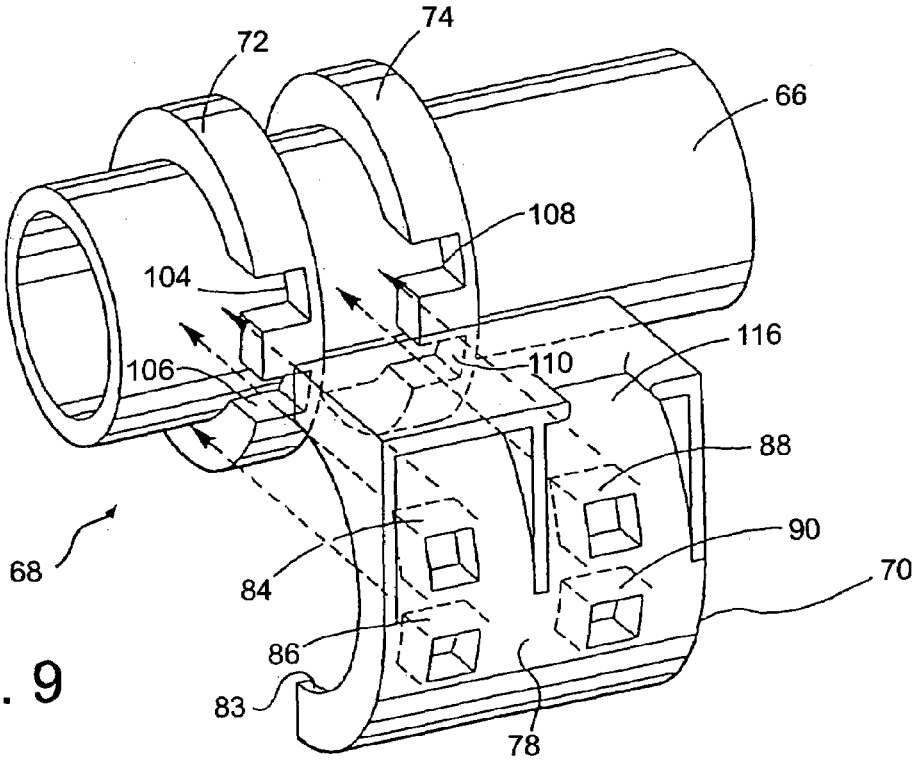
FIG. 9 is a fragmented exploded front perspective view of the upper lock of FIG. 6, shown in the released position.

Referring now to FIGS. 5–9, an upper lock 68 is provided that is moveable between a locked position (as shown in FIG. 8) to prevent pivotal movement of upper handle 40 relative to lower handle 34 and a released position (as shown in FIG. 9) to allow pivotal movement of upper handle 40 relative to lower handle 34. As will now be described, upper lock 68 comprises a slide lock 70, locking rings 72 and 74, and a twist lever 76 that cooperate together to form the upper lock 68.

As best shown in FIG. 7, slide lock 70 of upper lock 68 includes a slide body 78 that is configured to be captured between the yoke 46 and the upper cross member 66. As can be seen, slide body 78 has an upper edge 80 and a lower edge 82 that fit into a rectangular slot in yoke 46 such that slide body 78 can slide back and forth relative to yoke 46, but can not rotate in yoke 46. Slide body 78 also has two curved surfaces 81, 83 that abut and upper cross member 66 and allow slide body 78 to rotate about and slide axially along upper cross member 66.

Slide body 78 also includes a plurality of generally square-shaped tabs 84, 86, 88, 90 that extend inwardly toward upper cross member 66. Although four tabs have been shown in the illustrated embodiment, it should be understood that any number of tabs may be used, and the tabs may have shapes other than square shapes.

Slide lock 70 also includes two spring retainer posts 92 and 94 that project outwardly from the side of slide body 78. Mounted on spring retainer posts 92 and 94 are two coil compression springs 96 and 98, respectively, that are biased to urge slide body 78 in the direction of arrow D (see FIG. 7) to the locked position. Springs 96 and 98 are seated within two U-shaped spring stops 100 and 102, respectively, so as to maintain springs 96 and 98 on spring retainer posts 92 and 94. Spring stops 100 and 102 are attached to, or formed integrally with, the inner surface of first half 46*a* of yoke 46 at the appropriate position so as to surround springs 96 and 98 and spring retainer posts 92 and 94 when assembled.

As best shown in FIGS. 8 and 9, locking rings 72 and 74 of upper lock 68 are each rigidly connected around and may be integrally formed with upper cross member 66 of lower handle 34. Locking ring 72 has two notches 104 and 106 formed therein that are circumferentially spaced to engage tabs 84 and 86, respectively, of slide lock 70. Similarly, locking ring 74 has two notches 108 and 110 formed therein that are circumferentially spaced to engage tabs 88 and 90, respectively, of slide lock 70. It should be noted that retainer posts 92 and 94, springs 96 and 98 and spring stops 100 and 102 have been removed from FIGS. 8 and 9 for ease of illustration.

As best shown in FIGS. 6 and 7, twist lever 76 of upper lock 68 comprises a twist handle 112 that is rigidly connected to an actuation pawl 114. Twist lever 76 is mounted to upper handle 40 such that twist handle 112 projects outwardly through an opening formed in first half 46*a* of yoke 46 (see FIG. 1) and actuation pawl 114 is positioned within a recess 116 formed in slide body 78 of slide lock 70. Twist handle 112 may be rotated by a user to cause pivotal movement of actuation pawl 114 about the center of twist handle 112. Twist lever 76 may also have a bias spring (not shown) attached thereto to hold the actuation pawl 114 against one side of recess 116 to prevent it from rattling in the recess and to ensure that twist handle 112 returns to its original position when not being used.

When upper lock 68 is in the locked position, slide lock 70 is biased in the direction of arrow D (see FIG. 7) by springs 96 and 98. In this position, tabs 84, 86, 88 and 90 of slide lock 70 are engaged within notches 104, 106, 108 and 110, respectively, of locking rings 72 and 74 (as shown in FIG. 8). As such, upper handle 40 is fixed to lower handle 34 in an upright position and cannot be pivoted relative thereto. The tabs and/or the notches may be provided with a slight taper so that they self-tighten when they engage to reduce any play that may be present in the lock. To move upper lock 68 to the released position, twist handle 112 may be rotated by a user in the direction of arrow E (see FIG. 6), whereby actuation pawl 114 engages the edge of recess 116 and moves slide lock 70 against the bias of springs 96 and 98 in the direction of arrow F (see FIG. 6). In this position, tabs 84, 86, 88 and 90 of slide lock 70 have disengaged notches 104, 106, 108 and 110, respectively, of locking rings 72 and 74 (as shown in FIG. 9). As such, upper handle 40 may be pivoted relative to lower handle 34. It will be understood that locking rings 72 and 74 may also have a second set of notches (not shown) into which tabs 84, 86, 88 and 90 engage when upper handle 40 is fully folded relative to lower handle 34, to thereby lock handle 14 in the folded position, as shown in FIG. 11. Similar structures may also be provided to lock the handle 14 in partially-folded positions.

Although the upper lock 68 described herein with reference to FIGS. 5–9 is preferred, it will be appreciated by those of ordinary skill in the art that other devices and assemblies may be employed with device 10 to pivotally lock upper handle 40 relative to lower handle 34 in one or more locked positions.

As will now be described in detail, operating handle 14 is moveable between an extended position for operation of device 10 (as shown in FIG. 1) and a collapsed position for compact storage, shipping, and/or transportation of device 10 (as shown in FIGS. 10 and 11).

Referring to FIG. 1, when operating handle 14 is in the extended position, upper lock 68 is in the locked position (as shown in FIG. 8) such that upper handle 40 is fixed to lower handle 34 in an upright position and cannot pivot relative thereto. As such, lower and upper handles 34 and 40 are maintained in a substantially rigid extended position. Generally, during use, lower lock 54 is released and operating handle 14 is tilted back towards the operator to allow easy manipulation of the device 10 in a back-and-forth motion. Handle 14 also may by pivoted into an upright position (as shown in FIG. 1), where lower lock 54 engages (as shown in FIG. 3) such that lower handle 34 is fixed to base assembly 12 in an upright position and cannot pivot relative thereto. This upright locked position is useful to allow device 10 to stand on its own when the operator needs to momentarily leave device 10, such as to relocate the power cord to a different power outlet, and also allows the user to pull back on handle 14 to pivot the front end of base assembly 12 upwards to facilitate movement on wheels 11.

Referring now to FIGS. 10 and 11, when it is desired to move operating handle 14 to the collapsed position for storage, shipping, and/or transportation of device 10, a user may depress handle release pedal 64 (see FIG. 2) to move lower lock 54 to the released position (as shown in FIG. 4) and thereby permit pivotal movement of lower handle 34 relative to base assembly 12. The user may also rotate twist handle 112 to move upper lock 68 to the released position (as shown in FIG. 9) and thereby permit pivotal movement of upper handle 40 relative to lower handle 34.

When lower lock 54 and upper lock 68 are both in the released position, operating handle 14 may be moved to the fully collapsed position by folding lower handle 34 downwardly and forwardly to a position atop lower housing 18 (see FIG. 10), and then folding upper handle 40 downwardly and backwardly to a position atop upper housing 20 (see FIG. 11). Of course, it should be understood that operating handle 14 could alternatively be moved to the fully collapsed position by folding upper handle 40 downwardly and backwardly, and then folding lower handle 34 downwardly and forwardly to the position shown in FIG. 11, or the folding of the upper and lower handles 40 and 34 may be done simultaneously.

When operating handle 14 is in the collapsed position, it can be seen that lower arms 36 and 38 of lower handle 34 rest on support ledges 30 and 32 of lower housing 18 and straddle upper housing 20. Preferably, the front surfaces of lower arms 36 and 38 are in substantially continuous contact with support ledges 30 and 32, and the inner side surfaces of lower arms 36 and 38 are in close proximity to the side surfaces of upper housing 20. In this manner, lower arms 36 and 38 substantially conform in shape to the space provided above support ledges 30 and 32 and to the sides of upper housing 20 so that lower arms 36 and 38 may solidly rest on support ledges 30 and 32. However, if support ledges 30 and 32 do not extend along the entire length of lower housing 18, then lower arms 36 and 38 may instead rest only partially on support ledges 30 and 32. In another embodiment, the support ledges may also be omitted entirely, and the lower arms may rest on other parts of the base assembly 12.

It can also be seen that yoke 46 of upper handle 40 rests on upper housing 20 when operating handle 14 is in the collapsed position. Preferably, the back surface of yoke 46 is in substantially continuous contact with the sloped top surface of upper housing 20. In this manner, yoke 46 substantially conforms in shape to the sloped top surface of upper housing 20 so that yoke 46 may solidly rest thereon.

In addition, when operating handle 14 is in the collapsed position, it can be seen that lower and upper handles 34 and 40 do not extend laterally from the outer periphery of base assembly 12 by any significant distance. For example, in a preferred embodiment, lower and upper handles 34 and 40 extend less than about 4 inches, and more preferably less than about 1 inch, from the outer periphery of base assembly 12. This provides a minimal footprint, as viewed from above, which facilitates storage in tight closets and other small spaces. This sizing also allows the device 10 to be shipped with corner or edge shipping supports—which increase the overall size of the base assembly's periphery—without making special accommodations for the handle, because any overhanging portions of the lower and upper handles 34 and 40 can be fitted between the shipping supports. Furthermore, in order to obtain the greatest degree of compactness for purposes of shipping and transporting the device 10, it is preferred that the overall length, width and height of the collapsed device 10 do not significantly exceed the overall length, width and height, respectively, of the base assembly 12. In these embodiments, operating handle 14 collapses so that it occupies a minimal amount of horizontal and vertical space to facilitate compact storage, shipping, and/or transportation of device 10, but can still be extended to a height and length that is comfortable for the operator during use.

It can be appreciated that device 10 offers several advantages over traditional floor cleaning devices. For example, device 10 may be compactly stored in a closet or other small space. Also, the compact design of device 10 allows it to be easily transported from one location to another (e.g., up or down a flight of stairs) by grasping a carrying handle 118 positioned on top of upper housing 20 between upper arms 42 and 44. Device 10 may also be easily transported in the trunk compartment or other area within a vehicle without having to tip the device on its side or disassemble it. In addition, device 10 may be compactly packed in a single carton for shipment to a user, whereby operating handle 14 is pre-assembled to base assembly 12 upon delivery and can be used immediately upon unpacking. Further, the compact nature of device 10 when collapsed provides better protection against damage that could be caused to device 10 during transport or shipment.

Device 10 also may be conveniently used as a canister-type cleaning device by providing an accessory outlet 119 that is accessible and usable when the device 10 is in the collapsed position. Accessory outlet 119 may comprise, for example, a simple vacuum hose connection, or a wet extractor spot cleaning attachment point. This outlet 119 may also be used when the operating handle is un the extended position.

Figure 12:
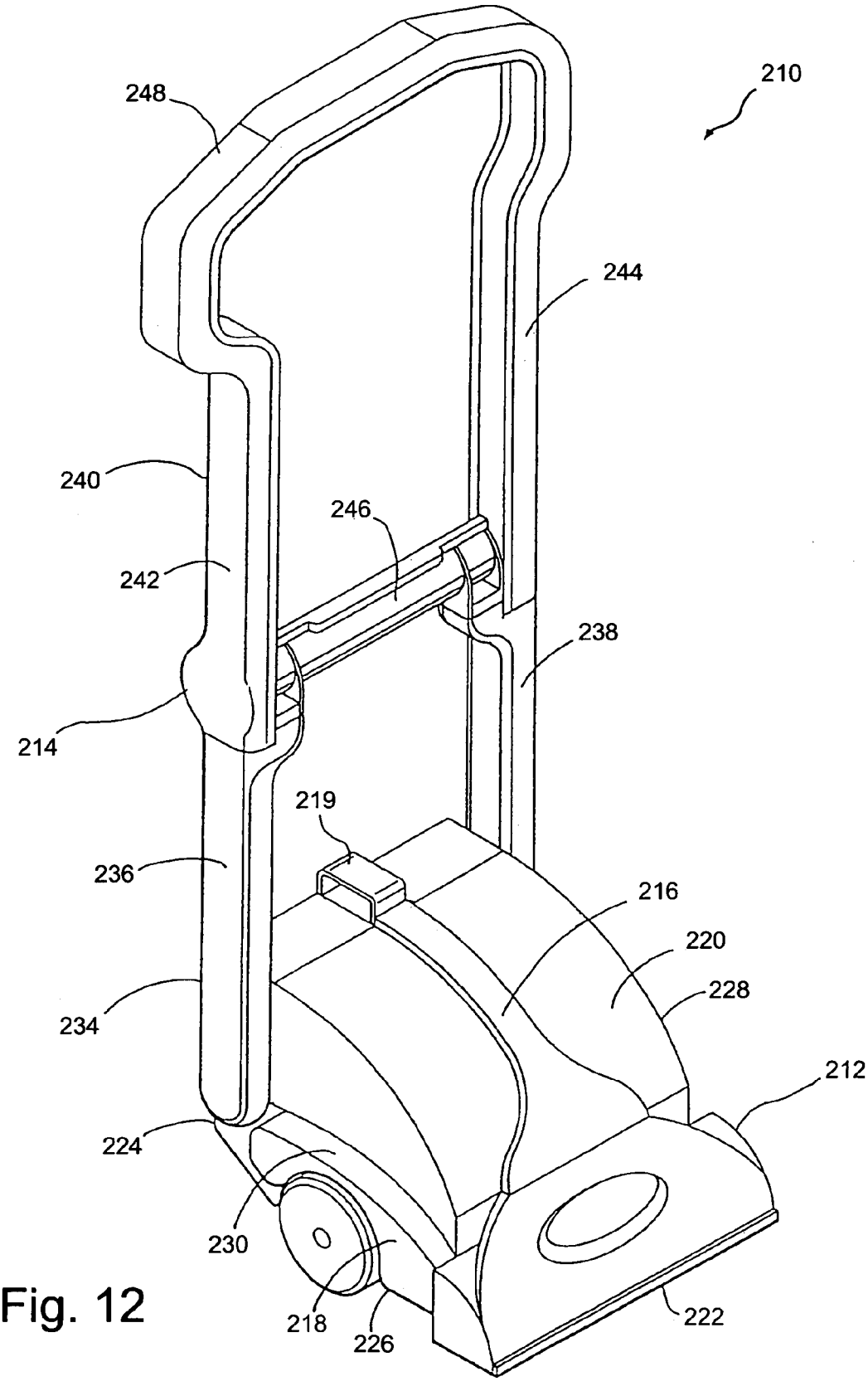
FIG. 12 is a front perspective view of a floor cleaning device in accordance with a first alternative embodiment of the present invention, with the operating handle shown in the extended position.
Figure 13:
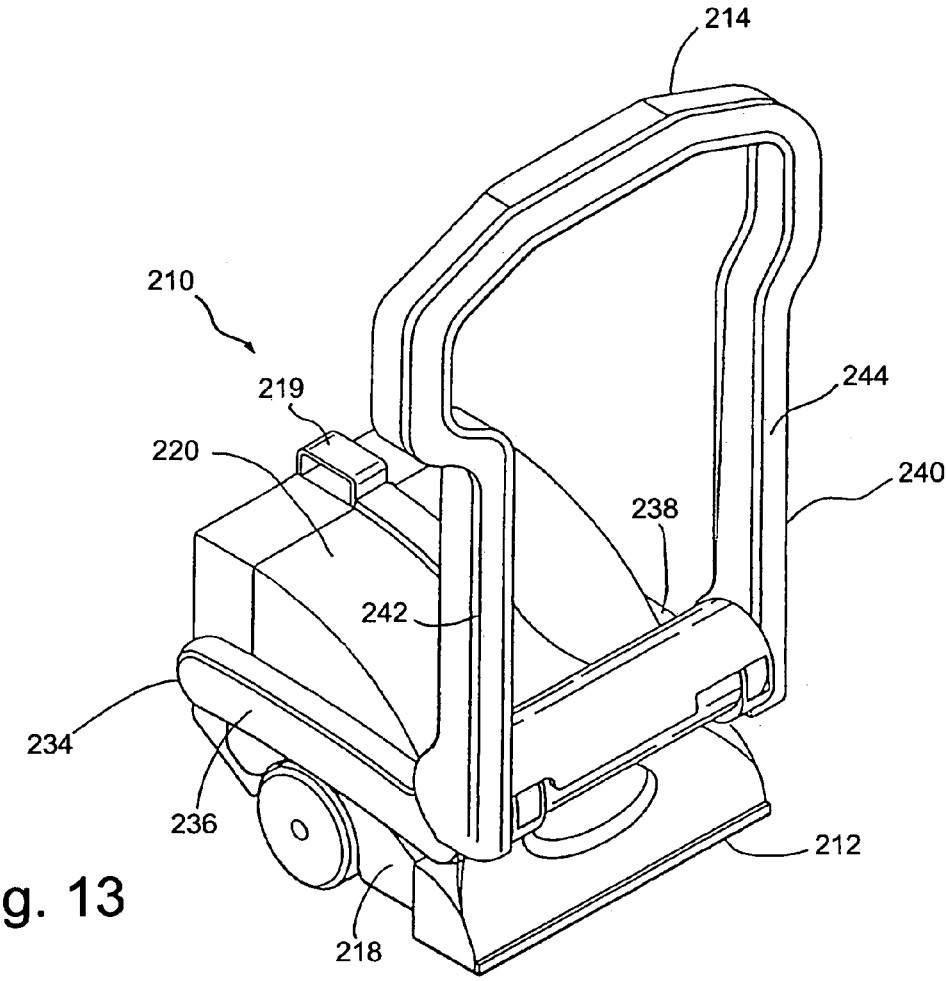
FIG. 13 is a front perspective view of the floor cleaning device of FIG. 12, with the operating handle shown in a partially collapsed position.
Figure 14:
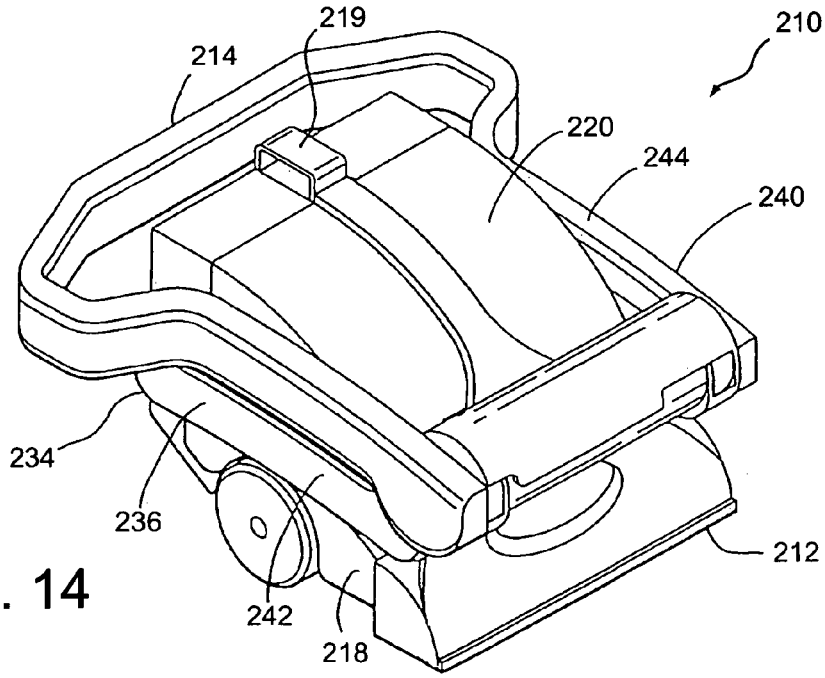
FIG. 14 is a front perspective view of the floor cleaning device of FIG. 12, with the operating handle shown in the collapsed position.

Referring to FIG. 12, a floor cleaning device in accordance with a first alternative embodiment of the present invention is designated generally by reference numeral 210. Device 210 includes a base assembly 212 that is adapted to be guided across a floor during operation of device 210. Device 210 also includes an operating handle 214 that extends upwardly from the rear of base assembly 212. As will be described in greater detail herein, operating handle 214 is moveable between an extended position (as shown in FIG. 12) for upright operation of device 210 for use on floors or with accessory tools, and a collapsed position for use with accessory tools, compact storage, shipping, and/or transportation of device 210 (as shown in FIGS. 13 and 14).

Base assembly 212 includes a base housing 216 that surrounds or holds the various internal components of device 210, as is known in the art. Base housing 216 includes a lower housing 218 positioned adjacent the floor, and an upper housing 220 projecting above lower housing 218 that slopes upwardly from the front side to the rear side thereof. The outer periphery of lower housing 218 is formed by a front side 222, a rear side 224, a right side 226 and a left side 228, which together define the floor space occupied by base assembly 212. A first support ledge 230 extends generally horizontally along the top surface of lower housing 218 adjacent the right side 226 thereof, and a second support ledge (not shown) extends generally horizontally along the top surface of lower housing 218 adjacent the left side 228 thereof. It will be seen that support ledges 230 are positioned and configured to support the lower arms of operating handle 214 when it is moved to the collapsed position.

Operating handle 214 includes a lower handle 234 having a pair of spaced lower arms 236 and 238 disposed generally parallel to each other, which are pivotally connected at their lower ends to opposite sides of upper housing 220 at the rear of base assembly 212. The upper ends of the lower arms 236 and 238 are connected to one another by a cross-piece 246. Operating handle 214 also includes an upper handle 240 having a pair of spaced upper arms 242 and 244 disposed generally parallel to each other, which are pivotally connected at their lower ends to the upper ends of lower arms 236 and 238. Upper arms 242 and 244 may taper outwardly at their upper ends and are connected together to form a transversely extending hand grip 248, which may be grasped by a user during operation of device 210.

As shown in FIG. 12, when operating handle 214 is in the extended position, upper handle 240 is fixed to lower handle 234 and cannot pivot relative thereto. As such, lower and upper handles 234 and 240 are maintained in a substantially rigid extended position for operation of device 210. Also, lower handle 234 may be fixed to base assembly 212 in an upright position such that it cannot pivot relative thereto by using a selectively releasable lower lock. It should be understood by one skilled in the art that any suitable releasable lower lock may be used to fix lower handle 234 to base assembly 212, such as lower lock 54 shown in FIGS. 3 and 4. Likewise, any suitable releasable upper lock may be used to fix upper handle 240 to lower handle 234. As with various other embodiments described herein, the lower lock may be released to allow handle 214 to pivot backwards relative to base assembly 212 to facilitate operation, and forward to collapse handle 214.

As shown in FIGS. 13 and 14, operating handle 214 may be moved to the collapsed position by releasing the lower lock and folding lower handle 234 downwardly and forwardly to a position atop lower housing 218 (see FIG. 13), and then releasing the upper lock and folding upper handle 240 downwardly and backwardly to a position atop lower handle 234 (see FIG. 14). Of course, it should be understood that operating handle 214 could alternatively be moved to the collapsed position by folding upper handle 240 downwardly and backwardly, and then folding lower handle 234 downwardly and forwardly to the position shown in FIG. 14, of both folds may be performed simultaneously.

When operating handle 214 is in the collapsed position, it can be seen that lower arms 236 and 238 of lower handle 234 rest on support ledges 230 of lower housing 218 and straddle upper housing 220. Preferably, the front surfaces of lower arms 236 and 238 are in substantially continuous contact with support ledges 230, and the inner side surfaces of lower arms 236 and 238 are in close proximity to the side surfaces of upper housing 220. In this manner, lower arms 236 and 238 substantially conform in shape to the space provided above support ledges 230 and to the sides of upper housing 220 so that lower arms 236 and 238 may solidly rest on support ledges 230.

It can also be seen that upper arms 242 and 244 of upper handle 240 are stacked on lower arms 236 and 238 and straddle upper housing 220 when operating handle 214 is in the collapsed position. Preferably, the back surfaces of upper arms 242 and 244 are in substantially continuous contact with the back surfaces of lower arms 236 and 238 so that upper arms 242 and 244 may solidly rest on lower arms 236 and 238.

In addition, when operating handle 214 is in the collapsed position, it can be seen that lower and upper handles 234 and 240 are substantially contained within the outer periphery of base assembly 212. As such, operating handle 214 occupies a minimal amount of horizontal and vertical space to facilitate compact storage, shipping, and/or transportation of device 210. Furthermore, handle 219 may be readily grasped to convey the device 210 while it is in the collapsed configuration.

Figure 15:
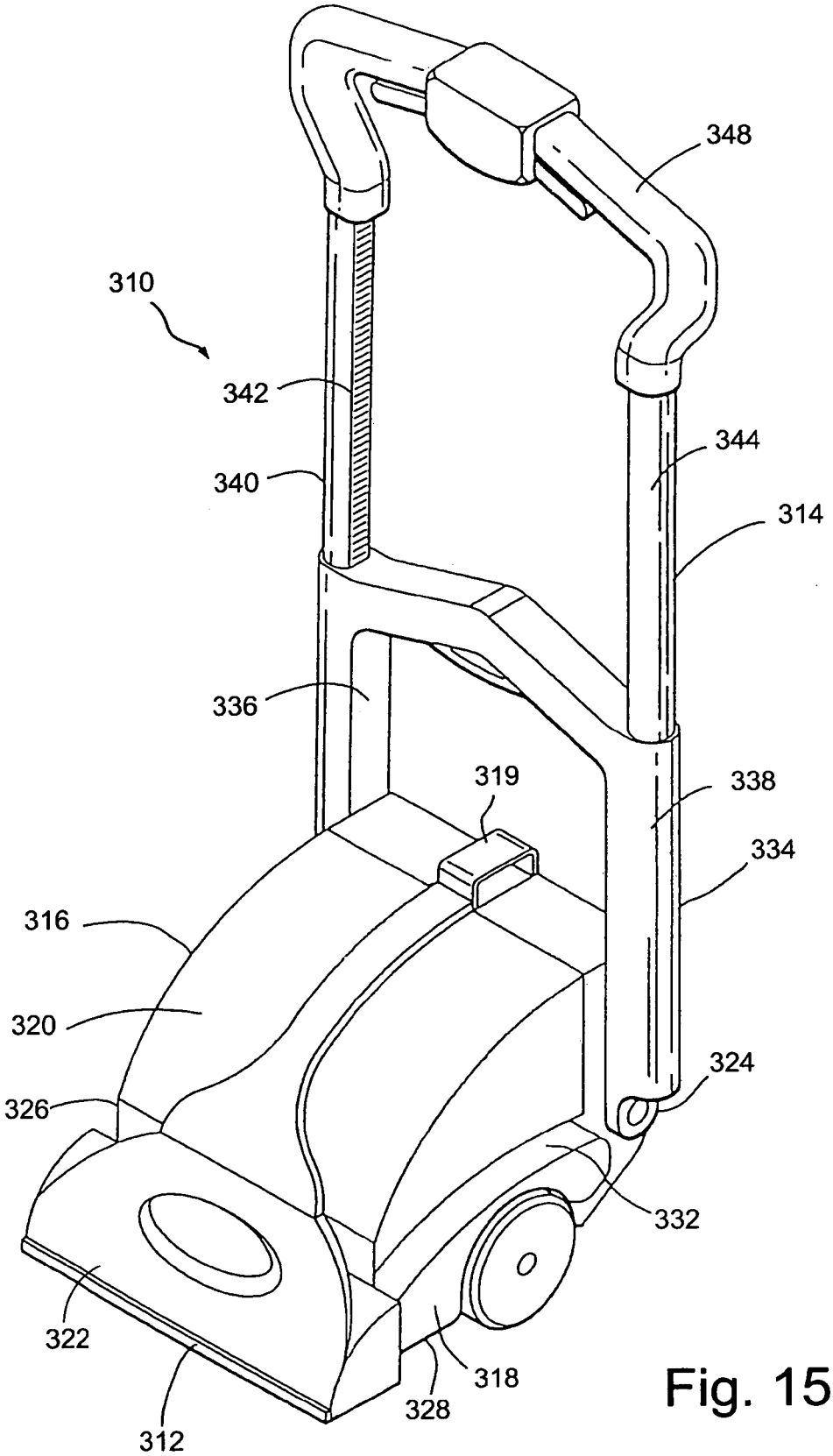
FIG. 15 is a front perspective view of a floor cleaning device in accordance with a second alternative embodiment of the present invention, with the operating handle shown in the extended position.
Figure 16:
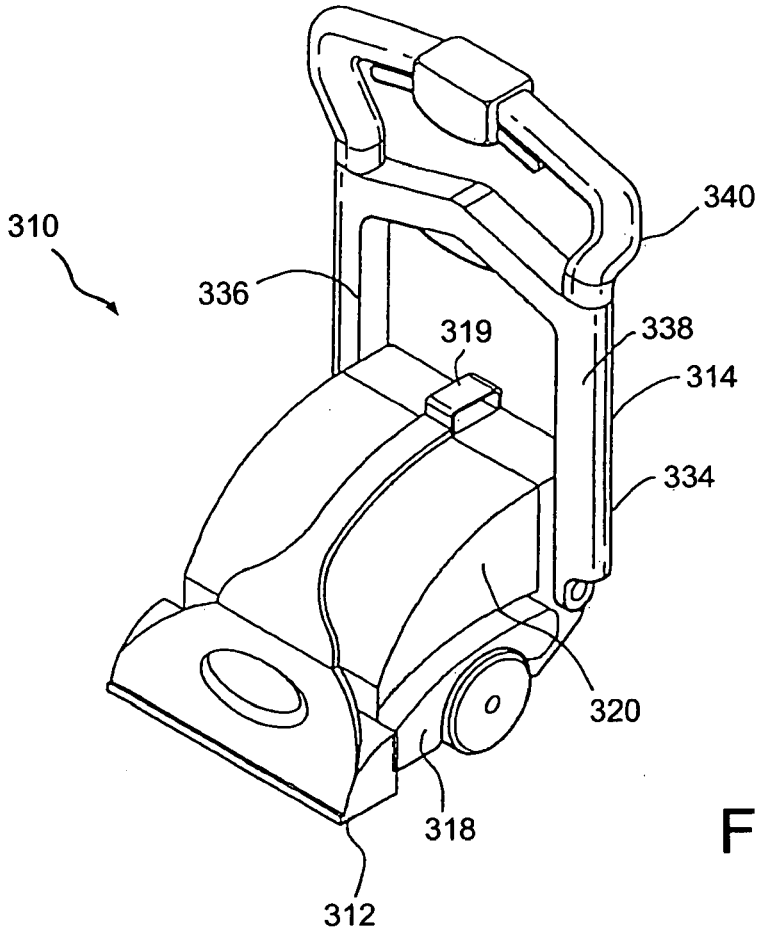
FIG. 16 is a front perspective view of the floor cleaning device of FIG. 15, with the operating handle shown in a partially collapsed position.
Figure 17:
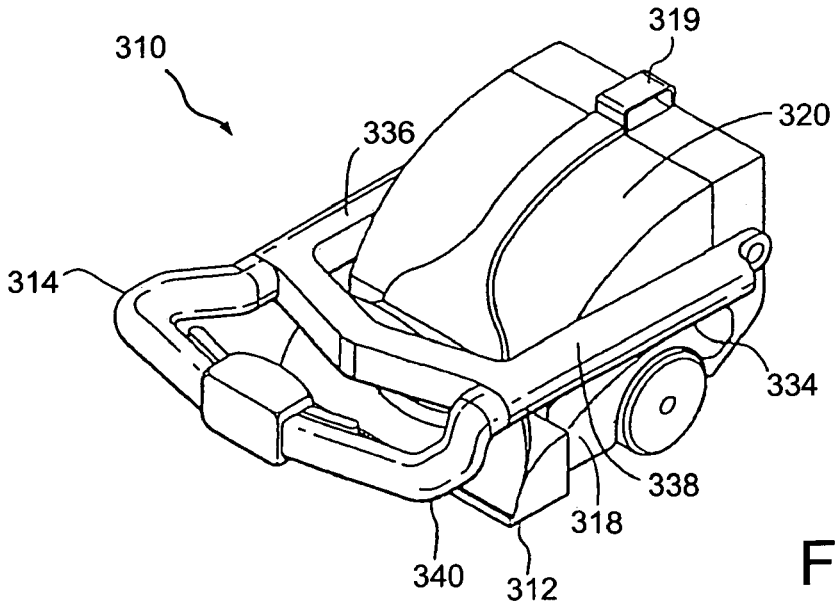
FIG. 17 is a front perspective view of the floor cleaning device of FIG. 15, with the operating handle shown in the collapsed position.

Referring to FIG. 15, a floor cleaning device in accordance with a second alternative embodiment of the present invention is designated generally by reference numeral 310. Device 310 includes a base assembly 312 that is adapted to be guided across a floor during operation of device 310. Device 310 also includes an operating handle 314 that extends upwardly from the rear of base assembly 312. As will be described in greater detail herein, operating handle 314 is moveable between an extended position for operation of device 310 (as shown in FIG. 15) and a collapsed position for compact storage, shipping, and/or transportation of device 310 (as shown in FIGS. 16 and 17).

Base assembly 312 includes a base housing 316 that surrounds or otherwise holds the various internal components of device 310, as is known in the art. Base housing 316 includes a lower housing 318 positioned adjacent the floor, and an upper housing 320 projecting above lower housing 318 that slopes upwardly from the front side to the rear side thereof. The outer periphery of lower housing 318 is formed by a front side 322, a rear side 324, a right side 326 and a left side 328, which together define the floor space occupied by base assembly 312. A first support ledge (not shown) extends generally horizontally along the top surface of lower housing 318 adjacent the right side 326 thereof, and a second support ledge 332 extends generally horizontally along the top surface of lower housing 318 adjacent the left side 328 thereof. It will be seen that support ledges 332 are positioned and configured to support the lower arms of operating handle 314 when it is moved to the collapsed position.

Operating handle 314 includes a lower handle 334 having a pair of spaced lower arms 336 and 338 disposed generally parallel to each other, which are pivotally connected at their lower ends to opposite sides of upper housing 320 at the rear of base assembly 312. Operating handle 314 also includes an upper handle 340 having a pair of spaced upper arms 342 and 344 disposed generally parallel to each other, which are telescopically connected at their lower ends to the upper ends of lower arms 336 and 338. The outer diameter of upper arms 342 and 344 is slightly smaller than the inner diameter of lower arms 336 and 338 such that upper arms 342 and 344 may be telescoped within lower arms 336 and 338. Upper arms 342 and 344 taper outwardly at their upper ends and are connected together to form a transversely extending hand grip 348, which may be grasped by a user during operation of device 310.

As shown in FIG. 15, when operating handle 314 is in the extended position, upper handle 340 is fixed to lower handle 334 such that it cannot be telescoped therein. As such, lower and upper handles 334 and 340 are maintained in a substantially rigid extended position for operation of device 310. Also, lower handle 334 may be fixed to base assembly 312 in an upright position so that it cannot pivot relative thereto, to allow handle 314 to stand upright. Handle 314 may be pivoted backwards, as described elsewhere herein, to operate the device 310, while upper handles 340 remain telescopically fixed relative to lower handles 334. It should be understood by one skilled in the art that any suitable releasable lower lock may be used to pivotally fix lower handle 334 to base assembly 312, such as lower lock 54 shown in FIGS. 3 and 4. Likewise, any suitable releasable upper lock may be used to telescopically fix upper handle 340 to lower handle 334, such as a rack-and-pinion type lock or any other suitable device.

As shown in FIGS. 16 and 17, operating handle 314 may be moved to the collapsed position by releasing the upper lock and telescoping upper arms 342 and 344 into lower arms 336 and 338 (see FIG. 16), and then releasing the lower lock and folding lower handle 334 downwardly and forwardly to a position atop lower housing 318 (see FIG. 17). Of course, it should be understood that operating handle 314 could alternatively be moved to the collapsed position by folding lower handle 334 downwardly and forwardly, and then telescoping upper arms 342 and 344 into lower arms 336 and 338 to the position shown in FIG. 17, or the folding and telescoping steps may be performed simultaneously.

When operating handle 314 is in the collapsed position, it can be seen that lower arms 336 and 338 (with upper arms 342 and 344 telescoped therein) rest on support ledges 332 of lower housing 318 and straddle upper housing 320. Preferably, the front surfaces of lower arms 336 and 338 are in substantially continuous contact with support ledges 332, and the inner side surfaces of lower arms 336 and 338 are in close proximity to the side surfaces of upper housing 320. In this manner, lower arms 336 and 338 substantially conform in shape to the space provided above support ledges 332 and to the sides of upper housing 320 so that lower arms 336 and 338 may solidly rest on support ledges 332.

In addition, when operating handle 314 is in the collapsed position, it can be seen that lower and upper handles 334 and 340 are substantially contained within the outer periphery of base assembly 312. As such, operating handle 314 occupies a minimal amount of horizontal and vertical space to facilitate compact storage, shipping, and/or transportation of device 310. Furthermore, handle 319 is readily accessible to use to transport device 310 when it is in the collapsed position. It will be apparent from FIG. 17 that the device may also be stored on its rear side 324 if it is flat or provided with support members. This vertical storage feature may also be provided with the other embodiments described herein.

Figure 18:
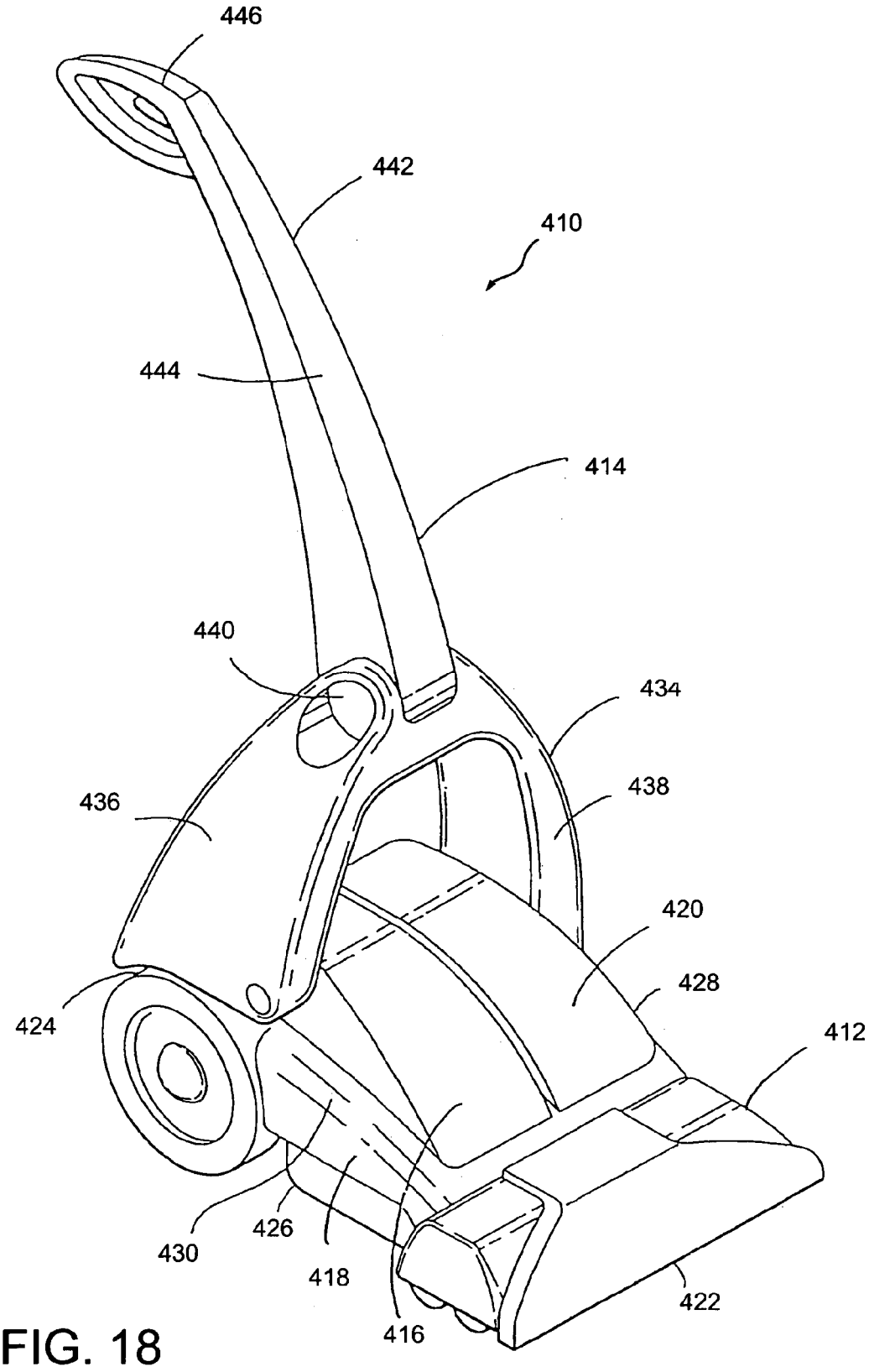
FIG. 18 is a front perspective view of a floor cleaning device in accordance with a third alternative embodiment of the present invention, with the operating handle shown in the extended position.
Figure 19:
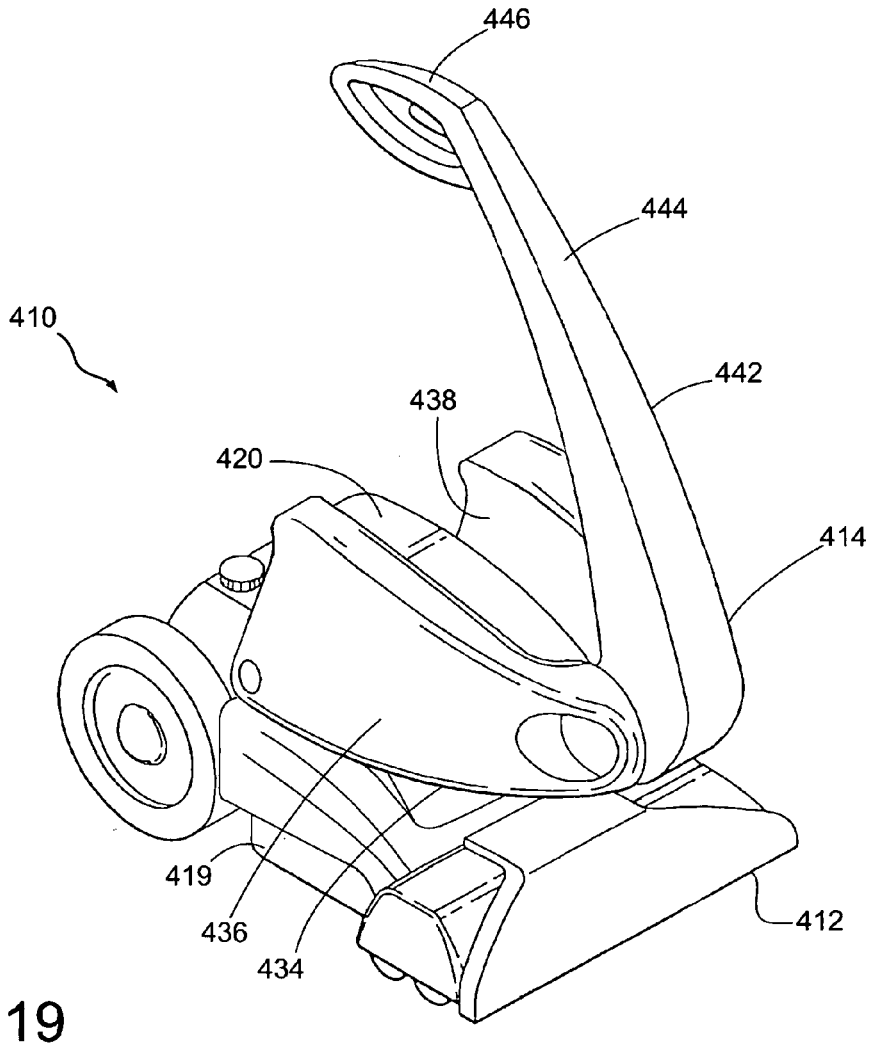
FIG. 19 is a front perspective view of the floor cleaning device of FIG. 18, with the operating handle shown in a partially collapsed position.
Figure 20:
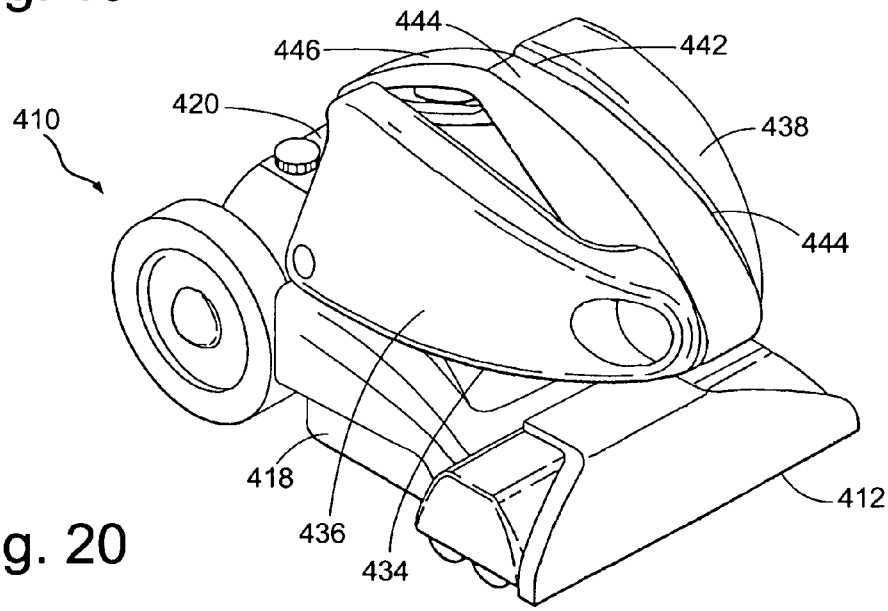
FIG. 20 is a front perspective view of the floor cleaning device of FIG. 18, with the operating handle shown in the collapsed position.

Referring to FIG. 18, a floor cleaning device in accordance with a third alternative embodiment of the present invention is designated generally by reference numeral 410. Device 410 includes a base assembly 412 that is adapted to be guided across a floor during operation of device 410. Device 410 also includes an operating handle 414 that extends upwardly from the rear of base assembly 412. As will be described in greater detail hereinbelow, operating handle 414 is moveable between an extended position for operation of device 410 (as shown in FIG. 18) and a collapsed position for compact storage, shipping, and/or transportation of device 410 (as shown in FIGS. 19 and 20).

Base assembly 412 includes a base housing 416 that surrounds or carries the various internal components of device 410, as is known in the art. Base housing 416 includes a lower housing 418 positioned adjacent the floor, and an upper housing 420 projecting above lower housing 418 that slopes upwardly from the front side to the rear side thereof. The outer periphery of lower housing 418 is formed by a front side 422, a rear side 424, a right side 426 and a left side 428, which together define the floor space occupied by base assembly 412. A first support ledge 430 extends generally horizontally along the top surface of lower housing 418 adjacent the right side 426 thereof, and a second support ledge (not shown) extends generally horizontally along the top surface of lower housing 418 adjacent the left side 428 thereof. It will be seen that support ledges 430 are positioned and configured to support the lower arms of-operating handle 414 when moved to the collapsed position.

Operating handle 414 includes a lower handle 434 having a pair of spaced lower arms 436 and 438 that taper inwardly to a pivot point 440. Lower arms 436 and 438 are pivotally connected at their lower ends to opposite sides of upper housing 420 at the rear of base assembly 412. Operating handle 414 also includes an upper handle 442 having a single upper arm 444, which is pivotally connected at its lower end to pivot point 440. Upper arm 444 has a hand grip 446 formed at its distal end, which may be grasped by a user during operation of device 410.

As shown in FIG. 18, when operating handle 414 is in the extended position, upper handle 442 may be fixed to lower handle 434 such that it cannot pivot relative thereto. During use, the entire handle 414 may be pivoted relative to the base assembly 412. Alternatively, lower handle 434 may be fixed to the base assembly 412 in an upright position and upper handle 442 may pivot relative to lower handle 434 during use. Of course, both upper and lower handles 442 and 434 may be adapted to be locked in pivotally fixed positions, if desired. It should be understood by one skilled in the art that any suitable releasable lower lock may be used to fix lower handle 434 to base assembly 412, such as lower lock 54 shown in FIGS. 3 and 4. Likewise, any suitable releasable upper lock may be used to fix upper handle 442 to lower handle 434.

As shown in FIGS. 19 and 20, operating handle 414 may be moved to the collapsed position by releasing the lower lock and folding lower handle 434 downwardly and forwardly to a position atop lower housing 418 (see FIG. 19), and then releasing the upper lock and folding upper handle 442 downwardly and backwardly to a position atop upper housing 420 (see FIG. 20). Of course, it should be understood that operating handle 414 could alternatively be moved to the collapsed position by folding upper handle 442 downwardly and backwardly, and then folding lower handle 434 downwardly and forwardly to the position shown in FIG. 20, or such folding can be done simultaneously.

When operating handle 414 is in the collapsed position, it can be seen that lower arms 436 and 438 of lower handle 434 rest on support ledges 430 of lower housing 418 and straddle upper housing 420. Preferably, the front surfaces of lower arms 436 and 438 are in substantially continuous contact with support ledges 430, and the inner side surfaces of lower arms 436 and 438 are in close proximity to the side surfaces of upper housing 420. In this manner, lower arms 436 and 438 substantially conform in shape to the space provided above support ledges 430 and to the sides of upper housing 420 so that lower arms 436 and 438 (or ledges (not shown) on the inward-facing sides thereof) may solidly rest on support ledges 430. It can also be seen that hand grip 446 of upper handle 440 rests on upper housing 420 when operating handle 414 is in the collapsed position. Preferably, upper arm 444 has a slight curvature that allows it to conform in shape to the sloped top surface of upper housing 420.

In addition, when operating handle 414 is in the collapsed position, it can be seen that lower and upper handles 434 and 442 do not extend laterally from the outer periphery of base assembly 412. As such, operating handle 414 occupies a minimal amount of horizontal and vertical space to facilitate compact storage, shipping, and/or transportation of device 410. Furthermore, hand grip 446 provides a convenient carrying handle that can be used when device 410 is collapsed, provided upper and lower handles 442, 434 can be fixed in the folded position by the upper and lower locks.

Figure 21:
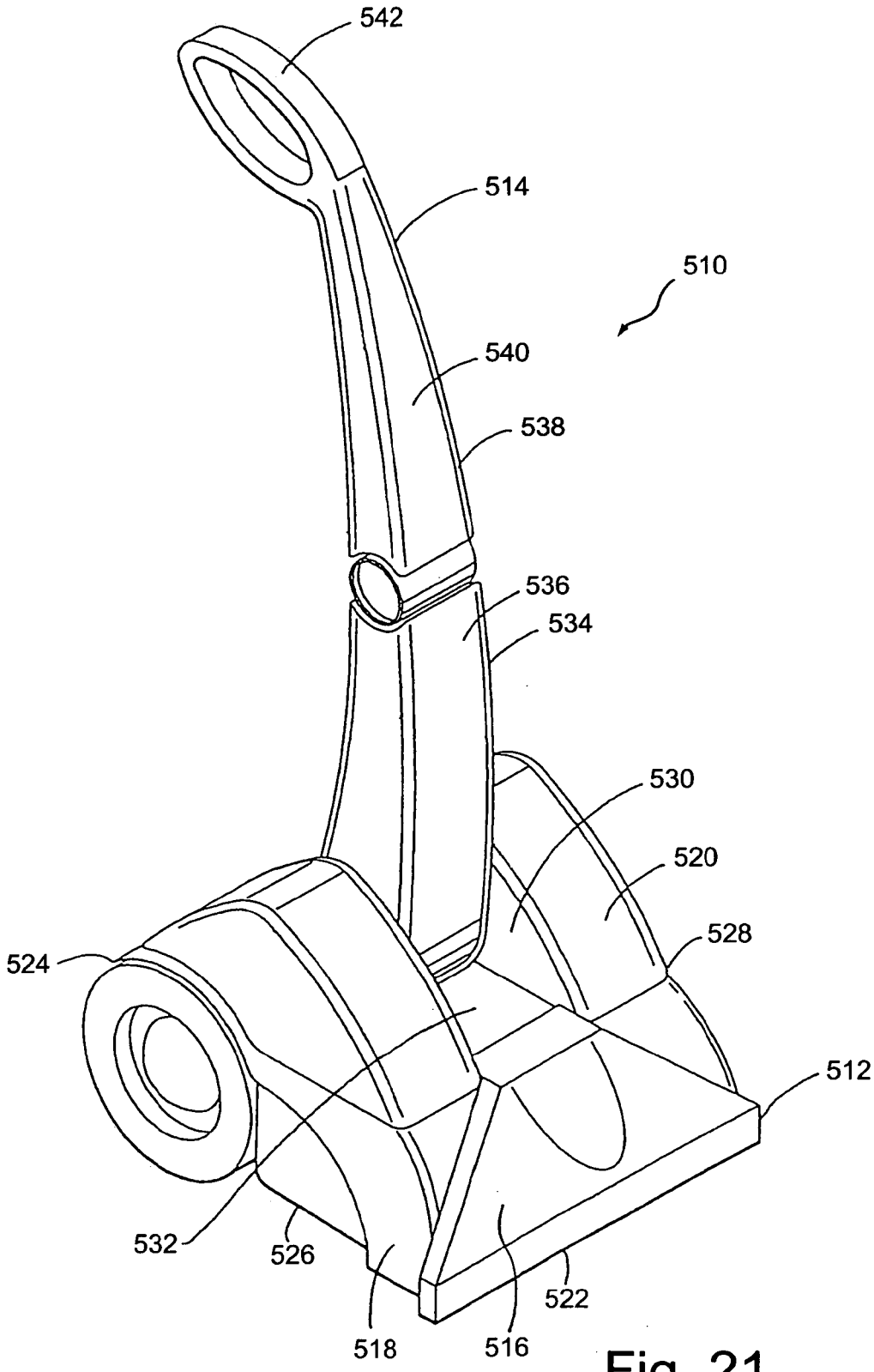
FIG. 21 is a front perspective view of a floor cleaning device in accordance with a fourth alternative embodiment of the present invention, with the operating handle shown in the extended position.
Figure 22:
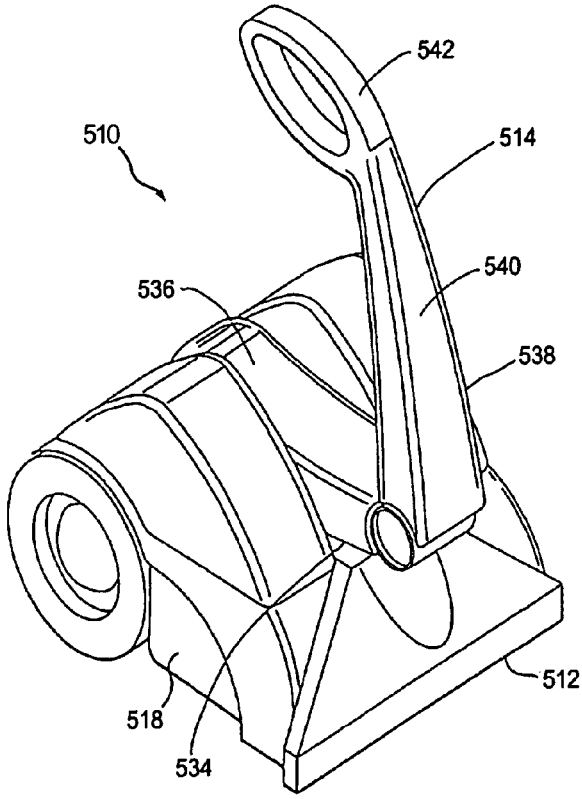
FIG. 22 is a front perspective view of the floor cleaning device of FIG. 21, with the operating handle shown in a partially collapsed position.
Figure 23:
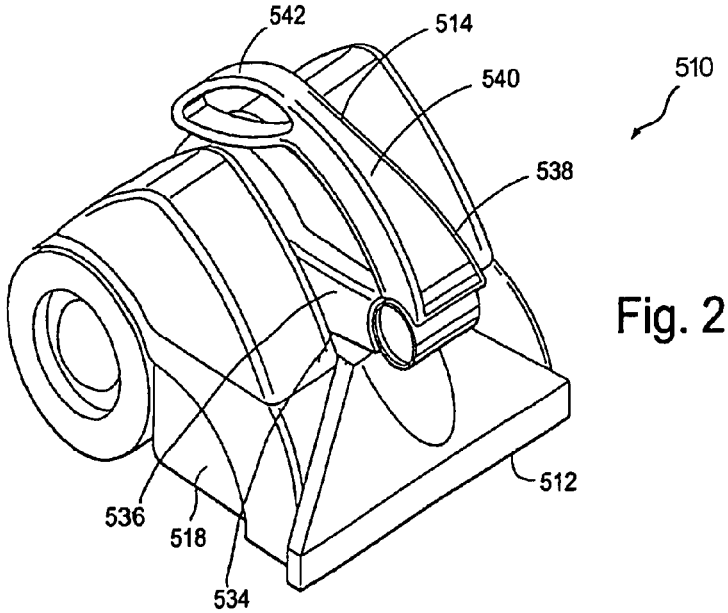
FIG. 23 is a front perspective view of the floor cleaning device of FIG. 21, with the operating handle shown in the collapsed position.

Referring to FIG. 21, a floor cleaning device in accordance with a fourth alternative embodiment of the present invention is designated generally by reference numeral 510. Device 510 includes a base assembly 512 that is adapted to be guided across a floor during operation of device 510. Device 510 also includes an operating handle 514 that extends upwardly from the rear of base assembly 512. As will be described in greater detail hereinbelow, operating handle 514 is moveable between an extended position for operation of device 510 (as shown in FIG. 21) and a collapsed position for compact storage, shipping, and/or transportation of device 510 (as shown in FIGS. 22 and 23).

Base assembly 512 includes a base housing 516 that surrounds or holds the various internal components of device 510, as is known in the art. Base housing 516 includes a lower housing 518 positioned adjacent the floor, and an upper housing 520 projecting above lower housing 518 that slopes upwardly from the front side to the rear side thereof. The outer periphery of lower housing 518 is formed by a front side 522, a rear side 524, a right side 526 and a left side 528, which together define the floor space occupied by base assembly 512. A recess 530 is formed in upper housing 520, and a support surface 532 is formed on the top surface of lower housing 518 within recess 530. It will be seen that support surface 532 is positioned and configured to support the lower arm of operating handle 514 when moved to the collapsed position.

Operating handle 514 includes a lower handle 534 having a single lower arm 536, which is pivotally connected at its lower end to upper housing 520 at the rear of base assembly 512. Operating handle 514 also includes an upper handle 538 having a single upper arm 540, which is pivotally connected at its lower end to the upper end of lower arm 536. Upper arm 540 has a hand grip 542 formed at its distal end, which may be grasped by a user during operation of device 510.

As shown in FIG. 21, when operating handle 514 is in the extended position, upper handle 538 is fixed to lower handle 534 and cannot pivot relative thereto. As such, lower and upper handles 534 and 538 are maintained in a substantially rigid extended position for operation of device 510. In addition, lower handle 534 may be selectively fixed to base assembly 512 in an upright position and such that it cannot pivot relative thereto. Of course, handle 514 may be pivoted backwards at its junction with the base assembly 512 during use to accommodate the back-and-forth movement of the device 510. It should be understood by one skilled in the art that any suitable releasable lower lock may be used to fix lower handle 534 to base assembly 512. Likewise, any suitable releasable upper lock may be used to fix upper handle 538 to lower handle 534.

As shown in FIGS. 22 and 23, operating handle 514 may be moved to the collapsed position by releasing the lower lock and folding lower handle 534 downwardly and forwardly to a position atop housing 516 (see FIG. 22), and then releasing the upper lock and folding upper handle 538 downwardly and backwardly to a position atop lower handle 534 (see FIG. 23). Of course, it should be understood that operating handle 514 could alternatively be moved to the collapsed position by folding upper handle 538 downwardly and backwardly, and then folding lower handle 534 downwardly and forwardly to the position shown in FIG. 23, or these folding motions can be performed simultaneously.

When operating handle 514 is in the collapsed position, it can be seen that lower arm 536 rests on support surface 532 of lower housing 518 within recess 530 of upper housing 520. Preferably, the front surface of lower arm 536 is in substantially continuous contact with support surface 532, and the outer side surfaces of lower arm 536 are in close proximity to the side surfaces of recess 530. In this manner, lower arm 536 substantially conforms in shape to the space provided above support surface 532 within recess 530 so that lower arm 536 may solidly rest on support surface 532. It can also be seen that hand grip 542 of upper handle 538 rests on lower arm 536 when operating handle 514 is in the collapsed position.

In addition, when operating handle 514 is in the collapsed position, it can be seen that lower and upper handles 534 and 538 do not extend laterally from the outer periphery of base assembly 512. As such, operating handle 514 occupies a minimal amount of horizontal and vertical space to facilitate compact storage, shipping, and/or transportation of device 510. Furthermore, hand grip 542 provides a convenient lifting handle, provided upper and lower handles 540, 536 are lockable in the collapsed position.

Another aspect of the present invention is directed towards a novel arrangement of supply and recovery tanks in a wet extractor. In a preferred embodiment, the present invention provides a recovery tank having a tank inlet for receiving air and waste water, a tank outlet for evacuating air, interior wall surfaces defining a waste water reservoir, exterior wall surfaces defining an outer periphery of the recovery tank, and a generally downward sloped inlet conduit having an upper wall, a lower wall and side walls. The exterior wall surfaces may be adapted to slidably engage with an extractor housing. The recovery tank may also have a unique float assembly, filter chamber, airflow and baffling systems, and other features, as described herein. In other preferred embodiments, the invention also provides a supply tank that is shaped to increase its ease of use and is slidably received in the extractor housing. The supply and recovery tanks may beneficially be located laterally relative to one another to provide a compact and functional design that maintains the overall weight of the device in approximately the same location throughout use of the device.

Figure 24:
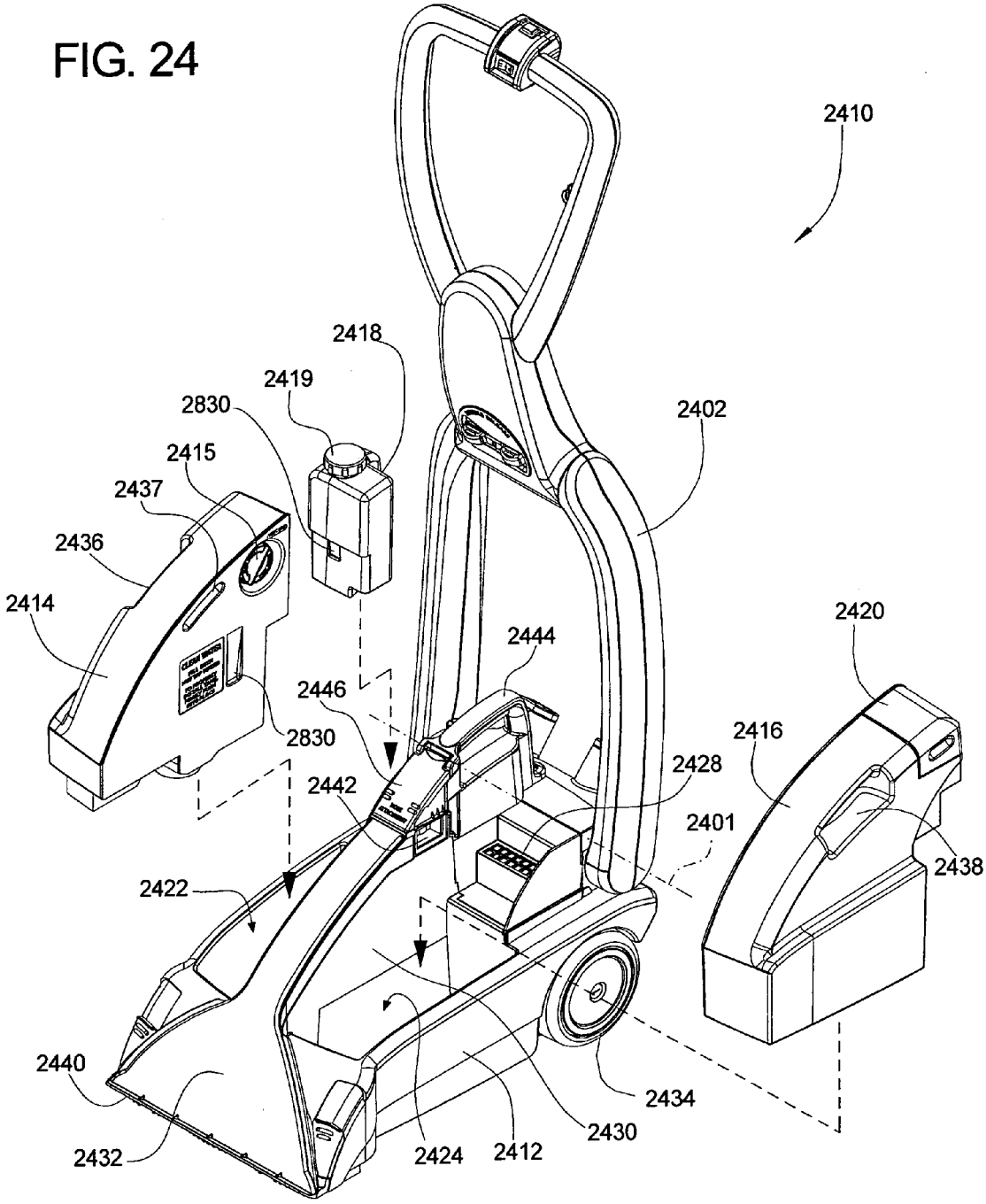
FIG. 24 is a fragmented front disassembled view a wet extractor of one embodiment of the present invention.

A wet extractor employing one embodiment of the novel tank configuration is shown in FIG. 24, in which a wet extractor 2410 approximately of the design shown in FIG. 1 is shown with various components removed from the wet extractor 2410. The wet extractor 2410 comprises a housing 2412, a supply tank 2414 and a recovery tank 2416. Supply tank 2414 and recovery tank 2416 are each preferably formed from a transparent material so that their contents can be readily determined. Wet extractor 2410 also may be provided with a detergent tank 2418 (also preferably a transparent material) so that the operator does not have to manually mix detergent and water in supply tank 2414. In addition, recovery tank 2416 may be equipped with a removable float assembly 2420, which is more clearly shown in FIGS. 27A–B, or may have an integral float assembly.

Supply tank 2414 and recovery tank 2416 are slidably engageable with housing 2412. Preferably, supply tank 2414 and recovery tank 2416 are individually removable, but they may be joined together to be removable as a unit, either by integrally forming the tanks or by attaching a common handle to both. In the embodiment of FIG. 24, supply tank 2414 slides into opening 2422 and recovery tank 2416 slides into opening 2424. Tanks 2414 and 2416 may be shaped so that they do not fit into the wrong opening 2422 and 2424. Openings 2422 and 2424 comprise pockets formed in housing 2412 that retain supply tank 2414 and recovery tank 2416 in both the longitudinal direction and the lateral direction. It is preferred for openings 2422 and 2424 to have essentially vertical side walls so that tanks 2414 and 2416 are removable in a direction orthogonal to the floor, but openings 2422 and 2424 may be angled somewhat relative to the ground so that tanks 2414 and 2416 are pulled out at an angle relative to the floor. Openings 2422 and 2424 (or the tanks) also may be tapered to help align tanks 2414 and 2416 as they are being inserted. In this configuration, tanks 2414 and 2416 are securely held in housing 2412, but are selectively removable by simply sliding them upwards out of housing 2412. Although it is preferred that housing 2412 has a separate opening for each tank, as shown in FIG. 24, it is also envisioned that supply tank 2414 and recovery tank 2416 can be inserted into a single continuous opening or that the openings be otherwise joined to one another.

In the embodiment of FIG. 24, housing 2412 is adapted to be moved (or move under the device's own motive power, if a drive motor is provided) on a surface to be cleaned on wheels 2434 located at the rear part of housing 2412. The front part of housing 2412 rests on an inlet slit 2440 that leads into inlet nozzle 2432. Inlet slit 2440 is preferably formed as a narrow elongated slot between inlet nozzle 2432 on one side and housing 2412 on the other side, but may be entirely formed by housing 2412 or inlet nozzle 2432. In one embodiment, inlet nozzle 2432 comprises a transparent removable cover that can be removed by an operator to be cleaned. Preferably such a removable nozzle 2432 can be removed without the use of tools, as described elsewhere herein. Inlet nozzle 2432 provides a fluid communication path between inlet slit 2440 and recovery tank 2416. Inlet nozzle 2432 may have a rounded or ramped surface protruding forward of housing 2412 to help slide housing 2412 across the surface to be cleaned, as will be understood by those of ordinary skill in the art. While it is preferred for the weight of housing 2412 to be distributed primarily between wheels 2434 and the portions of inlet nozzle 2432 and housing 2412 that form inlet slit 2440, it is also possible for the agitator (if used), additional wheels (if used), or other surfaces on the bottom of housing 2412 to bear some of the weight of housing 2412.

In a preferred embodiment, supply tank 2414 and recovery tank 2416 are located in front of the pivot axis 2401 of handle 2402 and are laterally juxtaposed relative to the longitudinal axis of housing 2412. In this embodiment, tanks 2414 and 2416 are also preferably generally positioned between inlet slit 2440 and wheels 2434 to distribute their weight approximately between them. Housing 2412 forms a vertical rib 2430 that extends between tanks 2414 and 2416, and may be provided with a carry handle 2444 that can be used to lift and move wet extractor 2410. Inlet nozzle 2432 extends backwards and is located, at least in part, atop vertical rib 2430. Inlet nozzle terminates at a nozzle outlet 2442, and outlet 2442 is positioned adjacent a corresponding recovery tank inlet 2712 (FIG. 27A) when recovery tank 2416 is installed. In this embodiment, recovery tank 2416 also has an outlet that abuts vacuum source opening 2428 when the recovery tank 2416 is installed to thereby connect recovery tank 2416 in fluid communication between inlet nozzle 2432 and a vacuum source. Rib 2430 may also be provided with an accessory tool attachment port 2446 (shown covered by a door) that provides a fluid communication path to recovery tank 2416 when opened. A preferred accessory tool attachment system is described elsewhere herein, and other such systems are known in the art.

Wet extractor 2410 is also provided with a fluid deposition assembly (not shown in FIG. 24) that receives liquid from supply tank 2414 (and detergent tank 2418, if used) and deposits the liquid on the surface to be cleaned. A preferred deposition assembly is described elsewhere herein, and other deposition assemblies are known in the art. Such fluid deposition assemblies generally include a valve assembly that is used to control the flow of liquid, and a nozzle that is directed to spray or trickle fluid onto the surface to be cleaned. A pump also may be provided to pressurize the liquid, and a heater or steam generator may be provided to heat the liquid. In a preferred embodiment, at least the valve assembly portion of the fluid deposition system is conveniently located in rib 2430.

The preferred configuration of FIG. 24, in which tanks 2414 and 2416 are laterally juxtaposed around a central rib 2430, has been discovered to provide an extremely compact design that does not sacrifice any of the functionality of the wet extractor 2410. Furthermore, this configuration does not require any of the main components to be located in operating handle 2402 (although operating switches preferably are conveniently placed in operating handle 2402). Some or all of the liquid management and deposition system, which is preferably a liquid management assembly as described herein, can be housed entirely within central housing rib 2430 between supply tank 2414 and recovery tank 2416; intake nozzle 2432 is conveniently located on top of central housing rib 2430; and the vacuum source and motors and other power and drive gear (if used), water heaters (if used) and the like, are readily located in the back of housing 2412 behind supply tank 2414 and recovery tank 2416 to localize their weight over wheels 2434.

In the pocketed configuration of the present invention, tanks 2414 and 2416 are retained in the housing, at least in part, by their own weight. The security of the tanks' engagement with the pockets can be increased by shaping them such that tanks 2414 and 2416 fit snugly into their respective pockets 2422 and 2424. Another way to improve the engagement between tanks 2414 and 2416 with pockets 2422 and 2424 is to form them to "snap" into one another. For example, each opening may be provided with a slight protrusion that fits into a corresponding snap detent 2830 on the side of the part that fits therein, or vice-versa. Of course, snap engagement can be provided by any other structure that causes one part to have a slight interference fit, at least during engagement, with the part with which it is being engaged. The interfering structures may be positioned to firmly hold the parts together when they are fully engaged, or may allow some play between the parts, depending on the desired design and the tolerances of the parts.

The use of sliding and snap engagement in the present invention provides numerous advantages. For example, this configuration is simple and intuitive to operate and eliminates the need for mechanical fasteners, such as locking levers or latches. Such mechanical fasteners increase the cost of manufacture, can be difficult to understand and operate and are subject to breaking. In addition, supply tank 2414 and recovery tank 2416 are preferably positioned in housing 2412 to be removable when the operating handle 2402 (or the lower portion thereof, if operating handle 2402 is collapsible) is in the upright resting position, as shown in FIG. 1. This eliminates the inconvenience of having to tilt operating handle 2402 back to access tanks 2414 and 2416, as required in prior art devices. When the operating handle 2402 is a folding handle, the tanks may be constructed to be removable even during various stages of folding, or when the operating handle is completely folded, as shown in FIGS. 13, 14, 16, 17, 19, 22 and 23. Still another advantage of this construction is that tanks 2414 and 2416 are removable without having to remove housing covers, shrouds or other encasing or covering structures. As used herein, the term "upright resting position" includes any position in which a device's handle will remain upright when unattended, and includes, but is not limited to, configurations in which the handle has a lower lock, as described elsewhere herein, has a friction stop or rests by abutting part of the lower housing.

Detergent tank 2418 and removable float assembly 2420, if provided, may be adapted to slidably engage with housing 2412 in a manner similar to that described with respect to tanks 2414 and 2416. Alternatively, detergent tank 2418 and/or removable float assembly 2420 may be adapted to slidably engage with supply tank 2414 and recovery tank 2416, respectively, in which case detergent tank 2418 may be removable with supply tank 2414 as a unit and removable float assembly 2420 may be removable with recovery tank 2416 as a unit. In the embodiment of FIG. 24, detergent tank 2418 fits into its own separate opening (not visible) and removable float assembly 2420 fits into recovery tank 2416, as described with reference to FIGS. 27A–C. In another embodiment, removable float assembly 2420 may slide partly into recovery tank 2416, and partly into opening 2428 to provide a vacuum passage between the vacuum source and recovery tank 2416.

Supply tank 2414 and detergent tank 2418 have fill caps 2415 and 2419, respectively, that are removable to fill the tanks with fluid. In order to provide fluid passages between supply tank 2414 and detergent tank 2418 and the device 2410, opening 2422 and the detergent tank opening have dry-break valve assemblies (such as shown as supply tank receptacle 3060 in FIG. 30B) that mate with corresponding valve assemblies (see, e.g., 2810 in FIGS. 28A–B) on the bottoms of supply tank 2414 and detergent tank 2418. Such dry-break valves are known in the art, and typically comprise a simple spring-biased rubber plug that closes when the valve is disengaged from housing 2412 and is opened by a pin (3062 in FIG. 30B) mounted in housing 2412 when engaged. A rubber seal typically surrounds either the pin or the plug to provide a water-tight seal around the valve assembly.

Supply tank 2414 and recovery tank 2416 each have an integrally formed handle 2436 and 2438, respectively, to facilitate their removal, carrying and installation. Integral handles 2436 and 2438 are formed directly in the exterior walls of the tanks 2414 and 2416, and require no additional parts or assemblies. As such, integral handles 2436 and 2438 are substantially stronger than attached handles, less expensive to produce, and more convenient to use. The additional strength of integral handles 2436 and 2438 is particularly advantageous when tanks 2414 and 2416 are held in firm snap engagement with housing 2412, because there is no risk that handles 2436 and 2438 will separate from tanks 2414 and 2416 during removal from housing 2412. Handles 2436 and 2438 also may be provided with a textured or rubberized grip surface. While the handles 2436, 2438 are preferably deep enough that a typical user's fingers can nest in them to facilitate lifting and holding each tank solely by the handle, one or both of tanks 2414 and 2416 also may have grip detents 2437 and 2764 (FIG. 27A) positioned opposite integral handles 2436 and 2438 to help the operator grip the tanks. When tanks 2414 and 2416 are installed, their grip detents 2437 may also serve as snap detents by engaging with corresponding protrusions on housing 2412 to hold tanks 2414 and 2416 in snap engagement with housing 2412.

Figure 25:
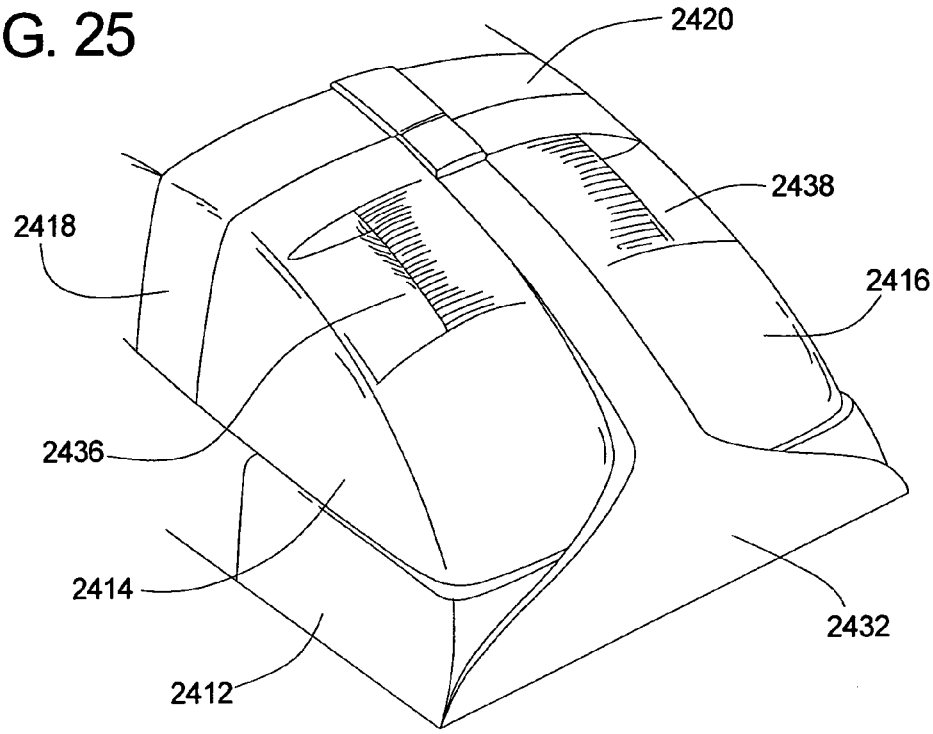
FIG. 25 is a fragmented front perspective view of supply and recovery tank designs of one embodiment of the present invention.
Figure 26:
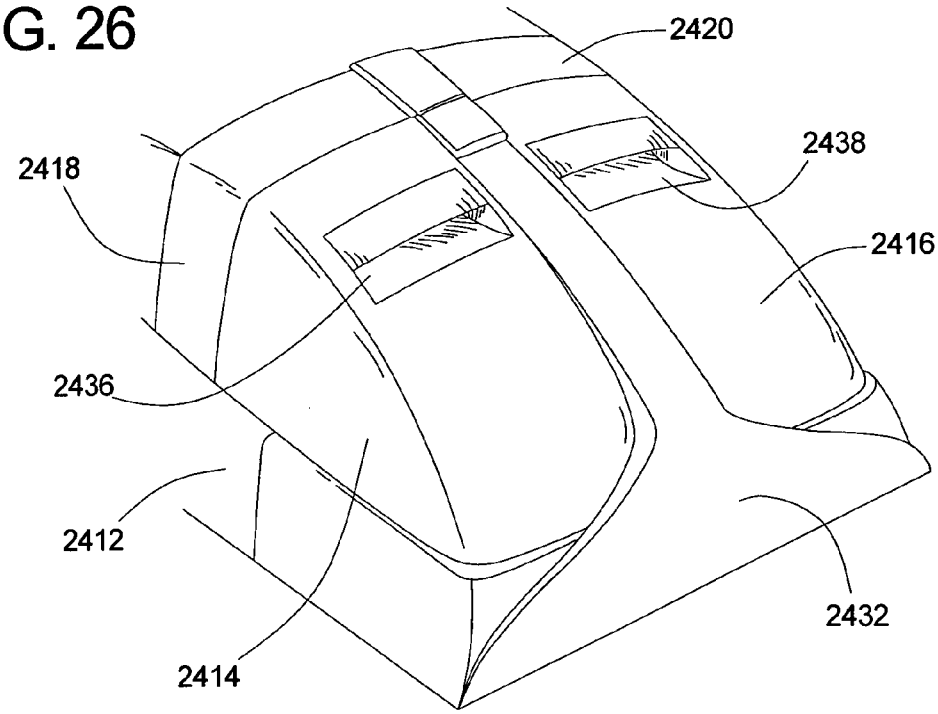
FIG. 26 is a fragmented front perspective view of supply and recovery tank designs of another embodiment of the present invention.

Referring now to FIGS. 25 and 26, two additional embodiments of supply and recovery tanks 2414 and 2416 are shown. In the embodiment of FIG. 25, integral handles 2436 and 2438 are longitudinally oriented in supply tank 2414 and recovery tank 2416, respectively. In the embodiment of FIG. 26, integral handles 2436 and 2438 are laterally oriented in supply tank 2414 and recovery tank 2416, respectively. Of course, handles 2436 and 2438 also may be oriented at angles relative to the longitudinal or lateral directions, and handle 2436 may be oriented differently than handle 2438.

Figure 27A:
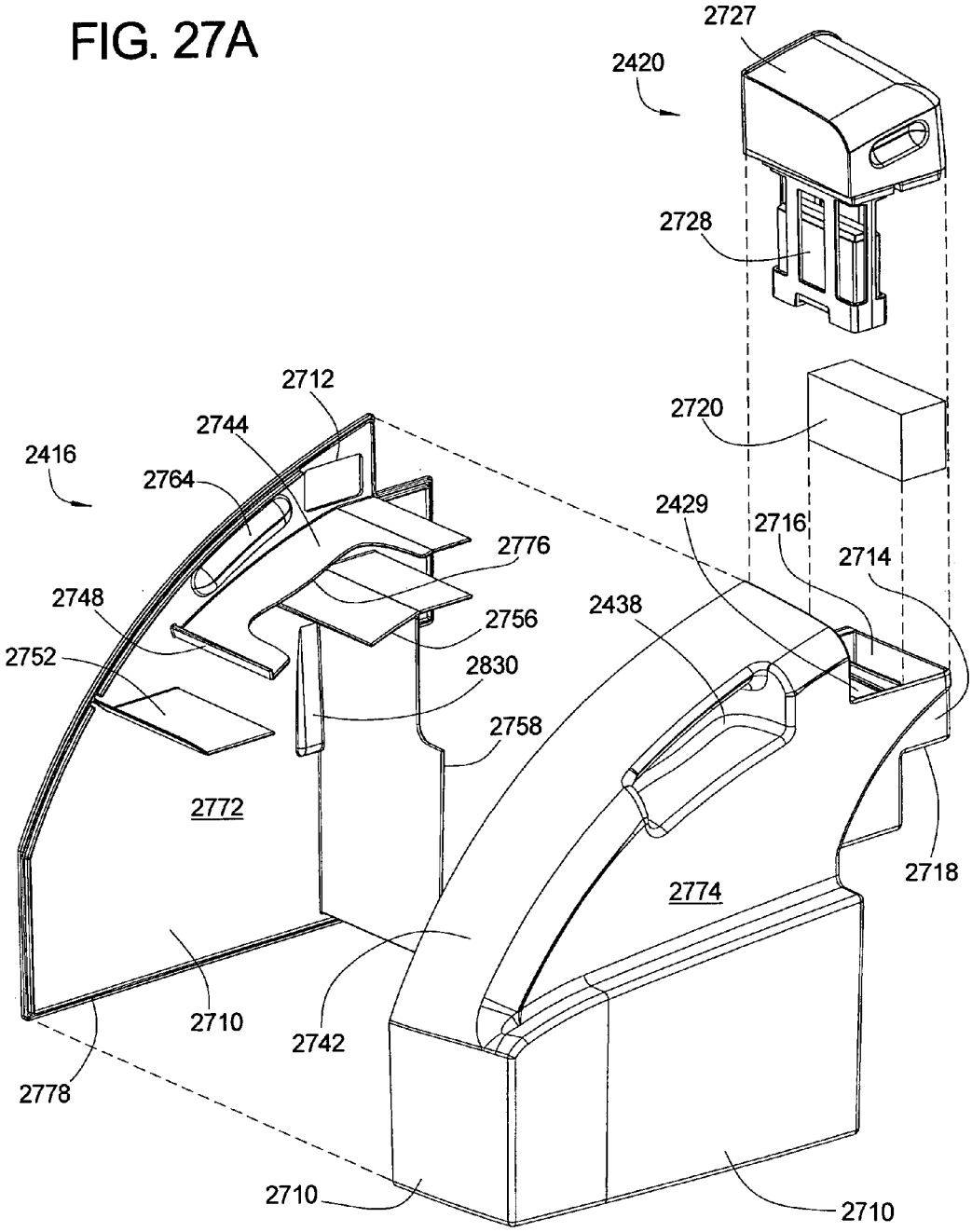
FIG. 27A is a perspective view of a recovery tank and a recovery tank float assembly of one embodiment of the present invention.

Referring now to FIGS. 27A, B and C, an embodiment of a recovery tank 2416 having a removable float assembly 2420 is described. Recovery tank 2416 comprises a plurality of walls having interior and exterior surfaces that form the tank 2416. It is preferred that recovery tank 2416 has a single-wall construction, in which the walls have outward surfaces that form the exterior of tank 2416 and inward surfaces that form the interior of tank 2416. It is also envisioned, however, that recovery tank 2416 could have a double-walled design, in which the interior and exterior surfaces are formed from different layered walls. A double-walled design may be favorable to provide insulation if the device employs heated cleaning fluid or steam. An insulating coating may alternatively be used to help insulate recovery tank 2416. The exterior surfaces of the tank walls, particularly the lower portions thereof 2710, are shaped to slidably engage with housing 2412, as described previously herein. The interior surfaces of the tank walls form a waste water reservoir 2711.

Figure 29:
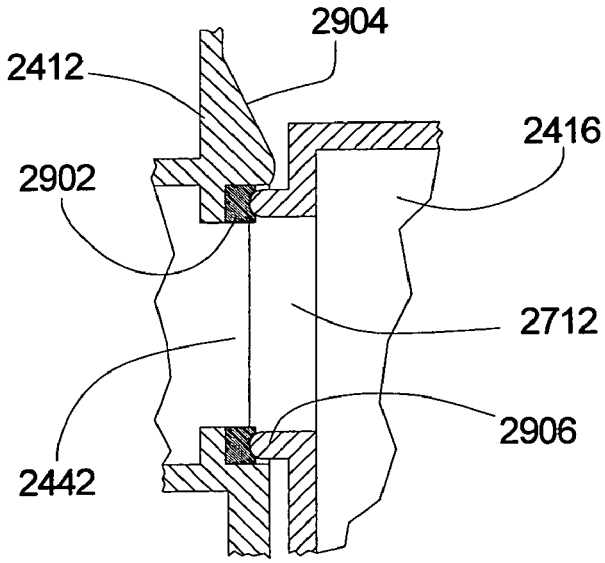
FIG. 29 is a fragmented cutaway front view of the housing and recovery tank of FIG. 24, as shown when the recovery tank is installed in the housing.

Recovery tank 2416 includes an inlet 2712 that is positioned to align with inlet nozzle outlet 2442 (FIG. 24) to thereby be in fluid communication with inlet nozzle 2432 (FIG. 24) of wet extractor 2410. Recovery tank 2416 also includes an outlet 2429 that can be placed in fluid communication with opening 2428 (FIG. 24) that leads to a vacuum source contained within housing 2412. Outlet 2442 and/or inlet 2712 and opening 2428 may be provided with a foam or rubber sealing gasket to improve sealing. FIG. 29 shows a preferred sealing arrangement between inlet nozzle outlet 2442 and recovery tank inlet 2712. In this embodiment, housing 2412 has a gasket 2902 positioned in a recess around outlet 2442. Recovery tank inlet 2712 comprises a raised lip 2906 that slides over ramp 2904 and snaps into engagement with housing 2412. This provides a good seal, and also helps hold recovery tank 2416 in snap engagement with housing 2412.

In the embodiment of FIG. 27A, removable float assembly forms part of the fluid communication path between outlet 2429 and the vacuum source, as shown and described in more detail with reference to FIG. 27C. Recovery tank 2416 may also comprise a filter chamber 2714 that is located outside the waste water reservoir 2711 and proximal to outlet 2429. Filter chamber 2714 comprises walls that form an inlet 2716 and an outlet 2718, and is shaped to retain a filter 2720, such as a foam or synthetic fibrous filter or other filter medium that will not deteriorate if exposed to fluid. Due to the possibility of contact with fluid and wet air, a block of synthetic open cell foam is preferred as the filter 2720. Filter chamber outlet 2718 is placed in fluid communication, preferably along an airtight passage, with a vacuum source when recovery tank 2416 is installed in the device 2410.

Recovery tank outlet 2429 doubles as a drain opening for emptying recovery tank 2419 when removable float assembly 2420 is removed. In a preferred embodiment, at least a portion of integral handle 2438 is positioned, with respect to a plane parallel to the surface to be cleaned, between the center of gravity of recovery tank 2416, as measured with waste water therein, and recovery tank outlet 2429. This measurement is shown representatively in FIG. 27C by distance DCG between the center of integral handle 2438 and the recovery tank's center of gravity CG. The purpose of this arrangement is to encourage recovery tank outlet 2429 to tilt upwards when recovery tank 2416 is removed from housing 2412, to thereby minimize the possibility of waste fluid spilling out of outlet 2429 during removal and transportation.

Figure 27B:
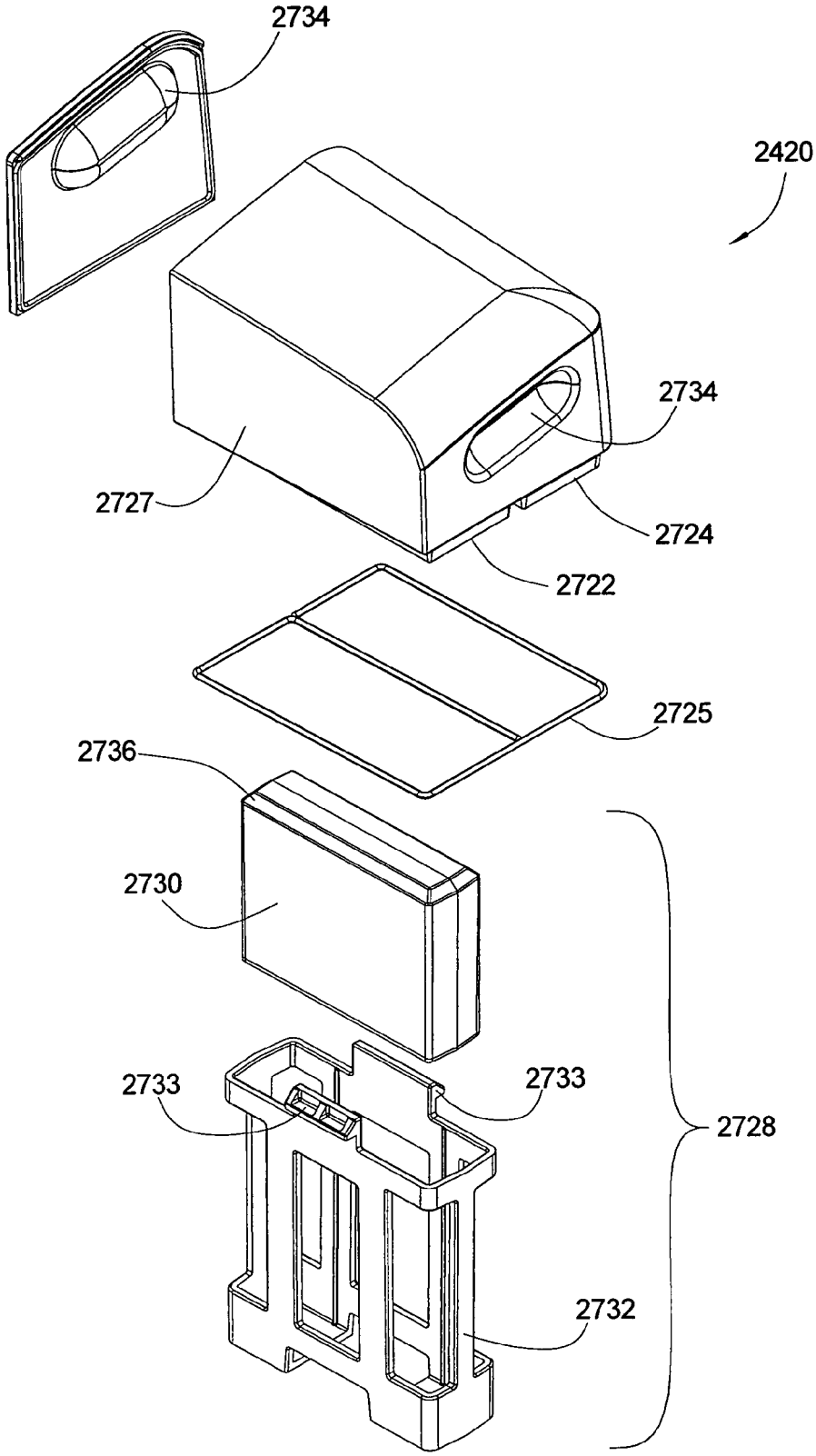
FIG. 27B is a perspective view of the recovery tank float assembly of FIG. 27A.
Figure 27C:
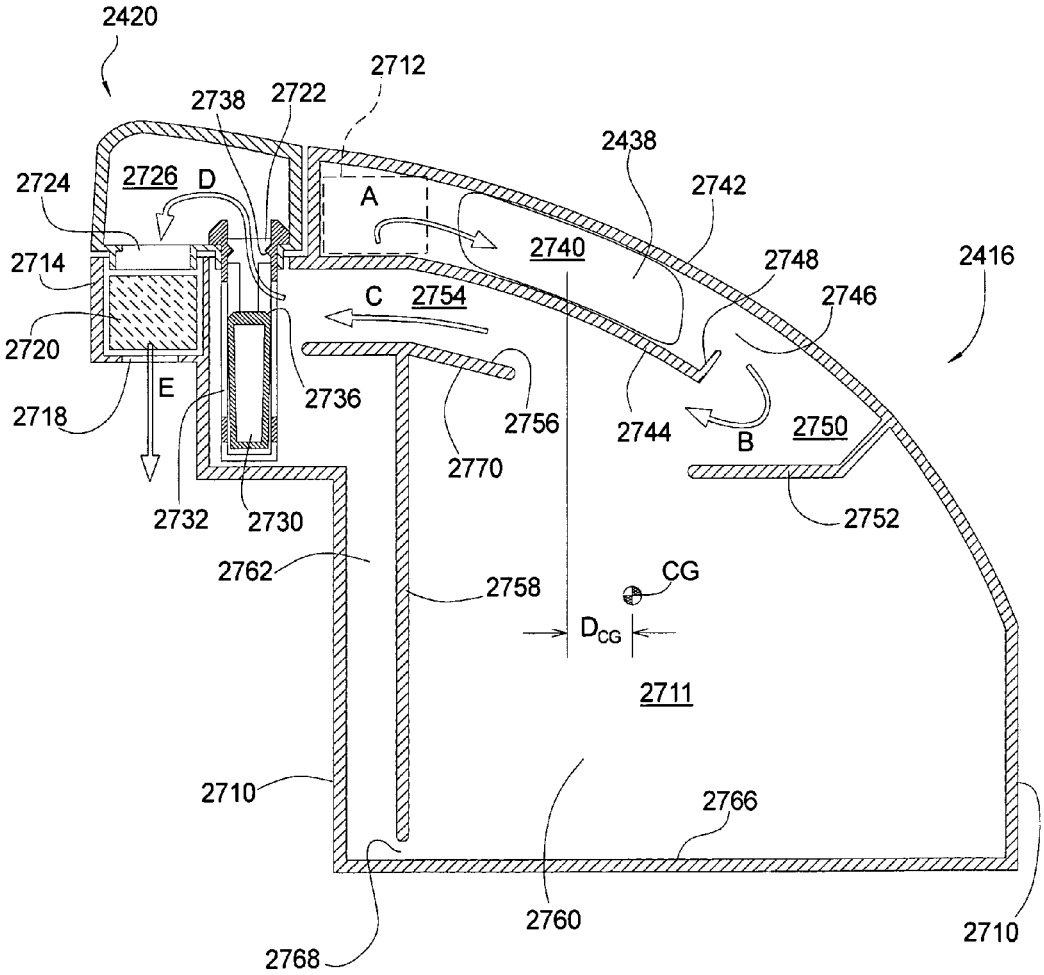
FIG. 27C is a cutaway side view of the recovery tank of FIG. 27A shown with the recovery tank float assembly of FIG. 27B installed therein.

As best shown in FIGS. 27B and 27C, removable float assembly 2420 comprises an inlet 2722, an outlet 2724 and a plenum 2726 providing a fluid communication path between inlet 2722 and outlet 2724. Plenum 2726 is preferably formed from a housing 2727 having grip detents 2734 adapted to be gripped by an operator to assist with removal and installation, and is also preferably a transparent material so that an operator can monitor the operation of the device.

Removable float assembly inlet 2722 is adapted to engage with tank outlet 2429, and float assembly outlet 2724 is adapted to engage with filter chamber inlet 2716. A gasket 2725 may optionally be provided between removable float assembly 2420 and recovery tank 2416 to improve the vacuum seal between them. It is preferred that removable float assembly 2420 be engageable with recovery tank 2416 by snap engagement. In the embodiment shown in FIG. 27C, removable float assembly 2420 and recovery tank 2416 are conveniently removable from housing 2412 as a single unit. When recovery tank 2416 and removable float assembly 2420 are installed in housing 2412, the vacuum source draws the air/fluid mixture from the surface being cleaned through inlet nozzle 2432 (FIG. 24), into recovery tank inlet 2712 (as shown by arrow "A"), through recovery tank 2416 (arrows "B" and "C") where the liquid entrained in the air is removed and settles in waste water reservoir 2711, into plenum 2726 (arrow "D") and through filter chamber 2714 (arrow "E") to the vacuum source.

Removable float assembly 2420 has a float device 2728 incorporated therein or attached thereto. Generally speaking, the float device can be any device that detects the level of waste water in recovery tank 2416 and blocks or impedes the flow of air to the vacuum source when the level of waste water rises to a predetermined level. In the embodiment of FIG. 27A–C, float device comprises a simple buoyant float 2730 that is slidably captured within a float cage 2732. Float cage 2732 preferably snaps into float assembly inlet 2722 by one or more hooks 2733. Buoyant float 2730 comprises an upper surface 2736 that abuts a corresponding surface 2738 (FIG. 27C) when buoyant float 2730 reaches the top of its travel, to thereby restrict or stop the air flow from recovery tank 2416 to plenum 2726 and indicate to the operator (by change in pitch of the vacuum device) that recovery tank 2716 is full.

The float device 2728 described herein comprises a simple sliding float having a sealing surface positioned directly on the float, however, other float devices may be used with the present invention. For example, the float device may instead comprise a door attached to a float by way of a linkage, post or pushrod. Furthermore, although the float device 2728 is shown being located outside plenum 2726, it could instead be located therein. Still further, removable float assembly 2420 may be provided as a separate float device 2728 and housing 2727. In other embodiments, recovery tank 2416 may be provided with an integral float assembly and filter (or the filter may be omitted), in which case, removable float assembly 2420 is not used.

Recovery tank 2416 is configured with various internal passages that have been found to provide efficient water separation and operation characteristics. The inlet of recovery tank 2416 comprises a downward-sloped inlet conduit 2740, that is formed between an upper exterior wall 2742 of recovery tank 2416, and a sloped internal wall 2744. The sides of inlet passage 2740 are formed by exterior side walls of recovery tank 2416. Inlet passage 2740 extends downward into recovery tank 2416 and terminates at a conduit exit 2746 proximal to the main portion of waste water reservoir 2711. The downward slope of inlet passage 2740 prevents waste water that might cling to the interior surfaces of recovery tank 2416 from flowing backwards out of the inlet nozzle 2432 and soiling the floor when the vacuum source is off, and also moves the entrance into the reservoir 2711 as far from the suction source as possible to maximize the amount of time available to separate fluid from the airflow.

A rib 2748 is preferably provided at conduit exit 2746 to extend into inlet conduit 2740 to reduce the conduit's cross-sectional area. This reduction in area throttles the airflow and accelerates the air/fluid mixture as it exits inlet conduit 2740. The abrupt area change before and after rib 2748 also may initiate a swirling movement in the air/fluid mixture. In various embodiments of the invention, inlet conduit 2740 is sloped downward at an angle of about 5 degrees to about 50 degrees, and more preferably about 20 degrees to about 30 degrees, as measured from the center of the conduit at the beginning of the downward slope to the center of the conduit at the conduit exit (not including the rib 2748, if present).

Integral handle 2438 also may be formed such that the internal surfaces of the walls defining integral handle 2438 extend into inlet conduit 2740. This also decreases the cross-sectional area of inlet conduit 2740 and throttles the air/fluid mixture as it passes therethrough. The location of integral handle 2438 between upper exterior wall 2742 and sloped interior wall 2744 also increases the strength of integral handle 2438.

In the embodiment shown in FIGS. 27A–C, recovery tank inlet 2712 is positioned on the side of recovery tank 2416. In addition, recovery tank 2416 is generally elongated in the longitudinal direction and has generally parallel interior walls. Inlet conduit 2740 also extends in the longitudinal direction. In this embodiment, the air/fluid mixture recovered from the surface being cleaned enters recovery tank 2416 at approximately right angles to the longitudinal direction, and must immediately negotiate a tight turn to travel longitudinally along inlet conduit 2740 (arrow "A"), which helps separate fluid, by momentum, that is entrained in the air. Separated fluid can then flow down inlet conduit 2740 to waste water reservoir 2711.

It is preferable, but not necessary, to orient the inlet conduit so that it extends generally away from recovery tank outlet 2429. This helps prevent the incoming air/fluid mixture from immediately traveling to outlet 2429, thereby "short-circuiting" the waste water reservoir 2711. In this embodiment, a flow reversing pocket 2750, preferably is positioned at conduit exit 2746 to cause the air/fluid mixture to rapidly negotiate a tight change in direction, as shown by arrow "B." Flow reversing pocket 2750 is preferably formed by internal wall 2752, but may be formed by other surfaces, such as an internal surface of an exterior wall. When the air/fluid mixture negotiates this turn, the relatively heavy water tends to become separated, by its own momentum, from the air in which it is entrained. Separated water may settle on internal wall 2752, and flow into waste water reservoir.

Inlet conduit 2740 preferably has a substantial length to thereby help prevent short-circuiting and to focus the flow of the incoming air/fluid mixture towards flow reversing pocket 2750. In a preferred embodiment, inlet conduit 2740 has a length of at least about 1 inch, and more preferably at least about 2 inches, and most preferably at least about 3.5 inches. The length of inlet conduit is measured generally from the center of conduit exit 2746 to the nearest edge of recovery tank inlet 2712.

After negotiating the turn created by flow reversing pocket 2750, the air/fluid mixture passes into waste water reservoir 2711, where it rapidly slows due to the abrupt increase in volume of reservoir 2711. The air/fluid mixture also may undertake a complex tumbling and recirculating flow pattern when it enters and navigates through waste water reservoir 2711, which increases the overall length of the air's flow path before it exits recovery tank 2416. This reduction in speed and increase in flow path length gives entrained water time to precipitate out of the air and settle in reservoir 2711.

The air, and any remaining entrained fluid, preferably exits recovery tank 2416 by way of a throttling passage 2754. Throttling passage is most conveniently formed on the top by the bottom side of sloped internal wall 2744, on the bottom by an additional internal wall 2756, and on the sides by the sides of recovery tank 2416. Of course, other wall configurations can be used instead. Throttling passage 2754 has a smaller cross section than waste water reservoir 2711, and therefore air in throttling passage 2754 tends to accelerate as it passes therethrough. This acceleration tends to remove water entrained in the air because the relatively heavy water does not accelerate as quickly as the air. Throttling passage 2754 exits proximal to recovery tank outlet 2429, where the air turns 90 degrees to exit recovery tank 2416. This abrupt turn also tends to remove entrained fluid from the air, as described previously herein with reference to flow reversing pocket 2750. In a preferred embodiment, throttling passage 2754 is located level with or above the lower wall of conduit exit 2746, which helps prevent the air/fluid mixture from short-circuiting, and forces the air/fluid mixture to turn upwards before exiting waste water reservoir 2711, to thereby use gravity to help pull entrained water out of the air.

Recovery tank 2416 preferably includes a baffle 2758 that extends upward from recovery tank floor 2766 and divides waste water reservoir 2711 into a main chamber 2760 and an isolation chamber 2762. Baffle 2758 generally extends across the entire width of recovery tank 2416, and vertically extends to at least about the location of float 2730. Baffle 2758 also preferably extends in a direction perpendicular, relative to a horizontal plane (i.e., as seen from above), to an imaginary line extending from the center of main chamber 2760 to tank outlet 2429 to thereby form a wall that obstructs liquid movement from the main chamber 2760 to the outlet 2429. Baffle 2758 preferably also comprises a splash baffle 2770 that extends over main chamber 2760 to impede fluid that might otherwise splash over baffle 2758. If recovery tank 2416 includes a throttling passage 2754, then the throttling passage's lower wall 2756 may form splash baffle 2770.

Fluid in main chamber 2760 can enter isolation chamber 2762 essentially only through a passage 2768 (or passages) formed near the bottom of baffle 2758, and preferably between baffle 2758 and floor 2766. Passage 2768 may extend across the entire width of baffle 2758, or only a portion or portions thereof. Float device 2728 preferably extends downward into isolation chamber 2762, and isolation chamber 2762 operates to prevent float device 2728 from being inundated with sloshing fluid whenever the wet extractor is moved backwards and forwards during operation.

Isolation chamber 2762 operates by restricting the flow rate of fluid from main chamber 2760 to isolation chamber 2762 during momentary forward and rearward longitudinal accelerations, such as those experienced when the wet extractor is moved back and forth to clean a surface. Such accelerations cause fluid in waste water reservoir 2711 (in both main chamber 2760 and isolation chamber 2762) to move backwards and forwards, creating sloshing waves. The vertical height of the wave depends on a number of factors, including the length of the chamber, the amount of fluid in the chamber, and the magnitude of the acceleration. Generally, longer chambers produce greater wave height. Baffle 2758 and passage 2768 operate to effectively reduce the length of waste water reservoir 2711 during wave-producing accelerations, without reducing its volume. During accelerations, the small passage 2768 prevents rapid movement of fluid between isolation chamber 2762 and main chamber 2760, and thereby effectively isolates them from one another, reducing their length and therefore the wave sizes generated in both chambers. By preventing these waves from striking float device 2728, the present invention prevents float device 2728 from unnecessarily blocking the vacuum source during cleaning, and prevents large sloshing waves from rapidly exiting recovery tank 2416 before float device 2728 has time to close.

It has been found that passage 2768 provides beneficial performance in an approximately 0.60 gallon to one-gallon waste water reservoir, and most preferably about a 0.80 gallon waste water reservoir, when passage 2768 has an area of about 2.50 $in^2$ or less, and more preferably about 1.50 $in^2$ or less, and most preferably about 0.75 $in^2$ or less. These areas may vary, of course, depending on the particular shape and size of the recovery tank 2416. Preferably, the minimum width of passage 2768 is at least about 0.125 inches, and more preferably at least about 0.500 inches, to prevent clogging. In a most preferred embodiment, passage 2768 is about 3.75 inches wide, and about 0.500 inches high, and located at the bottom of baffle 2758.

While baffles such as those described herein are useful in many different shapes of any recovery tank, it has been found that such a baffle is particularly useful in a recovery tank, as shown in FIGS. 27A–C, that is elongated in the longitudinal direction of the wet extractor (i.e., generally parallel to the direction in which the wet extractor is typically rolled or moved during use). As shown in FIGS. 27A–C, recovery tank 2416 has generally parallel side walls, which are joined by front and rear interior walls, and the outlet 2429 is located near the rear interior wall. Baffle 2758 is particularly useful for preventing the formation of large waves along the relatively long longitudinal recovery tank direction in the present invention.

The various external and internal walls that form the walls and baffles described herein may be fabricated by a number of different methods. However, it has been found that the walls can be inexpensively and efficiently constructed by forming recovery tank 2416 by two halves 2772 and 2774, as shown in FIG. 27A, that have the walls and baffles formed integrally thereon. In FIG. 27A walls 2744, 2748, 2752, 2756 and 2758 are shown being formed integrally with housing half 2772 (wall 2744 is shown with a cutout 2776 that abuts the inner contour of integral handle 2438). In a more preferred embodiment, walls 2744, 2748 and 2752 are integrally formed with housing half 2774, while walls 2756 and 2758 are formed with housing half 2772. Housing halves 2772 and 2774 may also have grooves formed therein to receive the walls formed in the opposite housing. Housing halves 2772 and 2774 also may be provided with a tongue-and-groove fitment system in which a tongue 2778 extending around the perimeter of one housing half fits into a groove on the other housing half. Each housing half 2772 and 2774 also may be formed by an assembly of subparts that are bonded together.

It will be appreciated by those of ordinary skill in the art that the various recovery tank features described herein may be used separately or in combination, and also may be used in combination with various recovery tank features known in the art.

Figure 28A:
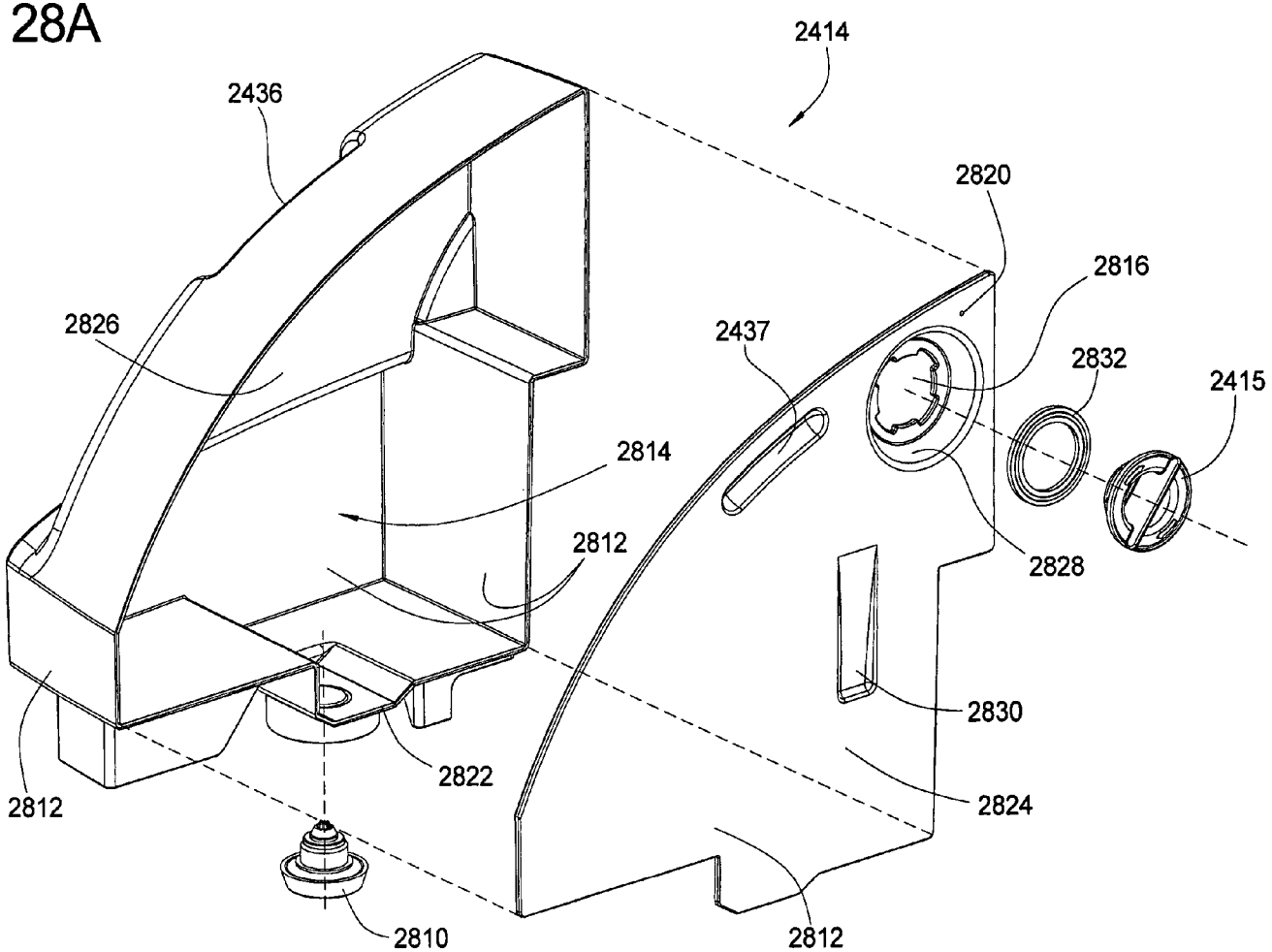
FIG. 28A is a perspective view of a supply tank of one embodiment of the present invention.

Referring now to FIG. 28A, another aspect of the present invention is directed towards a unique supply tank 2414. Supply tank 2414 may be used to provide fresh water or a mixture of water and detergent. Supply tank 2414 also may be operated in conjunction with a heater or steam generator (not shown). As with recovery tank 2416, the exterior surfaces of the supply tank walls, particularly the lower portions thereof 2812, are shaped to slidably engage with housing 2412, and preferably also form an integral handle 2436 and grip detent 2437, as described previously herein. Interior surfaces of supply tank 2414 form a fluid reservoir 2814. Supply tank 2414 may have single walls, double walls, insulated walls, or other configurations, as will be appreciated by those of ordinary skill in the art in light of the teachings herein.

Supply tank 2414 comprises a selectively sealable inlet 2816 having a cover or, more preferably, a screw-on cap 2415. Cap 2415 or inlet 2816 is also preferably provided with a gasket 2832 to help prevent fluid from leaking therethrough. A vent hole 2820 is located near the uppermost extent of supply tank 2414, and may be formed in cap 2415. Supply tank 2414 is provided with a dry-break outlet 2810, as are known in the art, which is positioned in the lowermost wall 2822 of fluid reservoir 2814 to allow the maximum amount of fluid to be extracted from supply tank 2414 during use. Dry-break outlet 2810 is positioned to engage with a corresponding inlet located in opening 2422 when supply tank 2414 is inserted therein (see FIG. 30B).

Figure 28B:
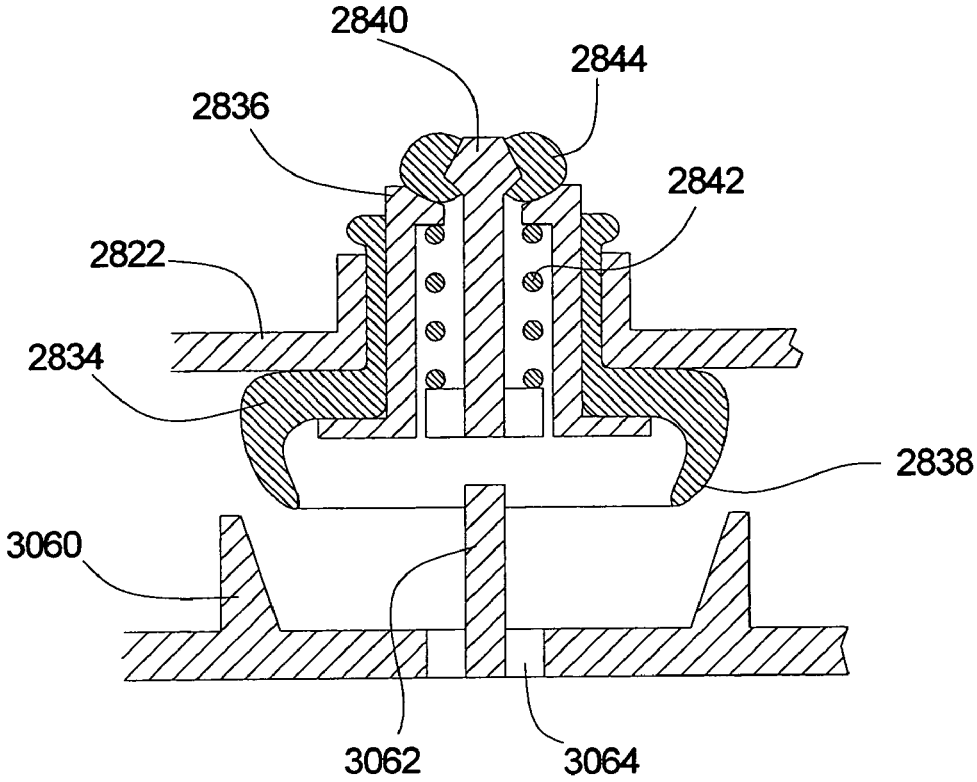
FIG. 28B is a cross-section view of a supply tank valve assembly.

Dry-break outlet 2810 is shown in detail in FIG. 28B. Outlet 2810 comprises a boot seal 2834 that surrounds a hollow central member 2836. Boot seal 2834 is configured to frictionally fit within a hole in the lowermost wall 2822 of supply tank 2414, and has a skirt portion 2838 that extends downward to seal with a corresponding supply tank receptacle 3060, such as the one shown in FIG. 30B. A sliding valve member 2840 is disposed in the bore of hollow central member 2836, and pre-loaded by a spring 2842 that biases valve member 2840 downward. When in this position, a rubber plug 2844 abuts the upper end of hollow central member 2836 to seal the exit from supply tank 2414. When dry-break outlet 2810 is pushed downward into engagement with supply tank receptacle 3060, pin 3062 pushes sliding member 3040 upwards against the spring 2842, thereby opening the valve formed by rubber plug 2844 and permitting fluid to flow out of supply tank 2414 and into fluid inlet 3064.

Supply tank 2414 is preferably shaped so that it has a low profile when it is oriented to be filled. This allows supply tank 2414 to be filled even when relatively little vertical room is available, as is often the case in bathroom sinks, in which the sink basin is typically shallower and the faucet is typically lower than in kitchen sinks. In order to accomplish this goal, the exterior walls of supply tank 2414 define a flattened outer periphery that has a first generally flat side 2824, and selectively sealable inlet 2816 is located on this flattened side 2824. The filling profile of supply tank 2414 may also be further flattened by providing another substantially flattened side 2826 opposite first flattened side 2824, as shown in the figures. Filling of supply tank 2414 may be even further facilitated by placing selectively sealable inlet 2816 in a funnel-shaped cavity 2828, as shown in FIG. 28A. If such a funnel-shaped cavity is provided, the overall size of supply tank 2414 can be conveniently reduced by shaping cap 2415 to fit within cavity 2816 so that it is flush with or recessed within flattened side 2824.

In this embodiment, supply tank 2414 is filled by removing it from housing 2412, removing cap 2415, turning housing 2414 on its side, and positioning inlet 2816 under a sink faucet. The narrow, flattened profile of supply tank 2414 provides substantially more clearance than typical supply tanks, and allows inlet 2816 to be positioned under faucets in sinks that have relatively shallow basins and low faucets.

Another aspect of the present invention is a unique liquid management assembly for a wet extractor. The liquid management assembly is adapted to perform one or more of various functions that control the flow of clean water, detergent and mixtures thereof in the wet extractor. Functions of the liquid management assembly may include, but are not limited to, priming, pumping, mixing and distribution of cleaning fluids such as water and detergents. It will be appreciated that any suitable fluid or fluids may be used with the present invention, and the term "detergent" includes any useful cleaning fluid, brightener, deodorant, perfume and other useful cleaning compounds. The present invention provides a compact and relatively inexpensive centralized liquid management assembly.

Figure 30A:
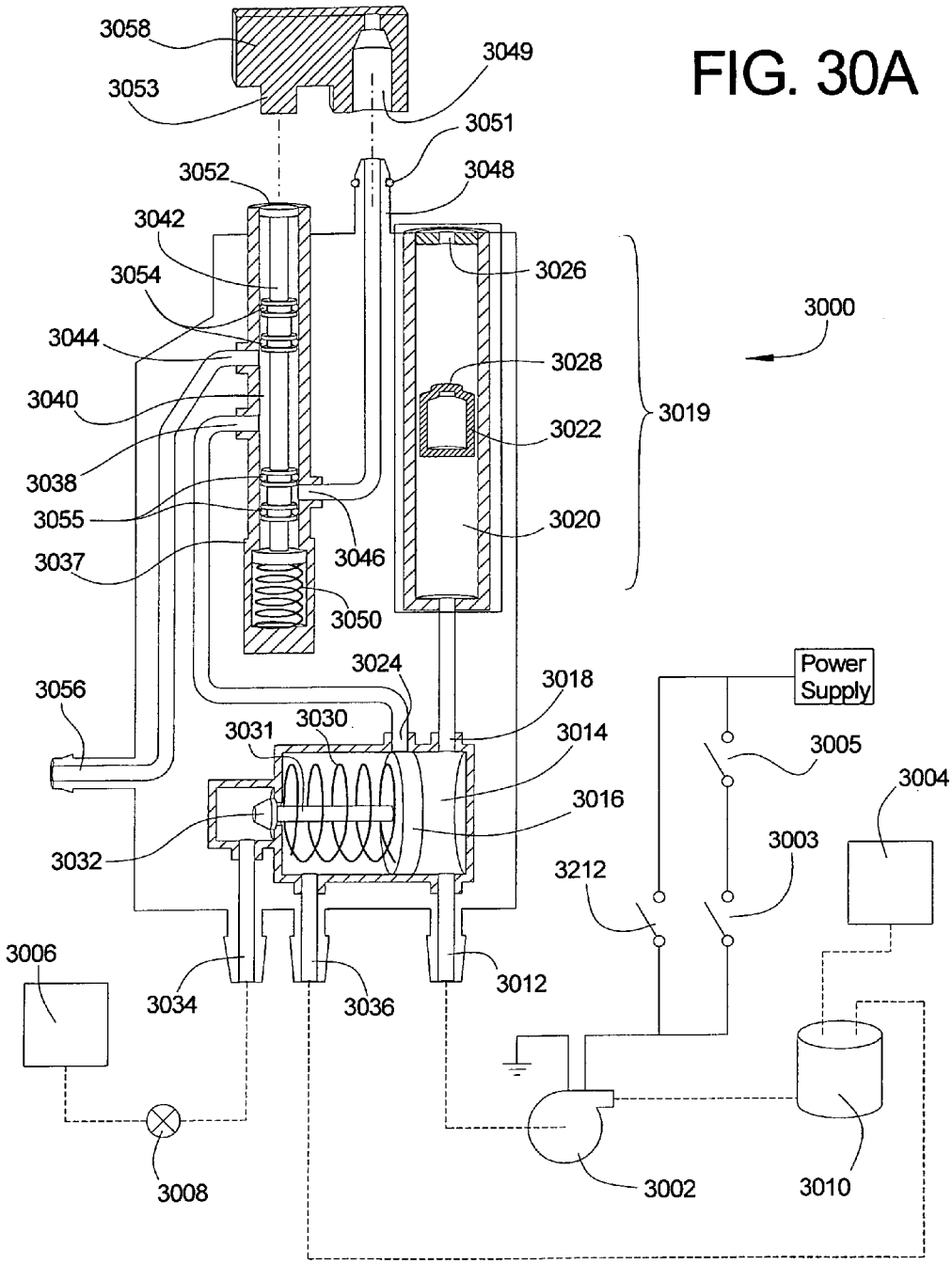
FIG. 30A is a side view of an embodiment of a liquid management assembly of the present invention.

A first embodiment of the liquid management assembly is shown in FIG. 30A, which is a side view of liquid management assembly 3000. Assembly 3000 has a pump inlet 3012 that receives pressurized fluid from a conventional pump 3002. Pump inlet 3012 leads to a flow valve chamber 3014 having a flow valve 3016 (or "power valve"), a first outlet 3024, and a priming assembly outlet 3018.

Primer outlet 3018 leads to a priming assembly 3019 that operates to prime pump 3002. Such priming is useful when pump 3002 does not self-prime, as is the case in typical centrifugal pumps. Priming assembly 3019 has a float chamber 3020 in which a float 3022 is captured such that it can freely slide from the bottom of the chamber to the top. It is preferred that float chamber 3020 be vertical to reduce any friction between float 3022 and the float chamber walls. Float 3022 may be any device that will rise on fluid in float chamber 3020, and may comprise a sealed air chamber, an inverted cup, or the like. The body of float 3022 is shaped and sized to allow air to pass between float 3022 and the walls of float chamber 3020. Float chamber 3020 has a vent hole 3026 at its upper end that, in one embodiment, is preferably placed in fluid communication with atmospheric air. Float 3022 is provided with a sealing structure 3028 that engages with vent hole 3026 when float 3022 reaches the upper extent of its travel to thereby seal float chamber 3020 and prevent the escape of fluid. Sealing structure 3028 preferably has a domed shape or a tapered point, but other shapes may be used. In another embodiment, an additional sealing structure (not shown) may be placed on the bottom of float 3022 to seal the entrance to float chamber 3020, when float 3022 is at the bottom thereof.

When fluid is provided to assembly 3000 the fluid enters float chamber 3020 and raises float 3022 until the float's sealing structure 3028 closes vent 3026 or until the hydrostatic head pressure of the fluid equalizes at some point below the full height of float 3022. Any air in the system escapes around float 3022 and exits through vent hole 3026. In this embodiment, it is preferred for the wet extractor's fluid supply tanks, such as supply tank 3004 and detergent tank 3006, to be positioned above pump 3002 so that fluid flows to and primes pump 3002 by gravity. In this case, priming assembly 3019 serves the useful function of venting any captured air out of the system to allow fluid to flow from tanks 3004 and 3006 to pump 3002. Also, using this configuration, the vent 3026 need not be connected to a vacuum source as in other systems, which reduces the cost of the device and eliminates the risk of damage that may occur when the vacuum source ingests fluids. Furthermore, if priming assembly 3019 is positioned above the tank attachment points (i.e., above the receptacles with which the tanks' valve assemblies 2810 mate), then one or more check valves (not shown) may be used to prevent fluid in float chamber 3020 from flowing backwards and out of the tank attachment points when the tanks are removed.

Flow valve 3016 is positioned in chamber 3014 to block the fluid communication path between inlet 3012 and outlet 3024 when valve 3016 is in a closed position, and allow fluid communication between inlet 3012 and outlet 3024 when valve 3016 is in an opened position. FIG. 30A shows valve 3016 in the closed position. When opened, valve 3016 would be moved to the left in FIG. 30A. A resilient biasing member, such as spring 3030, is provided to bias flow valve 3016 to the closed position. Spring 3030 may be located outside chamber 3014, but is preferably inside chamber 3014 to simplify the structural design. When closed, flow valve 3016 blocks the path between inlet 3012 and outlet 3024, and preferably completely blocks outlet 3024 to prevent any fluid or air passage therethrough. By so covering outlet 3024, valve 3016 helps prevent fluid either flowing in behind valve 3016 or siphoning out of the system. Although spring 3030 is shown as a coil spring, it, and other resilient biasing members described herein, can be replaced with elastomeric springs, leaf springs and other devices, as will be appreciated by those of ordinary skill in the art.

Pump 3002 and spring 3030 are selected such that pressurized fluid from pump 3002 has sufficient pressure (usually about 7–10 psi) to overcome the spring bias and frictional resistance of the valve seal in the bore. When the bias and friction are overcome, the fluid moves valve 3016 into the open position, and forces its way into outlet 3024. When pump 3002 is turned off, spring 3030 forces flow valve 3016 back to prevent fluid communication to outlet 3024. This feature of the present invention allows the operator to control the flow of fluid to the surface to be cleaned by selectively activating and deactivating pump 3002, which automatically opens flow valve 3016. This is advantageous over systems that operate the pump constantly and control flow with a manually-operated mechanical or electric valve. One advantage is that it requires fewer parts because it does not require wiring or mechanical linkages to operate the valve, and instead simply uses the existing power wires to an electric motor driving the pump 3002. Another advantage of this feature of the invention is that pump 3002 and valve 3016 can be conveniently located virtually anywhere in the wet extractor, whereas systems that have manually operated valves either require the valve to be located in the wet extractor's handle (in the case of mechanically-operated valves) or require the use of expensive solenoid valves and additional wiring (in the case of electrically-operated valves). This configuration also eliminates "dead head" hydrostatic forces that occur when the pump is driven against a closed fluid passage.

In wet extractors having separate supply and detergent tanks, it is often desirable to allow the operator to control the amount of detergent that is mixed with the water from the supply tank. In such cases, it has been found to be desirable to prevent the fluid in the two tanks from intermingling when the wet extractor is not in use. It has been discovered that the flow valve 3016 can also be used to selectively stop the flow of detergent in a wet extractor, thereby isolating the detergent tank from the supply tank when the device is idle.

One embodiment of this feature of the invention is shown in FIG. 30A, in which valve 2016 is operably connected to a detergent flow valve 3032. Detergent flow valve 3032 is attached to valve 3016 through a pushrod 3031, and is fluidly located between a detergent inlet 3034 and a detergent outlet 3036, so that when it is in the opened position it allows fluid communication between inlet 3034 and outlet 3036, and when closed it blocks such fluid communication. In the depicted embodiment, the fluid communication path between detergent valve 3032 and detergent outlet 3036 is conveniently made from a portion of valve chamber 3014 that is sealed off from inlet 3012 and outlet 3024 by valve 3016, but this is not required. In addition, although the embodiment of FIG. 30A depicts detergent valve 3032 as a poppet or plunger-type valve (i.e., one that operates by plugging and unplugging a hole), detergent valve 3032 could instead comprise any other valve type, such as a piston valve like valve 3016, a rotary valve, or a slide valve. Plunger valves are preferred for this application due to their typically lower operating friction and inexpensiveness.

Figure 31:
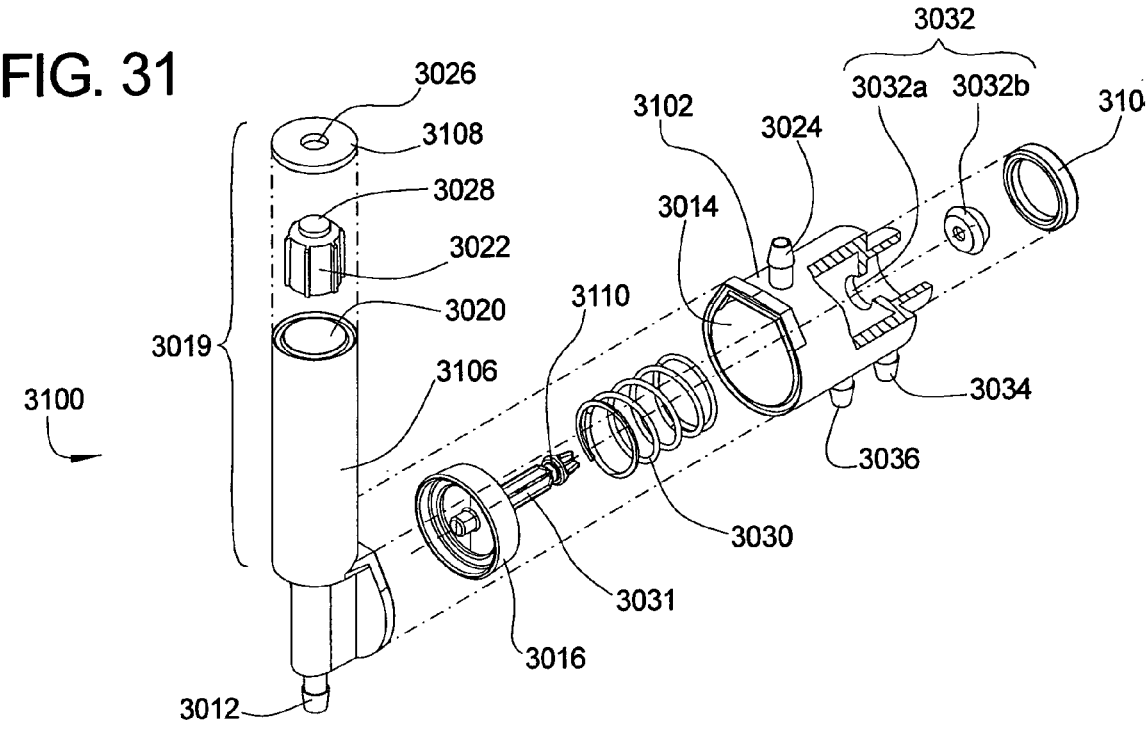
FIG. 31 is an exploded view of an embodiment of a flow valve assembly of the present invention.

Referring now to FIG. 31, in a preferred embodiment detergent valve 3032, detergent inlet 3034 and detergent outlet 3036 are constructed as an integral assembly 3100 with valve chamber 3014 and priming assembly 3019. In this embodiment, valve chamber 3014 is formed in a housing 3102 that includes inlet 3034 and a outlets 3036 and 3024. The parts are assembled by placing spring 3030 into valve chamber 3014, inserting valve 3016 and pushrod 3031 (which is attached to valve 3016) into valve chamber 3014 until the end of pushrod 3031 protrudes through the hole 3032*a* that forms the seat portion of detergent valve 3032, and placing a rubber plug 3032*b* that forms the valve portion of detergent valve 3032 onto pushrod 3031. Plug 3032*b* partially encapsulates a knob 3110 on the end of pushrod 3031 and thereby retains the parts together. Valve 3016 comprises a flexible cup-like seal that is overmolded onto the end of pushrod 3031, one or more o-rings, or any other suitable type of sealing structure. A cap 3104 is glued or screwed to the end of housing 3102 to seal the detergent flow path. Once valve 3016 is in place, a second housing portion 3106 is attached to housing 3102 to close the open end of valve chamber 3014. Second housing portion 3106 includes inlet 3012 and a float chamber 3020 into which float 3022 is inserted. A cap 3108 having vent 3026 disposed therein is attached to the open end of float chamber 3020 to complete the assembly.

It will be understood that although the configuration described with reference to FIGS. 30 and 31 is preferred and useful to provide a compact assembly, this configuration is not required. In an alternative embodiment, a separate detergent valve assembly, having its own valve and detergent inlet and outlet, may be used instead. In this alternative embodiment, valve 3016 may be attached to detergent valve 3032 by a mechanical linkage, an electrical relay circuit, or by any other connection that causes detergent valve 3032 to open when valve 3016 opens.

Referring back to FIG. 30A, detergent inlet 3034 is attached (preferably by a flexible hose) to detergent supply tank 3006. Although the detergent may be pressurized by a pump before it is provided to inlet 3034, it is preferred to be unpressurized (i.e., not pumped) to reduce cost and the possibility of leakage through valve 3032, and allow the use of simple low-pressure seals. As used herein, "pressurized" fluid includes any fluid that has its operating pressure increased by a mechanical pump, pneumatic pressurization of the fluid supply tank, and so on, whereas "unpressurized" fluid includes fluid provided by a gravity feed system or any other feed system that does not actively increase the operating pressure of the fluid. Preferably, a detergent valve 3008, such as those described elsewhere herein (see FIGS. 36–37 and accompanying disclosure), is positioned between detergent tank 3006 and inlet 3034. Detergent outlet 3036 is connected to a mixing manifold 3010 where it mixes with water from supply tank 3004 before going into pump 3002. One or more check valves (not shown) may be placed along the various fluid circuits to further reduce the incidence of unwanted fluid commingling, backflow and siphoning.

Figure 30B:
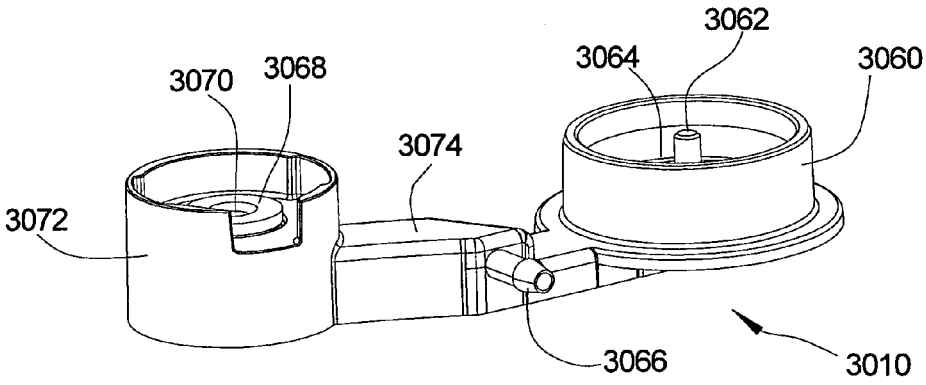
FIG. 30B is an isometric view of a mixing manifold of an embodiment of the present invention.

The mixing manifold 3010 is shown in detail in FIG. 30B. The mixing manifold 3010 comprises a cup-like supply tank receptacle 3060 and a pump receptacle 3072 that are joined by a hollow center passage 3074. The supply tank receptacle 3060 has a pin 3062 and a fluid inlet 3064. Pin 3062 engages with a corresponding valve in a supply tank to open a fluid passage from the supply tank to fluid inlet 3064. Center passage 3074 also includes a detergent inlet 3066 for receiving fluid from detergent outlet 3036 (FIG. 30A). Pump receptacle 3072 is shaped with an outlet 3070 that receives the inlet of pump 3002, so that fluid entering fluid inlet 3064 and detergent inlet 3066 is conveyed to pump 3002. A boot seal 3068 is preferably provided to ensure a water-tight fit between pump 3002 and mixing manifold 3010.

During operation, when flow valve 3016 moves to place outlet 3024 into fluid communication with inlet 3012, detergent valve 3032 simultaneously opens and places detergent inlet 3034 in fluid communication with detergent outlet 3036. Once valve 3032 is opened, detergent can flow into mixing manifold 3010, become mixed with water from supply tank 3004, and be pressurized by pump 3002 for deposition onto the surface to be cleaned. When pump 3002 is deactivated, flow valve 3016 closes, simultaneously closing detergent valve 3032. With detergent valve 3032 closed, detergent is prevented from flowing from detergent tank 3006 to mixing manifold 3010 and into supply tank 3004.

Using the present invention, the flow of detergent can be controlled by the pump, rather than requiring separate solenoids or other valves to connect and disconnect the detergent supply. The present invention also reduces or eliminates the problem in some prior art devices in which detergent was free to siphon into the flow path between the supply tank and the pump during idle periods, which resulted in the wet extractor providing an initially high concentration of detergent for a short period after each restart.

Another feature of the invention relates to a system for switching a wet extractor between a floor cleaning mode and an accessory cleaning mode. Many wet extractors are provided with two output modes—one for when the wet extractor is being used on a floor, and one for when an accessory tool is being used with the wet extractor to clean remote surfaces. During accessory tool mode, fluid and vacuum must be diverted away from the floor and to the accessory tool. The unique output valve arrangement of the present invention automatically switches from floor cleaning mode to accessory tool mode when an accessory tool is attached to the wet extractor.

Referring still to FIG. 30A, liquid management assembly 3000 also includes an output valve assembly 3037 that has an inlet 3038 in fluid communication with valve chamber outlet 3024. Inlet 3038 opens into chamber 3040 in which a slide valve 3042 is slidably disposed. Slide valve chamber 3040 has a first outlet 3044 and a second outlet 3046. The first outlet 3044 is adapted to be connected to one or more nozzles 3302 (FIG. 33B) that are positioned to spray the pressurized fluid directly or indirectly onto a floor. In the embodiment of FIG. 30A, this connection is provided through an intermediate nozzle outlet 3056, but such an intermediate attachment point need not be provided (such as shown in FIG. 33B). Although valve 3042 is shown as a slide valve in the accompanying figures, it will be appreciated by those of ordinary skill in the art that other types of valve (such as a rotating valve) may be used with the present invention.

The second output valve assembly outlet 3046 is adapted to be connected to a detachable accessory tool by way of the tool's attachment plug 3058. To facilitate this attachment, outlet 3046 preferably leads to a tool hose plug 3048 that attaches to a matching hose plug receptacle 3049 in the tool attachment plug 3058 when it is inserted into the wet extractor. Plug 3048 and receptacle 3049 may comprise any hose attachment system that provides a fluid communication path when connected. In a preferred embodiment, plug 3048 comprises a simple cylindrical plug and receptacle 3049 comprises a slightly larger cylindrical bore. One or both of plug 3048 and receptacle 3049 is preferably provided with a seal, such as an o-ring 3051, to make the connection fluid-tight.

The position of valve 3042 determines whether the incoming pressurized fluid it transmitted to the first outlet 3044 (and hence to the floor) or the second outlet 3046 (and hence to the accessory tool). Because wet extractors are typically operated primarily in the floor cleaning mode, and it is desirable to cut off fluid flow to the accessory tool when it is not installed, it is desirable to have the default position of valve 3042 be the floor cleaning mode. To this end, output valve assembly 3037 is provided with a resilient biasing member, such as spring 3050, that urges valve 3042 into a first position (as shown in FIG. 30A) in which valve 3042 provides a fluid communication path from inlet 3038 to first outlet 3044, and hence to the floor. When valve 3042 is in the first position (i.e., floor mode), a seal blocks fluid communication to second outlet 3046. In a preferred embodiment this seal comprises a pair of o-rings 3055 that form an anti-siphon seal that completely blocks fluid and air passage to second outlet 3046.

When it is desired to attach and operate an accessory tool, slide valve 3042 is moved against the bias of spring 3050, into its second position (i.e., tool mode) to divert the pressurized fluid to tool outlet 3046. A second seal blocks fluid communication to the first outlet 3044 in this position. As with the first seal, the second seal preferably comprises a pair of o-rings 3054 that form an anti-siphon seal that completely blocks fluid and air communication to first outlet 3044. By providing an o-ring 3054 on both sides of outlet 3044, rather than just placing a single seal between outlet 3044 and inlet 3038, the seal fully blocks outlet 3044 and prevents any fluid remaining between outlet 3044 and nozzle 3302 from siphoning out of the system and onto the floor. A single large seal or other sealing device that completely covers outlet 3044 could also be used in lieu of the shown double o-ring design.

In a preferred embodiment, valve 2042 is adapted to change from the floor mode to the tool mode simply by the act of installing the accessory tool plug 3058 into the wet extractor. In this embodiment, no additional steps need to be taken to interrupt the fluid communication path to the floor and open the fluid communication path to the tool. In order to provide this automatic switching feature, accessory tool plug 3058 is provided with a structure, such as plunger 3053, that acts as a valve actuator by pressing on valve 3034 and moving it against the bias of spring 3050 to place it into tool mode. Preferably, plunger 3053 presses against an upper surface 3052 of valve 3042, but it is also envisioned that plunger 3053 or another structure could press against a trigger protruding from the side of valve 3042, pull on valve 3042, or operate valve 3042 through a linkage. Plunger 3053 also may be replaced by a flat surface, in which case top surface 3052 may be shaped to protrude out of output valve assembly 3037 to meet with plug 3058 during engagement with the wet extractor. In an alternative embodiment, in which valve 3042 is actuated by an electrical device such as a solenoid, tool plug 3058 may operate an electrical switch to actuate valve 3042 rather than using a mechanical actuation system as just described.

Figure 33A:
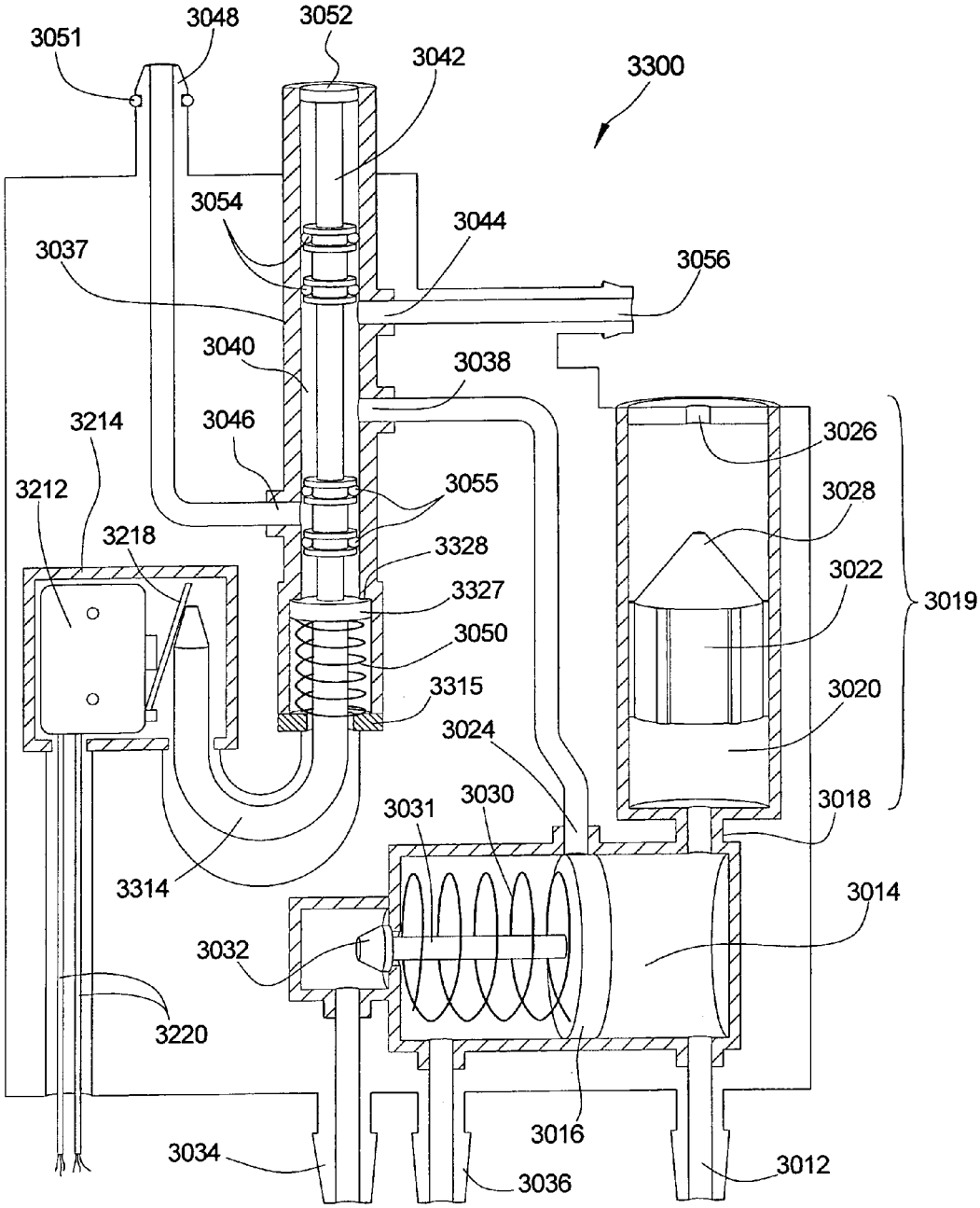
FIG. 33A is a side view of an embodiment of another liquid management assembly of the present invention.
Figure 33B:
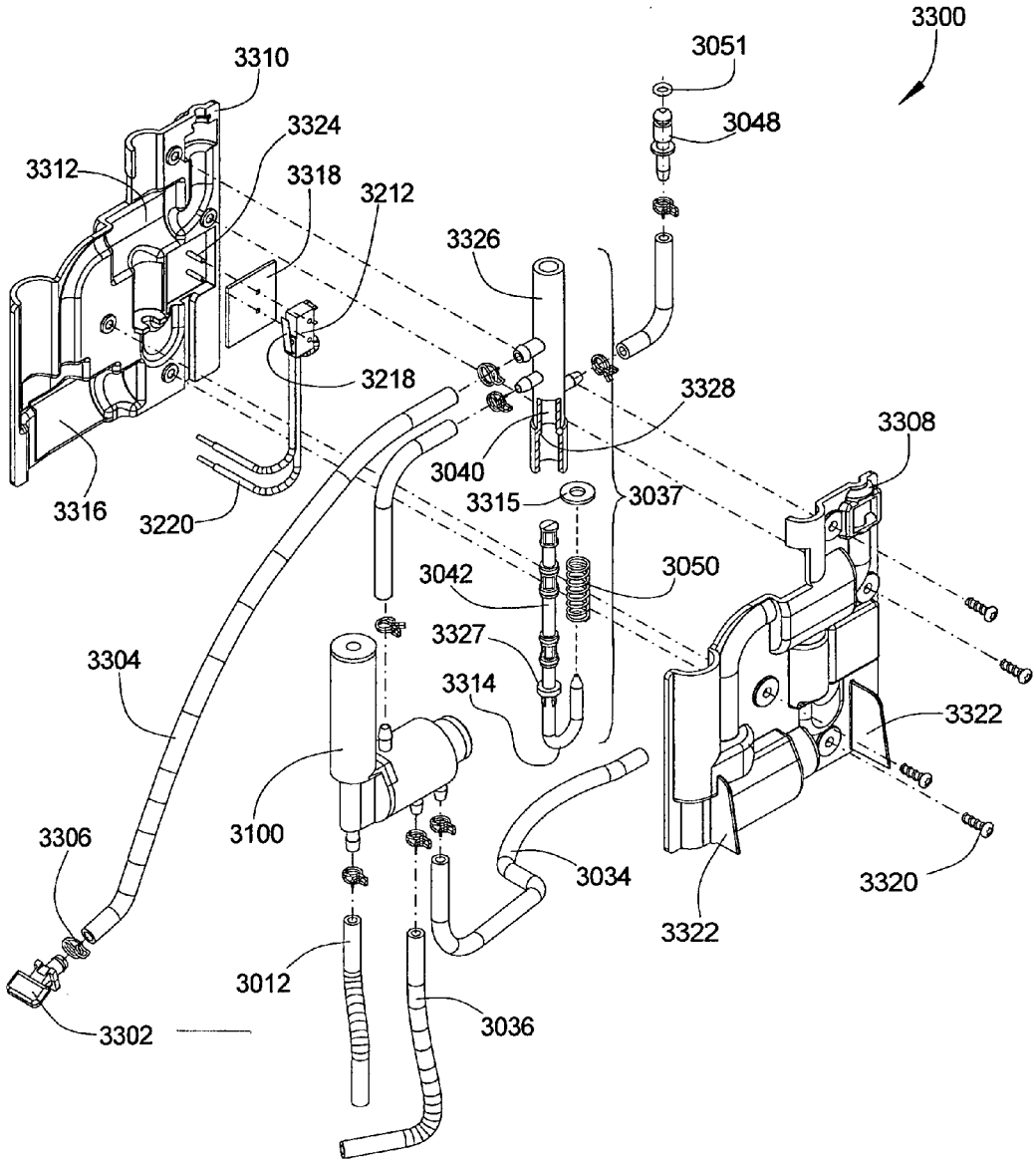
FIG. 33B is an exploded and partially cut away isometric view of the liquid management assembly of FIG. 33A.
Figure 33C:
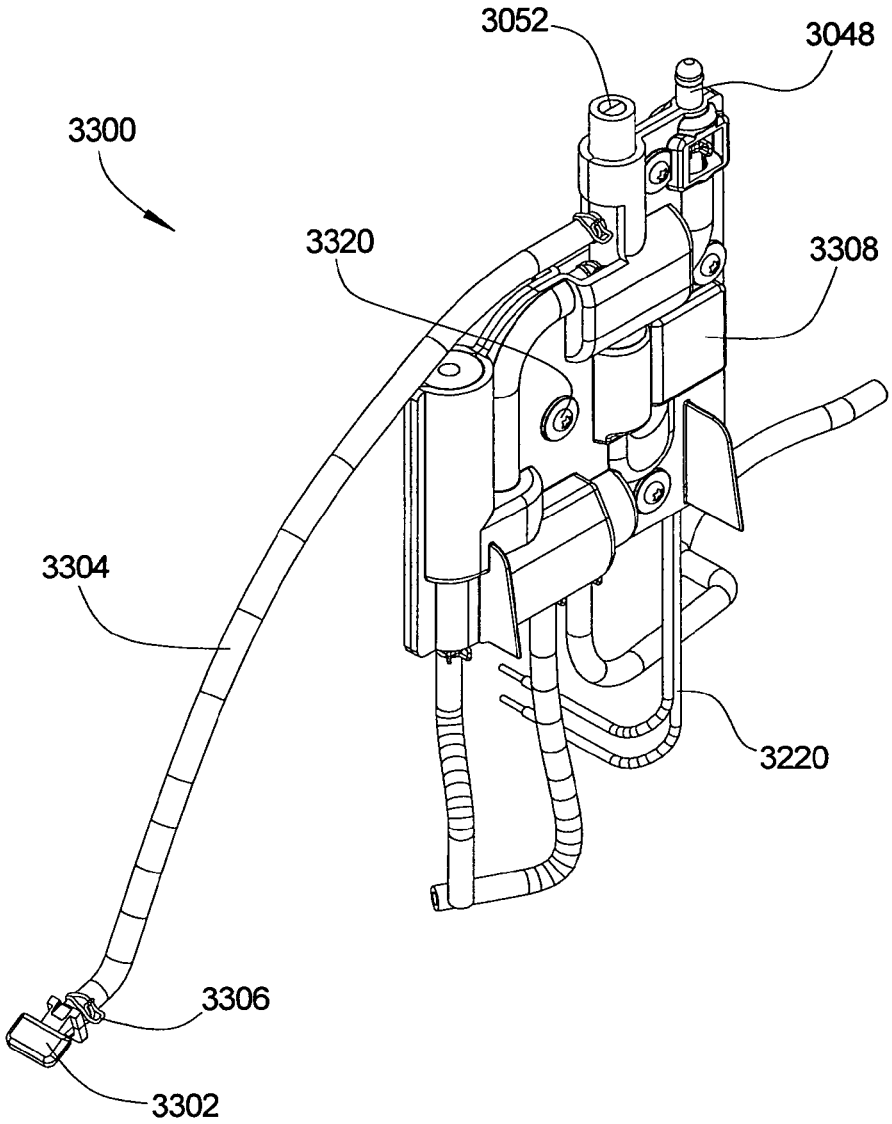
FIG. 33C is the liquid management assembly of FIG. 33B shown fully assembled.

In the embodiment shown in FIG. 30A, and the similar embodiment shown in FIGS. 33A–C, the tool hose attachment structure (e.g., tool hose plug 3048) is positioned separately from the flow switching structure (e.g., valve upper surface 3052). This configuration provides several advantages over structures in which the hose attachment structure and output flow switching structure are combined into a single structure, such as in the '098 patent, the '405 patent and the '300 patent described previously herein. One advantage is the reduced cost of the design of the present invention, which requires simpler structures and lower manufacturing tolerances. Another advantage is ease of operation, as the presently disclosed structure does not require any special operation steps to connect the fluid hose. Still another advantage lies in the fact that the hose seal is decoupled from the valve seal, so that a failure of the seal around the fluid connection point (e.g., between plug 4048 and receptacle 3049) will not cause the output valve assembly 3037 to leak when it is in the floor mode, as may occur in the previously known designs. This final consideration is particularly notable because the fluid connection point on the accessory tool plug 3058 is typically exposed to dust, dirt and other contaminants when it is disconnected from the wet extractor, and these contaminants can accumulate on and degrade the fluid seal when the accessory tool plug 3058 is inserted into the wet extractor. In contrast, in the embodiments of FIGS. 30 and 33A–C, if the seal 3051 around the fluid connection point is damaged, it can be easily replaced without having to replace the entire output valve assembly 3037. Other advantages will be apparent to those of ordinary skill in the art.

Although the separated (i.e., not combined) hose attachment/output valve switching system described thus far is preferred, this does not preclude various embodiments of the present invention from using coaxial, concentric or otherwise combined hose attachment/output valve switching structures, as are known in the art and shown, for example, in the '098, '405 and '300 patents. Such alternative embodiments may include dry-break valves, and systems in which the hose attachment and output valve switching functions are performed either simultaneously or at different times or by different steps. For example, in one alternative embodiment, in which an electric switch is incorporated into the device to automatically operate pump 3002 (as described in more detail below), the device may have an accessory tool plug 3058 having a hose attachment structure that automatically switches the flow output to go to the accessory tool when it is attached. In this embodiment, part of the tool plug, or the fluid valve that is actuated by the tool plug, may be adapted to actuate the electric switch and turn on the pump when the tool plug is inserted into the wet extractor, as described elsewhere herein.

Another feature of the present invention is the inclusion of an electric switch in the liquid management assembly for controlling the operation of pump 3002 during the accessory tool mode. As shown in FIG. 30A, pump 3002 is operated by a main switch 3003 that selectively activates pump 3002. During operation on a floor, the wet extractor operator selectively closes switch 3003 whenever the operator desires deposit cleaning fluid. In order to make operation convenient to the operator, switch 3003 is preferably located in the wet extractor handle. In order to prevent inadvertent activation of switch 3003, a cutoff switch 3005 may be placed in the wet extractor to deactivate switch 3003 whenever the handle is folded, as described elsewhere herein. As noted before, this system reduces the complexity of the device by eliminating the requirement for a manually operated valve (either mechanical or electric), and increases pump life by only activating pump 3002 during actual fluid deposition in the floor cleaning mode. This system also eliminates high "dead head" pressures, and the accompanying strain on the fluid system components and connections, that occur when the pump operates against a closed passage without being able to move fluid.

Although this embodiment of the invention has numerous advantages with regard to operation in floor cleaning mode, in some embodiments switch 3003 may not be easily operated when the operator is using an accessory tool. Although this inconvenience may be overcome by incorporating an electric switch in the accessory tool, similar to the manner shown in U.S. Pat. No. 5,400,462, such a solution is undesirable because it increases the cost of the device and, more importantly, introduces an electrocution hazard. It has been discovered, however, that this inconvenience can be overcome by incorporating a separate automatic pump activating switch directly into the liquid management assembly 3000. In this embodiment of the invention, whenever the tool accessory plug 3058 is installed in the wet extractor and engaged with the liquid management assembly 3000, pump 3002 is automatically activated. Fluid flow is then controlled locally at the accessory tool by a trigger valve, such as a pinch valve, slide valve, or the like located in the accessory tool or tool handle. Referring now to FIGS. 32 and 33A–C, various additional embodiments of the invention having automatic pump switches will now be described.

Figure 32:
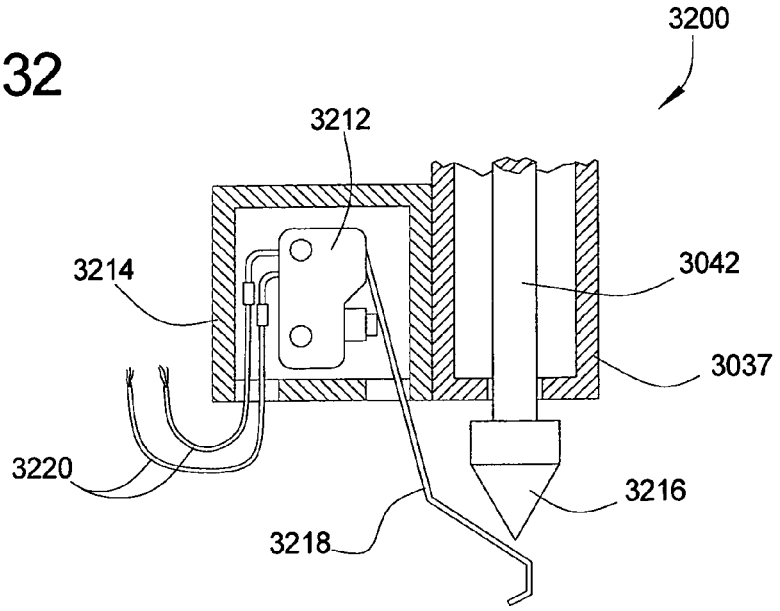
FIG. 32 is a cutaway side view of an embodiment of a pump switch assembly of the present invention.

Referring now to FIG. 32, there is shown a side view of an automatic pump switch assembly 3200 that may be integrated into the liquid management assembly 3000 of FIG. 30A. The pump switch assembly 3200 comprises an electrical switch 3212 that is positioned to be activated by a switch plunger 3216 attached to valve 3042. Switch 3212, which may be a relay, a microswitch or any other conventional electric switch, is wired to operate pump 3002 regardless of the position of the device's handle switch 3005 or main pump switch 3003 (see FIG. 30A). Switch 3212 may also be wired to simultaneously activate a vacuum source as well. In this embodiment, switch plunger 3216 comprises or is positioned on an end of valve 3042 opposite the surface 3052 that is pressed by plunger 3052. In alternative embodiments, plunger 3216 may be located elsewhere, such as on a trigger extending from the side of valve 3042, or plunger may be replaced by (or work in conjunction with) a mechanical linkage or other device. Although switch 3212 preferably is operated indirectly by the accessory tool plug 3058 by way of valve 3042, in other embodiments, it may be directly operated by accessory tool plug 3058 itself. For example, switch plunger 3216 may be located on tool plug 3058 itself. Such alternative configurations are acceptable, provided they do not pose an electrical shock hazard.

Various steps can be taken to prevent switch 3212 from being contaminated with fluids or dirt. For example, switch 3212 is preferably encased in a housing 3214 that protects the switch from contact with fluids. While housing 3214 is designed to prevent most fluid from dripping or splashing onto switch 3212, housing 3214 need not be fluid-tight, and it may be sufficient to simply orient the openings in the housing downward to prevent contact with fluids. In addition, the switch wires 3220, which provide an electrical connection to pump 3002, may be looped as shown, to form a drip-stop that prevents fluid from flowing along wires 3220 to switch 3212. In order to further isolate switch 3214 from potential contact with fluids, switch 3212 may be operated by way of a switch lever 3218 that projects out of housing 3214 with its end positioned in the path of slide valve 3042.

When valve 3042 is actuated to divert pressurized water to the outlet 3046, as described above, the switch plunger 3216 engages with switch lever 3218 to activate switch 3212 and turn on pump 3002. In this embodiment of the invention, all of the necessary functions to activate a detachable accessory tool—such as attaching the fluid hose, switching the fluid valve to operate in tool mode, and activating the pump—can be integrated into a single step of inserting the accessory tool plug into the wet extractor. Furthermore, this embodiment provides a highly centralized liquid management assembly 3000 that can be formed as a unit and easily placed into the wet extractor during assembly.

FIGS. 33A–C depict another embodiment of a liquid management assembly 3300 having an integrated automatic pump switch. Assembly 3300 operates in substantially the same manner as assembly 3000 described with reference to FIG. 30A, and therefore the same reference numerals are used where appropriate. The integrated electric switch 3212 of assembly 3300 is operated by a J-hook 3314 that extends from the bottom of valve 3042. In this embodiment, J-hook 3314 helps prevent any fluids that might escape downward from valve chamber 3040 past valve seals 3055 from shorting out or contaminating integrated switch 3212.

Instead, any such leaking fluids descend to the bottom of J-hook 3314 and harmlessly drip away. In other respects, the embodiment of FIGS. 33A–C is essentially the same, at least in operation, as the embodiment of FIG. 30A.

As previously shown with reference to FIG. 31, various parts of the liquid management assembly of the present invention can be constructed as joined units. In the case of the embodiment of FIG. 31, the main flow valve 3016 and its associated parts are joined with the priming assembly 3019. In other embodiments, various other parts of the liquid management assembly can be joined together, and in a most preferred embodiment, essentially all of the liquid managing parts of the wet extractor are assembled as a conjoined unitary structure. Such an embodiment will now be described with reference primarily to FIGS. 33B and 33C, which show exploded and assembled views, respectively, of an embodiment of assembly 3300 of FIG. 33A. When constructed in this manner, assembly 3300 can be easily incorporated into a wet extractor during assembly and replaced as a compact modular unit.

As shown in FIG. 33B, assembly 3300 comprises various operating parts, including an integral flow valve/priming assembly 3100, an output valve assembly 3037, a switch 3212 and a hose plug 3048. These parts are fluidly joined to one another by numerous hoses 3304 and hose clamps 3306, and the parts and hoses are sandwiched between first and second shell halves 3308 and 3310. Shell halves 3308 and 3310 may be glued or otherwise bonded together, but are preferably held together by one or more screws 3320. Shell halves 3308 and 3310 may also be formed or provided with locating ribs 3322 or other mounting points that are used to hold assembly 3300 in the proper location in the wet extractor.

In order to hold the parts and hoses in their desired positions, one or both of shell halves 3308 and 3310 are formed with various pockets 3312 and 3316 that contain the parts. One or both of shell halves 3308 and 3310 also may be provided with locating pins 3324 to help hold the parts in their proper locations. In the embodiment of FIG. 33B, insulation or padding 3318 is also provided to reduce shock on switch 3212 and hold it more firmly in place to ensure consistent operation. Also in the embodiment of FIG. 33B, pocket 3312 is shaped to hold spring 3050 and retaining washer 3315 in place in valve assembly 3037, which eliminates the need to provide valve assembly 3037 as a sealed unit. During installation, valve 3042 is inserted into valve housing 3326 until shelf 3327 abuts internal shelf 3328 in chamber 3040. Spring 3050 is then installed over J-hook 3314, followed by washer 3315. When inserted into pocket 3312, spring 3050 and washer 3315 are retained by a shelf 3330.

Although the embodiment of FIGS. 33B and 33C is shown having various parts captured between shell halves 3308 and 3310, in alternative embodiments, a unitary assembly of the present invention may be formed from various interlocking parts, parts that are bonded or fastened to one another, combinations of bonded, fastened or captured parts, and so on. Preferably, the present invention uses an inexpensive and compact series of valves, springs, floats and seals to control the fluid flow, prime the pump and prevent unwanted siphoning and provides an improved liquid management assembly that eliminates the expense and bulk of conventional devices. In one embodiment, the liquid management assembly 2610 of FIG. 26 can easily fit into a space less than about 6"×4.75"×1.5", and even more compact designs are possible.

Figure 33D:
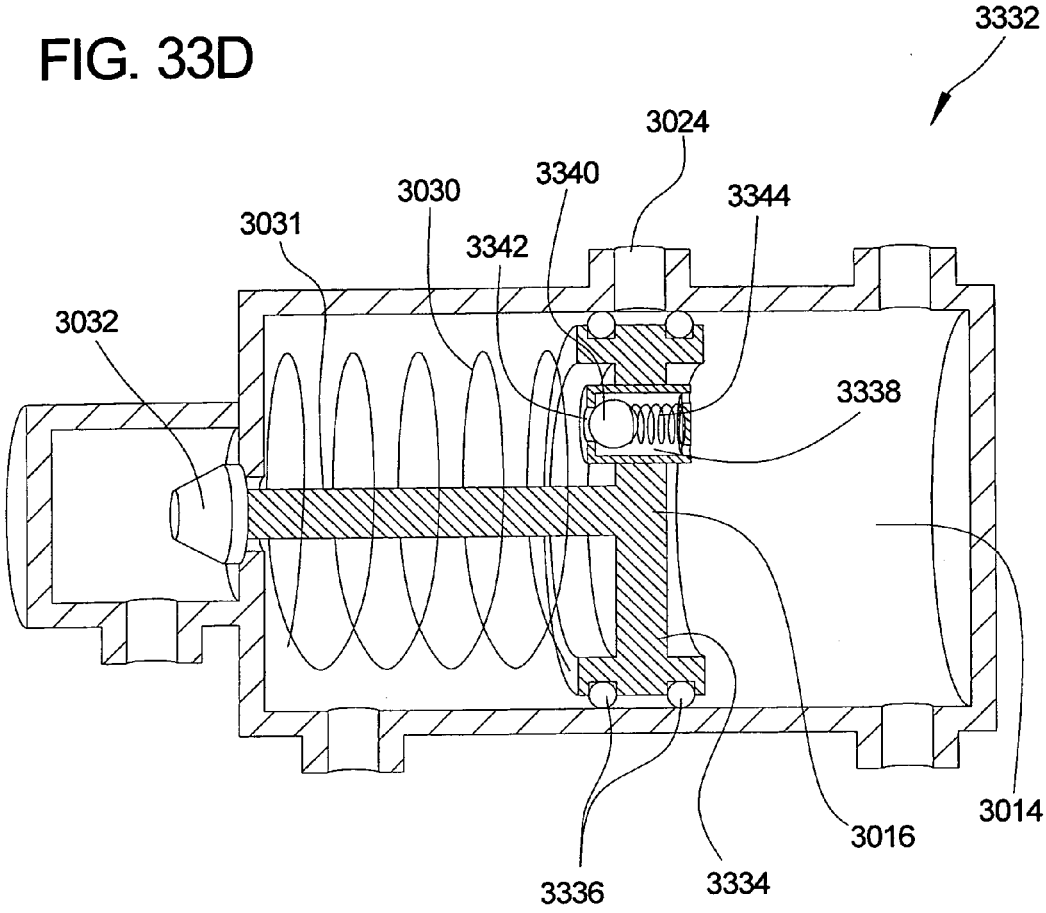
FIG. 33D is a cutaway side view of another embodiment of a flow valve of the present invention.

Referring now to FIG. 33D, an alternative flow valve assembly 3332 for the embodiment of FIG. 33A is shown. Of course, assembly 3332 may also be used with any of the other liquid management assemblies described herein, and may be integrally formed with other parts, such as priming assembly 3019, as shown in the embodiment of FIG. 31. Assembly 3332 comprises a flow valve 3016 slidably disposed in a flow valve chamber 3014, and a detergent valve 3032 that is attached to flow valve 3016 by a pushrod 3031. Assembly 3332 is installed in the fluid circuit as described herein, and the parts are essentially identical to those described previously herein, but with two additional features. The first additional feature is that flow valve 3016 comprises a rigid piston body 3334 that is provided with a pair of o-rings 3336 to seal flow valve chamber 3014, rather than a flexible cup-like structure as shown in FIG. 31. This construction has been found to provide improved sealing to prevent air or fluid from escaping out of first outlet 3024 when the valve is off.

Another additional feature of the embodiment of FIG. 33D is a check valve 3338 located in the face of flow valve 3016. Check valve 3338 comprises a sliding ball 3340 or piston that can be moved to abut and seal a corresponding hole 3342, and is held in the closed position by a light spring 3344. Check valve 3338 prevents fluid from passing from flow valve chamber 3014 into the space behind flow valve 3016 (i.e., into the space between flow valve 3016 and detergent valve 3032), but spring 3344 is light enough to allow air to evacuate from behind flow valve 3016 into flow valve chamber 3014 when the device is priming. Air that passes through check valve 3338 escapes through flow valve chamber 3014 and priming assembly 3019. Of course, other check valve configurations, such as a rubber flapper door, also may be used. The inclusion of check valve 3338 and o-rings 3336 has been found to improve priming of the system, especially during startup, however these features are not required with the present invention.

The present invention also overcomes the inconvenience of having to perform multiple operations on a device to attach and activate an accessory or spot cleaning tool. In a most preferred embodiment, the operator can attach the accessory tool fluid and vacuum hoses, shut off fluid and vacuum flow to the floor, divert these flows to the accessory tool, and activate the fluid pump to provide pressurized fluid to the accessory tool in a single action. A preferred embodiment of an accessory tool plug and tool plug outlet system that can be used to simultaneously provide these functions will now be described with reference to FIGS. 34A through 35C.

Figure 34A:
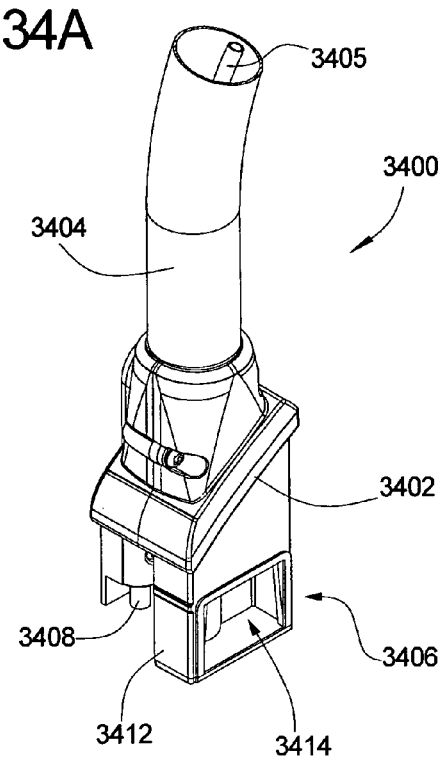
FIG. 34A is a partially cut away fragmented perspective view of an embodiment of an accessory tool plug of the present invention.
Figure 34B:
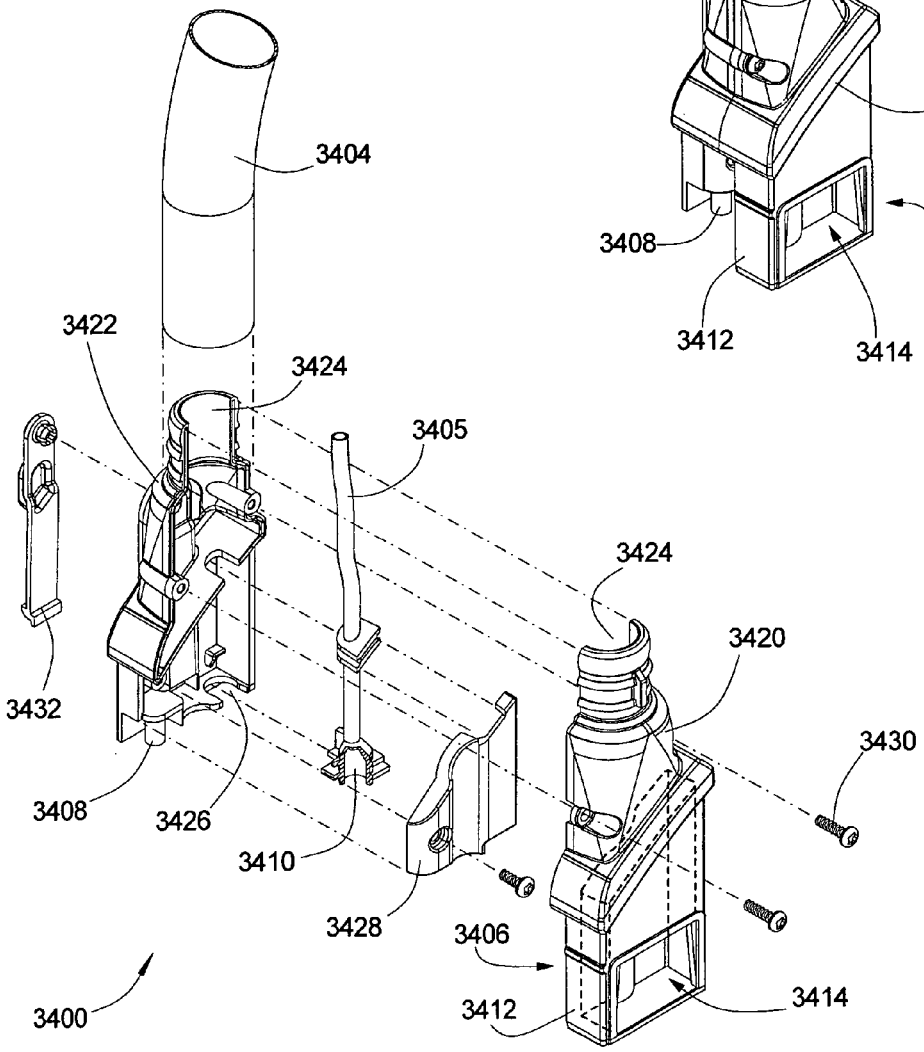
FIG. 34B is an exploded view of the accessory tool plug of FIG. 34A.

A preferred embodiment of an accessory tool plug 3400 is depicted in FIGS. 34A and 34B. Plug 3400 comprises a rigid body 3402 attached to one end of a flexible vacuum hose 3404. The other end of vacuum hose 3404 is attached to an accessory tool, which may be a conventional accessory tool or an accessory tool as described elsewhere herein (see, e.g., FIGS. 45A–50D). A flexible cleaning solution hose 3405 is disposed within (or, alternatively, outside) vacuum hose 3404 and extends between rigid body 3402 and the accessory tool. Rigid body 3402 has three main functional components: a vacuum diverter 3406, a valve actuator 3408, and a fluid receptacle 3410 (which is shown partially cut away in FIG. 34B). Vacuum diverter 3406 comprises one or more blocking surfaces 3412 that block the vacuum path between the wet extractor's floor vacuum nozzle and the recovery tank, and one or more bypass inlets 3414 that provide a vacuum path between the recovery tank and vacuum hose 3404, as will be described in more detail with reference to FIG. 35C. Valve actuator 3408 is shaped to actuate a fluid output valve assembly (3510 in FIG. 35A), and fluid receptacle 3410 is adapted to fluidly connect to a tool hose plug (3508 in FIG. 35A), as previously described with reference to FIG. 30A. Preferably, the fluid output valve assembly and tool hose plug are part of a unitary liquid management assembly, as shown in FIGS. 33A–C.

Plug 3400 may be manufactured or assembled in any way or by any method, but is preferably formed from two housing halves 3420 and 3422. Housing half 3420 forms vacuum diverter 3406 and has hollow vacuum passage therethrough, as shown by broken lines in FIG. 34B, extending from bypass inlet 3414 to an outlet opening 3424. The other housing half 3422 is molded to form valve actuator 3408, and has a recessed cavity 3426 that is shaped to hold a separately molded fluid receptacle 3410. Fluid receptacle 3410 is attached to fluid hose 3405, which extends out through opening 3424 and is contained within vacuum hose 3404 when assembled. An upper portion of housing half 3422 may also form part of the vacuum passage between bypass inlet 3414 and opening 3424. A plate 3428 holds fluid receptacle 3410 in place. A number of screws 3430 may be used to hold the parts together, or the parts may be bonded or shaped to snap-engage with one another without separate fasteners. A release latch 3432 is preferably attached to the rigid body 3402, preferably on the second housing half 3422 so that it does not obstruct bypass inlet 3414.

Although the embodiment of FIG. 34A shows valve actuator 3408 and fluid receptacle 3410 being positioned outside vacuum diverter 3406, one or both of these components may be located partially or entirely within vacuum diverter 3406. Also, valve actuator 3408 can be formed at virtually any location on rigid body 3402.

Referring now to FIG. 35A, the wet extractor housing 3500 is provided with a plug outlet 3502 having a first opening 3504 and a second opening 3506. First opening 3504 contains tool hose plug 3508 (such as plug 3048 in FIG. 30A) and an operable portion of fluid output valve assembly 3510 (such as the upper surface 3052 of assembly 3037 in FIG. 30A). These parts are recessed in opening 3504 and are shown in broken lines. Second opening 3506 opens to a vacuum path between the floor vacuum inlet nozzle 3512 (which has an inlet slit proximal to the floor), and recovery tank 3514. Floor vacuum inlet nozzle 3512 and recovery tank 3514 may be constructed according to various embodiments of the invention described elsewhere herein, or may have a conventional construction. A vacuum source (not shown) applies a vacuum to recovery tank 3514 to draw air therethrough.

Plug outlet 3502 is also provided with a cover 3516 having a sealing surface 3518 (preferably a foam or rubber pad or gasket) on the bottom side thereof. Cover 3516 may be hinged, slidably engaged, or otherwise attached to housing 3500. When cover 3516 is closed, sealing surface 3518 covers plug outlet 3502 and contains the vacuum within housing 3500. In one embodiment, cover 3516 (and sealing surface 3518) also seals first opening 3504 from second opening 3506 by abutting a dividing wall 3524 between the two, which eliminates the need to make first opening 3504 vacuum-tight to prevent unwanted vacuum leaks. Cover 3516 also may be equipped with tabs, hooks or fasteners (not shown) that engage with housing 3500 to hold it in engagement therewith (preferably snap engagement) when closed. Cover 3516 also may be provided with similar devices to engage with accessory plug 3400 to help retain plug 3400 when it is installed in housing 3500.

FIG. 35B shows the wet extractor when cover 3516 is closed and the device is in floor cleaning mode. In this configuration, the vacuum path 3520 travels from floor vacuum inlet nozzle 3512 and into recovery tank 3514 by way of opening 3522. Opening 3522 comprises an open passage through a vacuum path outlet (2442 in FIG. 24) in the housing 3500 and an adjoining opening (2712 in FIG. 27A) into recovery tank 3514. When it is desired to change from floor cleaning mode to accessory tool mode, accessory plug 3400 is inserted into plug outlet 3402, as shown in FIG. 35C. When tool plug 3400 is installed, surface 3412 blocks the vacuum path between floor vacuum inlet nozzle 3512 and opening 3522 into recovery tank 3514 and diverts the vacuum path 3520 to travel from the accessory tool to recovery tank 3514. This novel plug/outlet configuration provides a simple one-step connection between the accessory tool and the wet extractor.

Figure 36:
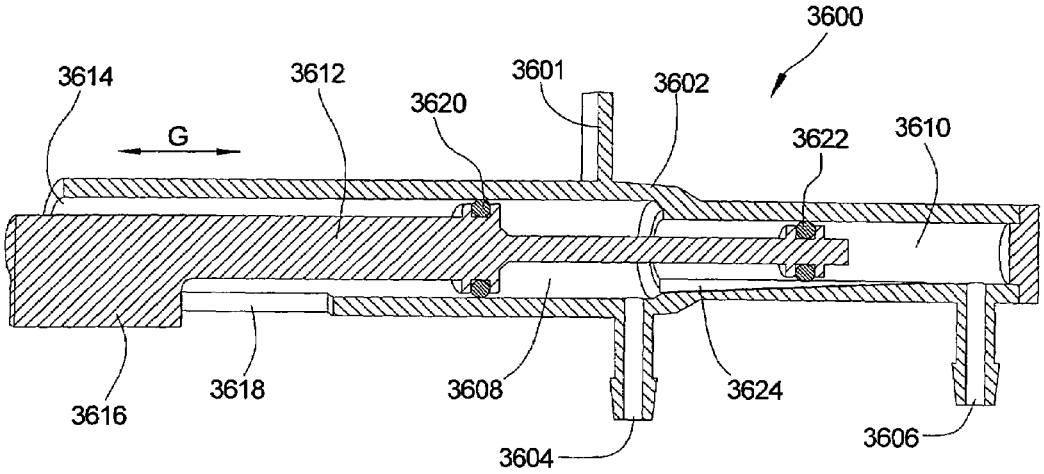
FIG. 36 is a cut away side view of an embodiment of a detergent valve assembly of the present invention.
Figure 37:
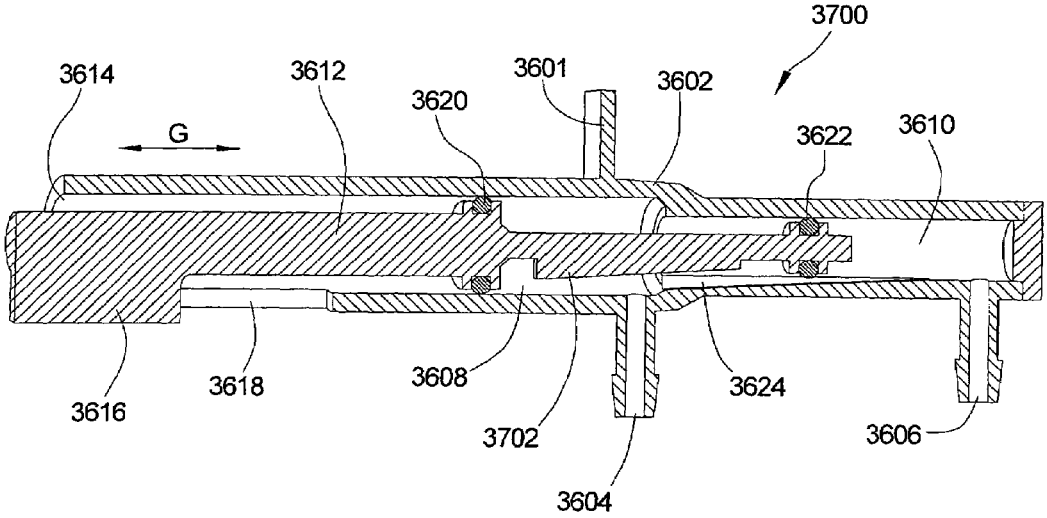
FIG. 37 is a cut away side view of another embodiment of a detergent valve assembly of the present invention.

Another aspect of the present invention is directed towards an infinitely adjustable detergent concentration valve that may be used to control the amount of detergent that is mixed with the fresh water of a wet extractor. Various preferred embodiments of a detergent valve of the present invention will now be described with reference to FIGS. 36–38. Except as otherwise noted, the detergent valves depicted in FIGS. 36 and 37 are substantially identical, and the same reference numerals are used where appropriate. These detergent valves may be used with the liquid management assembly shown elsewhere herein, or with conventional fluid systems.

Referring specifically to FIG. 36, a preferred embodiment of a detergent valve assembly 3600 is shown. Detergent valve assembly 3600 comprises a housing 3602 having a detergent inlet 3604 and a detergent outlet 3606. Detergent valve housing 3602 may have one or more flanges 3601 or other surfaces to facilitate its attachment in a wet extractor.

Detergent valve 3600 can be located, in a fluid flow sense, anywhere between the detergent tank and the mixing manifold 3010 where it mixes with water from the supply tank 2414. As noted before with reference to FIG. 30A, the detergent valve is preferably positioned in the fluid path between the detergent tank (3006 in FIG. 30A) and the liquid management assembly (3000 in FIG. 30A). In this embodiment, detergent inlet 3604 is fluidly attached to a detergent supply tank 3006 (FIG. 30A) and detergent outlet 3606 is attached to a detergent inlet 3034 (FIG. 30A) of a liquid management assembly 3000, where the flow of detergent can be selectively stopped and started by valve 3032 (FIG. 30A). After passing through valve 3032, the detergent flow path continues to a mixing manifold 3010 (FIG. 30A), where it mixes with fresh water from a supply tank 3004 (FIG. 30A). One notable advantage to locating the detergent valve in the gravity-fed portion of the fluid path as shown in FIG. 30A, rather than in the portion of the fluid path that is pressurized by the pump, is that it is unnecessary to provide pressure-proof seals in the detergent valve. This system also uses the negative pressure side of the pump to help pull detergent through the system to assist with the detergent's gravity feed.

Various alternative embodiments of this configuration are possible with the present invention. For example, a device other than valve 3032 may be used to control the flow of detergent, or valve 3032 can be omitted or placed between the detergent tank 3006 and the detergent valve assembly 3600. In another alternative embodiment, detergent outlet 3606 can lead directly to a mixing manifold to mix with water from a supply tank. In still another embodiment, one or more check valves (not shown) can be positioned in the detergent flow path to prevent backflow.

Detergent valve assembly 3600 has first and second bores 3608 and 3610 that are arranged in a substantially co-linear fashion. Bores 3608 and 3610 are also preferably generally concentric (i.e., sharing a common centerline), but this is not required. A plunger 3612 is inserted into detergent valve assembly 3600 through a plunger opening 3614 located at the end of first bore 3608 that is opposite second bore 3610. Plunger 3612 is slidably movable within detergent valve assembly 3600 in the direction shown by the double-headed reference arrow G. Plunger 3612 may also be shaped with a tang 3616 that engages with a slot 3618 in housing 3602, which prevents rotation of plunger 3612 relative to housing 3602, which may be particularly useful when bores 3608 and 3610 are made with a generally cylindrical shape. Rotation of plunger 3612 may also be prevented by making one or both of bores 3608 and 3610 generally non-circular in cross section, or by offsetting the centerline of the second bore 3610 relative to the centerline of the first bore 3608.

As shown in FIG. 36, detergent inlet 3604 is located between plunger opening 3614 and bore 3610. Plunger 3612 has a first fluid seal 3620, which is preferably an o-ring, that prevents fluid passage from inlet 3604 to plunger opening 3614. As such, detergent entering first bore 3608 through inlet 3604 is directed into second bore 3610 and towards outlet 3606. Although it is preferred for first fluid seal 3620 to be attached to plunger 3612 to move therewith, it may alternatively be fixedly positioned in bore 3608.

Plunger 3612 is adapted to control the amount of detergent that passes from detergent inlet 3604 to detergent outlet 3606. To do so, plunger 3612 is equipped with a second fluid seal 3622, which is preferably an o-ring, that is positioned on a portion of plunger 3612 that extends into second bore 3610. Second bore 3610 has a tapered slot 3624 that is deepest proximal to the end of bore 3610 closest to first bore 3608, and eventually tapers to nonexistence as it extends along the length of second bore 3610 towards detergent outlet 3606. Tapered slot 3624 may have a true taper (i.e., a continuous gradual slope), which is preferred, or a stepped profile in which its depth decreases by discrete incremental amounts. The remaining walls of second bore 3610 (i.e., those that do not form tapered slot 3624) form a cross-sectional shape that is continuous along the length of second bore 3610, and generally coincides with the shape of second fluid seal 3622. In this manner, second bore 3610 is provided with a variable cross-sectional shape that increases in area as a function of distance from outlet 3606 along the second bore 3610, as the taper deepens.

The length of tapered slot 3624 is selected so that, when plunger 3612 is in a fully inserted position (all the way to the right, as seen in FIG. 36), second fluid seal 3622 is positioned past the end of tapered slot 3624, and therefore fully seals the passage between detergent inlet 3604 and detergent outlet 3606 to prevent the passage of detergent therethrough. This is the detergent "off" position. As plunger 3612 and the attached second fluid seal 3622 are retracted from the fully inserted position (i.e., moved leftward in FIG. 36), second fluid seal 3622 slides along tapered slot 3624, and thereby allows an increasing amount of detergent to pass through tapered slot 3624 to detergent outlet 3606. This occurs because second fluid seal 3622 generally retains its cross-sectional shape, regardless of where it is located relative to tapered slot 3624, and thereby blocks less and less of the total cross section of second bore 3610 at it travels across deeper and deeper portions of tapered slot 3624. The movement of plunger 3612 is blocked at the fully opened position by a stop (not shown), such as a protrusion on the wet extractor housing, to prevent second fluid seal 3622 from passing into first bore 3608.

It will be seen from this discussion that when tapered slot 3624 has a true taper, the amount of detergent allowed past second fluid seal 2622 is essentially infinitely variable between the fully-opened and off positions. When tapered slot 3624 has a stepped profile, discrete detergent passage amounts are provided. Either of these embodiments may be used with the present invention. In another embodiment, shown in FIG. 37, a rib 3702 may be added to the body of plunger 3612 to slide into tapered slot 3624. This rib 3702 may provide added control over the amount of detergent added to the water, help seal the passage between detergent inlet 3604 and detergent outlet 3606, and provide additional resistance to rotation of plunger 3612. The rib 3702 also acts as a broach to physically remove any solidified detergent that may accumulate in the tapered slot 3624 after long periods of inactivity.

Although virtually any sealing device can be used as first and second seals 3620 and 3622, o-rings are inexpensive and perform adequately to prevent unwanted leaking. Furthermore, while the primary function of seals 3620 and 3622 is to control the flow of detergent, it should also be appreciated that seals 3620 and 3622 also provide a friction fit between plunger 3612 and bores 3608 and 3610 that prevents the gravity-induced head pressure of the detergent in the detergent tank from forcing the detergent valve assembly 3600 open. Again, it has been found that simple o-rings can provide a friction fit that prevents unwanted plunger movement, even when the detergent tank is raised substantially above the level of detergent valve assembly 3600.

Although the discussion herein identifies passage 3604 as a detergent inlet and passage 3606 as a detergent outlet, it will be readily appreciated that these may be reversed with respect to the direction of detergent flow. It will also be appreciated that detergent valve assembly 3600 can be oriented in any direction, although it is preferred that assembly 3600 be oriented vertically with plunger opening 3614 at the top. Furthermore, inlet 3604 and outlet 3606 may be positioned on different sides of housing 3602, rather than being on the same side as shown in the figures. Such variations are all within the realm of regular engineering design choice.

Figure 38:
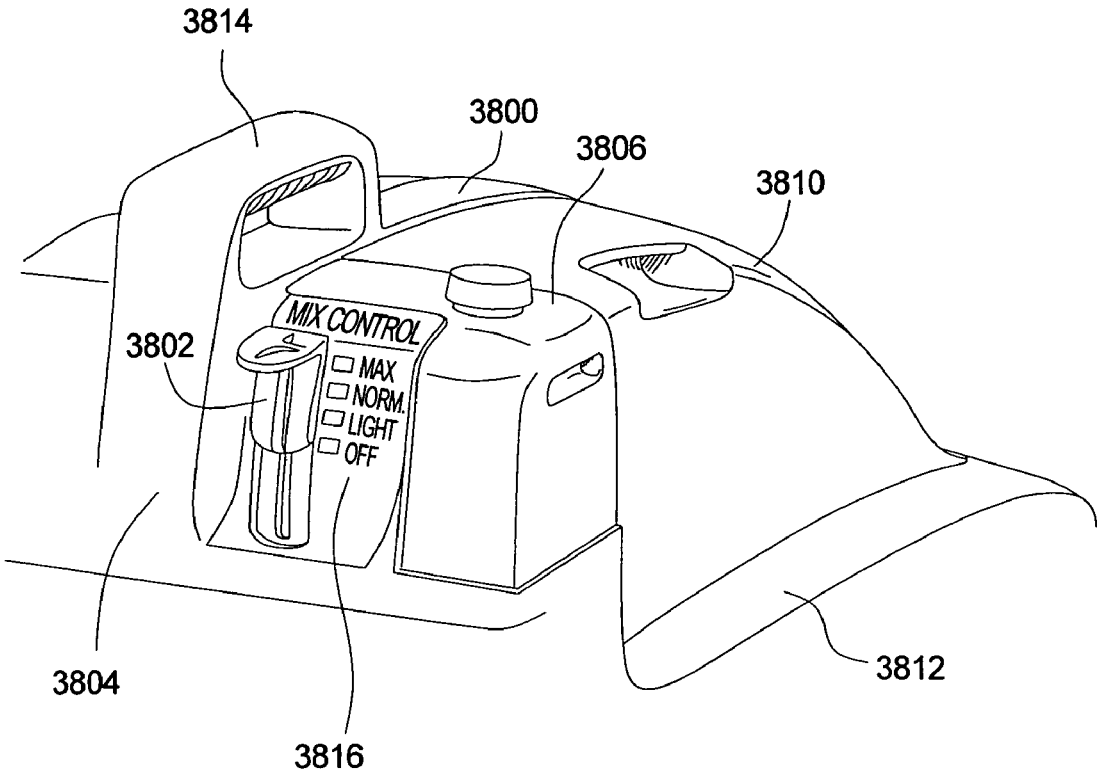
FIG. 38 is a fragmented perspective view of a wet extractor incorporating a detergent valve assembly of the present invention.

Referring now to FIG. 38, the detergent valve assembly 3600 is preferably operated by a slider 3802 located on the outside of a wet extractor housing 3800. Slider 3802 is either mechanically linked to plunger 3612, or, more preferably, slider 3802 and plunger 3612 are monolithically formed as a single unit. Housing 3800 holds slider 3802 in place on tracks, or, if a monolithic plunger/slider unit is used, slider 3802 may be held in place by the plunger's sliding interface within the bores of the detergent valve assembly. In the latter case, housing 3800 may still have a guide to help control the movement of the slider 3802 portion of the unit, and also preferably acts as a bump stop to stop the slider/plunger unit at the fully opened position and prevent the plunger 3612 from traveling too far out of the bores.

In a preferred embodiment, slider 3802 is located on a back face 3804 of wet extractor housing 3800, as shown in FIG. 38. The portion of wet extractor housing 3800 shown in FIG. 38 shows a detergent supply bottle 3806 and a fresh water supply tank 3810 that are inserted into a base assembly 3812 having a lifting handle 3814. An operating handle, like those described elsewhere herein, may also be attached to housing 3800, but is not shown in FIG. 38 for clarity. The wet extractor preferably has the features and construction of the embodiments described throughout the present disclosure, but this is not required.

Slider 3802 preferably is shaped to be easily operated by hand or by foot. Slider 3802 also may be marked with graphics 3816 to indicate the detergent-to-water mixture level, and it is preferred that graphics 2824 be clearly visible when the operator is standing upright. Using this configuration, a user can operate a simple sliding device to control the amount of detergent that is mixed with the fresh water of the extractor, rather than having to operate a rotating device. The user may even control the mixture without bending over by operating slide 3802 with his or her foot. Furthermore, the infinitely variable tapered slot-type device provided by the present invention allows the user to precisely tailor the amount of detergent used, without having to select from discrete concentration levels as required in conventional wet extractors. This provides the user with virtually unregulated control over the amount of detergent that can be mixed with the fresh water.

Still another aspect of the present invention relates to a unique agitation system that may be used in the main housing of a floor cleaning device or an accessory cleaning tool. Although the agitation system described herein is described in the context of a wet extractor, it will be apparent to those of ordinary skill in the art that it may also be used in other devices. In one embodiment, the cleaning device agitator has a mount, an agitator comb that is operatively attached to the mount and adapted to be vertically displaceable relative to the mount in a first linear direction perpendicular (or at least partly perpendicular) to a surface to be cleaned, and a drive assembly adapted to cyclically drive the agitator comb in a second linear direction substantially parallel to the surface to be cleaned without vertically driving the agitator comb. Preferably, the agitator comb is free to float on the surface being cleaned even when it is being driven.

FIGS. 39A through 44D depict various embodiments of linear agitators of the present invention that are usable in the main body of a cleaning device or in a powered accessory tool. Generally speaking, the linear agitator comprises an agitator comb that is operatively attached to a mount in the cleaning device. The agitator comb is adapted to be driven back and forth, relative to the mount, along a first linear direction that is parallel to the surface being cleaned. The agitator comb is also operatively attached to the mount in such a way that it is vertically displaceable relative to the mount (i.e. perpendicular to the surface being cleaned), which allows the agitator comb to "float" on the surface without applying a substantial vertical force to the surface beyond the weight of the agitator comb itself. Preferably, this operative attachment is through a drive assembly located between the agitator comb and the mount, and to which both the agitator comb and the mount are separately attached. As used herein, the term "operatively attached" and variations thereof refer to direct physical attachment (such as by directly fastening of one part to another), indirect physical attachment (such as by attaching two parts together through an intermediate part), physical capture (holding parts together by limiting their relative movement in one or more directions), or any other attachment (e.g., magnetic) that holds the parts in the desired physical relationship with one another.

Figure 39A:
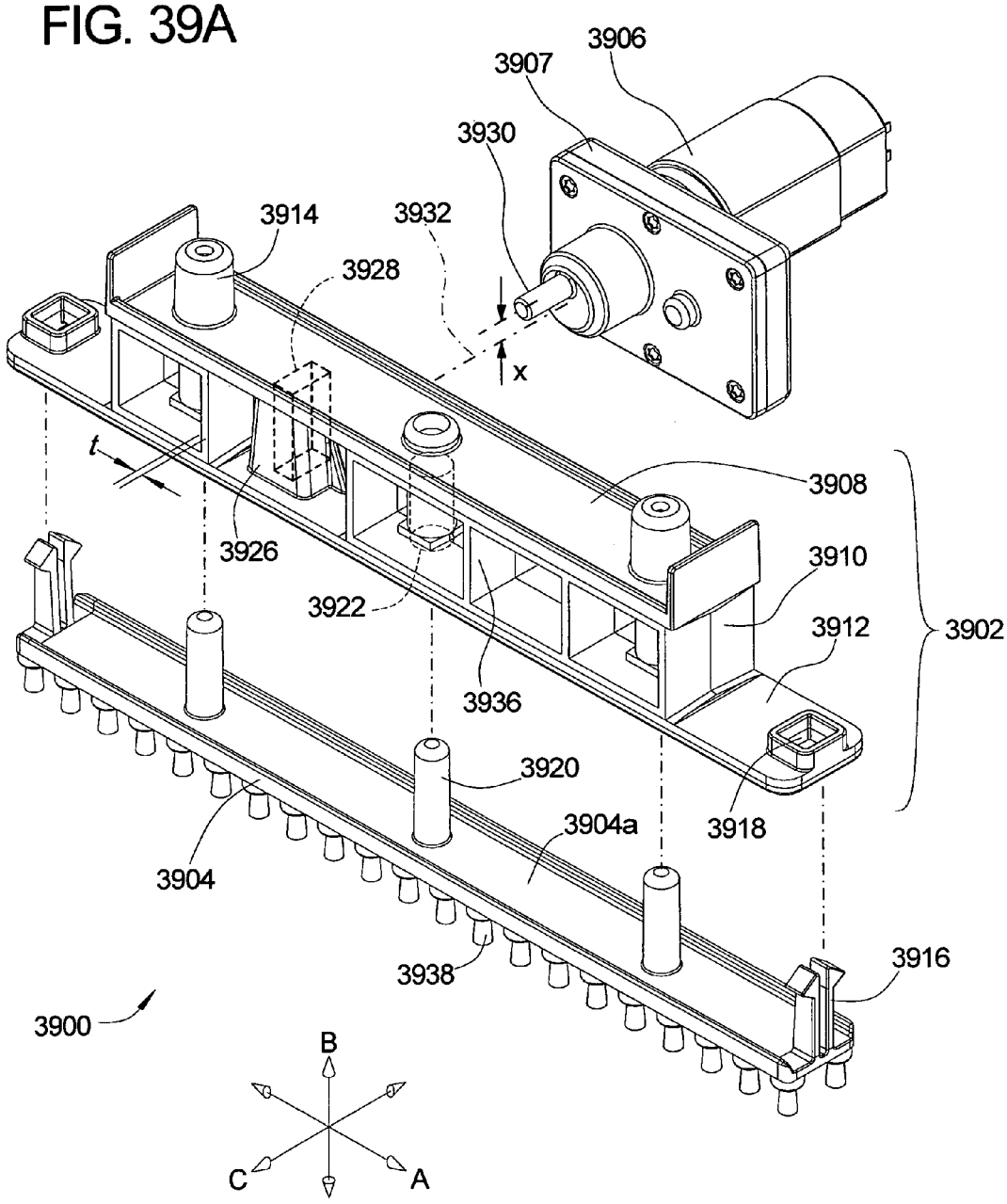
FIG. 39A is a partially exploded isometric view of linear agitator of the present invention.
Figure 39B:
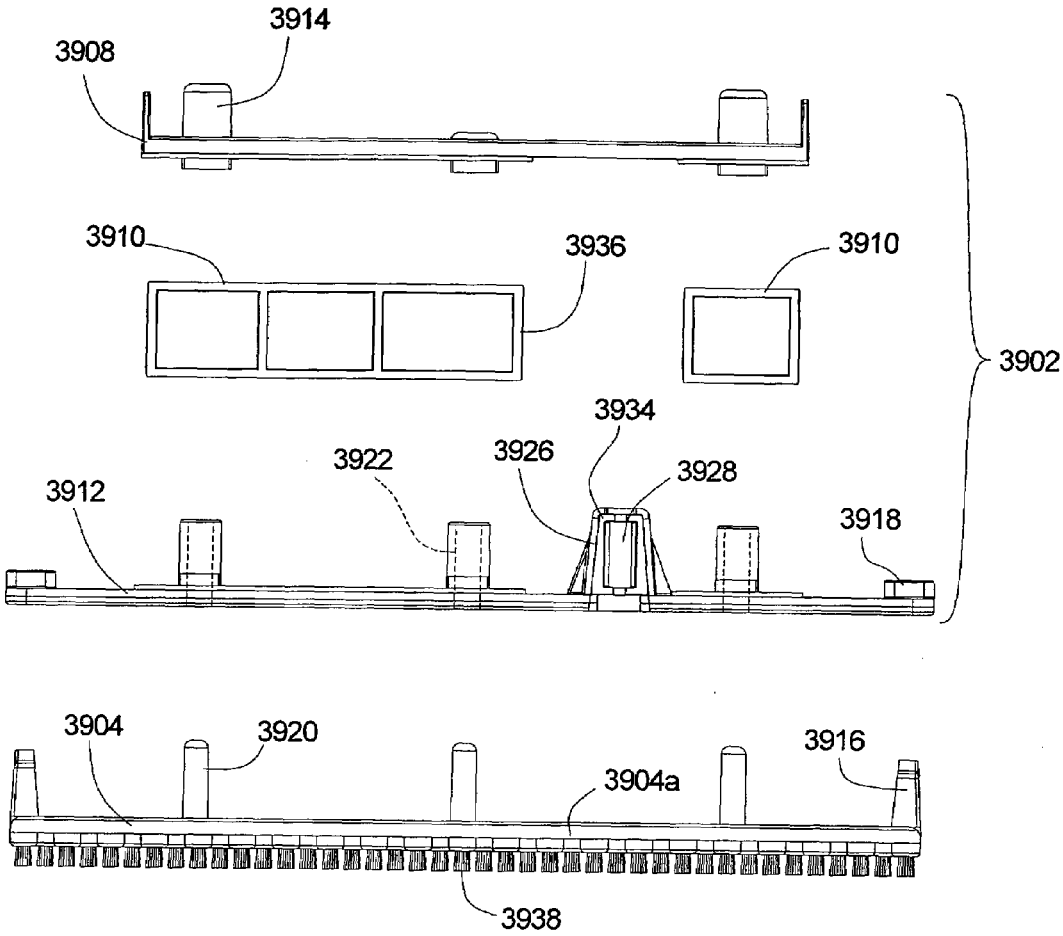
FIG. 39B is an exploded rear view of the linear agitator of FIG. 39A.

Referring specifically to FIGS. 39A–D, in a first preferred embodiment, the agitator comb 3904 is attached to the housing 3901 (FIGS. 39C–D) of a cleaning device by way of a drive assembly 3902. Generally speaking, agitator comb 3904 comprises a rigid base portion 3904*a* (comprising, for example, polypropylene or ABS plastic) to which flexible cleaning bristles 3938 or other agitating devices are attached to extend towards the surface to be cleaned. Although agitator comb 3904 is shown herein as a single piece that extends across substantially the entire width of the cleaning device, it will be appreciated that multiple shorter agitator combs, or multiple full-width agitator combs may be used with the present invention. Drive assembly 3902 is driven, as described in more detail below, in a cyclical side-to-side motion by a drive motor 3906, which may be an electric motor, a turbine drive, or any other type of motor, as are known in the art. In the embodiment of FIG. 39A, drive assembly 3902 comprises three parts: a mounting rail 3908, a flexible connector 3910, and an agitator drive bar 3912 (or drive plate). Mounting rail 3908, flexible connector 3910 and drive bar 3912 are preferably permanently united by mechanical, adhesive or molded-in-place/overmolding attachment. In other embodiments, mounting rail 3908, flexible connector 3910 and drive bar 3912 may be formed integrally, and the mounting rail and/or the drive bar may be omitted.

Figure 39C:
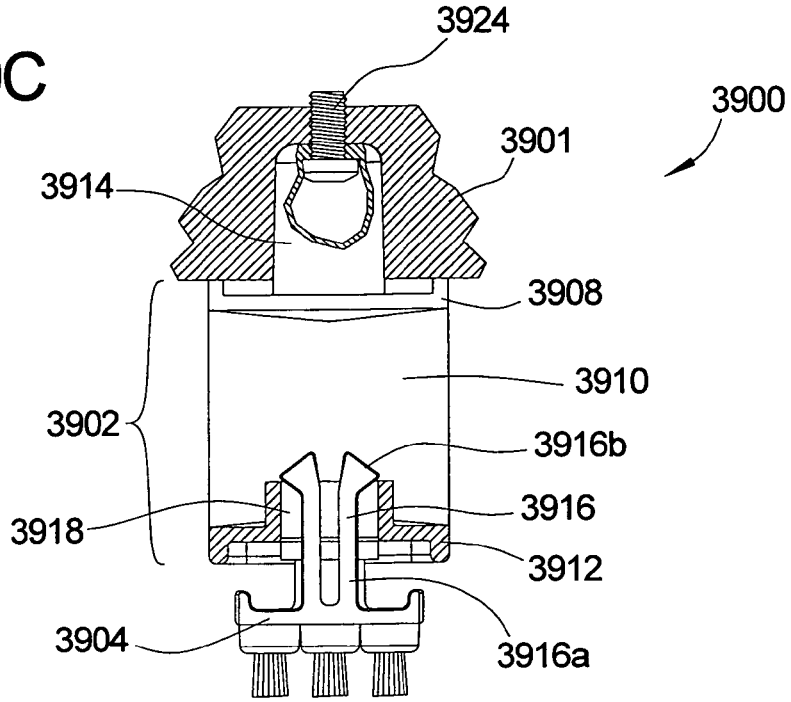
FIG. 39C is a partially cut away side view of the linear agitator of FIG. 39A, shown installed in a device housing and in the extended position.
Figure 39D:
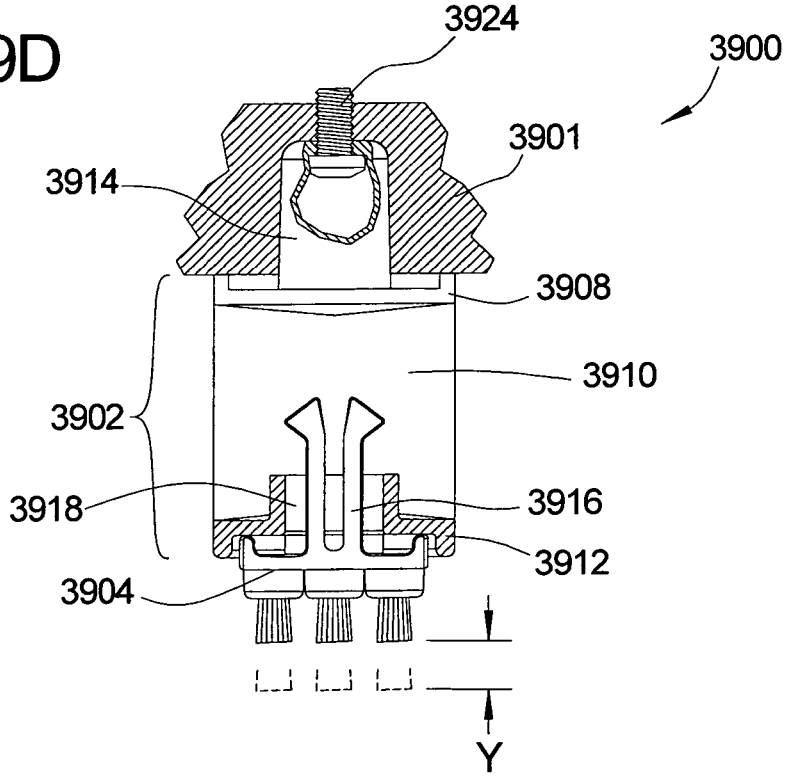
FIG. 39D is a partially cut away side view of the linear agitator of FIG. 39A, shown installed in a device housing and in the retracted position.

It has been found that it is particularly desirable for the agitator comb 3904 to be mounted to the device such that is can "float" on the surface being cleaned without applying a significant vertical force thereto. Alternatively, it can be spring biased to provide a downward force when the housing is located at the desired distance for cleaning. In the present invention, one way of providing this desired "float" is to mount the agitator comb 3904 so that it is vertically displaceable relative to its mounting point on the device to which it is attached (the direction "vertical" being generally perpendicular to the surface being cleaned and shown by arrow B in FIG. 39A). In the embodiment of FIGS. 39A–D, agitator comb 3904 can be isolation mounted such that it is vertically displaceable relative to the mount in at least three ways. One way of displaceably mounting agitator comb 3904 is to rigidly attach mounting rail 3908 to housing 3901, as shown in FIGS. 39C–D and displaceably mount agitator comb 3904 to drive assembly 3902. In the embodiment of FIGS. 39A–D, mounting rail 3908 has mounting posts 3914 that fit into corresponding sockets in housing 3901, and is rigidly (i.e., not displaceably) attached to housing 3901 by threaded fasteners 3924 or the like. Vertical displacement between agitator comb 3904 and drive assembly 3902 is accomplished by equipping agitator comb 3904 with a pair of vertically-extending clips 3916 that fit into corresponding holes 3918 through agitator drive bar 3912. As shown in FIGS. 39C and 39D, clips 3916 are elongated so that agitator comb 3904 can slide vertically relative to agitator drive bar 3912 (and housing 3901) by a float distance Y. While float distance Y may be virtually any distance, float distance Y is preferably at least about 0.125 inches, and more preferably at least 0.250 inches to provide sufficient float on various different surfaces.

The agitator comb 3904 of FIGS. 39A–D may also be provided with certain additional features. For example, agitator comb 3904 is equipped with guide pins 3920 that fit into corresponding holes 3922 in drive assembly 3902 to help guide the movement of agitator comb 3904 as it displaces relative to housing 3901. Mounting posts 3914 are conveniently located directly above holes 3922 to facilitate the insertion of fasteners 3924 to attach mounting rail 3908 to housing 3901. In addition, while clips 3916 are engaged in holes 3918 such that they will not come out under normal use, they are preferably selected to be easily removed from holes 3918 by a user to selectively remove agitator comb

3904 for cleaning, operation without the agitator comb 3904, or replacement with alternative agitator combs that better suit the requirements of the particular surface being cleaned.

In the embodiment shown in herein, clips 3916 are made removable by shaping each clip 3916 as a pair of flexible posts 3916*a* having ramped protrusions 3916*b* at the end thereof. When agitator comb 3904 is pulled away from agitator drive bar 3912, ramped protrusions 3916*b* are pressed towards one another by contact with the inner edges of hole 3918, thereby flexing posts 3916*a* until protrusions 3916*b* move toward one another far enough to allow the clip's removal. The design of such releasable clips 3916 is within the ordinary skill of the art. It should also be understood that, while clips 3916 are shown as internal clips (i.e., clips that are inserted into a hole or opening in the part that they grip), clips 3916 may also be replaced by external clips that wrap around the part that they grip, or any other suitable type of sliding fastener. Any such variations are within the scope of the invention.

Two alternative embodiments for operatively attaching agitator comb 3904 so that it is displaceable relative to housing 3901 are shown in FIGS. 40A and B. In FIG. 40A, agitator comb 3904 is slidably mounted to drive assembly 3902 using clips 3916, as in FIGS. 39A–D, and mounting rail 3908 is also mounted to housing 3901 by a similar set of clips 4002. Like the agitator clips 3916, the drive assembly clips 4002 are elongated to allow vertical displacement between drive assembly 3902 and housing 3901. In this embodiment, the amount of vertical travel is the cumulative amount of travel provided by each set of slideable clip fasteners. In a third embodiment shown in FIG. 40B, mounting rail 3908 is attached to housing 3901 by vertically displaceable clips 4002, as in FIG. 40A, but agitator comb 3904 is rigidly affixed to the lower part of drive assembly 3902 by fasteners 4004. In this embodiment, the amount of displacement is equal to the slideable engagement distance between drive assembly 3902 and housing 3901. In either of these embodiments, the entire drive assembly 3902 may be removed for cleaning by disengaging clips 4002.

Although the embodiments described herein use slideable engagement systems to provide displaceability between agitator comb 3904 and housing 3901, other systems and embodiments if isolation mounts also may be used to provide the desired relative movement between agitator comb 3904 and housing 3901. For example, one or both of drive assembly 3902 and the agitator comb 3904 may be mounted on a displaceable linkage or a pivoting swing arm (such as shown in U.S. Pat. No. 5,937,475) that allows agitator comb 3904 to freely move towards and away from housing 3901. These and other embodiments will be apparent to those of ordinary skill in the art in light of the present disclosure.

In still another embodiment, shown in FIG. 40C, the agitator comb 3904 and/or drive assembly 3902 may also be mounted to pivot through an arc relative to housing 3901. In this embodiment, agitator comb 3904 is mounted such that it rocks back and forth about an axis parallel with the long axis of the agitator comb 3904 as the device is moved back and forth over the surface being cleaned. This may be accomplished by replacing mounting posts 3914 and fasteners 3924 with hinged mounts 4006.

In a preferred embodiment, both mounting rail 3908 and agitator drive bar 3912 comprise a relatively rigid structure. Molded plastic, such as ABS plastic, or other lightweight rigid materials are most preferred. Agitator drive bar 3912 also includes one or more drive points 3926 that are adapted to be driven in a generally side-to-side motion by drive motor 3906 (the drive point or points may alternatively be located on flexible connector 3910 or agitator comb 3904). Motor 3906 is preferably attached to a switch to allow the user to selectively operate the agitator 3900 when desired. In embodiments using an electric motor, motor 3906 is preferably wired independently of the vacuum source, so that motor 3906 can operate either when the vacuum is operating or when it is not operating.

In the preferred embodiment of FIGS. 39A–D, drive point 3926 comprises a vertically-oriented slot 3928 (i.e., a slot that extends generally in the vertical direction as shown by arrow B) into which a rotatable eccentric drive pin 3930 slidably fits. Slot 3928 may be formed integrally with agitator drive bar 3912, but is more preferably formed as a replaceable insert 3934, as shown in FIGS. 39B and 43A–C. In this embodiment, insert 3934 may be easily replaced if slot 3928 becomes worn, and the entire agitator drive bar 3912 need not be made of the hard, wear-resistant, low-friction or self-lubricating material that is preferred to make slot 3928. A bearing (not shown) or lubricating grease also may be provided between eccentric pin 3930 and slot 3928 to help reduce friction and wear.

Eccentric pin 3930 rotates about a drive axis 3932 that is offset from the centerline of eccentric pin 3930. As such, eccentric pin 3930 translates both laterally and vertically, in the directions of arrows A and B, respectively, as it rotates. The lateral movement of eccentric pin 3930 (in the direction of arrow A) is imparted to the vertical walls of slot 3928 to thereby drive agitator drive bar 3912, and the attached agitator comb 3904, in a cyclical lateral motion in direction A. The vertical length of slot 3928 is selected to be greater than the total vertical movement of eccentric pin 3930, and eccentric pin 3930 therefore slides up and down relative to agitator drive bar 3912 or agitator comb 3904 without imparting any substantial vertical force thereto. In this manner, motor 3906 imparts lateral driving forces to agitator comb 3904, while isolating agitator comb 3904 from vertical forces that could wear the surface being cleaned, or drive dirt deeper into the surface.

Figure 43A:
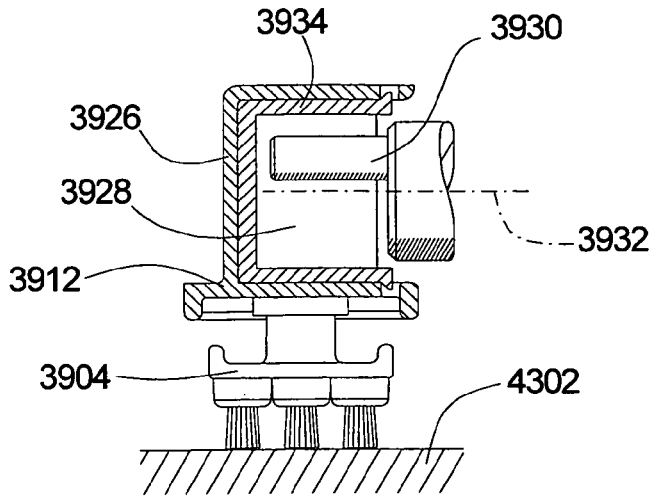
FIGS. 43A–C are partially cut away side views of three embodiments of linear agitator drive interfaces of the present invention.

The eccentric pin/slot configuration of the embodiment of FIGS. 39A–D is shown in a more detailed cross-section in FIG. 43A. Replaceable insert 3934 is also shown in FIG. 43A. Although it is preferred for slot 3928 to be oriented vertically (i.e., at about 90 degrees) relative to the surface to be cleaned 4302, is it also envisioned that slot 3928 may also be oriented at other angles relative to surface 4302. For example, in FIG. 43B, eccentric pin 3930 is positioned above agitator comb 3904, and its rotation axis 3932 is perpendicular to surface 4302, rather than being parallel to it. In this embodiment, slot 3928 is oriented generally parallel to surface 4302. Similarly, in FIG. 43C eccentric pin 3930 and slot 3928 are angled (i.e., between parallel and perpendicular) relative to surface 4302. In any of these embodiments, eccentric pin 3930 drives agitator comb 3904 by way of slot 3928 without imparting a substantial vertical force on surface 4302. Furthermore, to the extent any vertical force is imparted by the movement of eccentric pin 3930 in slot 3928, the use of isolation mount clips 3916 prevents any significant amount of this vertical force from being imparted to surface 4302.

Referring back to FIG. 39A, motor 3906 preferably drives eccentric pin 3930 by way of a gearbox 3907. Gearbox 3907 is selected to rotate eccentric pin 3930 at the desired cyclical frequency for linear agitator 3900. The shape of eccentric pin 3930, particularly the pin's diameter and its offset distance from drive axis 3932 (shown as distance x), can be changed to increase or decrease the linear agitator's amplitude (range of movement). Such changes will be appreciated by those of ordinary skill in the art of machine design. Various speeds and drive amplitudes may be used with the present invention. In various embodiments, agitator comb 3904 is driven at about 1.00 to about 30.0 Hz (cycles per second), and more preferably at about 3.00 Hz to about 15.0 Hz, and most preferably at about 6.67 Hz. Also in various embodiments, the linear agitator's amplitude (as measured either by the movement of agitator comb 3904 or agitator drive bar 3912) is about 0.125 inches to about 1.00 inches, and more preferably about 0.250 inches to about 0.750 inches, and most preferably about 0.375 inches. Gearbox 3907 may use any type of gear, such as spur gears or epicyclic gears, and may include a clutch to prevent overloading in the event the agitator drive bar 3912 becomes stuck.

It is also anticipated that drive speeds in the ultrasonic range (about 20,000+Hz), may be used with very low amplitudes to agitate the carpet and help remove dirt and debris. In this case, the entire agitator comb 3904 may be driven at ultrasonic frequencies or with ultrasonic overtones, or just parts of the agitator comb 3904 may be driven at ultrasonic frequencies or with ultrasonic overtones. When ultrasonic drive frequencies are desired, it is preferred to use an ultrasonic driver to drive the linear agitator 3900 rather than attempting to obtain such speeds from a conventional rotating drive motor. Ultrasonic drivers (or "horns") are commercially available from a number of sources, and the adaptation of such devices to drive the agitator of the present invention will be within the ordinary skill in the art in light of the present disclosure.

In the embodiment of FIGS. 39A–D, flexible connector 3910 preferably comprises a thermoplastic elastomer or other suitable flexible material having ribs 3936 that extend from mounting rail 3908 (or housing 3901, if mounting rail 3908 is omitted) to agitator drive bar 3912 (or agitator comb 3904, if drive bar 3912 is omitted). Ribs 3936 form a guide structure that flexes laterally to allow lateral movement of agitator drive bar 3912 relative to housing 3901, but limits longitudinal flexing (i.e., in the direction designated by arrow C). Ribs 3936 pivot slightly as they deform, and thus agitator drive bar 3912 will have a slight vertical movement as it cycles horizontally. In this embodiment, each rib 3936 can be described as rotating about a rotational axis at each of its ends. In the embodiment of FIG. 39A, this axis generally corresponds to direction C, and is parallel to the surface to be cleaned and oriented perpendicular to the axis along which the agitator comb 3904 is moved. Using this construction, the movement of agitator drive bar 3912, and hence the agitator comb 3904, is limited to an essentially linear direction.

The dimensions of the flexible ribs 3936 can be manipulated to achieve the desirable flexibility and fatigue resistance. In one embodiment, the thickness t of each rib 3936 is about 10% of the rib's height and depth. In another embodiment, each rib 3936 has a thickness t (in direction A) of about 2 mm, a depth (in direction C) of about 32 mm, and a height (in direction B) of about 24 mm. In this embodiment, there may be six ribs 3936, and flexible connector 3910 comprises two separate pieces that are located on opposite sides of the drive point 3926. Also in this embodiment, the resilience of flexible connector 39810 provides a restoring force that reduces the amount of force required to change the agitator bar's and agitator comb's direction of movement, which helps reduce fatigue on drive point 3926 and eccentric pin 3930.

Although the shown and described embodiment of the flexible connector 3910 is preferred, other embodiments are also possible. For example, flexible connector 3910 may instead comprise one or more mechanical linkages that are affixed to agitator drive bar 3912 and housing 3901 by hinges or a sliding bar. As used herein, "flexible" includes any structure that allows movement, such as pivots, slides, deformable structures, and the like. Flexible connector 3910 also may be oriented horizontally or at an angle relative to the surface to be cleaned (see, e.g., FIG. 44D).

A unique and beneficial feature of one embodiment of the present invention is that agitator comb 3904 can be easily removed and replaced with a variety of different agitator combs that are adapted to suit different surfaces (such as bare floors, rugs of different materials and constructions, and so on). For example, various agitator combs 3904 having the construction shown in FIGS. 39A–D (i.e., having a plurality of bristles) may be provided having different numbers of bristles 3938, or the densities, stiffnesses and/or shapes of the bristles 3938 can be modified to provide different cleaning performance on different surfaces. Such variations are within the realm of routine experimentation. A device embodying the present invention may be provided with a kit that includes various different agitator combs 3904, or may simply be provided with a single agitator comb 3904 having a construction that is found to work suitably well on a number of different surfaces. In a preferred embodiment, such a universal-use agitator comb 3904 may comprise about sixty-two bristle tufts having about ninety bristle strands each, wherein each strand is a 6/6 nylon strand having a diameter of about 0.008 inches and a free length of about 0.250 inches. Preferably, the tufts are arranged in a linear pattern of three rows in which a row of about twenty tufts is located between two rows of about twenty-one tufts, with the tufts of adjacent rows being offset relative to one another in the longitudinal direction. In other preferred embodiments, the bristle tufts may each comprise at least about thirty strands, and most preferably about sixty-two strands and are arranged in a pattern that provides about 3 to 8 bristle tufts per square inch, and most preferably 6 bristle tufts per square inch.

Figure 41A:
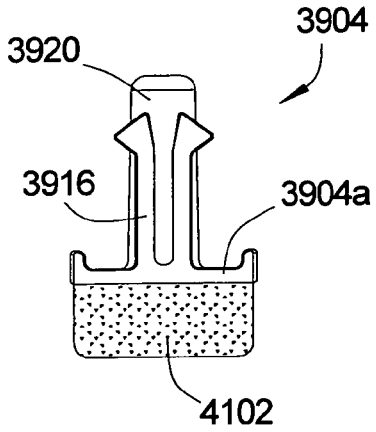
FIGS. 41A–C are side views of three embodiments of agitator combs of the present invention, shown uninstalled.
Figure 41B:
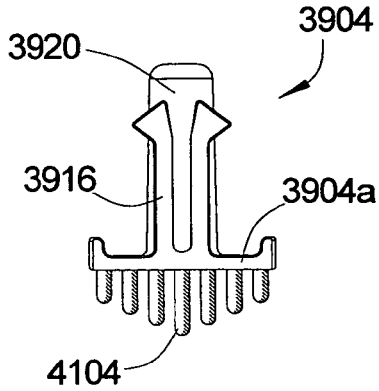
Figure 41C:
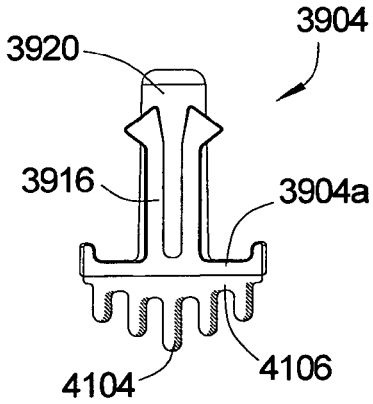

Referring to FIGS. 41A–C, agitator comb constructions other than the bristle-brush configuration of FIGS. 39A–D may also be used with the present invention. For example, as shown in FIG. 41A, bristles 3938 may be replaced by a foam pad 4102, which has been found to be useful for scrubbing bare floors. Pad 4102 also may comprise a backing surface to which disposable or reusable cleaning or polishing pads can be affixed. FIG. 41B shows another embodiment in which agitator comb 3904 has a number of flexible elastomeric cleaning "fingers" 4104. The cleaning fingers 4104 may have a flat profile, as viewed from the side (such as bristles 3938 are shown having in FIG. 39C), or may have a tapered or otherwise contoured profile, as shown in FIG. 41B. As with bristles 3938, the thickness, length, shape, composition and other properties of the cleaning fingers 4104 may be varied to obtain improved cleaning results on various different surfaces, and may be selectively tailored to clean particular surfaces. In the embodiment of FIG. 41C, the cleaning fingers 4104 are joined to one another by a common base 4106, which may increase the rigidity and fatigue resistance of the cleaning fingers 4104, and allows them to be cast as a single unit and more readily attached to the agitator comb base 3904*a* by overmolding or other well-known means. Of course, other variations of the agitator comb 3904, and different cleaning members, other than bristles, pads and "fingers" may be used with the invention.

Figure 42:
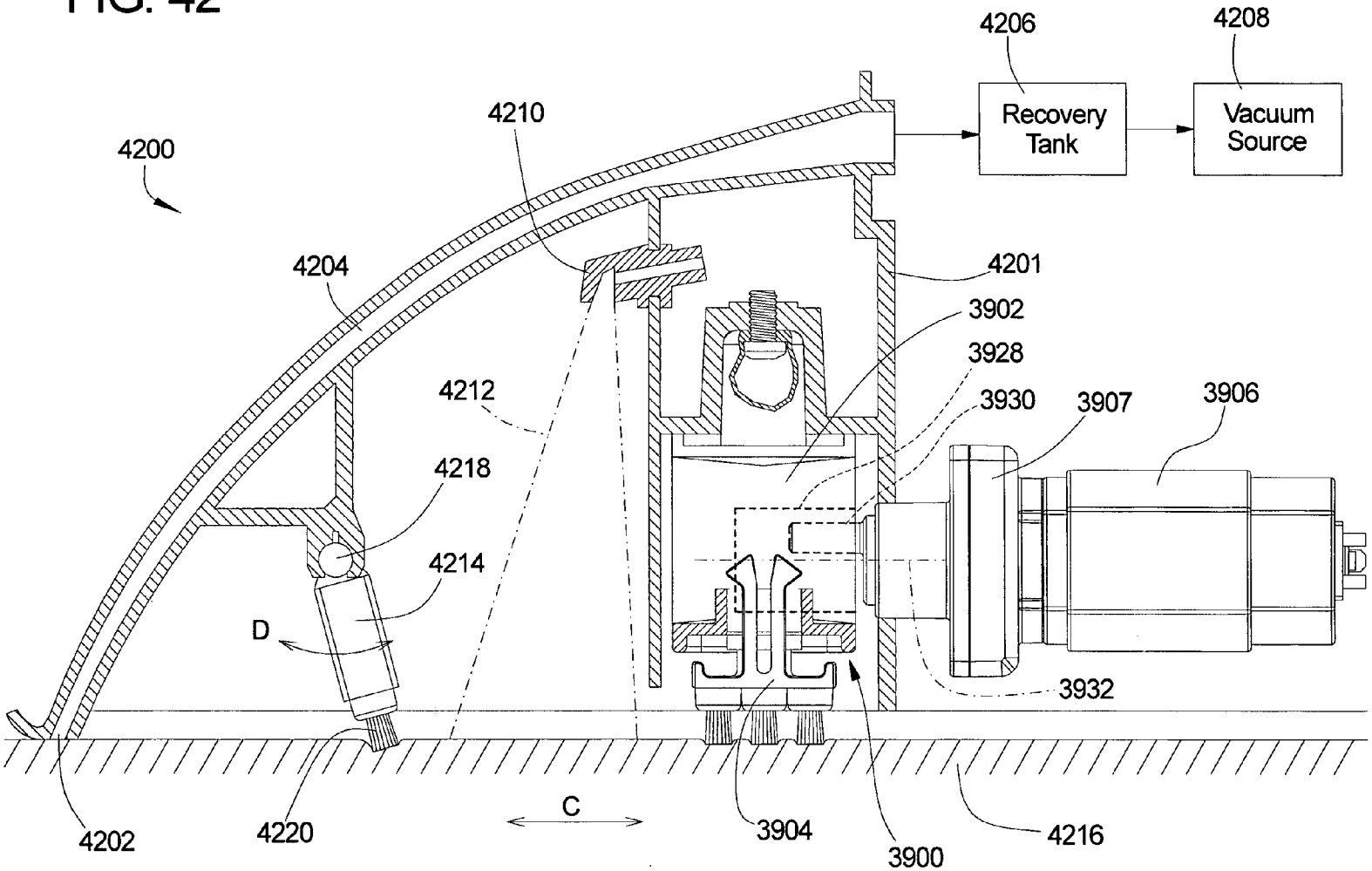
FIG. 42 is a cut away, partially schematic, side view of a wet extractor housing incorporating a linear agitator of the present invention.

While the linear agitator of the present invention may be mounted in the device housing in any suitable location, in a preferred embodiment the linear agitator is mounted as shown in FIG. 42, which is a partially cut away side view of the front end of a wet extractor 4200. In this embodiment, the linear agitator 3900 of FIG. 39A–D is mounted in wet extractor 4200 as described with reference to FIGS. 39C–D, and is driven by motor 3906 by way of gearbox 3907 and eccentric pin 3930. Wet extractor 4200 is similar in construction to the device 10 of FIG. 1, and has a vacuum inlet nozzle 4202 at its front end, and two or more wheels (not shown) at or near its back end. Vacuum inlet nozzle 4202 leads to a vacuum passage 4204 that eventually leads to a recovery tank 4206 and then to a vacuum source 4208. Wet extractor 4200 also has a fluid spray nozzle 4210 (or nozzles), that is attached to a liquid management system by a hose (not shown) and positioned with its spray pattern 4212 directed behind the inlet nozzle 4202, and in front of linear agitator 3900. While this configuration (i.e., spray nozzle 4210 between vacuum inlet nozzle 4202 and linear agitator 3900) is preferred, other configurations may also be used with the present invention. For example, spray nozzle 4210 may be located behind or even within linear agitator 3900. Spray nozzle 4210 may also be replaced by a fluid drip system that allows fluid to seep onto the surface being cleaned by gravitational flow.

It is preferable that linear agitator 3900 be positioned between vacuum inlet nozzle 4202 and the wet extractor's wheels, and located vertically with respect to wet extractor 4200 in such a way that the weight of the wet extractor does not rest, at least in any large degree, upon agitator comb 3904. This is desirable to maintain the desired "float" that prevents agitator comb 3904 from being forced into hard contact with the surface being cleaned 4216. The agitator comb's vertical travel Y (FIG. 39D) is also selected to allow agitator comb 3914 to conform to changing contours of surface 4216 without allowing agitator comb 3904 to run out of travel (i.e., "bottom out") on bumps. As noted before, a vertical travel distance Y of at least about 0.125 inches, and more preferably 0.250 inches, is generally sufficient during normal operation to allow agitator comb 3904 to conform to most surfaces that are cleaned using wet extractors without bottoming out or being lifted too far to contact the surface. Of course, even with these amounts of vertical travel Y, some loss of contact with the surface 4216 and bottoming out may be experienced, but these incidences generally do not degrade the overall performance of the present invention.

A grooming brush 4214 may also be provided, preferably between inlet nozzle 4202 and spray pattern 4212. The wet extractor is operated by moving it forwards and backwards in the direction shown by reference arrow C. When wet extractor 4200 is pulled backwards (to the right in FIG. 42) on its final cleaning stroke over a portion of the surface being cleaned, grooming brush 4214 straightens the carpet and provides a desirable uniform look thereto. In a preferred embodiment, grooming brush 4214 is affixed to wet extractor housing 4201 such that it can pivot along an axis parallel to the surface being cleaned 4216 and perpendicular to the device's normal direction of travel. (This pivot axis generally corresponds to reference arrow A in FIG. 39A.) This pivoting movement reduces the vertical force applied to the surface 4216 while still providing suitable grooming action. In the embodiment of FIG. 42, grooming brush 4214 has bristles 4220 that extend towards surface 4216, and is mounted on one or more pivots 4218 to allow it to swing back and forth, as shown by reference arrow D. Bristles 4220 preferably comprise a single row of about thirty-nine bristle tufts of 6/6 nylon bristle fibers, wherein the row is about 9.75 inches long, each bristle tuft comprises about ninety bristle fibers, and each bristle fiber has a diameter of about 0.008 inches and a free length of about 0.300 inches. Also in this embodiment, bristles 4220 extend only about 0.125 inches or less below the plane defined between the lower edge of inlet nozzle 4202 and the bottoms of the wheels, to thereby limit the depth to which bristles 4220 penetrate surface 4220.

In a preferred embodiment, grooming brush 4214 may be removed by the operator for cleaning, replacement, and use without it. Grooming brush 4214 may also be replaced by other types of brushes or other devices to accommodate the different carpets and floors that may be treated with wet extractor 4200. For example, a squeegee may be used to replace grooming brush 4214 when wet extractor 4200 is used on tile or hardwood floors.

Figure 44A:
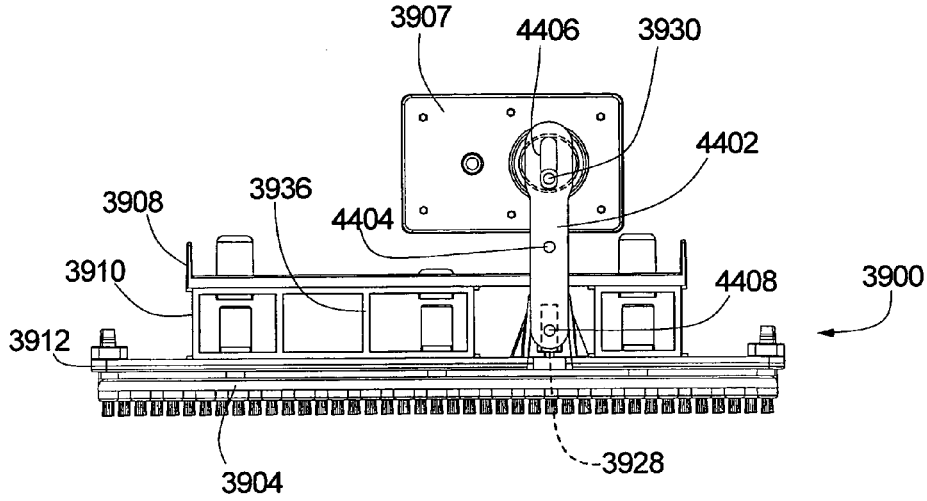
FIGS. 44A and 44B are front views of two embodiments of drive systems of the present invention.
Figure 44B:
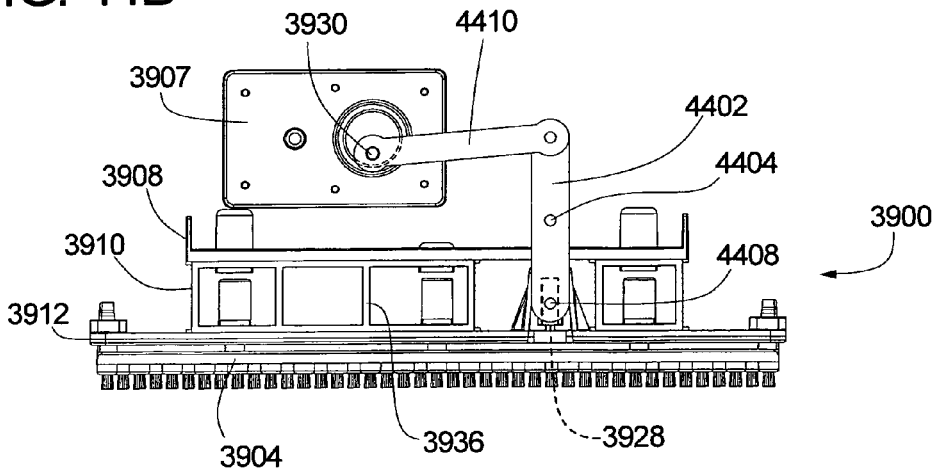

It should be appreciated by those of ordinary skill in the art that numerous variations on the drive system for the linear agitator are possible with the present invention, and any system that can drive agitator comb 3904 in a cyclical motion without applying a substantial vertical load to agitator comb 3904 will be suitable. Some examples of alternative drive systems are now described with reference to FIGS. 44A–D. In the embodiment of FIG. 44A, which is a front view, linear agitator 3900 is driven from above by a motor (not visible) through gearbox 3907, and an offset rocker arm 4402. Offset rocker arm 4402 is pivotally mounted on pivot 4404, has a slot 4406 at its first end, and a driving pin 4408 at its second end. Eccentric pin 3930 fits in slot 4406, while driving pin 4408 fits into slot 3928 in agitator drive bar 3912. As eccentric pin 3930 rotates, it moves the first end of offset rocker arm 4402 back and forth on pivot 4404, and offset rocker arm 4402 transfers this motion to linear agitator 3900. In a similar embodiment, shown in FIG. 44B, slot 4406 can be eliminated by driving the first end of offset drive bar by way of an intermediate link 4410. In either of these embodiments, slot 3928 may also be removed and replaced by a simple pivot hole to form a ball-and-socket joint. In such an embodiment, agitator drive bar 3912 may be driven with a slight up and down movement, caused by the arcuate path of driving pin 4408, but such movement can be effectively isolated from the surface being cleaned by providing an appropriate vertical travel Y for agitator comb 3904.

Figure 43B:
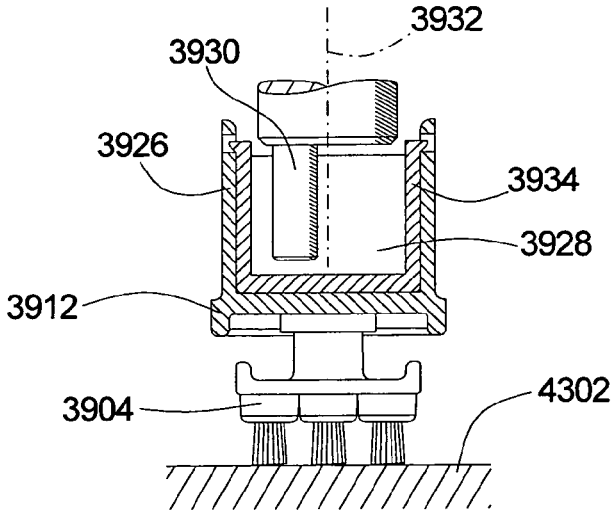
Figure 43C:
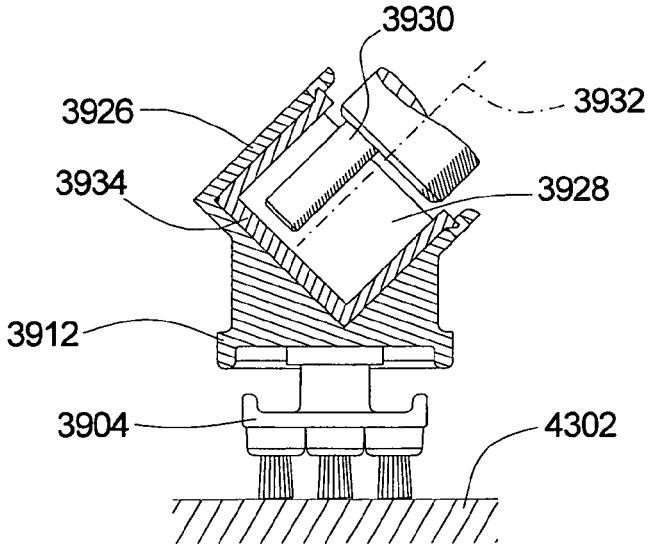
Figure 44C:
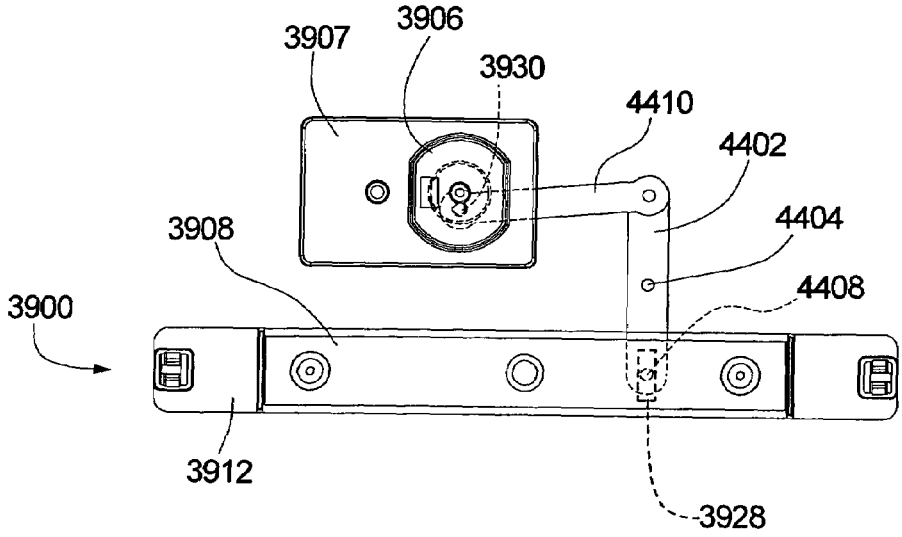
FIGS. 44C and 44D are top views of two additional embodiments of drive systems of the present invention.

The embodiments of FIGS. 44A and B can be further modified by rotating the motor and gearbox to be vertical relative to the surface to be cleaned, as shown in the top view (i.e., the view along direction B in FIG. 39A) of FIG. 44C. In this embodiment, motor 3906 drives eccentric pin 3930 through gearbox 3907, which in turn causes intermediate link 4410 to rock offset rocker arm 4402 back and forth. In this embodiment, slot 3928 is parallel to the surface to be cleaned, as shown in FIG. 43B. It is also envisioned that slot 3928 may be replaced by a simple pivot or ball-and-socket joint, in which case flexible connector 3910 should be chosen to allow a limited amount of play to account for the arcuate path through which driving pin 4408 will travel as it pivots on offset rocker arm 4402.

Figure 44D:
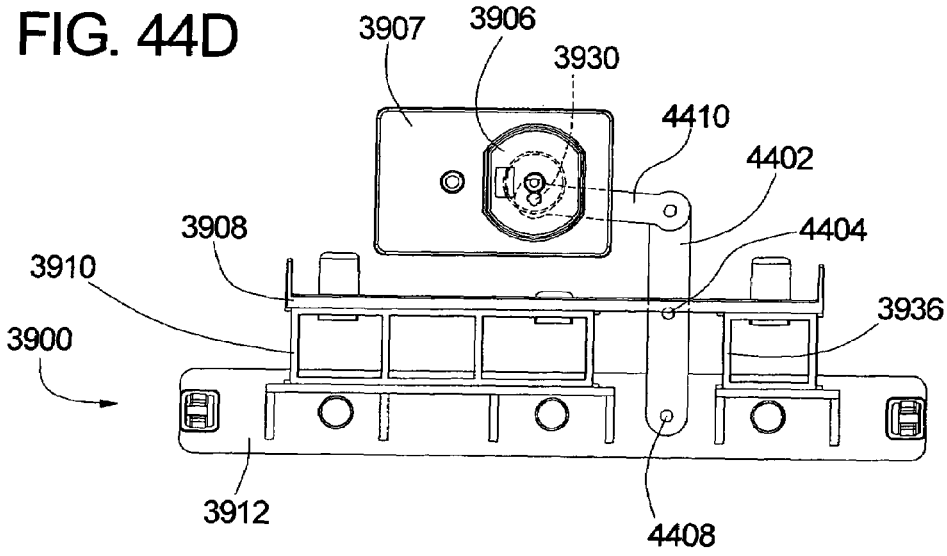

Still another embodiment of an alternative drive assembly is shown in FIG. 44D. This embodiment is a modification of the embodiment of FIG. 44C, in which mounting rail 3908 and flexible connector 3910 are positioned on the side of agitator drive bar 3912, rather than being on top of agitator drive bar 3912. In this embodiment the ribs 3936 of flexible connector 3910 flex each about an axis perpendicular to the surface being cleaned (this pivot axis is into the page in FIG. 44D, and generally corresponds with arrow B in FIG. 39A), rather than pivoting about axes that are parallel to the surface to be cleaned. If it is desired to use a simple pivot for driving pin 4408 (rather than placing driving pin 4408 into a slot 3928), tensile and compressive loads on flexible connector 3910 caused by the arcuate path of driving pin 4408 can be minimized by selecting the distance between pivot 4404 and driving pin 4408 to approximately equal the length of ribs 3936. This approach may also be used when slot 3928 is omitted from the embodiments of FIGS. 44A and B.

The linear agitator of the present invention has been found to be effective at cleaning carpets and bare floors, while also providing a number of benefits over conventional designs. For example, the linear agitator generally does not leave streaks of accumulated water on the floor, as often happens with vertically-oriented spinning brushes. Furthermore, the linear agitator can be made such that it is readily modified by a user to use different agitator combs to meet the needs of different surfaces. Also, the agitator comb can be adapted so that it "floats" on the surface being cleaned without applying significant vertical force thereto, which reduces wear on the surface. Still further, the linear agitator eliminates the need for expensive bearings, as required in "beater brush" agitators, and has been found to self-clean in operation because it doesn't tend to pick up, sling or retain dirt, string and hair, as rotating cleaners do. Other advantages and benefits of the invention are also available, as described in and evident from the discussion herein.

While the discussion herein has generally described embodiments of linear agitators that are mounted in the bases of cleaning devices, such as wet extractors, a linear agitator of the present invention can also be adapted for use in accessory cleaning tools that are used for remote and spot cleaning operations. As noted elsewhere herein, such accessory tools are useful to provide the ability to clean surfaces that are not readily accessible by the large floor-cleaning bases of cleaning devices. Similarly, the present invention can also be adapted for use in portable hand-held cleaning tools, canister-type tools, and other devices, as will be appreciated by those of ordinary skill in the art.

Figure 45A:
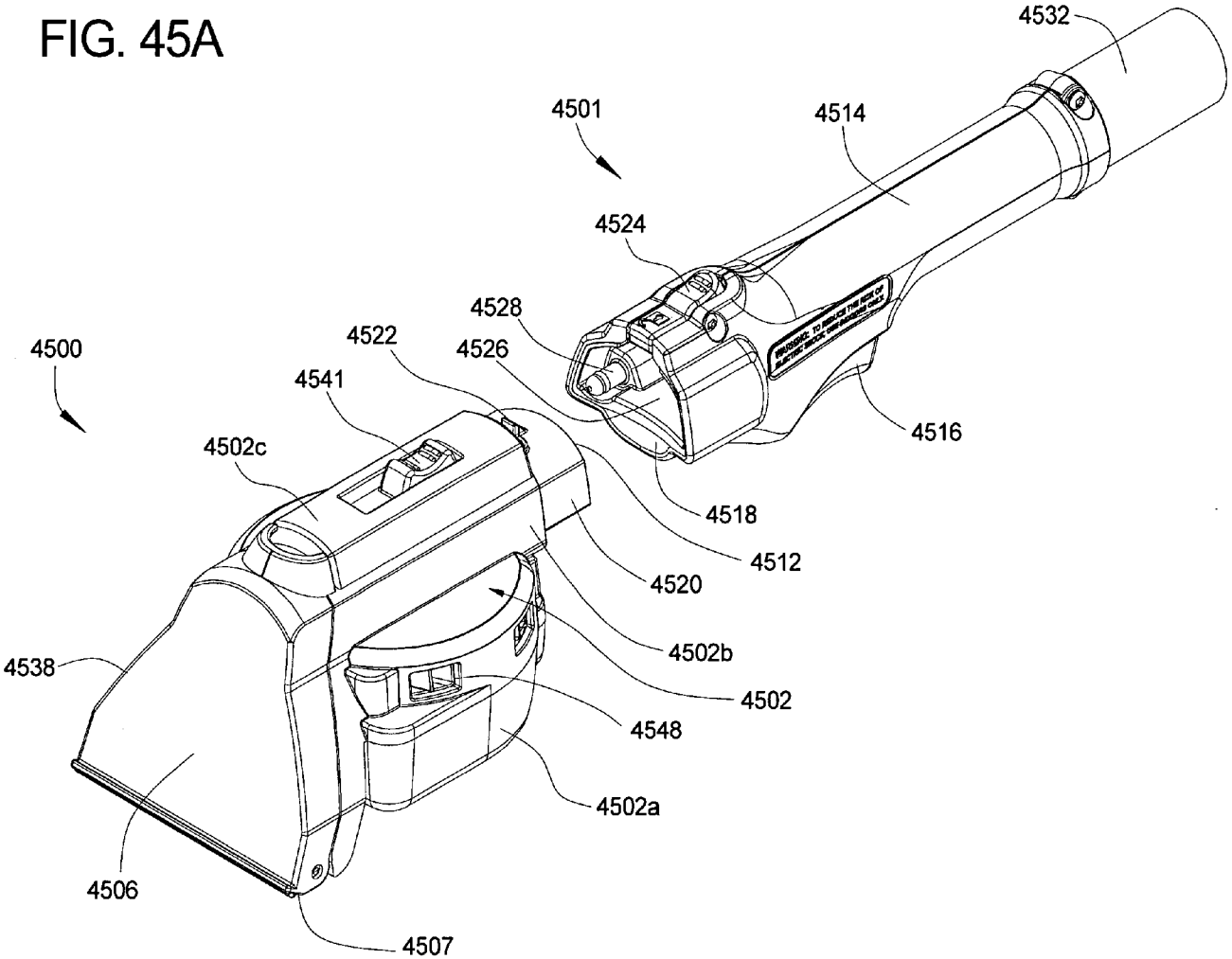
FIG. 45A is an isometric view of an agitator assembly and handle of another embodiment of the present invention.

An embodiment of a compact, hand-held agitator assembly 4500 that is usable as an accessory tool (often called a "turbo-tool") or as part of a self-contained hand-held cleaning device is shown in FIGS. 45A and B. In this embodiment, the agitator assembly is formed by a housing 4502 that comprises a lower housing 4502*a* that houses an agitator 4504, and an upper housing 4502*b* that houses a vacuum inlet passage 4506 having an elongated inlet slit 4507, a turbine drive 4508 and a gearbox 4510. A spray nozzle 4534 is also preferably provided in agitator assembly 4500 and oriented to spray cleaning fluid on the surface to be cleaned. Spray nozzle 4534 is connected by hose 4536 to a fluid hose receptacle 4530 located adjacent a main vacuum passage 4512 formed in upper housing 4502*b*. In this embodiment, agitator assembly 4500 is operated by air drawn in by a vacuum through main vacuum passage 4512. It will be appreciated that in other embodiments agitator 4504 may instead be powered by an electric motor or other drive device, and that spray nozzle 4534 and/or vacuum inlet 4506 may be omitted from the device.

Referring also to FIGS. 50A–D, vacuum inlet passage 4506 passes through upper housing 4502*b* and meets a main vacuum passage 4512. The front portion of vacuum inlet passage 4506 is preferably formed on one side by housing 4502*b*, and on the other side by a removable inlet nozzle cover 4538. A second vacuum passage, the turbine drive passage 5004 (FIGS. 50A–D), leads from turbine drive 4508 to main vacuum passage 4512. While it is envisioned that both the vacuum inlet passage 4506 and the turbine drive passage 5004 may be open to main vacuum passage 4512 at all times, in which case agitator 4504 and vacuum inlet passage 4506 will operate at all times, it is preferred that a mode selector valve 4540 is provided to selectively control the vacuuming and agitating functions. Mode selector valve 4540 may be operated by a sliding switch 4541 that is retained on the top of housing 4502*b* by an additional subhousing 4502*c*. The operation of such a mode selector valve 4540 is described in more detail elsewhere herein. One or more of housings 4502*a* and 4502*b*, subhousing 4502*c* and nozzle cover 4538 may comprise a transparent material to allow operation to be monitored, obstructions to be detected, and to increase the visual appeal of the device.

Agitator assembly 4500 is preferably connectable with a handle 4501, but handle 4501 also may be integrally formed with agitator assembly 4500 or omitted. Handle 4501 preferably comprises a rigid structure that is connected or connectable to a flexible hose 4532 that leads to the main body of the cleaning device. Handle 4501 has a hollow grip 4514 having vacuum and fluid passages therethrough. Flexible hose 4532 includes a vacuum passage and a fluid hose (not shown), which is preferably located inside the vacuum passage. A trigger 4516 is provided on handle 4501 to operate a valve (not shown) that controls the flow of fluid through the fluid passage, or with an electric switch to activate a fluid pump to send fluid to the accessory tool. A handle interface 4518 mates with a corresponding agitator assembly interface 4520 to join the two parts. Handle interface 4518 includes a vacuum passage 4526 that engages with main vacuum passage 4512, and a fluid plug 4528 that mates with fluid hose receptacle 4530. Handle 4501 also has a latch 4524 that engages with a hook 4522 on agitator assembly 4500 to lock the two parts together. When the parts are engaged with one another, the air and fluid passages are preferably sealed together with little, if any, appreciable leakage of vacuum or fluid.

Figure 45B:
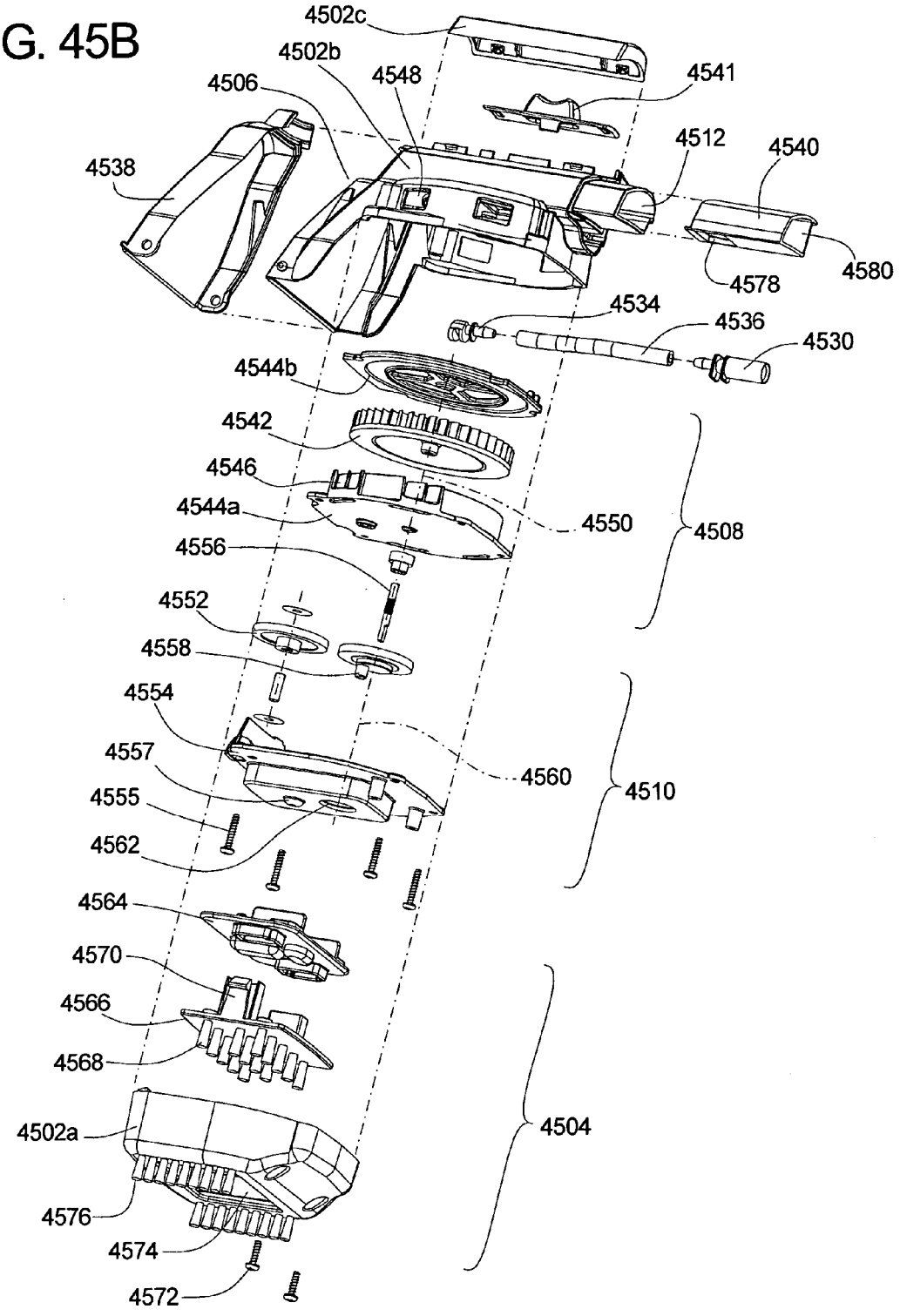
FIG. 45B is an exploded view of the agitator assembly of FIG. 45A.

Turbine drive 4508 is housed in upper housing 4502*b*. Turbine drive 4508 includes a vaned air turbine 4542 that is sandwiched between a separate, two-piece housing 4544*a* and 4544*b*. Housing 4544*a* has a number of openings 4546 through which air enters to activate turbine drive 4508. When turbine drive 4508 is installed in upper agitator assembly housing 4502*b*, openings 4546 match with openings 4548 through upper housing 4502*b* to allow airflow to air turbine 4542. As shown in FIGS. 45A–B, air turbine 4542 is positioned between mode selector valve 4540 and agitator 4504, and is oriented with its rotating axis 4550 generally orthogonal to the plane of the surface to be cleaned. In other embodiments, however, air turbine 4508 may be turned on its side or angled relative to this orientation, and any suitable intervening drive mechanisms (such as belts and gears) may be provided to use the air turbine's movement to drive agitator 4504 in the manner described below. The implementation of such intervening mechanisms will be understood by those of ordinary skill in the art without undue experimentation.

A gearbox 4510 is preferably provided to convert the high-speed, low-torque movement of air turbine 4542 to a lower speed and higher torque drive output. Gearbox 4510 comprises a gear case 4554 that houses a set of gears 4552 of conventional construction. Fasteners 4555 pass through gear case 4554 and turbine housing 4544*a* and 4544*b* to retain gearbox 4510 and turbine drive 4508 in upper housing 4502*b*. Gears 4552 are driven by an air turbine axle 4556, and the gearbox output is an eccentric pin 4558 that, like the other eccentric pins described herein, rotates at an offset distance about a drive axis 4560. Eccentric pin 4558 exits gear case 4554 through an opening 4562 located opposite turbine drive 4508. In a preferred embodiment, in which air turbine 4550 is a conventional design having a diameter of about 3.375 inches and a speed reduction of about 11.75:1, has been found to be suitable to drive the agitator 4504 at a useful speed and torque. Of course, other gearing variations may be used depending on the turbine efficiency and speed, the vacuum level, the desired output speed and torque, and so on, and such variations are within the scope of routine experimentation.

Figure 46:
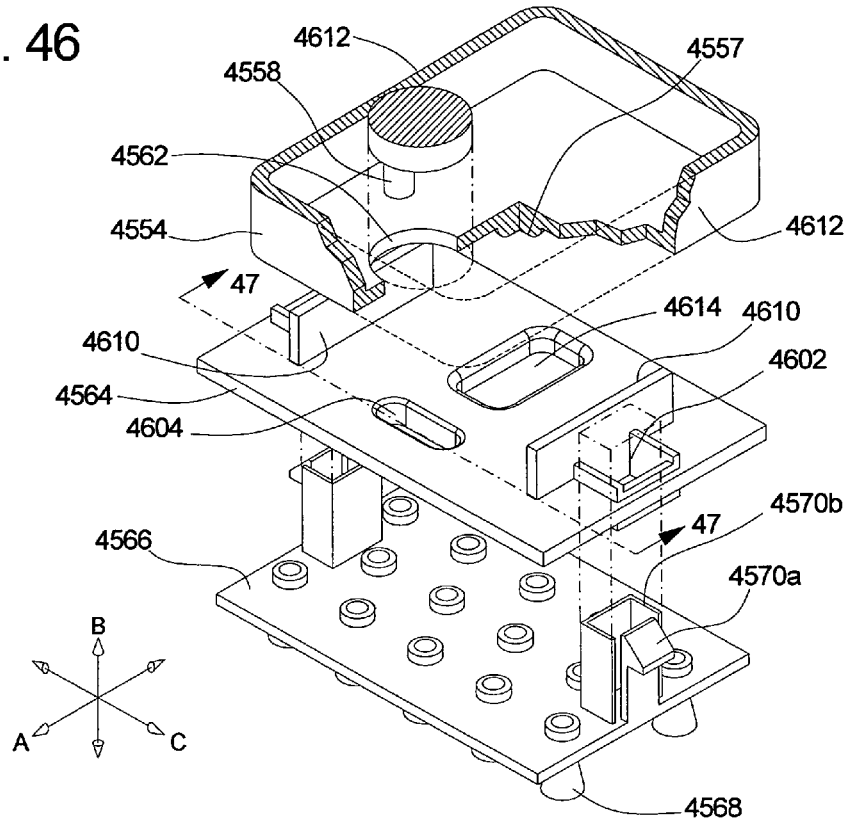
FIG. 46 is a partially cut away isometric exploded view of an embodiment of an agitator of the present invention.
Figure 47:
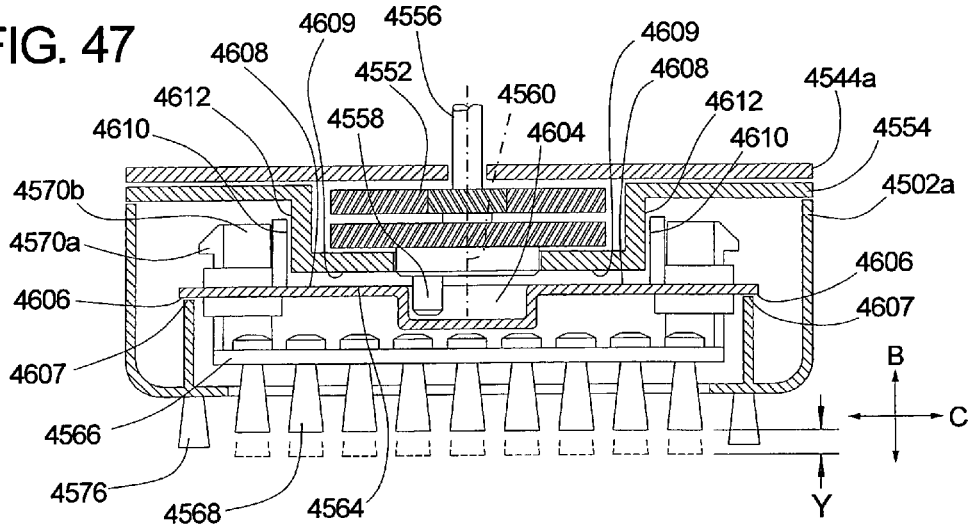
FIG. 47 is a cut away view of the agitator of FIG. 46 as viewed along reference line 47—47, shown installed in an agitator assembly housing.

Eccentric pin 4558 drives a drive plate 4564, which in turn drives an agitator comb 4566, preferably in a manner described elsewhere herein with reference to FIGS. 46 and 47. Agitator comb 4566 is preferably affixed to drive plate 4564 by clips 4570, that allow agitator comb 4566 to displace towards and away from drive plate 4564 in a manner such as described with reference to agitator comb 3904 and agitator drive bar 3912 of FIGS. 39A–D. Clips 4570 may also be hand-removable to facilitate removal and replacement of agitator comb 4566. Agitator comb 4566 has one or more cleaning members 4568 extending therefrom in a the direction towards the intended surface to be cleaned. Cleaning members 4568 may be bristles, cleaning "fingers," sponges, foam pads, or the like, as described previously herein. In a preferred embodiment, cleaning members 4568 comprise about fourteen tufts of 6/6 nylon fibers, in which the fibers each have a diameter of about 0.008 inches and a length of about 0.500 inches. In this embodiment, the tufts are arranged in a rectangular pattern having a row of four tufts between two rows of five tufts.

Drive plate 4564 and agitator comb 4566 are contained in lower housing 4502*a*, which abuts upper housing 4502*b* when installed, and is affixed thereto by fasteners 4572 that engage with gear case 4554. In a preferred embodiment, drive plate 4564 is physically captured within lower housing 4502*a*, but is retained in such a manner that it is free to slide along a linear direction. Agitator comb 4566 may be similarly captured within lower housing 4502*a*, but it is also envisioned that agitator comb 4566 may instead be removable without having to remove lower housing 4502*a*. In such a removable embodiment, agitator comb 4566 may be easily removed for cleaning or for replacement with other combs to suit the surface being cleaned.

The agitator comb cleaning members 4568 extend through an opening 4574 through lower housing 4502*a* to reach the surface to be cleaned. Lower housing 4502*a* may also be equipped with a number of fixed bristles 4576 that extend parallel to cleaning members 4568. Fixed bristles 4576 are useful in one respect as additional scrubbing bristles during manual agitation. It is also envisioned that one or more rows of bristles may be provided on lower housing 4502*a* or on upper housing 4502*b* adjacent the inlet to vacuum inlet passage 4506 to act as a grooming brush. Fixed bristles 4576 support agitator assembly 4500 on the surface being cleaned to help obtain the preferred "floating" agitator comb action and prevent the operator from pressing the agitator assembly 4500 too firmly into the surface being cleaned. This aspect of the invention is described in more detail elsewhere herein. In a preferred embodiment, fixed bristles 4576 comprise about eighteen bristle tufts of 6/6 nylon bristle strands, wherein each bristle strand has a diameter of about 0.008 inches and a free length of about 0.4375 inches (7/16"). In this embodiment, fixed bristles 4576 are arranged in two rows of nine bristle tufts each, and the rows are disposed on opposite sides of agitator comb 4566, and preferably along the sides that are parallel to the direction of the agitator comb's reciprocating movement.

A preferred agitator 4504 for use in agitator assembly 4500 is shown in more detail in FIGS. 46 and 47. In this preferred embodiment, the clips 4570 that attach agitator comb 4566 to drive plate 4564 each comprise a displaceable hook 4570*a* and a box-like guide structure 4570*b*. Clips 4570 fit into corresponding clip openings 4602 in drive plate 4564 to thereby retain agitator comb 4566 in engagement with drive plate 4564, while still allowing agitator comb 4566 to freely displace relative to drive plate 4564 between contracted and extended positions. The direction in which agitator comb 4566 displaces is shown by reference arrow B in FIG. 46. When agitator comb 4566 is fully contracted, cleaning members 4568 extend from lower housing 4502*a* by a minimum distance, and when agitator comb 4566 is fully extended, cleaning members 4568 extend from lower housing 4502*a* by a maximum distance. The difference between these distances is the amount of agitator comb "float," which is designated by distance Y in FIG. 47, in which agitator comb 4566 is shown in the contracted position, and the tips of cleaning members 4568 are shown by phantom lines as they would appear in the extended position.

Because agitator assembly 4500 is typically held in the operator's hand, rather than being affixed to a cleaning device base that is supported on the surface being cleaned, it has been found to be desirable to include fixed bristles 4576 (or other deformable support structures) on lower housing 4502*a* to help support agitator assembly 4500 and give the operator some indication of the proper height at which to operate the device relative to the surface being cleaned. As such, fixed bristles 4576 are selected to have a length that is somewhere between the minimum and maximum distances of the cleaning members, as shown in FIG. 47, or greater than the maximum cleaning member distance. The stiffness and length of fixed bristles 4576 is preferably selected to make it somewhat difficult to compress them, during normal use, to the point where agitator comb 4566 reaches the contracted position (i.e., "bottoms out").

It is anticipated that agitator assembly 4500 may be used in various orientations, and in some orientations (e.g., upside-down) agitator comb 4566 may not be pulled towards the surface being cleaned by gravity, and may retract to the contracted position. As such, in one embodiment one or more light springs (not shown) may be positioned between agitator comb 4566 and agitator comb 4566 to apply a light force to hold agitator comb 4566 away from the contracted position. Of course, such springs may also be used with an agitator of the invention that is installed in a base housing (such as the agitator of FIGS. 39A–D), but in those cases the use of an additional spring is not preferred.

The agitator drive plate 4564 is held by guide structures such that it is free to slide back and forth in a linear direction shown by reference arrow A in FIG. 46, but otherwise generally restricted from translational and rotational movement. While these guide structures may comprise a flexible connector, such as flexible connector 3910 described previously herein, it is preferred that the guide structures comprise walls, pins, rollers or other surfaces in housing 4502*a* that abut corresponding surfaces on drive plate 4564, to retain drive plate 4564 in housing 4502. In such an embodiment, drive plate 4564 may simply be captured within lower housing 4502*a* without being directly attached to the agitator assembly 4500.

In a preferred embodiment, best shown in FIG. 47, drive plate 4564 is captured between lower housing 4502*a* and gear case 4554. In this embodiment, drive plate 4564 comprises a first set of walls 4606 and 4608 that slidably abut corresponding walls 4607 and 4609 of lower housing 4502*a* and gear case 4554, respectively, to limit the drive plate's movement in the vertical direction, as shown by reference arrow B. Drive plate 4564 also has a second set of walls 4610 that slidably abut corresponding walls 4612 on gear case 4554 to limit the drive plate's lateral movement in the direction show by reference arrow C. The combined limitations on movement provided by these walls restricts drive plate 4564 to being movable generally only along direction A (FIG. 46). Drive plate 4564 may also be provided with a guide pin recess 4614 (FIG. 46) that receives a guide pin 4557 (FIG. 46) that protrudes from gear case 4554. Guide pin recess 4614 is generally slot-shaped, and extends in the direction in which drive plate 4564 is reciprocated, as shown by reference arrow. A. In order to reduce friction, slight gaps may be provided between the various surfaces described herein (as shown in FIG. 47), and/or the surfaces may be made from a low-friction material or greased.

As noted before, agitator 4504 is driven by eccentric pin 4558 that rotates at an offset distance about drive axis 4560 (in the compact gear set shown, the eccentric pin's drive axis 4560 is coaxial with the air turbine's drive axis 4550). Eccentric pin 4558 slidably fits into a drive slot 4604 in drive plate 4564. Drive slot 4604 is preferably oriented such that it extends generally perpendicular to the desired drive direction. For example, drive slot 4604 extends generally in the direction shown by arrow C, which is perpendicular to the drive direction, which is shown by arrow A. As eccentric pin 4558 rotates, it alternately presses on the drive slot's side walls (the walls that extend along the slot's length) and moves drive plate 4564 in a reciprocating linear manner.

It will be appreciated that the circular rotation of eccentric pin 4558 in drive slot 4604 causes drive plate 4564 to move with a velocity profile that follows a sinusoidal pattern, with the maximum velocities being obtained when eccentric pin 4558 is at 0 degrees and 180 degrees along the longitudinal axis of drive slot 4604, and minimum velocities being obtained when eccentric pin 4558 is at 90 degrees and 270 degrees. This velocity profile can be varied be angling drive slot 4604 relative to the drive direction or providing drive slot 4604 with non-rectangular side walls. The effects of such variations can be readily calculated using simple geometric and dynamic principles, and such variations are within the ordinary skill in the art of machine design and within the scope of the invention. These principles are also applicable to driving an agitator that is affixed within a device's base, as described with reference to agitator 3900.

Although the shown embodiment in which eccentric pin 4558 is located in drive slot 4604 is preferred, it will be appreciated by those of ordinary skill in the art that other mechanisms (such as rocker arms, gears, linkages and the like) may be used to operate drive plate 4564 in a reciprocating motion, and such variations are within the scope of the present invention.

Figure 48A:
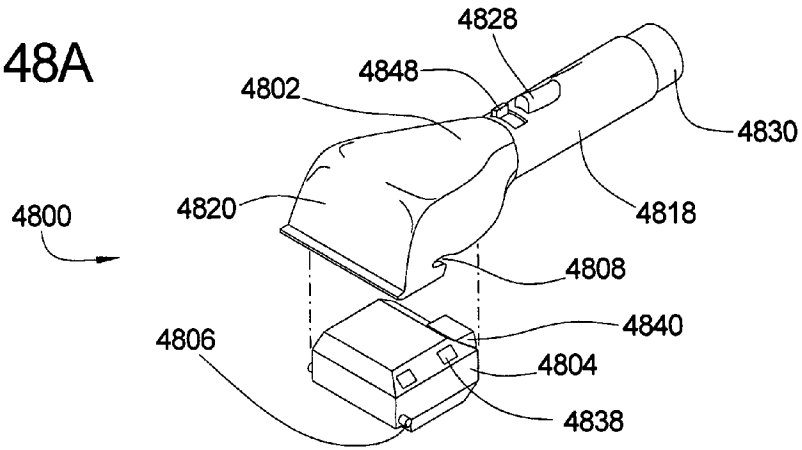
FIG. 48A is an exploded isometric view of an embodiment of a modular agitator assembly of the present invention.

Referring now to FIGS. 48A and B, in one embodiment of the invention, the agitator of the present invention may be provided as a modular device that can be selectively removed or inserted into an agitator assembly (or device housing). Such a modular system provides a number of benefits. For example, it is sometimes desirable to clean with an accessory tool without using an agitator, and in such cases, the modular agitator can be removed to reduce the weight of the accessory tool. Being removable also makes the agitator and accessory tool easier to clean, and makes it possible to provide different replaceable agitator modules that are suited for cleaning particular surfaces.

Figure 48B:
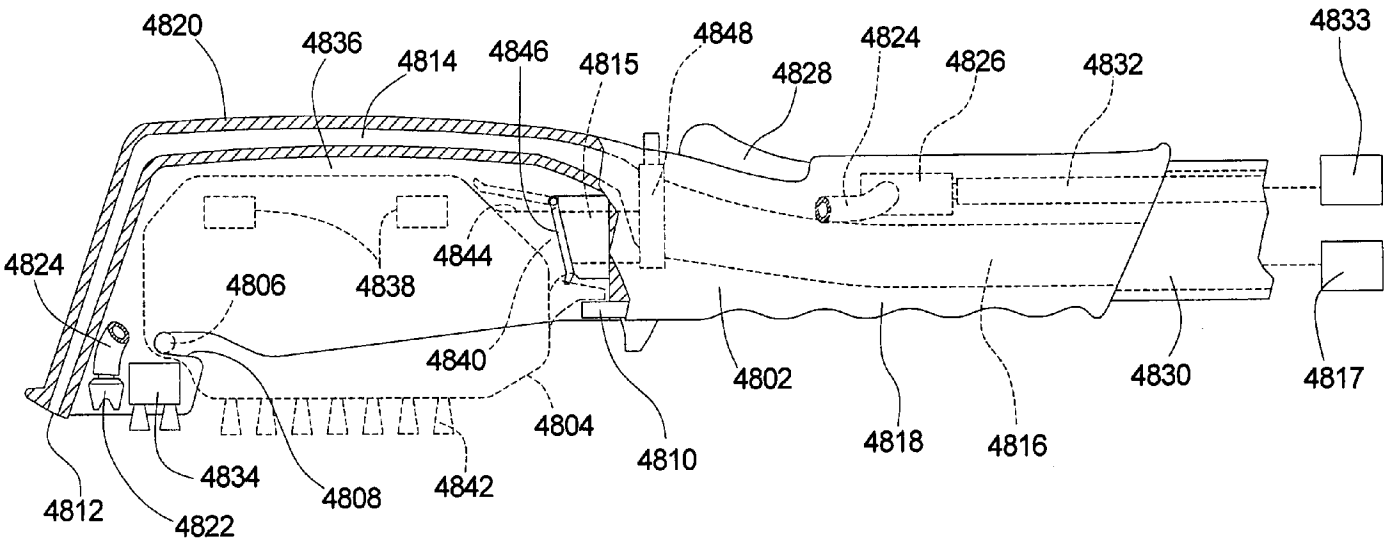
FIG. 48B is a partially cut away side view of the modular agitator assembly of FIG. 48A.

In the shown embodiment, modular agitator assembly 4800 comprises a main housing 4802 and an agitator module 4804 (which is shown in phantom in FIG. 48B). Main housing 4802 preferably comprises a rigid structure, preferably made of plastic, having a handle portion 4818 and a cleaning head portion 4820. A vacuum inlet 4812 leads through a vacuum inlet passage 4814 to a main vacuum passage 4816 that passes through the hollow handle 4818. An agitator vacuum port 4815 is also provided in main housing 4802 to provide a passage from the agitator module 4804 (when it is installed) to main vacuum passage 4816. A spray nozzle 4822 is positioned in cleaning head 4820 to project cleaning fluid onto a surface to be cleaned. Hose 4824 connects spray nozzle 4822 to a valve 4826 in handle 4818, and a trigger 4828 is provided to control valve 4826 and the flow of fluid therethrough. A hollow, flexible hose 4830 extends from the back of handle 4818 to connect main vacuum passage 4816 to a vacuum source 4817 in the main body of the cleaning device. Flexible hose 4830 also has a fluid hose 4832 disposed therein to connect spray nozzle 4822 to a cleaning fluid source 4833. Main housing 4802 may also be equipped with one or more fixed brushes 4834 that can be used to manually agitate or groom the surface being cleaned. Brushes 4834 may also be replaced by squeegees, sponges, foam pads, or other cleaning members or useful devices.

Agitator module 4804 is preferably shaped to fit into a corresponding cavity 4836 in main housing 4802, but may simply be attached to a surface of main housing 4802. Inside agitator module 4804 are an agitator and a turbine adapted to drive the agitator. The agitator and turbine may be any conventional devices, but are preferably devices as described previously herein with reference to FIGS. 45A and B. The agitator comprises a number of cleaning members 4842 that extend from agitator module 4804 towards the surface to be cleaned. One or more turbine air inlet ports 4838 pass into agitator module 4804 to supply air to the turbine. Agitator module 4804 also has a turbine air outlet port 4840 that is positioned such that it is connected to the agitator vacuum port 4815 when agitator module 4804 is installed in main housing 4802, thereby providing the vacuum necessary to draw air into vacuum inlet ports 4838, and through the turbine to power the turbine and agitator. It is also anticipated that the agitator turbine may be replaced by other types of motor, such as an electric motor. In such an embodiment, the turbine air ports may be replaced by electrical contacts that lead to the electric motor, and a switch to energize the contacts may be provided on handle 4818.

When it is desired to clean with an agitator, agitator module 4804 is inserted into main housing 4802 by sliding pins 4806 at the front of agitator module 4804 into corresponding slots 4808 in main housing 4802, pivoting agitator module 4804 up into main housing 4802, and moving slide lock 4810 in place to retain the back end of agitator module 4804. As agitator module 4804 is moved up into main housing 4802, an upper surface 4844 of agitator module 4804 presses against and opens a spring-loaded door 4846 that normally blocks the flow of air into agitator vacuum port 4815. In this manner, the flow of air through agitator vacuum port 4815 is automatically enabled when agitator module

4804 is installed, and disabled when it is removed. Of course, other connection systems may be used to retain agitator module 4804 in main housing 4802 and to automatically or manually open the door 4846 or other closure covering agitator vacuum port 4815 (if such a closure is provided, which is not required), and the invention is not limited to the shown system.

Figure 49A:
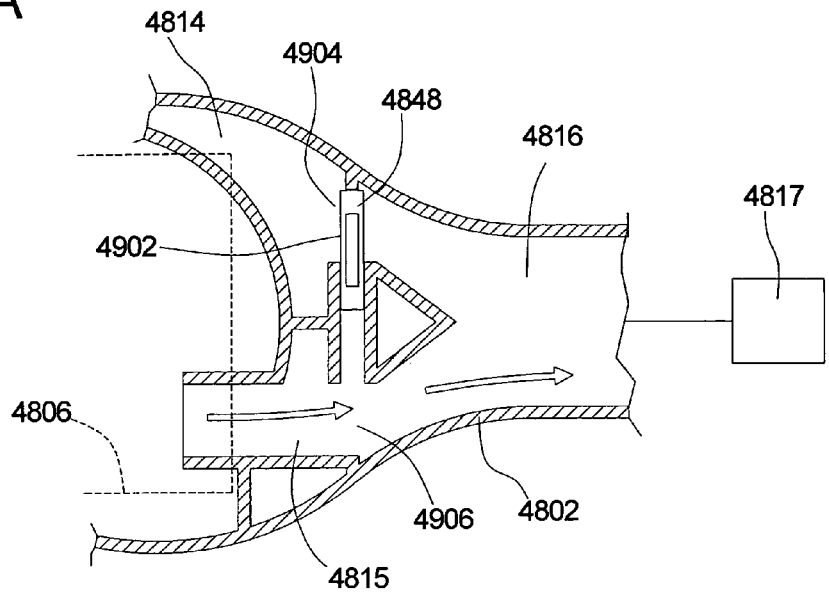
FIGS. 49A and 49B are a cut away top views of the modular agitator assembly of FIG. 48A showing a mode selector valve in the agitating and vacuuming positions, respectively.

Although it is desirable to have a connection system that automatically enables the airflow to agitator vacuum port 4816 whenever agitator module 4804 is installed, such a system is not necessary in an embodiment of the invention having a mode selector valve 4848. Mode selector valve 4848 controls the amount of air that passes into main vacuum passage 4816 from vacuum inlet passage 4814 and/or agitator vacuum port 4815. One embodiment of a mode selector valve 4848 is depicted in FIGS. 49A and B, which show mode selector valve 4848 in the agitating and vacuuming positions, respectively. Mode selector valve 4848 comprises a blocking surface 4902 that is slidably movable between a vacuuming port 4904 and an agitating port 4906. Vacuuming port 4904 is an opening between vacuum inlet passage 4814 and main vacuum passage 4816, and agitating port 4906 is an opening between agitator vacuum port 4815 and main vacuum passage 4816. As mode selector valve 4848 is moved back and forth, it blocks all or a portion of vacuuming port 4904 and/or agitating port 4906. In the shown embodiment, the length of mode selector valve 4848 is selected such that it can be positioned between vacuuming port 4904 and agitating port 4906 without blocking either, which allows simultaneous full-power vacuuming and agitating.

Figure 49B:
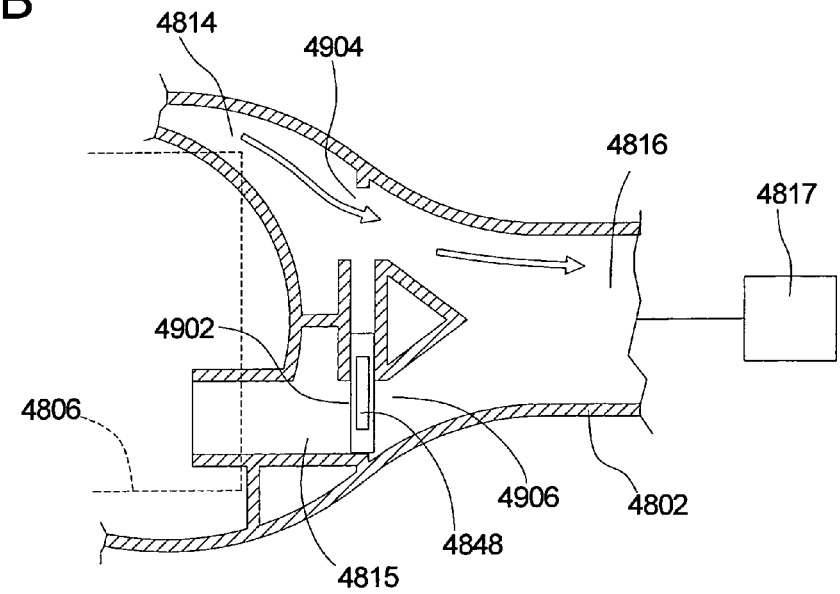

In FIG. 49A, the agitating position, mode selector valve 4848 is in a first operating position in which fluid communication between vacuum inlet passage 4814 and main vacuum passage 4816 is blocked, and fluid communication between agitator vacuum port 4815 and main vacuum passage 4815 is allowed. In FIG. 49B, the vacuuming position, mode selector valve 4848 is in a second operating position in which fluid communication between vacuum inlet passage 4814 and main vacuum passage 4816 is allowed, and fluid communication between agitator vacuum port 4815 and main vacuum passage 4815 is blocked. A variable mixed-mode operating position is also available between the agitating position and the vacuuming position, in which both vacuum inlet passage 4814 and agitator vacuum port 4815 are in fluid communication with main vacuum passage 4816. In this mode, the device simultaneously vacuums and agitates, and the relative strengths of these operations can be adjusted by the user, in essentially infinite relative proportions, by moving mode selector valve 4848 back and forth to restrict the vacuuming port 4904 and/or the agitating port 4906. In order to help control its operation and prevent inadvertent actuation, mode selector valve 4848 may be equipped with detents to hold it in certain positions, such as full-vacuum, full-agitate, and 50/50 vacuum and agitate.

When mode selector valve 4848 is provided on modular agitator assembly 4800, the operator can place it in the vacuuming position whenever agitator module 4804 is removed from main housing 4802 to prevent unwanted vacuum leakage through agitator vacuum port 4815. Of course, this is not required when the device has an automatic shutoff mechanism, such as spring-loaded door 4846. One advantage of not providing an automatic shutoff is that the user can adjust mode selector valve 4848 to bleed air in through agitator vacuum port 4815 when agitator module 4804 is removed, to thereby control the strength of the vacuum applied through vacuum inlet passage 4814.

In still another embodiment of the invention, agitator module 4804 may be adapted to automatically actuate mode selector valve 4848 when it is removed to move it to the vacuuming mode position and prevent airflow through agitator vacuum port 4815. For example, main housing 4802 may have a spring-actuated lever that presses mode selector valve 4848 into the vacuuming position, and agitator module 4804 may have a pin that moves this lever out of the way when agitator module 4804 is installed, thereby making it possible to move mode selector valve into the agitating position. When agitator module 4804 is removed, the pin is withdrawn and the lever is moved back into place by a spring to "lock out" the agitating position.

Mode selector valves are also beneficially used with non-modular agitator assemblies. For example, the non-modular agitator assembly 4500 of FIGS. 45A and B may incorporate a mode selector valve 4540 to regulate the relative intensities of its agitating and vacuuming functions. As shown in FIG. 45B, this embodiment of mode selector valve 4540 comprises a hollow chamber having a lower opening 4578 in its bottom surface, and a rear opening 4580 in its rearward-facing surface. An internal passage 5002 (FIGS. 50A–D) connects lower opening 4578 and rear opening 4580 to form a continuous passage through mode selector valve 4540. Mode selector valve 4540 fits into upper housing 4502*b* between vacuum inlet passage 4506 and main vacuum passage 4512, and is slideable from a forward position to a rearward position. Mode selector valve 4540 can also be placed in an essentially infinite range of positions intermediate the forward and rearward positions, or can be provided with detents to locate it in a discrete number of intermediate positions.

Figure 50A:
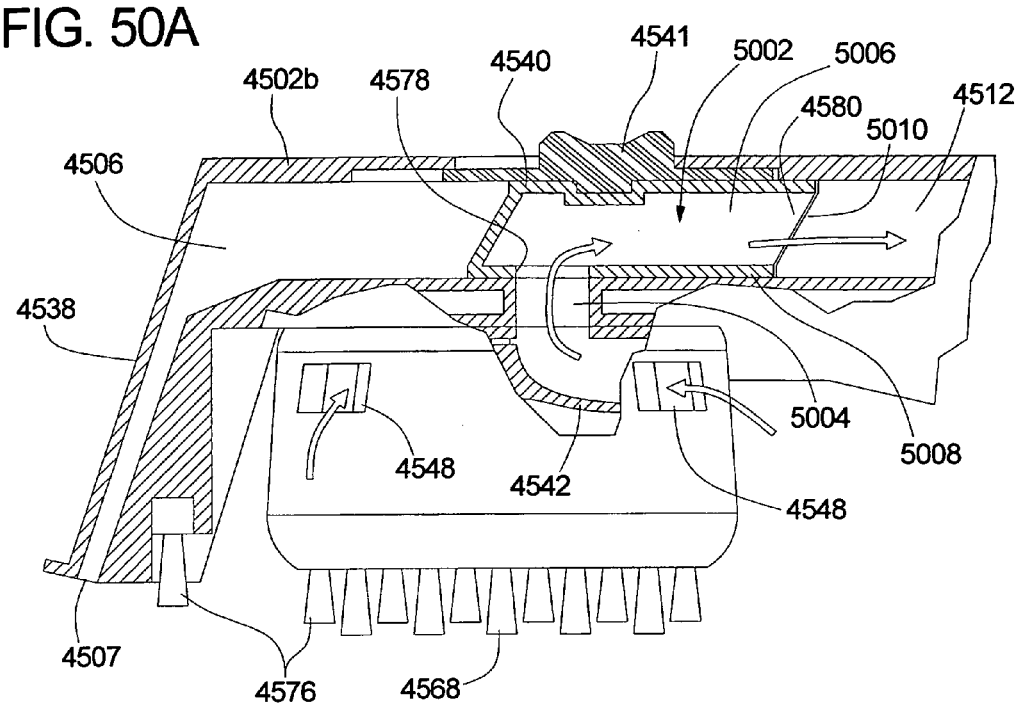
FIGS. 50A and 50B are partially cut away side and top views, respectively, of the modular agitator assembly of FIG. 45A showing the mode selector valve in the agitating position.
Figure 50B:
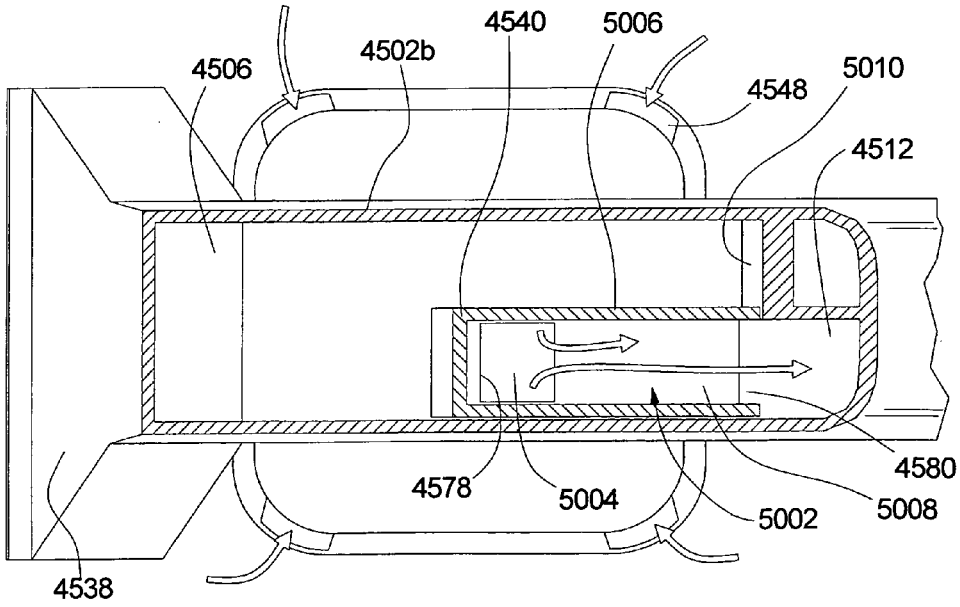
Figure 50C:
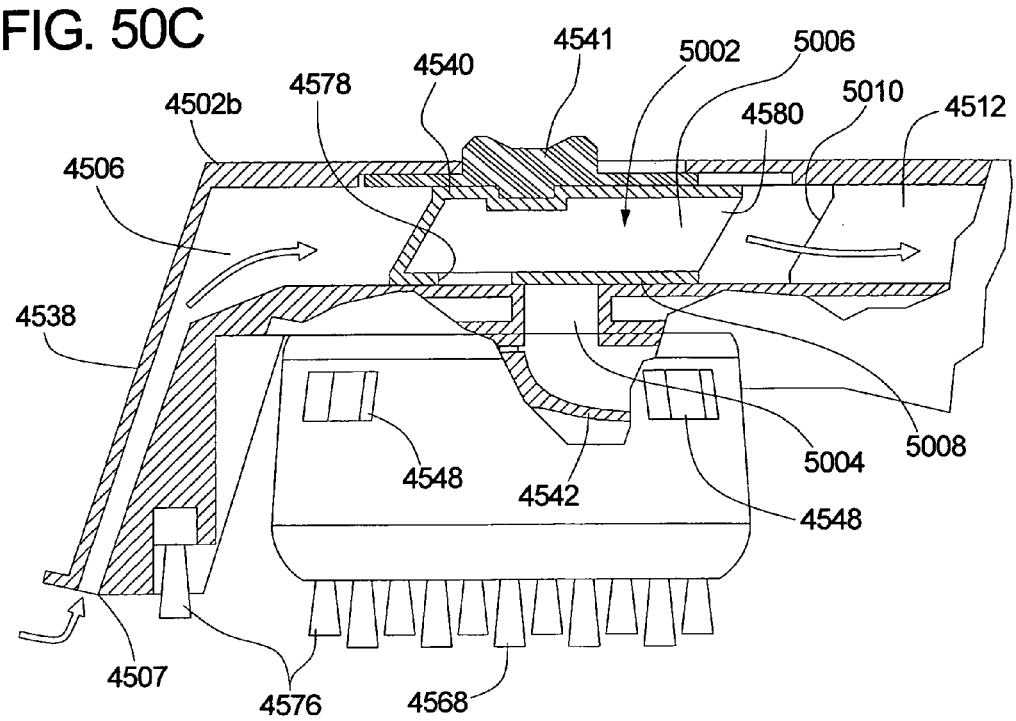
FIGS. 50C and 50D are partially cut away side and top views, respectively, of the modular agitator assembly of FIG. 45A showing the mode selector valve in the vacuuming position.
Figure 50D:
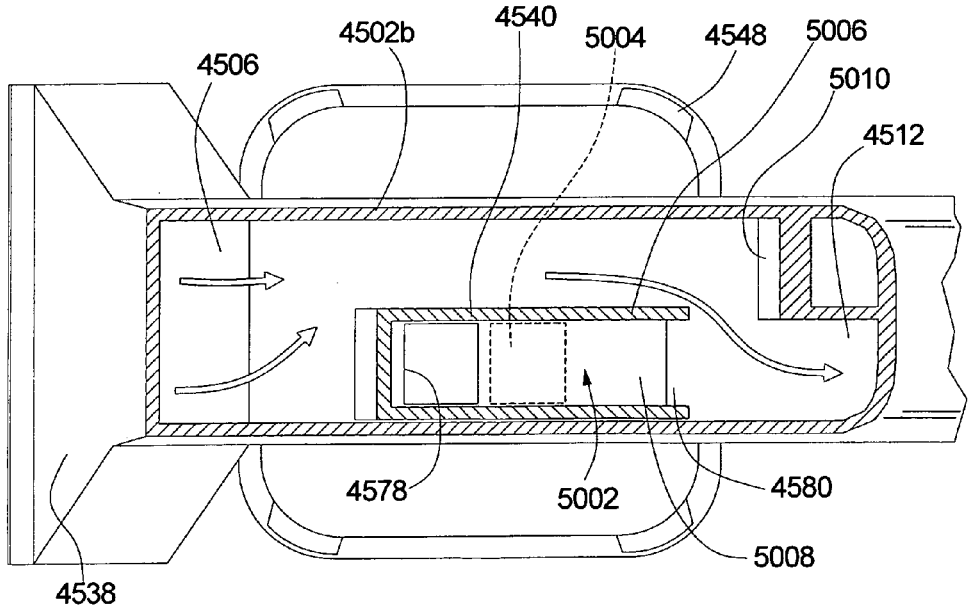

The operation of mode selector valve 4540 is shown in FIGS. 50A–D, with FIGS. 50A and B showing side and top views of the agitating position, and FIGS. 50C and D showing similar views of the vacuuming position. In the agitating position, mode selector valve 4540 is moved to its rearward position within upper housing 4502*b*. In this position, lower opening 4578 is oriented over an agitator vacuum port 5004 to allow air to enter turbine air openings 4548, pass through air turbine 4542 to operate it, and into main vacuum passage 4512, as shown by the arrows in FIGS. 50A and B. Also in this position, a side wall 5006 of mode selector valve 4540 is located adjacent an interior housing wall 5010 to substantially block the air path between vacuum inlet passage 4506 and main vacuum passage 4512 and prevent any appreciable vacuuming action.

In the vacuuming position, shown in FIGS. 50C and D, mode selector valve 4540 is in its forward position. In this position, side wall 5006 is moved forward away from interior housing wall 5010 to allow air to flow from inlet slit 4507, through vacuum inlet passage 4506, and into main vacuum passage 4512, as shown by the arrows. Also in this position, agitator vacuum port 5004 is no longer positioned under lower opening 4578, and is instead covered by a lower wall 5008 of mode selector valve 4540 to block airflow therethrough. Mode selector valve 4540 can also be positioned in intermediate positions to provide a blend of agitation and vacuuming, as noted previously herein.

Although the mode selector valves described with reference to FIGS. 49A–B and FIG. 50A–D both comprise slide-type valves, they throttle the airflow through their respective vacuum inlet passages and agitator vacuum ports in different manners. Specifically, mode selector valve 4848 of FIGS. 49A–B only throttles one of the passages at a time, while the other remains fully-opened. In contrast, mode selector valve 4540 of FIGS. 50A–D simultaneously opens one passage while closing the other. This second embodiment has been found to be advantageous because it allows the device to be more compact. Mode selector valve 4848, vacuuming port 4904 and agitating port 4906 of FIGS. 48A–B may also be re-shaped or sized to provide simultaneous throttling of both passages, as provided by mode selector valve 4540.

The mode selector valve 4540 of FIGS. 50-A–D also provides the advantage of providing a convoluted path from vacuum inlet passage 4506 to agitator vacuum port 5004, which is useful to prevent fluid recovered during the vacuuming operation from flowing or dripping into air turbine 4542 and potentially harming it. As shown in FIGS. 50C–D, in order for water to travel from vacuum inlet passage 4506 to agitator vacuum port 5004, the fluid would have to escape the airflow into main vacuum passage 4512, completely reverse its direction, travel down the length of internal passage 5002, and fall through lower opening 4578. Furthermore, fluid that is settled on the floor of vacuum inlet passage 4506 or main vacuum passage 4512 would have to rise over the rear lip of lower wall 5008 in order to continue to agitator vacuum port 5004.

While the mode selector valves described herein have comprised slide valve-type structures, it is also envisioned that embodiments of the present invention may have different types of mode selector valves, and any type of valve that blocks airflow can be used. For example, the mode selector valve may comprise a rotary valve that draws air through a rotatable tube. The tube is fitted into a hole having a vacuum inlet passage and an agitator vacuum passage located at different locations about the hole's circumference, and the tube can be rotated through various positions about its circumference to receive air from either or both of the vacuum inlet passage and the agitator vacuum port. In another embodiment, the mode selector valve may comprise a simple damper door that can be pivoted to obstruct the air flow from either the vacuum inlet passage or the agitator vacuum port. In addition, in another embodiment of the invention, the mode selector valve may be bifurcated into two separate and individually-operable valves that each control one of the vacuum inlet passage and the agitator vacuum port. Other variations will be readily apparent to those of ordinary skill in the art.

Still another aspect of the present invention is a unique surface cleaning tool that can be attached to the vacuum inlet nozzle of a wet extractor or other cleaning device to provide improved cleaning performance on particular surfaces. In general terms, the surface cleaning tool of the present invention comprises a main body that is selectively positioned adjacent an elongated inlet nozzle or slit of a cleaning device. A forward inlet extends along the inlet nozzle and provides a first passage through the main body into the inlet nozzle, and a rearward inlet extends along the inlet nozzle and provides a second passage to the inlet nozzle. A wiper is attached to the main body and extends along the inlet nozzle. The wiper is positioned between the first inlet and the second inlet, and can move into positions where it blocks either the forward or rearward inlet. As the device is moved on a floor or other surface being cleaned, the wiper moves to block the inlet located opposite the direction of movement. For example, when the cleaning device is moved forward, the wiper moves backwards (relative to the rest of the device) and covers the rearward inlet, and vice versa. This applies the vacuum provided from the vacuum inlet nozzle in front of the wiper (with respect to the device's direction of travel), regardless of whether the device is moved forward or backward. The present invention is particularly suited for cleaning bare surfaces, such as tile and hardwood floors, windows, linoleum, countertops and the like, but may also be used on other surfaces.

Figure 51A:
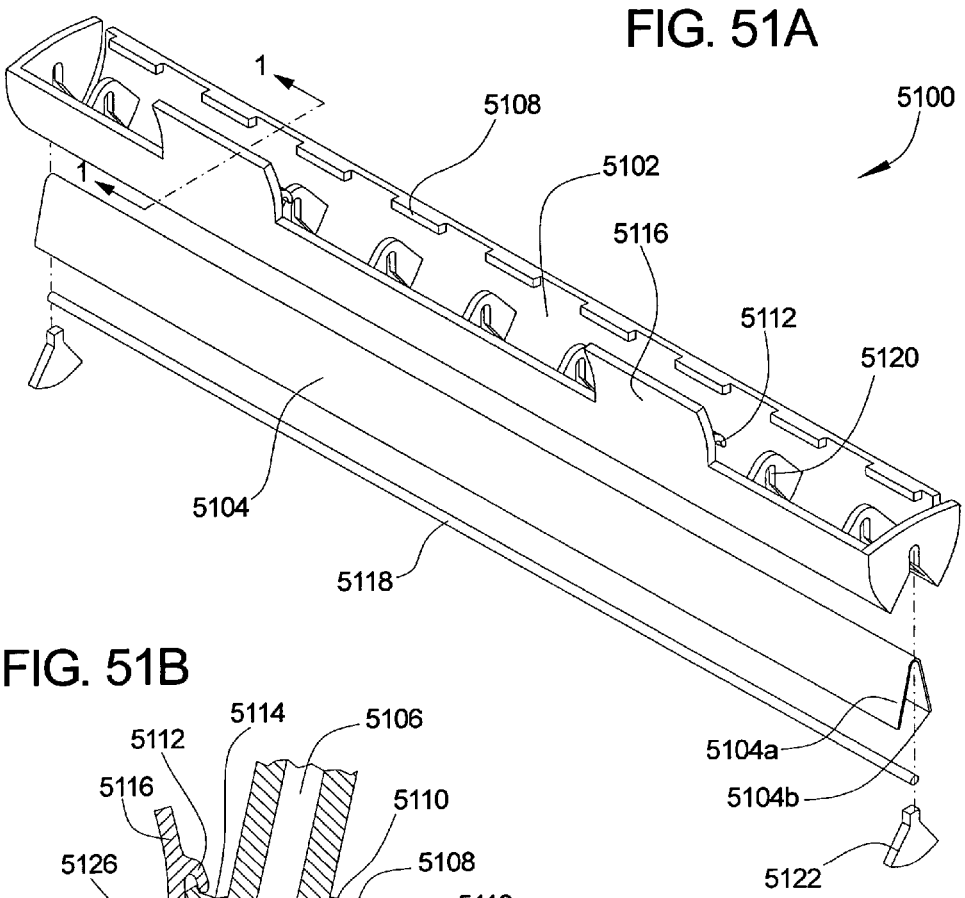
FIG. 51A is an exploded isometric view of a surface cleaning tool of one embodiment of the present invention.
Figure 51B:
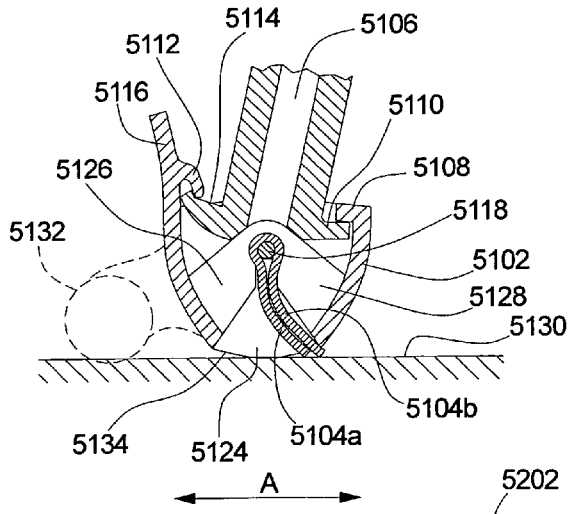
FIG. 51B is a cut away side view of the surface cleaning tool of FIG. 51A as seen from reference line 1—1 thereof, and shown attached to the inlet nozzle of a cleaning device.

Referring now to FIGS. 51A–B, an embodiment of a surface cleaning tool of the present invention is described in detail. Surface cleaning tool 5100 comprises a main body 5102 and a wiper 5104. Main body 5102 may either be integrally formed with the cleaning device to which tool 5100 is attached, or may be separately formed and equipped with means to attach and detach it from the cleaning tool. Main body 5120 is elongated to fit over all or most of a cleaning device's elongated vacuum inlet nozzle. In the shown embodiment, main body 5102 comprises a molded detachable piece made of hard plastic or another rigid material, that fits over the inlet nozzle 5106 (FIG. 51B) of a cleaning device. Main body 5102 preferably has rear clips 5108 that wrap around a rear ledge 5110 of inlet nozzle 5106, and front clips 5112 that wrap around a front ledge 5114 of inlet nozzle 5106. Tool 5100 preferably is installed by hooking rear clips 5108 over rear ledge 5110 and pressing upwards until front clips 5112 snap into engagement with front ledge 5114. A finger grip 5116 is provided to assist the user with removing front clips 5112 to remove surface cleaning tool 5100.

Inlet nozzle 5106 eventually leads to a vacuum source that draws air up through main body 5102. Although the present invention may be used with any type of cleaning device, it is preferably used with a wet extractor, and in this embodiment, inlet nozzle 5106 leads to the vacuum source by way of a recovery tank, as described elsewhere herein, that is adapted to remove debris and water entrained in the air. Inlet nozzle 5106 is positionable proximal to the surface that is desired to be cleaned, and may either be part of a cleaning device's lower housing, such as a housing that is adapted to be moved across a floor, or part of an accessory cleaning tool or portable device that is intended to clean raised or remote surfaces and surfaces that are inaccessible to large floor cleaning devices.

In the embodiment of FIGS. 51A–B, wiper 5104 comprises first and second wiper blades 5104*a* and 5104*b* that are arranged parallel to one another, and preferably formed of opposite parts of the same folded piece of material. Wiper 5104 may be attached to main body 5102 in any manner that is suitable with the objectives described herein. Preferably, wiper 5104 is retained by folding wiper 5104 over a pin 5118, and pressing the wiper and pin into a series of slots 5120 in main body 5102. By using a slight interference fit, pin 5118 and wiper 5104 lodge firmly into slots 5120. One or more plugs 5122 may also be snap-fitted, glued or otherwise attached to main body 5102 to hold pin 5118 and wiper 5104 in slots 5120. Wiper 5104 is oriented to extend along the length of, and generally below, the cleaning device's elongated inlet nozzle 5106 when floor cleaning device 5100 is installed.

Wiper 5104 may comprise any resilient flexible material, and preferably comprises a natural or synthetic rubber or polymeric compound having good durability and chemical stability. When used with wet extractors that apply a chemical solution to the surface being cleaned, wiper 5104 should be made from a material that resists chemical attack by any anticipated cleaning solutions.

Wiper 5104 extends through an opening 5124 through the bottom of main body 5102, and effectively divides the open space within main body 5102 into a forward inlet 5126 and a rearward inlet 5128. The lengths of the wiper blades 5104*a* and 5104*b* are selected such that they contact the surface being cleaned 5130 when main body 5102 is placed on surface 5130.

During use, surface cleaning tool 5100 and the device to which it is attached are moved in a back-and-forth motion, generally along reference arrow A of FIG. 51B. As tool 5100 is moved forward (to the left in FIG. 51B), friction contact with surface 5130 causes first and second wiper blades 5104*a* and 5104*b* to drag behind to a first position in which one or both of wiper blades 5104*a* and 5104*b* blocks or obstructs rearward inlet 5128. This position is shown in FIG. 51B. When moved rearward (to the right in FIG. 51B), wiper blades 5104*a* and 5104*b* move to a second position in which one or both of them blocks forward inlet 5126. The rigidity and lengths of wiper blades 5104*a* and 5104*b* can be readily tailored to provide the desired back-and-forth pivoting in response to friction forces with the surface 5130. Although the use of friction to move wiper blades 5104*a* and 5104*b* to their first and second positions is preferred, it is also envisioned that other means, such as a mechanical linkage, may be used to actuate wiper 5104 between the first and second positions, and such means may be controlled manually or by an automated system-that senses the direction of the device's movement.

The direction-sensitive vacuum-blocking wiper 5104 of the present invention provides distinct advantages over conventional designs that use separate wipers located on opposite sides of the inlet nozzle. For example, the single, central wiper performs the water-capturing "squeegee" function in both directions of travel, and selectively applies the vacuum to whichever inlet is located above the operating side of the wiper to recover the accumulated fluid and debris. Consequently the vacuum is always applied in the proper location relative to the movement of the device. As such, it is unnecessary to provide two separate wipers, and it is further unnecessary to modify the wipers, as required in the prior art, to allow them to pass fluid when going in one direction, while capturing fluid when going in the other direction.

Of course, various other embodiments of the invention are possible. For example, floor cleaning device 5100 (or inlet nozzle 5106, or the device to which inlet nozzle 5106 is connected) may be equipped with wheels 5132 (shown in phantom) that hold opening 5124 a predetermined distance above the surface being cleaned 5130. Wheels 5132 also may be placed on user-adjustable mounts so that the user can change the predetermined height of opening 5124 to tailor the cleaning performance to particular surfaces. When wheels 5132 are not provided, the height of opening 5124 may be dictated by the overall geometries and shape of the cleaning device to which surface cleaning tool 5100 is attached, or surface cleaning tool 5100 may have extended skids 5134 at either end upon which it rests to hold opening 5124 above the surface 5130. Skids 5134 are shown here as the lower edge of plugs 5122, but may be made integrally with other parts of the device.

Figure 52:
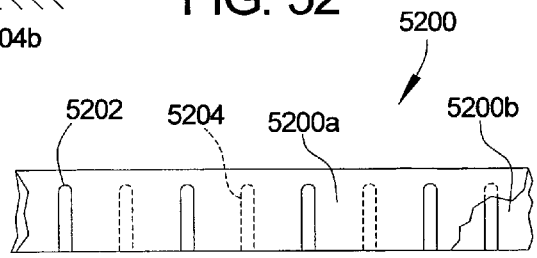
FIG. 52 is a fragmented front view of an embodiment of a wiper that may be used with an embodiment of the present invention.

Another embodiment, shown in FIG. 52, comprises a wiper 5200 having a number of slots 5202 and 5204. Wiper 5200 is similar to wiper 5104 of FIG. 51A–B in that it comprises parallel first and second blades 5200*a* and 5200*b*, which may be folded halves of the same piece of material. A first set of slots 5202 are made in first wiper blade 5200*a*, and a second set of slots 5204 are made in second wiper blade 5200*b*. Slots 5202 and 5204 provide additional flexibility to wiper 5200, which allows wiper 5200 to conform to irregular surfaces, particularly when wiper blades 5200*a* and 5200*b* are made of a relatively rigid material. The sets of slots 5202 and 5204 preferably are offset relative to one another to prevent fluid and vacuum air from escaping past the wiper blades 5200*a* and 5200*b*, but may alternatively be aligned relative to one another to increase the flexibility of wiper 5200.

In still other embodiments, the type and number of wipers and the manner in which the wipers operate can be varied. Five exemplary alternative embodiments are now described with reference to FIGS. 53–57.

Figure 53:
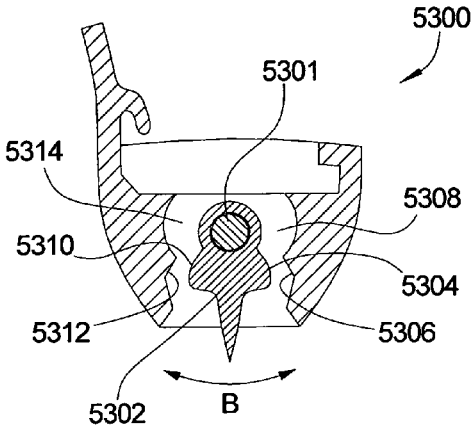
FIGS. 53 to 56 are cut away side views of four additional embodiments of surface cleaning tools of the present invention.

In the surface cleaning tool 5300 of FIG. 53, the flexible ribbon-type wiper blades 5104*a* and 5104*b* are replaced by a single pivoting wiper 5302. Pivoting wiper 5302 is shown in a neutral position in FIG. 53, and is adapted to pivot about a pivot point 5301 in the directions shown by arrow B. Pivoting wiper 5302 has a first side 5304 that abuts a corresponding first wall 5306 in rearward inlet 5308 to block or impede airflow therethrough when pivoting wiper 5302 is in the first position (i.e., when the device is being moved forward), and a second side 5310 that abuts a corresponding second wall 5312 in forward inlet 5314 to block or impede airflow therethrough when pivoting wiper 5302 is in the second position (i.e., when the device is being moved backward). In operation, surface cleaning tool 5300 operates in substantially the same manner as surface cleaning tool 5100.

While the pivoting wiper 5302 of surface cleaning tool 5300 is shown having a single blade, it is also envisioned that such a wiper may also be constructed with multiple conjoined blades. For example, the surface cleaning tool 5400 of FIG. 54 has a single pivoting wiper 5402 having a plurality of radially-extending conjoined wiper blades 5404. Such multiple blades 5404 may provide improved containment and wiping of fluids. This embodiment is substantially the same as the embodiment of FIG. 53 in all other respects.

Figure 54:
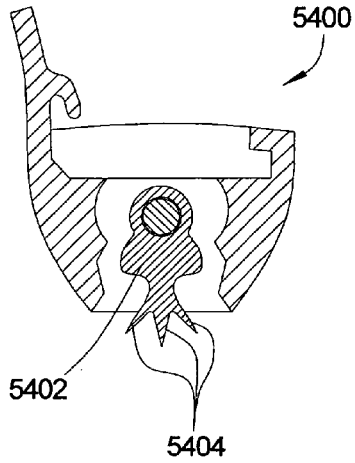
Figure 55:
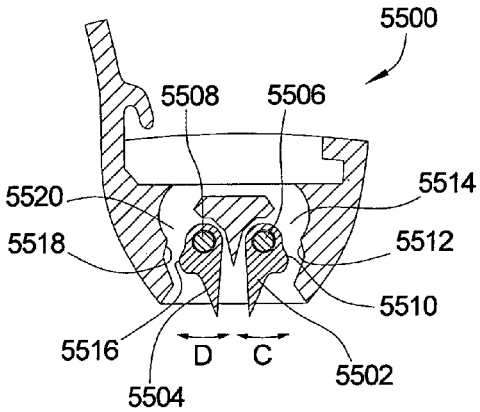
Figure 56:
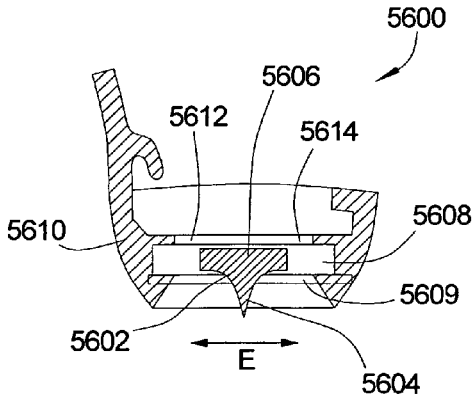

In still another embodiment, shown in FIG. 55, the present invention may comprise two or more separate wipers. In this embodiment, surface cleaning tool 5500 has parallel but separately-formed and separately-pivoting first and second wipers 5502 and 5504. First wiper 5502 pivots about a first pivot 5506 in the directions shown by arrow C, and second wiper 5504 pivots about a second pivot 5508 in the directions shown by arrow D. Each of these wipers 5502 and 5504 may comprise a single blade, as shown in FIG. 53, or multiple blades, as shown in FIG. 54. In this embodiment, first wiper 5502 has a side 5510 that abuts a corresponding wall 5512 to block airflow through the rearward inlet 5514 when the device is moved forwards, and second wiper 5502 has a side 5516 that abuts a corresponding wall 5518 to block airflow through the forward inlet 5520 when the device is moved backwards.

While the embodiments provided heretofore have described the wiper as pivoting within the main body of the surface cleaning tool, it is also envisioned that other types of wiper movement may be successfully employed with the present invention. For example, the surface cleaning tool 5600 of FIG. 56 comprises a wiper 5602 that slides within the device. In this embodiment, wiper 5602 comprises one or more blades 5604 that extend from a slide body 5606. Slide body 5606 is retained on a track 5608 in main body 5610, and is free to slide in the directions shown by reference arrow E. Track 5608 may be formed, for example, by inserting slide body 5606 into an opening in main body 5610 and inserting pins 5609 through main body 5610 to capture slide body 5606 and simultaneously form the lower side of track 5608. During operation, friction contact between blade 5604 and the surface being cleaned causes slide body 5602 to slide and block either the forward inlet 5612 (when the device is moved backward), or the rearward inlet 5614 (when the device is moved forward).

Figure 57:
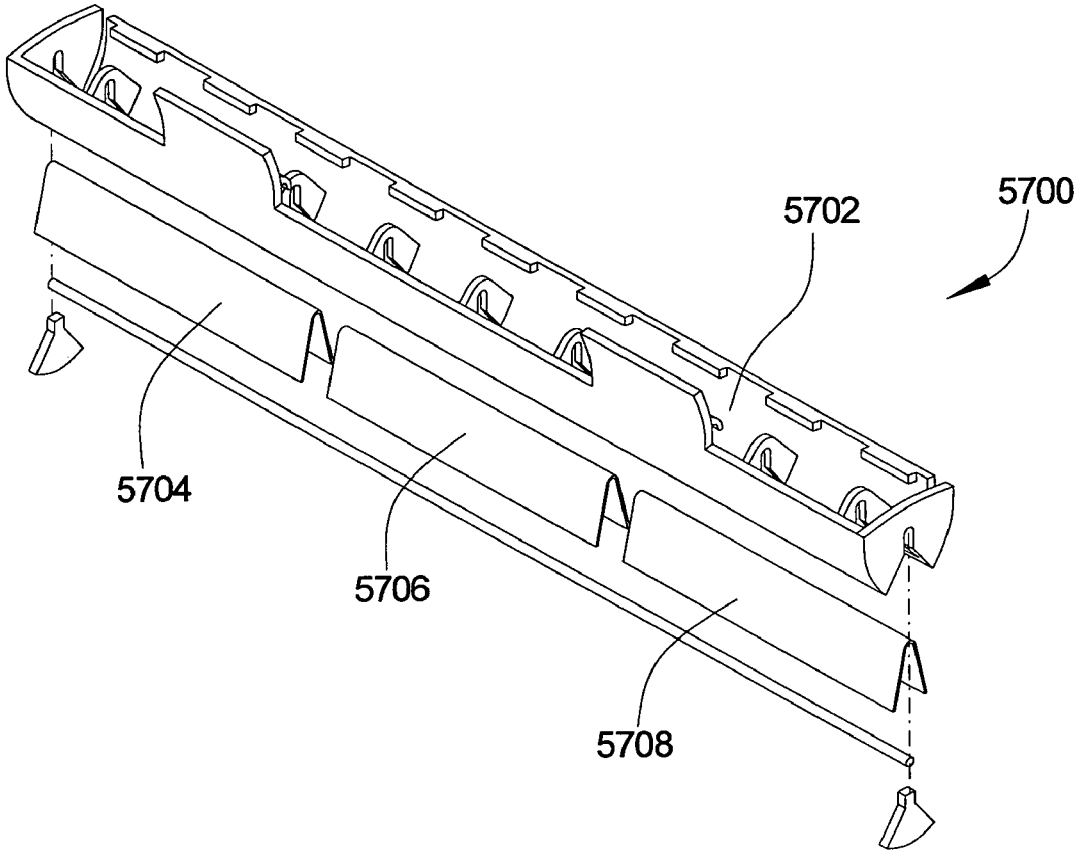
FIG. 57 is an exploded isometric view of another embodiment of a surface cleaning tool of the present invention.

Referring now to FIG. 57, in yet another embodiment, the surface cleaning tool 5700 may comprise multiple separate wipers 5704, 5706 and 5708 that are disposed end-to-end relative to one another within the main body 5702. The remainder of this embodiment is substantially the same as floor cleaning tool 5100 of FIGS. 51A–B. Such separate wipers also may be configured to overlap one another as well.

Figure 58:
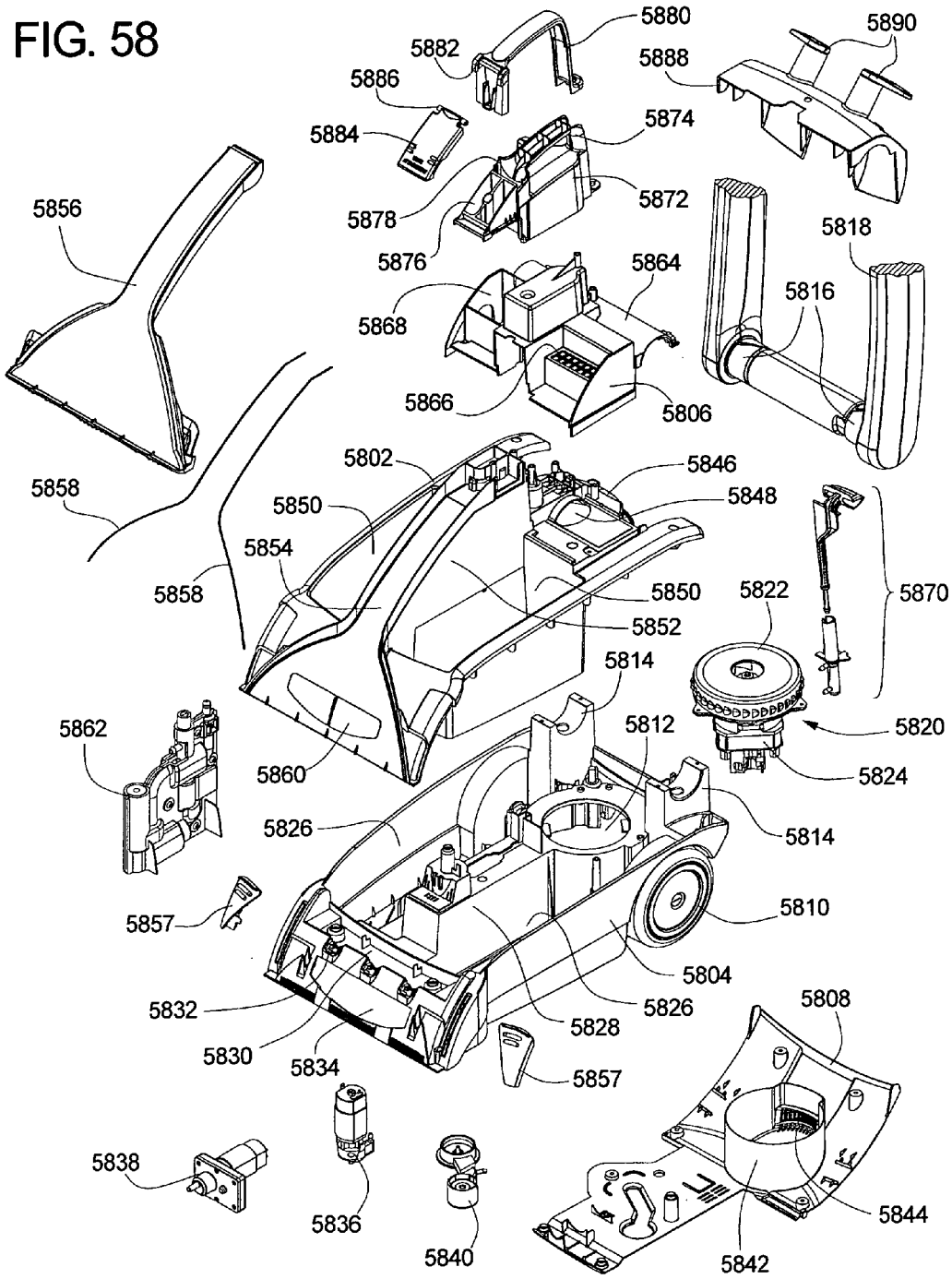
FIG. 58 is an exploded isometric view of a wet extractor of the present invention showing the housing construction thereof.

Referring now to FIG. 58, still another feature of the present invention is a unique lower housing construction for a cleaning device. The lower housing generally comprises a number of shells and covers, each of which may be formed as a separate, single piece, or as an agglomeration of separate pieces. The shells and covers fit together to retain or capture the various working parts of the device, as will now be described.

Lower shell 5804 comprises, at its back end, wheels 5810, a motor opening 5812, and handle supports 5814. Wheels 5810 support the back end of the device, as described elsewhere herein. The handle supports 5814 are shaped to receive pivoting bushings 5816 on the lower part of a handle assembly 5818, which may be a handle as described elsewhere herein or a conventional handle. Motor opening 5812 is shaped to receive a portion of a motor/fan assembly 5820, shown in FIG. 58 as comprising a fan 5822 and an electric motor 5824. Fan 5822 may comprise any suction, or pressure-producing device, and motor 5824 may be of any type. Motor 5824 and fan 5822 are attached to one another in a working sense at least to the extent that motor 5824 drives fan 5822 to produce a working air flow, such as through a drive shaft or gearbox, and may also be attached to one another physically to allow them to be handled as a single unit. Preferably, motor opening 5812 is large enough to receive motor 5824 at the point where it is connected to fan 5822, such that motor 5824 is located below the surface of lower shell 5804, and fan 5822 is located above lower shell 5804. A sealing and/or vibration reducing gasket (not shown) preferably is positioned between fan 5822 and lower shell 5804 to prevent air leakage and reduce noise emissions from the device.

The forward end of lower shell 5804 comprises a pair of laterally juxtaposed pockets 5826 with a hollow central rib 5828 positioned therebetween. At the front of lower shell 5804 is an inverted pocket 5830 for receiving an agitator assembly (not shown) and having one or more nozzle mounts 5832 for mounting fluid spray nozzles, as described previously herein. An opening 5834 may be provided to view the interior of inverted pocket 5830. A fluid pump 5836 and agitator drive 5838 are located in the underside of lower shell 5804 in the hollow central rib 5828 thereof. These parts are captured in place by a lower cover 5808, which fits over the bottom of lower shell 5804. Also captured between lower shell 5804 and lower cover 5808 is a mixing manifold 5840, which extends from the central rib 5828 into one of the pockets 5826, where a portion of the mixing manifold 5840 is exposed to receive a fluid supply tank valve assembly (not shown). The mixing manifold 5840, agitator drive 5838 and pump 5836 may be as described previously herein or of other design. Lower cover 5808 also comprises a motor shroud 5842, which at least partially surrounds motor 5824 when installed to contain and direct the flow of cooling air that passes over motor 5824 out vents 5844 to help cool the device. While the foregoing parts (and any other parts described herein) are described as being captured in place, it will be understood that the parts may alternatively or additionally be held by fasteners, adhesives, or otherwise held in place.

An upper shell 5802 is provided, preferably as a single piece, to cover the upper surface of lower shell 5804. At the back, upper shell 5802 comprises a shroud that fits over fan 5822 to control the flow of air into and out of the fan. Shroud 5846 generally comprises a flat, cylindrical chamber that surrounds the peripheral edge of fan 5822, which is where air exits fan 5822. This chamber cooperates with a corresponding surface of lower shell 5804 to form an air passage that directs air exiting fan 5822 downward through a vent (not shown) through the bottom of lower shell 5804. Shroud 5846 also comprises an inlet opening 5848 through which air can be sucked into the central opening of fan 5822. The forward end of upper shell 5802 comprises a pair of laterally juxtaposed pockets 5850 that surround an upper hollow central rib 5852. Pockets 5850 fit into the corresponding pockets 5826 when the upper and lower shells are assembled. Pockets 5850 are preferably formed to receive supply and recovery tanks, as described previously herein, and do not have bottom walls, so that the supply and recovery tanks rest directly on the lower shell 5804.

Upper shell 5802 also has formed thereon a nozzle conduit 5854, which, in conjunction with a nozzle cover 5856, forms an inlet nozzle that extends from an inlet slit at the surface being cleaned, to a recovery tank located in one of the pockets 5850. A pair of seals 5858 are provided to help seal the junction between nozzle cover 5856 and nozzle conduit 5854, and tabs 5857 are provided to hold nozzle cover 5856 in place. The construction and operation of nozzle cover 5856 and nozzle conduit 5854 are described in greater detail below. A portion of nozzle conduit 5854 may comprise a window 5860, which is located adjacent opening 5834 when assembled, through which the interior of agitator chamber 5830 can be viewed.

Upper shell 5802 and lower shell 5804 are assembled together to capture fan 5822 and a liquid management assembly 5862 between the shells. Liquid management assembly 5862 fits within upper hollow central rib 5852, and preferably is constructed in accordance with the teachings herein to allow the overall size of hollow central rib 5852 to be reduced.

An upper cover 5806 is provided to cover the rear portion of upper shell 5802, capture the handle assembly 5818 in place, and provide a location for a detergent bottle, if desired (not shown). The rear portion of upper cover 5806 comprises a curved surface that forms an upper bearing retainer 5864 for both handle bushings 5816. While bearing retainer 5864 is shown as a single continuous surface, it may also be divided into separate bearing retaining surfaces. At its front, upper cover 5806 comprises, on one side, a vacuum passage 5866, which is adapted to receive the air outlet of a recovery tank, such as those described elsewhere herein. Upper cover 5806 is formed such that it provides a closed fluid passage between vacuum passage 5866 and inlet opening 5848 through upper shell 5802, and one or more seals (not shown) may be provided at the junction between upper cover 5806 and upper shell 5802 to seal this passage. Upper cover 5806 may also be provided with a pocket 5868 that is adapted to receive a detergent bottle (not shown). Such a pocket may alternatively be provided in upper shell 5802 or elsewhere. When pocket 5868 is provided in upper cover 5806, the assembly may further comprise a detergent flow valve assembly 5870, such as those described elsewhere herein, that is captured in place between upper cover 5806 and either upper shell 5802 or lower shell 5804.

The lower housing of FIG. 58 further comprises a lower handle housing 5872 that is adapted to fit over upper cover 5806. Lower handle housing 5872 may also be made integrally with upper cover 5806. Lower handle housing 5872 comprises a grip portion 5874 at its top, a set of access ports 5876 at its front, and a first access port cover retainer 5878. When installed, access ports 5876 are positioned rearward of nozzle cover 5856 to form a portion of the vacuum conduit between the inlet slit and the recovery tank, and above upper shell 5802 adjacent the liquid management assembly 5862. This location allows an accessory tool plug to be inserted into the device to simultaneously divert vacuum to the accessory tool and actuate various features of the liquid management assembly 5862.

An upper handle housing 5880 is provided to slide over lower handle housing 5872 to form the upper portion of a handle that can be used to lift the device. Upper handle housing 5880 also includes a second access port cover retainer 5882 that, when assembled, cooperates with first access port cover retainer 5878 to pivotally capture an access port cover 5884 in place at its hinge 5886. Access port cover 5884 can thus be pivoted to cover or uncover the access ports 5876.

The lower housing also includes a rear cover 5888. This part fits over the rear portion of the lower housing to provide a cosmetically pleasing surface. The rear cover 5888 also comprises a pair of horizontally juxtaposed electrical cord retainers 5890. The electrical cord retainers 5890 each comprise a post having a cantilevered arm at the end, which are adapted to receive and hold a wound electrical cord (not shown). Preferably, the cantilevered arm of at least one of the electrical cord retainers 5890 is adapted to pivot about the axis of the post to facilitate the removal of the wound electrical cord.

The various parts of the lower housing of FIG. 58 may be assembled using any type of fastening devices, such as screws, friction fits, adhesives, ultrasonic bonds, and the like.

The present invention also addresses a common inconvenience relating to wet extractors, which is that it is often difficult or impossible to access the interior of the inlet nozzle, which is typically a narrow slit, for routine cleaning and obstruction removal. In some previously known wet extractors, the inlet nozzle is fabricated either as a monolithic piece that can not be opened, in which case cleaning can only be accomplished by using pipe cleaners and other narrow implements. In other known extractors, the inlet nozzle comprises a nozzle cover, which forms half of the nozzle passage, that may be removed by unfastening screws or other fasteners using tools. While such extractors are more readily cleaned than those with monolithic inlet nozzles, it is not uncommon for the threaded fastener holes in the device to become stripped or broken after repeated cleanings. Users also must keep tools at the ready to in case the inlet nozzle becomes clogged during use. The present invention addresses these problems by providing an improved nozzle cover removal system that allows quick and simple access to the interior of the inlet nozzle for cleaning. An embodiment of this feature will now be described with reference to FIGS. 59A and B.

Figures 59A, 59B, 59C:
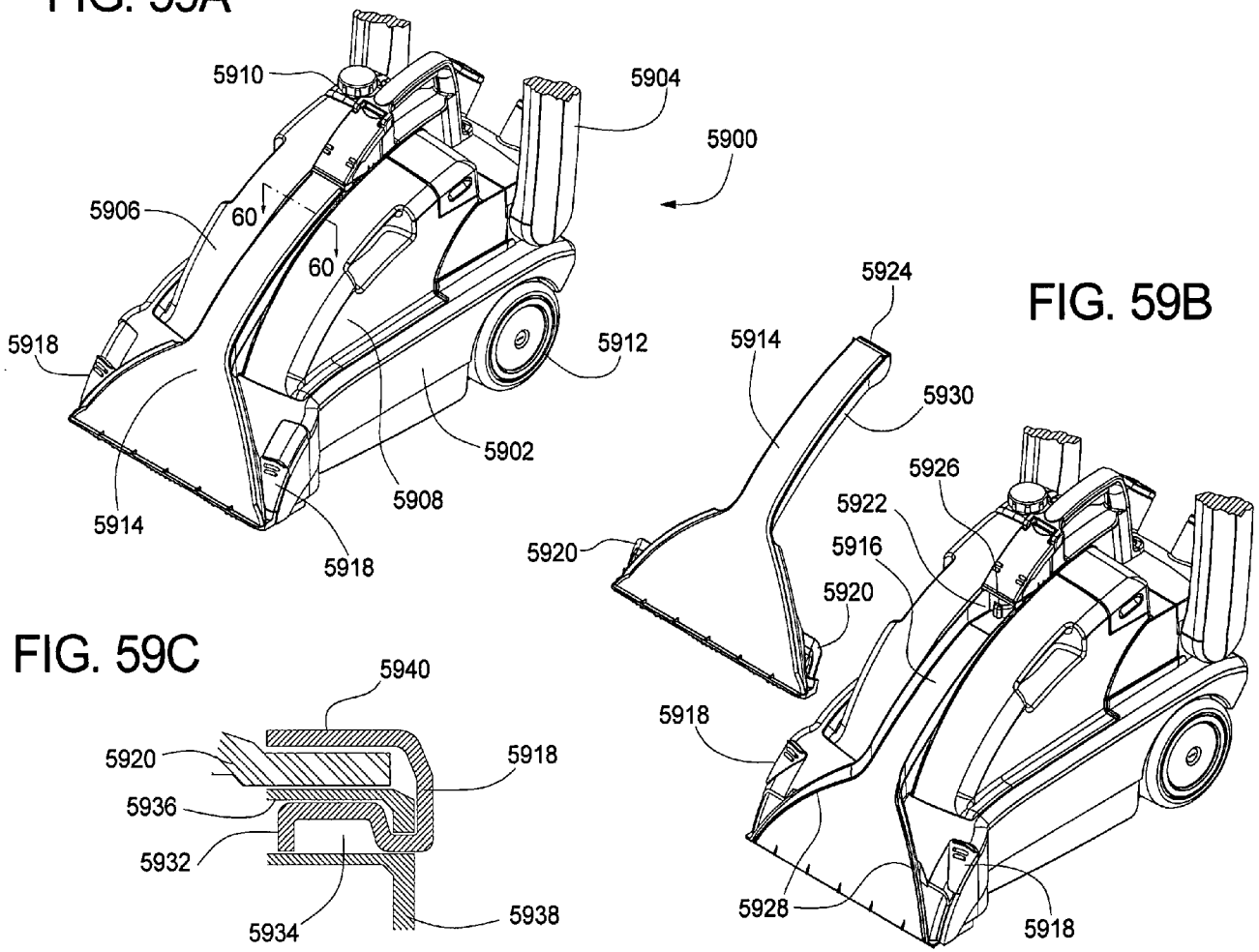
FIGS. 59A and 59B are isometric views of the embodiment of FIG. 58, shown with the nozzle cover attached and removed, respectively.
FIG. 59C is a section view of a nozzle assembly tab of the embodiment of FIGS. 59A and B.

FIGS. 59A and B depict an embodiment of a nozzle assembly of the present invention shown on an exemplary wet extractor 5900 having a base housing 5902 and an upright handle 5904 (shown partially removed). Base housing 5902 is supported on wheels 5912, and carries a supply tank 5906, a recovery tank 5908 and a detergent tank 5910, as well as various other features of the extractor 5900. While it is preferred that wet extractor 5900 and its various constituent parts be constructed according to the teachings herein, this is not necessary for the nozzle cover assembly of the present invention. Indeed, the nozzle cover assembly of the present invention may be used with any type of wet extractor having an inlet nozzle, regardless of the type of extractor (hand-held, canister, upright, etc.) or specific layout or composition of the extractor's components.

The nozzle cover assembly generally comprises a nozzle cover 5914, a nozzle conduit 5916, and one or more mounting tabs 5918. As shown in FIG. 59A, when nozzle cover 5914 is in place, it forms one half of an enclosed passage that extends from a slit-like inlet opening adjacent the surface being cleaned to the inlet of recovery tank 5908. When nozzle cover 5914 is removed, as shown in FIG. 59B, the enclosed passage is opened to reveal nozzle conduit 5916. When so removed, nozzle conduit 5916 and nozzle cover 5914 can be easily cleaned without resorting to pipe cleaners or other special tools.

When attached, nozzle cover 5914 is held in place at the front by tabs 5918, which slide over and engage flanges 5920 that are integrally formed with and laterally extend from either side of the front of nozzle cover 5914. Alternatively, tabs 5918 may simply slide over portions of the nozzle cover 5914 itself (i.e. extending flanges are not required). Tabs 5918 can be made in any suitable manner, but are preferably formed, as shown in FIG. 59C, as folded-over members that have one arm 5932 captured in an elongated sliding passage 5934 located between upper and lower housing shells 5936, 5938, and a free arm 5940 that acts as the tab to hold the flanges 5920 in place. The sliding passage 5934 may also include detents or bumps that hold tabs 5918 in certain positions (such as opened and closed positions). The back of nozzle cover 5914 is held in place by being captured within and opening 5922 that leads to recovery tank 5908. To facilitate this attachment, the back of nozzle cover 5914 is provided with a lip 5924 that hooks into an upper edge 5926 of opening 5922.

Figure 60A:
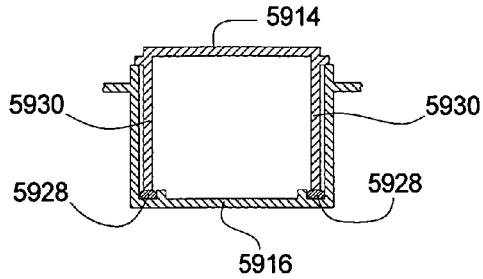
FIG. 60A is a section view of the nozzle cover and housing of FIG. 59A, as viewed along line 60—60 of FIG. 59A.
Figure 60B:
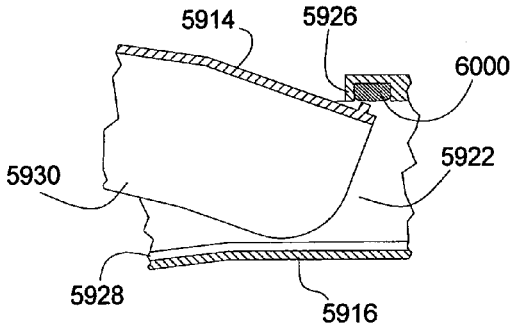
FIGS. 60B and 60C are a side section views of the nozzle cover and housing of FIG. 59A, shown with the nozzle cover partially and fully installed, respectively.
Figure 60C:
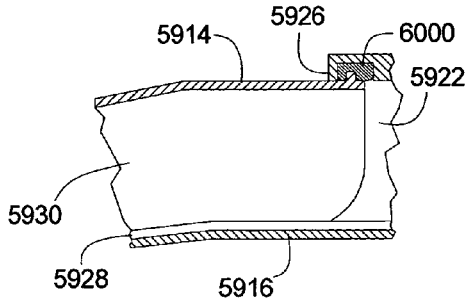

Referring now also to FIGS. 60A–C, one or more seals may also be provided to help seal nozzle cover 5914 to nozzle conduit 5916 to form an airtight passage between the inlet slit and recovery tank 5908. First seals 5928 are provided along the lower corner of each side of nozzle conduit 5916. These are engaged by the edges of a skirt 5930 that extends downward from nozzle cover 5914. This seal engagement is shown in FIG. 60A. The skirts 5930 add bending stiffness to nozzle cover 5914, which helps maintain a good seal along the entire length of nozzle cover. A second seal 6000 is provided under upper edge 5926 of opening 5922, as shown in FIGS. 60B and C. Second seal 6000 engages lip 5924 on nozzle cover 5914 to provide an airtight seal along the joined surfaces. The seals may be formed in any suitable manner, such as from separate pieces of flexible, airtight material (like closed-cell foam or rubber), by overmolding a soft flexible material directly to the extractor housing in the appropriate locations, or by any number of other means.

As shown in FIGS. 60B and C, nozzle cover 5914 is preferably installed by inserting lip 5924 into opening 5922, as shown in FIG. 60B, then pivoting nozzle cover 5914 downward until it seals against the first and second seals. At this time, tabs 5918 are slid down to capture flanges 5920 in place, thereby securely holding nozzle cover 5914 to lower housing 5902.

Figure 61A:
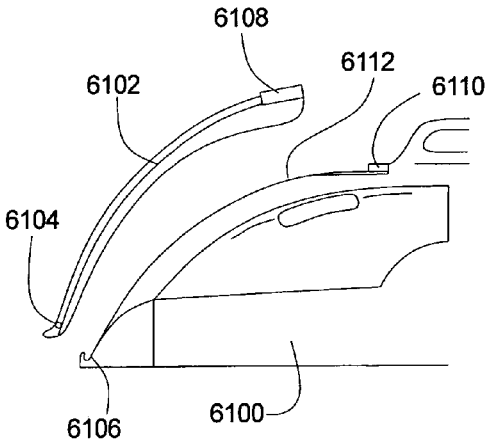
FIGS. 61A and 61B are side views of another embodiment of a nozzle cover assembly of the present invention shown uninstalled and installed, respectively.
Figure 61B:
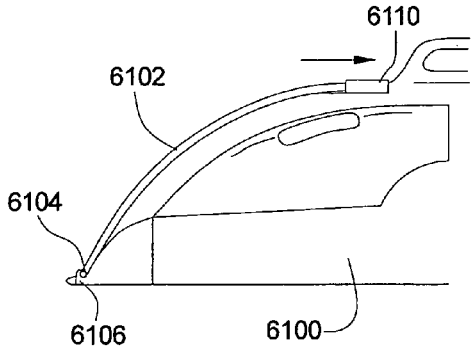

The above configuration can be varied in numerous ways without leaving the scope of the invention. For example, in one variation, shown in FIGS. 61A and B, instead of placing the back of the nozzle cover into the housing, pivoting it downward, and holding it in place with tabs at the front (as described above), the nozzle cover is pivotally mounted to the front of the housing, and held in place by a sliding tab at the back. In this embodiment, nozzle cover 6102 comprises a set of mounting pins 6104 at the front thereof. These pins 6104 fit into corresponding mounts 6106 near the front of extractor 6100. Mounts 6106 are preferably shaped to allow pins 6104 to be removed so that nozzle cover 6102 can be fully removed to ease cleaning. Nozzle cover 6102 (or the extractor housing) is provided with a sliding clasp 6108 that fits over corresponding protrusions 6110 on the housing near the end of the nozzle conduit 6112. The remainder of the nozzle assembly is otherwise the same as the nozzle assembly described above. In this embodiment, the nozzle cover 6102 is installed by inserting pins 6104 into mounts 6106, pivoting nozzle assembly 6102 backwards and down until sliding clasp 6108 is adjacent protrusions 6110 (at which point nozzle cover is pressed firmly in place over nozzle conduit 6112), then moving sliding clasp 6108 rearward, as shown by the reference arrow in FIG. 61B, to hold the assembly in place.

Both of the foregoing embodiments of nozzle cover assemblies provide a quick and simple system for cleaning the inlet nozzle for wet extractors, and overcomes numerous deficiencies of the prior art. While the foregoing embodiments are preferred, other variations within the scope of the invention will be readily apparent to those of skill in the art based on the teachings herein, and with experience derived from practicing the invention.

Figure 62:
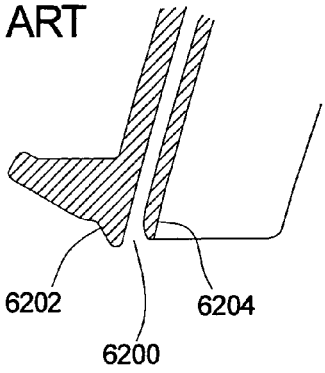
FIG. 62 PRIOR ART
FIG. 62 is a section view of a prior art extractor inlet nozzle.

Still another feature of the present invention is an improved inlet nozzle slit construction that provides improved performance over conventional designs. Conventional inlet slits for wet extractors comprise an elongated slit formed between two a generally flat lips of material (typically plastic). A typical prior art configuration is shown in FIG. 62, which shows a cross sectional view of an extractor inlet nozzle 6200 formed by a forward lip 6202 and a rearward lip 6204. It has been found that these flat lips tend to grip certain surfaces, such as carpets having short, stiff fibers, when aligned at certain angles relative to the carpet grain. When such gripping occurs, the lip resists movement and causes a chattering or vibrating effect as the extractor is moved. This chattering is unpleasant to hear and feel, and may reduce cleaning effectiveness.

Figure 63:
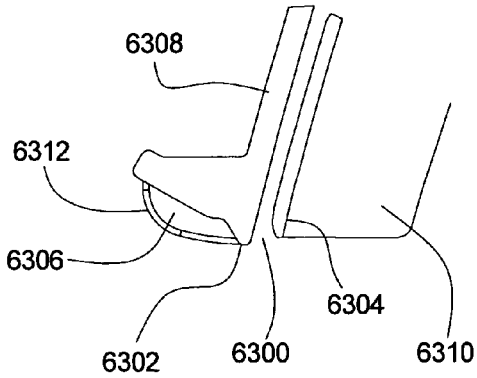
FIG. 63 is a section view of an extractor inlet nozzle of the present invention.

The present invention reduces the incidence of inlet nozzle chatter by providing a series of protrusions along the leading edge of the forward nozzle lip. Referring now to FIGS. 63 and 64, an embodiment of the present invention comprises an extractor nozzle inlet 6300 formed between a forward lip 6302 and a rearward lip 6304. The leading edge (i.e., the edge pointed in the forward direction of travel) of the forward lip 6302 is provided with a series of protrusions 6306. Each protrusion 6306 comprises a short rib that extends in the extractor's direction of travel. In the embodiment of FIG. 63, the forward lip 6302 is formed at the bottom edge of a removable nozzle cover 6308, such as those described previously herein, and rearward lip 6304 is formed in the base housing 6310 of the extractor. While the protrusions 6306 may take shape, it has been found that providing the protrusions with a rounded front edge 6312 improves the chatter resistance of the inlet nozzle.

Without being limited to any theory of operation, it is believed that the chatter experienced by conventional extractors occurs when one or both of the nozzle lips becomes aligned parallel with the grain of the carpet fibers, at which point the lip is located between adjacent rows of fibers. When this occurs, the lip receives less support from the carpet fibers and tends to drop down between them and become lodged there such that it resists further forward or rearward movement. As such, it is further believed that protrusions 6306 improve chatter resistance of the nozzle by deforming the rows of carpet fibers ahead of the nozzle inlet 6300 out of their normal linear shape. By doing so, the protrusions help prevent the nozzle lips from ever being positioned entirely or primarily between adjacent fiber rows.

Figure 64A:
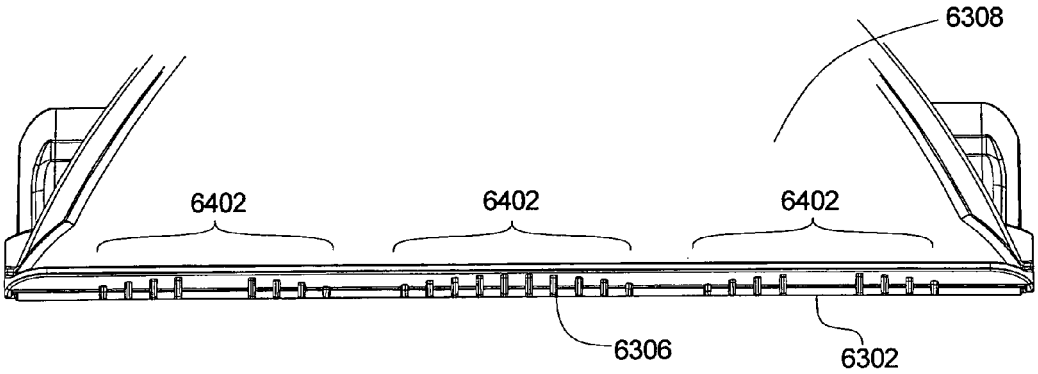
FIGS. 64A and 64B is a front and side views, respectively, of a removable nozzle cover of the present invention having chatter-reducing structures of the present invention.
Figure 64B:
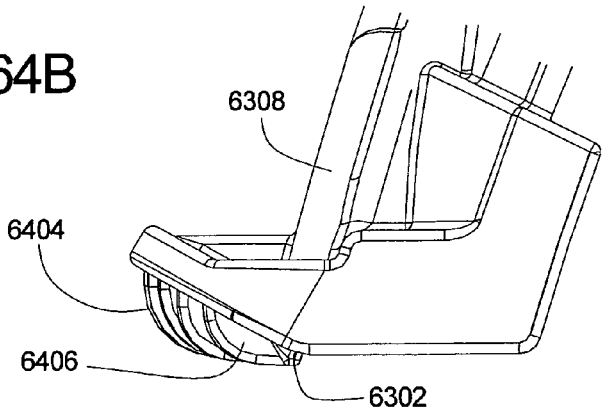

As shown in FIGS. 64A and 64B, it is preferred for the protrusions 6306 to be provided in a pattern having multiple sets of protrusions 6402. The protrusions 6306 of each set 6402 gradually increase in size towards the center of the set, and decrease towards the ends. As shown in the side view of FIG. 64B, the largest protrusions 6404 at the center of each set 6402 extend further forward than the smaller protrusions 6406 at the ends of each set 6403. It is believed that providing protrusions 6306 of various sizes in this manner further helps to prevent the nozzle lips from being captured between adjacent linear rows of carpet fibers.

While the foregoing embodiment is preferred, it is envisioned that various modifications can be made to the design without leaving the scope of the invention. For example, the protrusions of just one size may be used, and they may be arranged in different patterns. Furthermore, the protrusions may be located on the rear nozzle lip of the nozzle inlet, rather than the forward nozzle lip. The protrusions also may extend downward below the plane of either the front or rear nozzle lip, or may be positioned to extend partially or fully into the nozzle inlet itself. Other variations will be apparent to those of ordinary skill in the art in view of the teachings herein.

While the present invention has been described and illustrated herein with reference to various preferred embodiments it should be understood that these embodiments are exemplary only, and other embodiments will be apparent to those of ordinary skill in the art in light of the teachings provided herein. Furthermore, to the extent that the features of the claims are subject to manufacturing variances or variations caused by practical considerations, it will be understood that the present claims are intended to cover such claims. It will also be understood that while the present disclosure identifies and discusses numerous different inventions in relation to the preferred embodiments, the inventions recited in the following claims are not intended to be limited to being used in conjunction with any other inventions described herein unless specifically recited as having such limitations.

We claim:

1. A wet extraction cleaning device comprising:

a base assembly adapted to move on a surface to be cleaned, the base assembly comprising an inlet nozzle forming a fluid communication path between an inlet slit and a nozzle outlet, the inlet slit being located on the base assembly proximal to the surface to be cleaned;

an operation handle pivotally attached to base assembly, and having a pivot axis about which the operation handle pivots relative to the base assembly;

a supply tank adapted to hold cleaning fluid and having a supply tank outlet;

a recovery tank adapted to hold recovered fluid, and having a recovery tank inlet and a recovery tank outlet;

a fluid deposition assembly in selective fluid communication with the supply tank outlet and adapted to convey fluid from the supply tank to the surface to be cleaned;

a vacuum source having a vacuum source inlet;

a first externally facing pocket;

a second externally facing pocket;

wherein the supply tank is adapted to be selectively received in the first externally facing pocket to place the supply tank in fluid communication with the fluid deposition assembly, and the recovery tank is adapted to be selectively received in the second externally facing pocket to place the recovery tank inlet in fluid communication with the nozzle outlet and the recovery tank outlet in fluid communication with the vacuum source inlet; and wherein the first externally facing pocket and the second externally facing pocket are located in the base assembly.

2. The wet extraction cleaning device of claim 1, wherein the first externally facing pocket is adapted to receive the supply tank and thereby prevent longitudinal or lateral translation of the supply tank relative to the base assembly when received therein.

3. The wet extraction cleaning device of claim 2, wherein the supply tank is slidably receivable in a substantially vertical direction into the first externally facing pocket.

4. The wet extraction cleaning device of claim 1, wherein the second externally facing pocket is adapted to receive the recovery tank to thereby prevent longitudinal or lateral translation of the recovery tank relative to the base assembly when received therein.

5. The wet extraction cleaning device of claim 4, wherein the recovery tank is slidably receivable in a substantially vertical direction into the second externally facing pocket.

6. The wet extraction cleaning device of claim 1, wherein the first externally facing pocket and the second externally facing pocket are positioned between the inlet nozzle and the pivot axis.

7. The wet extraction cleaning device of claim 1, wherein the base assembly further comprises a third externally facing pocket and the wet extraction cleaning device further comprises a detergent tank adapted to be selectively received in the third externally facing pocket.

8. The wet extraction cleaning device of claim 7, wherein the supply tank, the recovery tank and the detergent tank are individually removable.

9. The wet extraction cleaning device of claim 1, wherein the base assembly comprises a lower housing and an upper housing and the supply tank and the recovery tank protrude from the lower housing.

10. The wet extraction cleaning device of claim 9, wherein the upper housing comprises a vertical rib positioned between the supply tank and the recovery tank.

11. The wet extraction cleaning device of claim 1, further comprising a handle lock adapted to selectively hold the operation handle in an upright resting position, and wherein the supply tank and the recovery tank are selectively removable when the operation handle is in the upright resting position.

12. The wet extraction cleaning device of claim 1, wherein the first externally facing pocket and second externally facing pocket are laterally juxtaposed with one another relative to a longitudinal axis of the base assembly.

13. A wet extraction cleaning device comprising:

a base assembly adapted to move on a surface to be cleaned, the base assembly comprising an inlet nozzle forming a fluid communication path between an inlet slit and a nozzle outlet, the inlet slit being located on the base assembly proximal to the surface to be cleaned;

an operation handle pivotally attached to base assembly, and having a pivot axis about which the operation handle pivots relative to the base assembly;

a supply tank adapted to hold cleaning fluid and having a supply tank outlet;

a recovery tank adapted to hold recovered fluid, and having a recovery tank inlet and a recovery tank outlet;

a fluid deposition assembly in selective fluid communication with the supply tank outlet and adapted to convey fluid from the supply tank to the surface to be cleaned;

a vacuum source having a vacuum source inlet;

a first externally facing pocket;

a second externally facing pocket;

wherein the supply tank is adapted to be selectively received in the first externally facing pocket to place the supply tank in fluid communication with the fluid deposition assembly, and the recovery tank is adapted to be selectively received in the second externally facing pocket to place the recovery tank inlet in fluid communication with the nozzle outlet and the recovery tank outlet in fluid communication with the vacuum source inlet; and wherein the inlet nozzle comprises a selectively removable nozzle cover attachable and removable without the use of tools.

14. A wet extraction cleaning device comprising:

a base assembly adapted to move on a surface to be cleaned, the base assembly comprising an inlet nozzle forming a fluid communication path between an inlet slit and a nozzle outlet, the inlet slit being located on the base assembly proximal to the surface to be cleaned;

an operation handle pivotally attached to base assembly, and having a pivot axis about which the operation handle pivots relative to the base assembly;

a supply tank adapted to hold cleaning fluid and having a supply tank outlet;

a recovery tank adapted to hold recovered fluid, and having a recovery tank inlet and a recovery tank outlet;

a fluid deposition assembly in selective fluid communication with the supply tank outlet and adapted to convey fluid from the supply tank to the surface to be cleaned;

a vacuum source having a vacuum source inlet;

a first externally facing pocket;

a second externally facing pocket;

wherein the supply tank is adapted to be selectively received in the first externally facing pocket to place the supply tank in fluid communication with the fluid deposition assembly, and the recovery tank is adapted to be selectively received in the second externally facing pocket to place the recovery tank inlet in fluid communication with the nozzle outlet and the recovery tank outlet in fluid communication with the vacuum source inlet; and wherein the operation handle comprises a collapsible handle having an upper handle portion and a lower handle portion;

the wet extraction cleaning device further comprises a handle lock adapted to selectively hold the lower handle portion in an upright resting position; and the supply tank and the recovery tank are selectively removable when the lower handle portion is in the upright resting position.

15. A wet extraction cleaning device comprising:

a base assembly adapted to move on a surface to be cleaned, the base assembly comprising an inlet nozzle forming a fluid communication path between an inlet slit and a nozzle outlet, the inlet slit being located on the base assembly proximal to the surface to be cleaned;

an operation handle pivotally attached to base assembly, and having a pivot axis about which the operation handle pivots relative to the base assembly;

a supply tank adapted to hold cleaning fluid and having a supply tank outlet;

a recovery tank adapted to hold recovered fluid, and having a recovery tank inlet and a recovery tank outlet;

a fluid deposition assembly in selective fluid communication with the supply tank outlet and adapted to convey fluid from the supply tank to the surface to be cleaned;

a vacuum source having a vacuum source inlet;

a first externally facing pocket;

a second externally facing pocket;

wherein the supply tank is adapted to be selectively received in the first externally facing pocket to place the supply tank in fluid communication with the fluid deposition assembly, and the recovery tank is adapted to be selectively received in the second externally facing pocket to place the recovery tank inlet in fluid communication with the nozzle outlet and the recovery tank outlet in fluid communication with the vacuum source inlet; and wherein the operation handle comprises a collapsible handle having an upper handle portion and a lower handle portion, the lower handle portion being pivotally attached to the base assembly, and the upper handle portion being pivotally attached to the lower handle portion.

16. A wet extraction cleaning device comprising:

a base assembly adapted to move on a surface to be cleaned, the base assembly comprising an inlet nozzle forming a fluid communication path between an inlet slit and a nozzle outlet, the inlet slit being located on the base assembly proximal to the surface to be cleaned;

an operation handle pivotally attached to base assembly, and having a pivot axis about which the operation handle pivots relative to the base assembly;

a supply tank adapted to hold cleaning fluid and having a supply tank outlet;

a recovery tank adapted to hold recovered fluid, and having a recovery tank inlet and a recovery tank outlet;

a fluid deposition assembly in selective fluid communication with the supply tank outlet and adapted to convey fluid from the supply tank to the surface to be cleaned;

a vacuum source having a vacuum source inlet;

a first externally facing pocket;

a second externally facing pocket;

wherein the supply tank is adapted to be selectively received in the first externally facing pocket to place the supply tank in fluid communication with the fluid deposition assembly, and the recovery tank is adapted to be selectively received in the second externally facing pocket to place the recovery tank inlet in fluid communication with the nozzle outlet and the recovery tank outlet in fluid communication with the vacuum source inlet; and wherein the first externally facing pocket and second externally facing pocket are arranged on opposite sides of a longitudinal centerline of the wet extraction cleaning device.

17. A wet extraction cleaning device comprising:

a base assembly adapted to move on a surface to be cleaned, the base assembly comprising an inlet nozzle forming a fluid communication path between an inlet slit and a nozzle outlet, the inlet slit being located on the base assembly proximal to the surface to be cleaned;

an operation handle pivotally attached to base assembly, and having a pivot axis about which the operation handle pivots relative to the base assembly;

a supply tank adapted to hold cleaning fluid and having a supply tank outlet;

a recovery tank adapted to hold recovered fluid, and having a recovery tank inlet and a recovery tank outlet;

a fluid deposition assembly in selective fluid communication with the supply tank outlet and adapted to convey fluid from the supply tank to the surface to be cleaned;

a vacuum source having a vacuum source inlet;

a first externally facing pocket;

a second externally facing pocket;

wherein the supply tank is adapted to be selectively received in the first externally facing pocket to place the supply tank in fluid communication with the fluid deposition assembly, and the recovery tank is adapted to be selectively received in the second externally facing pocket to place the recovery tank inlet in fluid communication with the nozzle outlet and the recovery tank outlet in fluid communication with the vacuum source inlet; and wherein the first externally facing pocket and second externally facing pocket are laterally juxtaposed with one another relative to a longitudinal axis of the base assembly.

18. A wet extraction cleaning device comprising:

a base assembly adapted to move on a surface to be cleaned, the base assembly comprising:

a fluid deposition assembly in fluid communication with a supply tank and adapted to convey fluid from the supply tank to a surface to be cleaned;

an inlet nozzle providing a fluid communication path between a recovery tank and an inlet slit, the inlet slit being located on the base assembly proximal to the surface to be cleaned;

a first externally facing pocket;

a second externally facing pocket; and an operation handle pivotally attached to base assembly, and having a pivot axis about which the operation handle pivots relative to the base assembly;

wherein the supply tank is adapted to be selectively received in the first externally facing pocket, the recovery tank is adapted to be selectively received in the second externally facing pocket, and the supply tank and the recovery tank are laterally juxtaposed with one another relative to a longitudinal axis of the base assembly.

19. The wet extraction cleaning device of claim 18, wherein the base assembly further comprises a carry handle.

20. The wet extraction cleaning device of claim 18, wherein the base assembly further comprises a vertical rib positioned between the supply tank and the recovery tank.

21. The wet extraction cleaning device of claim 20, wherein the base assembly further comprises a carry handle positioned on or adjacent the vertical rib.

22. The wet extraction cleaning device of claim 20, wherein the fluid deposition assembly comprises a valve assembly fluidly connected to one or more spray nozzles, and wherein the valve assembly is located within the vertical rib.

23. The wet extraction cleaning device of claim 20, wherein the inlet nozzle is at least partially positioned on top of the vertical rib.

24. The wet extraction cleaning device of claim 23, wherein the base assembly further comprises an accessory tool attachment port located on the vertical rib and in fluid communication between the inlet nozzle and the recovery tank.

* * * * *